US007172856B2

(12) United States Patent
Hioki et al.

(10) Patent No.: US 7,172,856 B2
(45) Date of Patent: Feb. 6, 2007

(54) SILVER HALIDE PHOTOGRAPHIC LIGHT-SENSITIVE MATERIAL

(75) Inventors: Takanori Hioki, Kanagawa (JP); Hiroo Takizawa, Kanagawa (JP); Katsuhiro Yamashita, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 658 days.

(21) Appl. No.: 10/199,044

(22) Filed: Jul. 22, 2002

(65) Prior Publication Data

US 2003/0228549 A1 Dec. 11, 2003

(30) Foreign Application Priority Data

Jul. 24, 2001 (JP) ..... P. 2001-223240
Dec. 26, 2001 (JP) ..... P. 2001-394160
Mar. 25, 2002 (JP) ..... P. 2002-083290

(51) Int. Cl.
*G03C 1/005* (2006.01)
*G03C 1/494* (2006.01)

(52) U.S. Cl. ..... 430/572; 430/570; 430/603; 430/599; 430/567; 430/576; 430/591; 430/592; 430/593; 430/594; 430/595; 430/581; 430/582; 430/583; 430/584

(58) Field of Classification Search ..... 430/572, 430/570, 603, 599, 567, 576, 591–595, 501–504
See application file for complete search history.

(56) References Cited

U.S. PATENT DOCUMENTS

| | | | | |
|---|---|---|---|---|
| 3,622,316 | A | 11/1971 | Bird et al. | |
| 6,465,166 | B1 * | 10/2002 | Kobayashi et al. | 430/581 |
| 6,521,401 | B1 * | 2/2003 | Yamashita et al. | 430/584 |
| 6,558,893 | B1 * | 5/2003 | Parton et al. | 430/574 |
| 6,582,894 | B1 * | 6/2003 | Hioki et al. | 430/572 |
| 6,610,466 | B2 * | 8/2003 | Sakurada et al. | 430/505 |
| 6,620,581 | B1 * | 9/2003 | Parton et al. | 430/559 |

FOREIGN PATENT DOCUMENTS

EP 0887700 A1 12/1998

* cited by examiner

*Primary Examiner*—Geraldine Letscher
(74) *Attorney, Agent, or Firm*—Sughrue Mion, PLLC

(57) ABSTRACT

A silver halide photographic light-sensitive material having high sensitivity and having a desired spectral sensitivity distribution. A silver halide photographic light-sensitive material comprising at least one multichromophore dye compound having at least two dye chromophores connected by covalent bonding or coordinate bonding, at least two of the dye chromophores forming a dye chromophore group and the light absorption of the dye chromophore group differing from the sum of individual light absorptions of respective dye chromophores constituting said dye chromophore group.

18 Claims, 2 Drawing Sheets

SILVER HALIDE PHOTOGRAPHIC LIGHT-SENSITIVE MATERIAL

FIELD OF THE INVENTION

The present invention relates to a high-sensitive silver halide photographic light-sensitive material, more specifically, the present invention relates to a silver halide photographic light-sensitive material spectrally sensitized to high sensitivity by a dye.

BACKGROUND OF THE INVENTION

A great deal of effort has heretofore been made for attaining higher sensitivity of silver halide photographic light-sensitive materials. In a silver halide photographic emulsion, a sensitizing dye adsorbed to the surface of a silver halide grain absorbs light entered into a light-sensitive material and transmits the light energy to the silver halide grain, whereby light sensitivity can be obtained. Accordingly, in the spectral sensitization of silver halide, it is considered that the light energy transmitted to silver halide can be increased by increasing the light absorption factor per the unit grain surface area of a silver halide grain and thereby the spectral sensitivity can be elevated. The light absorption factor on the surface of a silver halide grain may be improved by increasing the amount of a spectral sensitizing dye adsorbed per the unit grain surface area.

However, the amount of a sensitizing dye adsorbed to the surface of a silver halide grain is limited and the dye chromophore cannot be adsorbed in excess of the single layer saturation adsorption (namely, one layer adsorption). Therefore, individual silver halide grains currently have a low absorption factor in terms of the quantum of incident light in the spectral sensitization region.

To solve these problems, the following methods have been proposed.

In *Photographic Science and Engineering,* Vol. 20, No. 3, page 97 (1976), P. B. Gilman, Jr. et al. disclose a technique where a cationic dye is adsorbed as the first layer and an anionic dye is adsorbed as the second layer using the electrostatic force.

In U.S. Pat. No. 3,622,316, G. B. Bird et al. disclose a technique where a plurality of dyes are adsorbed in multiple layers to silver halide and the Forster-type excitation energy transfer is allowed to contribute to the sensitization.

In JP-A-63-138341 (the term "JP-A" as used herein means an "unexamined published Japanese patent publication") and JP-A-64-84244, Sugimoto et al. disclose a technique of performing the spectral sensitization using the energy transfer from a light-emitting dye.

In *Photographic Science and Engineering,* Vol. 27, No. 2, page 59 (1983), R. Steiger et al. disclose a technique of performing the spectral sensitization using the energy transfer from a gelatin-substituted cyanine dye.

In JP-A-61-251842, Ikegawa et al. disclose a technique of performing the spectral sensitization using the energy transfer from a cyclodextrin-substituted dye.

With respect to the so-called linked dye having two separate chromophores which are not conjugated but linked by covalent bonding, examples thereof are described in U.S. Pat. Nos. 2,393,351, 2,425,772, 2,518,732, 2,521,944 and 2,592,196 and European Patent 565,083. However, these are not used for the purpose of improving the light absorption factor. In U.S. Pat. Nos. 3,622,317 and 3,976,493 having an object of improving the light absorption factor, G. B. Bird and A. L. Borror et al. disclose a technique where a linking-type sensitizing dye molecule having a plurality of cyanine chromophores is adsorbed to increase the light absorption factor and the energy transfer is allowed to contribute to the sensitization. In JP-A-64-91134, Ukai, Okazaki and Sugimoto disclose a technique of bonding at least one substantially non-adsorptive cyanine, merocyanine or hemicyanine dye containing at least two sulfo and/or carboxyl groups to a spectral sensitizing dye which can be adsorbed to silver halide.

In JP-A-6-57235, L. C. Vishwakarma discloses a method of synthesizing a linked dye by a dehydrating condensation reaction of two dyes. Furthermore, in JP-A-6-27578, it is disclosed that the linked dye of monomethinecyanine and pentamethineoxonol has red sensitivity. However, in this case, the light emission of oxonol and the absorption of cyanine are not overlapped and the spectral sensitization using the Forster-type excitation energy transfer between dyes does not occur, failing in attaining higher sensitization by the light-converging action of linked oxonol.

Furthermore, in EP-A-0985964, EP-A-0985965 and EP-A-0985966, Richard Parton et al. disclose a technique where a combination of a cationic dye and an anionic dye is adsorbed in multiple layers with an attempt to attain high sensitivity using the energy transfer from the dye in the second to the dye in the first layer.

In these methods, however, the degree of adsorption of sensitizing dyes in multiple layers on the surface of a silver halide grain is actually insufficient and neither the light absorption factor per the unit grain surface area of silver halide grain nor the sensitivity can be sufficiently elevated. A technique capable of realizing practically effective multilayer adsorption is demanded.

Particularly, in the case of a color light-sensitive material, the spectral sensitivity must be present in the objective wavelength range. Usually, in the spectral sensitization of a silver halide light-sensitive material, absorption of a sensitizing dye in a monomer state is not used but J-band formed upon adsorption to the surface of a silver halide grain is used. The J-band has sharp absorption shifted to the longer wavelength side than the absorption in the monomer state and therefore, is very useful to have light absorption and spectral sensitivity in the desired wavelength range. Accordingly, even if sensitizing dyes can be adsorbed in multiple layer to the grain surface to increase the light absorption factor, when the dye in the second or upper layer not directly adsorbed to the silver halide grain is adsorbed in the monomer state, a very wide absorption results and this is improper as the spectral sensitivity of an actual light-sensitive material.

Under these circumstances, a technique of allowing sensitizing dyes to be adsorbed in multiple layers on the surface of a silver halide grain to increase the light absorption integrated intensity per the unit grain surface area and at the same time, enabling to limit the absorption and spectral sensitivity to the width of desired color sensitivity region is being demanded.

SUMMARY OF THE INVENTION

The object of the present invention is to provide a high-sensitivity silver halide photographic light-sensitive material having a desired spectral sensitivity distribution.

As a result of extensive investigations, it has been found that the object of the present invention can be attained by the following (1) to (29):

(1) A silver halide photographic light-sensitive material comprising at least one multichromophore dye compound having at least two dye chromophores connected by covalent bonding or coordinate bonding, at least two of the dye chromophores forming a dye chromophore group and the light absorption of the dye chromophore group differing from the sum of individual light absorptions of respective dye chromophores constituting the dye chromophore group.

(2) The silver halide photographic light-sensitive material as described in (1), wherein the dye chromophore group is in the associated (or aggregated) state.

(3) The silver halide photographic light-sensitive material as described in (1) or (2), wherein the absorption maximum wavelength of the dye chromophore group is longer than the maximum wavelength of the sum of absorptions of individual dye chromophores.

(4) The silver halide photographic light-sensitive material as described in any one of (1) to (3), wherein the multichromophore dye compound contains at least three dye chromophores.

(5) The silver halide photographic light-sensitive material as described in any one of (1) to (4), wherein the multichromophore dye compound further contains an adsorption group to a silver halide grain.

(6) The silver halide photographic light-sensitive material as described in any one of (1) to (5), wherein the multichromophore dye compound and other dye compound are bonded to each other by an attracting force except for covalent bonding or coordinate bonding.

(7) The silver halide photographic light-sensitive material as described in (5), wherein the adsorption group contains at least one atom selected from the group consisting of nitrogen atom, sulfur atom, phosphorus atom, selenium atom and tellurium atom.

(8) The silver halide photographic light-sensitive material as described in (5) or (7), wherein the adsorption group in the multichromophore dye compound is connected through a linking chain containing a heteroatom and a multichromophore.

(9) The silver halide photographic light-sensitive material as described in any one of (1) to (8), wherein the multichromophore dye compound has a divalent or greater valent charge.

(10) The silver halide photographic light-sensitive material as described in (6) and (9), wherein the multi-chromophore dye compound and the dye compound other than the multichromophore dye compound have opposite charges.

(11) The silver halide photographic light-sensitive material as described in any one of (1) to (10), wherein the multichromophore dye compound has an aromatic group.

(12) The silver halide photographic light-sensitive material as described in any one of (6) and (9) to (11), wherein the dye compound other than the multichromophore dye compound has an aromatic group.

(13) The silver halide photographic light-sensitive material as described in any one of (1) to (12), wherein the multichromophore dye compound has a hydrogen bond-donating group.

(14) The silver halide photographic light-sensitive material as described in any one of (1) to (13), wherein at least one chromophore of the multichromophore dye compound is selected from the group consisting of cyanine, merocyanine and oxonol.

(15) The silver halide photographic light-sensitive material as described in any one of (1) to (13), wherein at least one chromophore of the multichromophore dye compound is selected from the group consisting of hemicyanine, streptocyanine and hemioxonol.

(16) The silver halide photographic light-sensitive material as described in any one of (1) to (15), wherein the multichromophore dye compound is a compound represented by the following formula (I):

$$(Xa)_{r2}[(\text{—}Lb\text{—})_{p3}[Da(\text{—}La_1\text{—})_{p1}(Db(\text{—}La_2)_{p2}\}_{q1}Dc]_{q2}]_{r1} \quad (I)$$

$$M_1m_1$$

wherein Da, Db and Dc each represents a dye chromophore, $La_1$, $La_2$ and Lb each represents a linking group, p1, p2 and p3 each represents an integer of 1 to 4, q1 represents an integer of 0 to 5, q2 represents an integer of 1 to 5, Xa represents a dye chromophore (Dd) or an absorptive group (Ad) to a silver halide grain, r1 represents an integer of 1 to 5, r2 represents an integer of 0 to 5, $M_1$ represents an electric charge balancing counter ion, and $m_1$ represents a number necessary for neutralizing the electric charge of molecule.

(17) The silver halide photographic light-sensitive material as described in (16), wherein in formula (I), Xa is a dye chromophore (Dd) and r2 is an integer of 1 to 5.

(18) The silver halide photographic light-sensitive material as described in (16) or (17), wherein in formula (I), at least one of Da, Db and Dc is a dye chromophore selected from the group consisting of cyanine, merocyanine and oxonol.

(19) The silver halide photographic light-sensitive material as described in (16) or (17), wherein in formula (I), at least one of Da, Db and Dc is a dye chromophore selected from the group consisting of hemicyanine, streptocyanine and hemioxonol.

(20) The silver halide photographic light-sensitive material as described in any one of (1) to (19), wherein a dye chromophore is adsorbed in multiple layers on the surface of a silver halide grain.

(21) The silver halide photographic light-sensitive material as described in any one of (1) to (20), which contains a silver halide grain having a spectral absorption maximum wavelength of less than 500 nm and a light absorption intensity of 60 or more or having a spectral absorption maximum wavelength of 500 nm or more and a light absorption intensity is 100 or more.

(22) The silver halide photographic light-sensitive material as described in any one of (1) to (21), wherein assuming that the maximum value of spectral absorption factor of the silver halide grain by a sensitizing dye is Amax, the distance between the shortest wavelength showing 50% of Amax and the longest wavelength showing 50% of Amax is 120 nm or less.

(23) The silver halide photographic light-sensitive material as described in any one of (1) to (21), wherein assuming that the maximum value of spectral sensitivity of the silver halide grain by a sensitizing dye is Smax, the distance between the shortest wavelength showing 50% of Smax and the longest wavelength showing 50% of Smax is 120 nm or less.

(24) The silver halide photographic light-sensitive material as described in any one of (1) to (23), wherein assuming that the maximum value of the spectral absorption factor of the silver halide grain by the dye chromophore in the first layer is A1max, the maximum value of the spectral absorption factor by the dye chromophore in the second or upper layer is A2max, the maximum value of the spectral sensitivity of the silver halide grain by the dye chromophore in the first layer is S1max and the maximum value of the spectral sensitivity by the dye chromophore in the second or upper layer is S2max, each of A1max and A2max or each of S1max and S2max is in the range from 400 to 500 nm, from 500 to 600 nm, from 600 to 700 nm or from 700 to 1,000 nm.

(25) The silver halide photographic light-sensitive material as described in any one of (1) to (24), wherein the longest wavelength showing a spectral absorption factor of 50% of Amax or Smax is in the range from 460 to 510 nm, from 560 to 610 nm or from 640 to 730 nm.

(26) The silver halide photographic light-sensitive material as described in any one of (1) to (25), wherein in the silver halide grain, the excitation energy of the dye chromophore of the second or upper layer transfers to the dye chromophore in the first layer with an efficiency of 10% or more.

(27) The silver halide photographic light-sensitive material as described in any one of (1) to (26), wherein in the silver halide grain, the dye chromophore of the first layer and the dye chromophore of the second or upper layer both exhibit J-band absorption.

(28) The silver halide photographic light-sensitive material as described in any one of (1) to (27), wherein the silver halide photographic emulsion in the photographic light-sensitive material is an emulsion where tabular grains having an aspect ratio of 2 or more is present in a proportion of 50% (area) or more of all silver halide grains in the emulsion.

(29) The silver halide photographic light-sensitive material as described in any one of (1) to (28), wherein the silver halide photographic emulsion in the photographic light-sensitive material is subjected to selenium sensitization.

DETAILED DESCRIPTION OF THE INVENTION

Figure 1:
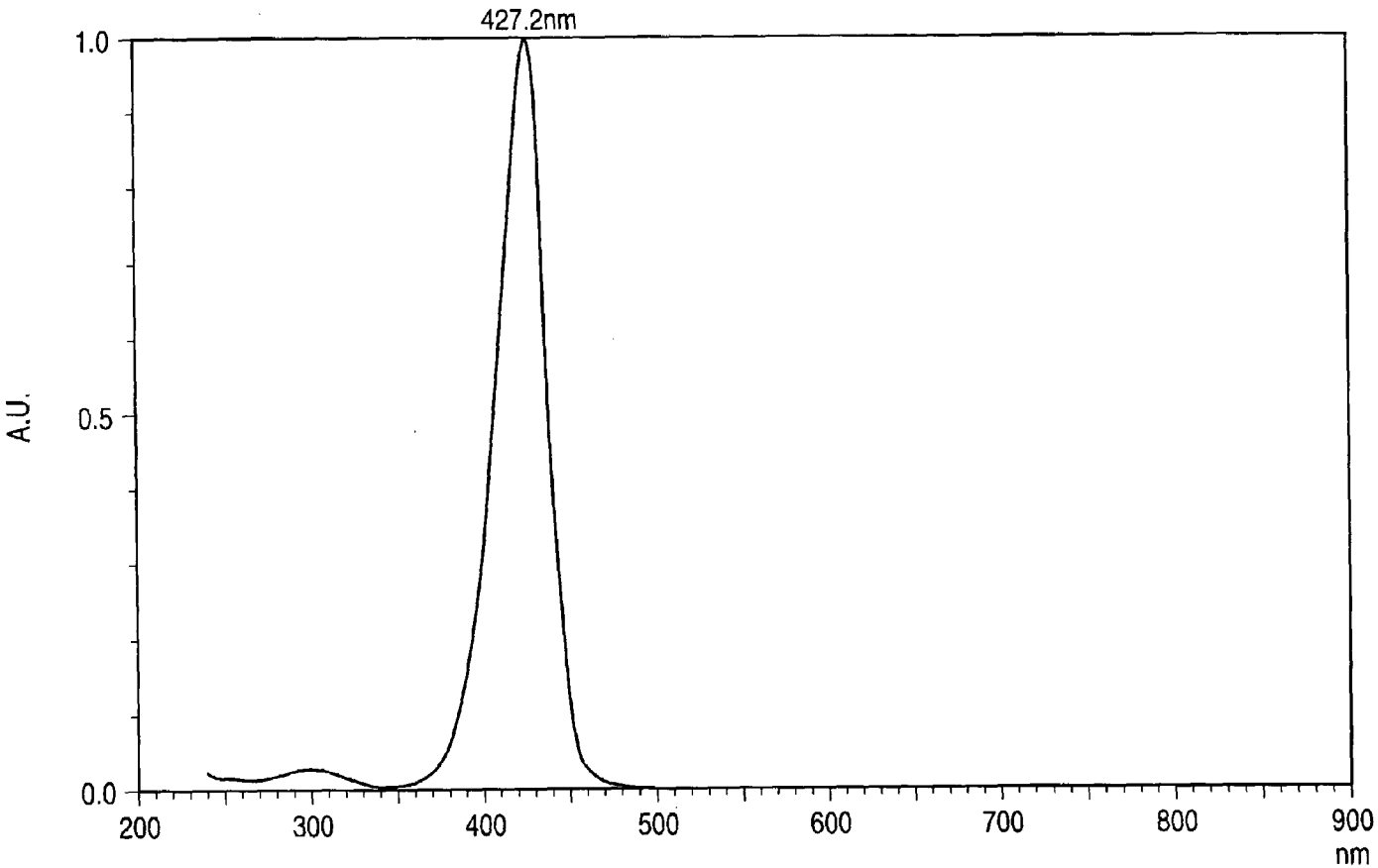
FIG. 1 shows an absorption spectrum of Comparative Dye SS-7.

The present invention is described in detail below.

The "multichromophore dye compound having at least two dye chromophores connected by covalent bonding or coordinate bonding, at least two of the dye chromophores forming a dye chromophore group and the light absorption of the dye chromophore group differing from the sum of individual light absorptions of respective dye chromophores constituting the dye chromophore group" for use in the present invention is described below.

This means that the dye chromophore group exhibits light absorption different from the sum of individual light absorptions of at least two dye chromophores constituting the dye chromophore group. The individual absorptions of dye chromophores mean an absorption when each chromophore is present alone, namely, present in the state of not being affected by other dye chromophore (this absorption may also be called "monomer absorption"). Usually, if at least two dye chromophores are not affected from each other, the absorption of the dye chromophore group containing these dye chromophores is the sum of the absorptions of these dye chromophores. The present invention is characterized in that the dye chromophores affect each other and thereby the absorption of the dye chromophore group containing these dye chromophores is changed.

The change in absorption may appear by any interaction but the absorption is preferably changed by a dipole-dipole interaction. This interaction is described, for example, in James (compiler), *The Theory of the Photographic Process,* 4th ed., Chap. 8, pp. 218–222, Macmillan (1977).

The state where dye chromophores are fixed with each other in a specific spatial disposition by covalent bonding, coordinate bonding or a bonding force such as various intermolecular forces (e.g., hydrogen bond, van der Waals force, Coulomb force) is generally called "association (or aggregation)". In the present invention, the dye chromophores are preferably fixed by covalent bonding or coordinate bonding. For reference, the associated form (aggregate) is described below. The aggregate is described in detail, for example, in James (compiler), *The Theory of the Photographic Process,* 4th ed., Chap. 8, pp. 218–222, Macmillan (1977) and Takayoshi Kobayashi, *J-Aggregates,* World Scientific Publishing Co., Ltd. (1996).

The monomer means a monomeric substance. In view of the absorption wavelength of aggregates, an aggregate having an absorption shifted to the shorter wavelength with respect to the monomer absorption is called an H-aggregate (a dimeric substance is particularly called "a dimer") and an aggregate shifted to the longer wavelength is called a J-aggregate. The absorption originated in the J-aggregate can be called J-band absorption. It is known that when a J-aggregate is formed, the absorption width in the longer wavelength side generally becomes small as compared with the monomer state.

In view of the aggregate structure, in the case of a bricklaying aggregate, an aggregate having a small shear angle is called a J-aggregate and an aggregate having a large shear angle is called an H-aggregate. The bricklaying aggregate is described in detail in *Chemical Physics Letters,* Vol. 6, page 183 (1970). The aggregate having the same structure as the bricklaying aggregate includes aggregates having a ladder or step structure. The aggregate having a ladder or step structure is described in detail in *Zeitschrift fur Physikalische Chemie,* Vol. 49, page 324 (1941).

As for the aggregate other than the bricklaying aggregate, an aggregate having a herringbone structure is known (this aggregate can be called a "herringbone aggregate").

The herringbone aggregate is described in Charles Reich, *Photographic Science and Engineering,* Vol. 18, No. 3, page 335 (1974). The herringbone aggregate has two absorption maximums originated in the aggregate.

The absorption in the "dye chromophore group exhibiting an absorption different from the sum of individual absorptions of dye chromophores" of the present invention can be divided into the factors of absorption waveform, absorption intensity and absorption wavelength. These are generically called an absorption spectrum. In the present invention, any of these factors may be changed but preferred is the case where the absorption wavelength is changed, more preferred is the case where accompanying the change of the absorption wavelength, the absorption intensity and the absorption waveform are changed. In the change of the absorption wavelength, more preferred is the case where the absorption maximum wavelength is changed.

In the present invention, the absorption is preferably changed to a longer wavelength (this is not limited to the absorption maximum wavelength but a part of the absorption may be changed to a longer wavelength). More preferred is the case where the absorption maximum wavelength is changed to a longer wavelength. When at least two dye chromophores form a J-aggregate and exhibit a J-band absorption, the spectral sensitivity can be present in a desired wavelength and this is particularly preferred.

The degree in shifting of the absorption maximum wavelength to a longer wavelength is preferably 5 nm or more, more preferably 10 nm or more, 20 nm or more, 30 nm or more, 40 nm or more, and 50 nm or more. The upper limit is not particularly limited, however, the degree to a longer wavelength is preferably 200 nm or less, more preferably 150 nm or less.

The width of the absorption spectrum is preferably narrow for individual absorptions of dye chromophores, preferably 9/10 or less, more preferably 4/5 or less, still more preferably 2/3 or less, particularly preferably 1/2 or less.

These absorption factors are preferably satisfied in the light-sensitive material but as a model, these factors can also be estimated from the absorption in a solvent.

For example, these factors can be simply estimated from the absorption when the dye is dissolved in a dilute state (for example, in a concentration of $1\times10^{-5}$ mol/liter) in a methanol solution at 25° C.

In order to allow at least two dye chromophores connected by covalent or coordinate bonding to exhibit absorption at a longer wavelength, these dye chromophores are preferably fixed with each other to a specific disposition/orientation by the bonding. The dye chromophores are preferably connected through a single bond or a plurality of covalent or coordinate bonds, because the disposition/orientation of dye chromophores connected with each other is fixed. If the dye chromophores are not fixed to a specific disposition/orientation, absorption at a shorter wavelength is disadvantageously exhibited.

In the multichromophore dye compound, the covalent bond or coordinate bond may be previously formed or may be formed in the process of preparing a silver halide light-sensitive material (for example, in the silver halide emulsion). In the latter case, the bond may be formed by the method described, for example, in JP-A-2000-81678.

Preferred is the case where the bond is previously formed.

Among the covalent bond and the coordinate bond to be formed in the multichromophore dye compound, preferred is the covalent bond.

The number of dye chromophores in the multi-chromophore dye compound may be any number insofar as it is 2 or more but is preferably from 2 to 7, more preferably from 2 to 5, still more preferably from 2 or 3, and most preferably 3. The plurality of dye chromophores may be the same or different but at least two dye chromophores are preferably the same. In the dye chromophore group exhibiting absorption different from the sum of individual absorptions of dye chromophores, the number of dye chromophores may be any number insofar as it is 2 or more but is preferably from 2 to 6, more preferably from 2 to 4, still more preferably 2 or 3, and most preferably 2. The plurality of dye chromophores may be the same or different but are preferably the same.

The dye chromophore for use in the present invention is described below. The dye chromophore may be any dye chromophore but examples thereof include a cyanine dye, a hemicyanine dye, a streptocyanine dye, a styryl dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarylium dye, a croconium dye, a azamethine dye, a coumarin dye, a arylidene dye, an anthraquinone dye, a triphenylmethane dye, an azo dye, an azomethine dye, a spiro compound, a metallocene dye, a fluorenone dye, a fulgide dye, a perylene dye, a phenazine dye, a phenothiazine dye, a quinone dye, a indigo dye, a diphenylmethane dye, a polyene dye, a acridine dye, a acridinone dye, a diphenylamine dye, a quinacridone dye, a quinophthalone dye, a phenoxazine dye, a phthaloperylene dye, a porphyrin dye, a chlorophyll dye, a phthalocyanine dye and a metal complex dye. Among these, preferred are methine dye chromophores such as cyanine dye, hemicyanine dye, streptocyanine dye, styryl dye, merocyanine dye, trinuclear merocyanine dye, tetranuclear merocyanine dye, rhodacyanine dye, complex cyanine dye, complex merocyanine dye, allopolar dye, oxonol dye, hemioxonol dye, squarylium dye, croconium dye and azamethine dye, more preferred are a cyanine dye, a hemicyanine dye, a streptocyanine dye, a merocyanine dye, a trinuclear merocyanine dye, a tetranuclear merocyanine dye, an oxonol dye, a hemioxonol dye and a rhodacyanine dye, still more preferred are a cyanine dye, a merocyanine dye, an oxonol dye, a hemicyanine dye, a streptocyanine dye and a hemioxonol dye.

At least one dye chromophore in the multichromophore dye compound for use in the present invention is preferably a cyanine dye, a merocyanine dye, a rhodacyanine dye, an oxonol dye, a hemicyanine dye, streptocyanine dye or a hemioxonol dye, more preferably a cyanine dye, a merocyanine dye, an oxonol dye, a hemicyanine dye, a streptocyanine dye or a hemioxonol dye, still more preferably a cyanine dye, a merocyanine dye, a hemicyanine dye, a streptocyanine dye or a hemioxonol dye, yet still more preferably a hemicyanine dye, a streptocyanine dye or a hemioxonol dye, particularly preferably a hemicyanine dye or a streptocyanine dye, and most preferably a hemicyanine dye. When it is a hemicyanine dye, a streptocyanine dye or a hemioxonol dye, the residual color after processing is less, which is preferable.

These dyes are described in detail in F. M. Harmer, *Heterocyclic Compounds—Cyanine Dyes and Related Compounds,* John Wiley & Sons, New York, London (1964), D. M. Sturmer, *Heterocyclic Compounds—Special topics in heterocyclic chemistry,* Chap. 18, Section 14, pp. 482–515, John Wiley & Sons, New York, London (1977), and *Rodd's Chemistry of Carbon Compounds,* 2nd ed., Vol. IV, Part B, Chap. 15, Items 369–422, Elsevier Science Publishing Company Inc., New York (1977). Examples of the formulae of preferred dyes include the formulae described in U.S. Pat. No. 5,994,051, pp. 32–36, and the formulae described in U.S. Pat. No. 5,747,236, pp. 30–34. For cyanine dyes, merocyanine dyes and rhodacyanine dyes, formulae (XI), (XII) and (XIII) described in U.S. Pat. No. 5,340,694, columns 21 to 22, are preferred (where, however, the numbers of n12, n15, n17 and n18 are not limited and each is an integer of 0 or more (preferably 4 or less)).

In the present invention, the multichromophore dye compound is preferably the compound represented by formula (I). In the formula, the dye chromophores represented by Da, Db and Dc satisfy the requirement of claim 1, "the light absorption of said dye chromophore group differing from the sum of individual light absorptions of respective dye chromophores".

In the "multichromophore dye compound containing at least three dye chromophores" (hereinafter referred to as "linked dye") described in (4), the covalent bond or coordinate bond may be previously formed or may be formed in the process of preparing a silver halide light-sensitive material (for example, in the silver halide emulsion). In the latter case, the bond may be formed by the method described, for example, in JP-A-2000-81678. Preferred is the case where the bond is previously formed.

Among the covalent bond and the coordinate bond to be formed in the dye compound, preferred is the covalent bond.

The compound described in (4) is preferably a compound when in formula (I), Xa is a dye chromophore (Dd) and $r_2$ is an integer of 1 to 5.

In the "multichromophore dye compound further containing an adsorption group to a silver halide grain", described in (5) the covalent bond or coordinate bond may be previously formed or may be formed in the process of preparing a silver halide light-sensitive material (for example, in the silver halide emulsion). In the latter case, the bond may be formed by the method described, for example, in JP-A-2000-81678. Preferred is the case where the bond is previously formed.

Among the covalent bond and the coordinate bond to be formed in the dye compound, preferred is the covalent bond.

The adsorption group to a silver halide grain may be any adsorption group but is preferably a group containing at least one atom selected from the group consisting of a nitrogen atom, a sulfur atom, a phosphorus atom, a selenium atom and a tellurium atom, and capable of accelerating the adsorption to a silver halide grain. This group may be a silver ligand or cationic surfactant moiety. The silver ligand moiety comprises a sulfur acid or a selenium or tellurium analogue thereof, a nitrogen acid, a thioether or a selenium or tellurium analogue thereof, a phosphine, a thioamide, a selenamide, a telluramide, or a carbon acid. The above-described acidic compounds preferably have an acid dissociation constant pKa of 5 to 14. The sulfur acid is preferably a mercaptan or a thiol, which forms a silver mercaptide or complex salt with silver ion. The thiol having a stable C—S bond, which is not a sulfide ion precursor, acts as a silver halide adsorptive substance as described in *The Theory of the Photographic Process,* pp. 32–34 (1977).

Preferred examples of the absorptive group to silver halide include alkyl mercaptan, a cyclic or acyclic thioether group, benzothiazole, tetraazaindene, benzo-triazole, tetralkylthiourea, and mercapto-substituted heterocyclic compounds (particularly, mercaptotetrazole, mercaptotriazole, mercaptothiadiazole, mercaptoimidazole, mercaptooxadiazole, mercaptothiazole, mercaptobenzimidazole, mercaptobenzothiazole, mercaptobenzoxazole, mercaptopyrimidine, mercaptotriazine, phenylmercaptotetrazole, 1,2,4-triazolium thiolate).

A cationic surfactant also acts as the adsorptive group to silver halide. Examples thereof include those containing a hydrocarbon group having 4 or more carbon atoms, which may be substituted with a functional group based on halogen, oxygen, sulfur or nitrogen atoms. Examples of the cation part include an ammonium group, a sulfonium group and a phosphonium group. This cationic surfactant is adsorbed to a silver halide grain in an emulsion containing an excess of halide ion, mostly by Coulomb attracting force as described in *J. Colloid Interface Sci.,* Vol. 22, p. 391 (1966). Preferred examples thereof include dimethyldodecylsulfonium, tetradecyl-trimethylammonium, N-dodecylnicotinic acid betaine and decamethylenepyridinium ion.

Specific examples of the adsorptive group which can be preferably used in the present invention include the adsorptive groups described in JP-A-9-211769, pp. 3–8.

The compound described in (5) is preferably a compound when in formula (I), Xa is an adsorptive group (Ad) to a silver halide grain and $r_2$ is an integer of 1 to 5.

The case where "bonded to each other by an attracting force except for covalent bonding or coordinate bonding" described in (6) is described below.

The attracting force except for covalent bonding or coordinate bonding may be any attracting force but examples thereof include van der Waals force (more specifically, orientation force acting between permanent dipole-permanent dipole, induction force acting between permanent dipole-induced dipole, and dispersion force acting between temporary dipole-induced dipole), charge transfer force (CT), Coulomb force (electrostatic force), hydrophobic bond force and hydrogen bond force. One of these bonding forces may be used alone or a plurality of these bonding forces may be freely combined and used.

Among these, preferred are van der Waals force, Coulomb force and hydrogen bond force, more preferred are van der Waals force and Coulomb force, and most preferred is van der Waals force.

The term "bonded to each other" means that the dye chromophores are bound by the above-described attracting force. In other words, the attracting energy (namely, adsorption energy ($\Delta G$)) is preferably 15 kJ/mol or more, more preferably 20 kJ/mol or more, still more preferably 40 kJ/mol or more. The upper limit is not particularly limited but is preferably 5,000 kJ/mol or less, more preferably 1,000 kJ/mol or less.

The multilayer adsorption in the present invention is described below.

The term "multilayer adsorption" as used in the present invention means that the dye chromophore is stacked (or laminated) in two or more layers on the surface of a silver halide grain.

In the present invention, multilayer adsorption is preferred.

In the present invention, the light absorption intensity is an integrated intensity of light absorption by a sensitizing dye per the unit grain surface area and defined as a value obtained by, assuming that the quantity of light incident on the unit surface area of a grain is $I_0$ and the quantity of light absorbed into a sensitizing dye on the surface is I, integrating the optical density $\mathrm{Log}(I_0/(I_0-I))$ with respect to the wave number ($cm^{-1}$) The integration range is from 5,000 $cm^{-1}$ to 35,000 $cm^{-1}$.

The silver halide photographic emulsion for use in the present invention preferably contains a silver halide grain having a light absorption intensity of 100 or more in the case of a grain having a spectral absorption maximum wavelength of 500 nm or more, or having a light absorption intensity of 60 or more in the case of a grain having a spectral absorption maximum wavelength of less than 500 nm, in a proportion of a half or more of the entire projected area of all silver halide grains. In the case of a grain having a spectral absorption maximum wavelength of 500 nm or more, the light absorption intensity is preferably 150 or more, more preferably 170 or more, still more preferably 200 or more. In the case of a grain having a spectral absorption maximum wavelength of less than 500 nm, the light absorption intensity is preferably 90 or more, more preferably 100 or more, still more preferably 120 or more. The upper limit is not particularly limited but it is preferably 2,000 or less, more preferably 1,000 or less, still more preferably 500 or less.

The spectral absorption maximum wavelength of a grain having a spectral absorption maximum wavelength of less than 500 nm is preferably 350 nm or more.

One example of the method for measuring the light absorption intensity is a method using a microspectrophotometer. The microspectrophotometer is a device capable of measuring the absorption spectrum of a microscopic area and can measure the transmission spectrum of one grain. The measurement of absorption spectrum of one grain by the microspectrometry is described in the report by Yamashita et al. (see, Nippon Shashin Gakkai, 1996 *Nendo Nenji Taikai Ko' en Yoshi Shu* (*Lecture Summary at Annual Meeting of Japan Photographic Association in* 1996), page 15). From this absorption spectrum, the absorption intensity per one grain can be obtained, however, the light transmitted through the grain is absorbed on two faces of upper face and lower face, therefore, the absorption intensity per unit are on the grain surface can be obtained as a half (½) of the absorption intensity per one grain determined by the above-described method. At this time, the segment for the integration of absorption spectrum is from 5,000 to 35,000 $cm^{-1}$ in the definition, however, in experiments, the integration may be performed in the segment containing the region of 500 $cm^{-1}$ shorter or longer than the segment having absorption by the sensitizing dye.

The light absorption intensity is a value indiscriminately determined by the oscillator strength of sensitizing dye and the number of molecules adsorbed per unit area and therefore, when the oscillator strength of sensitizing dye, the amount of dye adsorbed and the surface area of grain are obtained, the values obtained can be converted into the light absorption intensity.

The oscillator strength of sensitizing dye can be experimentally determined as a value in proportion to the absorption integrated intensity (optical density×$cm^{-1}$) of a sensitizing dye solution. Therefore, assuming that the absorption integrated intensity of a dye per 1 M is A (optical density×$cm^{-1}$), the amount of sensitizing dye adsorbed is B (mol/mol-Ag) and the surface area of grain is C ($m^2$/mol-Ag), the light absorption intensity can be obtained according to the following formula within an error of about 10%:

$$0.156 \times A \times B/C$$

The light absorption intensity calculated from this formula is substantially the same as the light absorption intensity measured based on the above-described definition (a value obtained by the integration of Log $(I_0/(I_0-I))$ with respect to the wave number ($cm^{-1}$)).

For increasing the light absorption intensity, multilayer adsorption as in the present invention is effective.

The multilayer adsorption is described in detail below. The state where the dye chromophore is adsorbed in two or more layers to the grain surface means that two or more dye layers bound are present in the vicinity of a silver halide grain. Here, the dyes present in the dispersion medium are excluded. Even in the case where a dye chromophore is connected through a covalent bond to a substance adsorbed to the grain surface, if the linking group is very long and the dye chromophore is present in the dispersion medium, the effect of increasing the light absorption intensity is disadvantageously low.

The "chromophore" as used herein means an atomic group mainly responsible for the absorption band of a molecule as described in *Rikagaku Jiten* (*Physicochemical Dictionary*), pp. 985–986, 4th ed., Iwanami Shoten (1987), and any atomic group, for example, an atomic group having an unsaturated bond such as C═C or N═N, may be used. Specific examples thereof include those described as specific examples of the dye chromophore, and preferred examples are also the same.

The dye chromophore is preferably adsorbed to a silver halide grain in 1.5 or more layers, more preferably in 1.7 or more layers, still more preferably in 2 or more layers. The upper limit is not particularly limited but is preferably 10 layers or less, more preferably 5 layers or less.

One of the methods for evaluating the multilayer adsorption state is described below. Out of the sensitizing dyes added to the silver halide emulsion in the state where dye chromophores are linked through a covalent bond, the saturation adsorption amount per unit area attainable by a dye having a smallest dye occupation area on the surface of a silver halide grain when individual dyes are not linked, is defined as the single layer saturation coverage. When the amount of dye chromophore adsorbed per unit area is large based on the single layer saturation coverage, the adsorption can be said multilayer adsorption. Also, the number of adsorbed layers means the amount adsorbed based on the single layer saturation coverage.

The dye occupation area can be obtained from an adsorption isotherm showing the relationship between the free dye concentration and the amount of dye adsorbed, and a grain surface area. The adsorption isotherm can be obtained by referring, for example, to A. Herz et al., *Adsorption from Aqueous Solution, Advances in chemistry Series*), No. 17, page 173 (1968).

For determining the amount of sensitizing dye adsorbed to an emulsion grain, two methods may be used, namely, one is a method of centrifuging an emulsion having adsorbed thereto a dye, separating the emulsion grains from the supernatant aqueous gelatin solution, measuring the spectral absorption of the supernatant to obtain the concentration of non-adsorbed dye, and subtracting the obtained concentration from the amount of dye added, thereby determining the amount of dye adsorbed, and another is a method of drying the emulsion grains precipitated, dissolving a predetermined mass of the precipitate in a 1:1 mixed solution of aqueous sodium thiosulfate solution and methanol, and measuring the spectral absorption, thereby determining the amount of dye adsorbed. In the case where a plurality of dyes are used, the amount of individual dyes adsorbed may also be determined using means such as high-performance liquid chromatography. The method of determining the amount of dye adsorbed by quantitating the amount of dye in the supernatant is described, for example, in W. West et al., *Journal of Physical Chemistry,* Vol. 56, page 1054 (1952). However, under the conditions of adding the dye in a large amount, even non-adsorbed dyes may precipitate and exact determination of the amount of dye adsorbed may not be obtained by the method of quantitating the dye concentration in the supernatant. On the other hand, according to the method of dissolving precipitated silver halide grains and measuring the amount of dye adsorbed, the amount of only the dye adsorbed to grains can be exactly determined because the emulsion grain is by far higher in the precipitation rate and the grains can be easily separated from the precipitated dye. This method is most reliable for determining the amount of dye adsorbed.

The amount of a photographically useful compound adsorbed to a grain can also be measured in the same manner as the sensitizing dye, however, since the absorption in the visible region is small, a quantitative method using high performance liquid chromatography is preferred more than the quantitative method by spectral absorption.

According to one example of the method for measuring the surface area of a silver halide grain, a photograph of grains is taken through a transmission electron microscope by a replica process, individual grains are measured on the shape and the size, and the surface area is calculated from the obtained values. In this case, the thickness of a tabular grain is calculated from the length of a shadow of the replica. The method for taking a photograph through a transmission electron microscope is described, for example, in *Denshi*

*Kenbikyo Shiryo Gijutsu Shu* (*Electron Microscopic Sample Technologies*), Nippon Denshi Kenbikyo Gakkai Kanto Shibu (compiler), Seibundo Shinko Sha (1970), and P. B. Hirsch et al., *Electron Microscopy of Thin Crystals,* Butterworths, London (1965).

Other examples of the measuring method include those described in A. M. Kragin et al., *The Journal of Photographic Science,* Vol. 14, page 185 (1966), J. F. Paddy, *Transactions of the Faraday Society,* Vol. 60, page 1325 (1964), S. Boyer et al., *Journal de Chimie Physique et de Physicochimie Biologique,* Vol. 63, page 1123 (1963), W. West et al., *Journal of Physical Chemistry,* Vol. 56, page 1054 (1952), and H. Sauvernier (compiler), E. Klein et al., *International Colloquium, Scientific Photography,* Liege (1959).

The occupation area of individual dye chromophores can be experimentally determined by the above-described methods, however, the molecular occupation area of sensitizing dyes usually used is present almost in the vicinity of 80 $Å^2$, therefore, the number of layers adsorbed can be roughly estimated by counting the dye occupation area of all dye chromophores as 80 $Å^2$.

In the multilayer adsorption, spectral sensitization needs be generated by the dye not directly adsorbed to the grain surface and for this purpose, an excitation energy or an electron must be transmitted from the dye not directly adsorbed to silver halide to the dye directly adsorbing to the grain. Between the excitation energy transmission and the electron transmission, the excitation energy transmission is preferred.

If the transmission of excitation energy or electron is attained through 10 or more stages, the final transmission efficiency of excitation energy and electron disadvantageously decreases. One example thereof is a polymer dye described in JP-A-2-113239, where the majority of dye chromophores are present in a dispersion medium and the excitation energy must be transmitted through over 10 stages.

In the present invention, the number of dye chromophores per one molecule is preferably from 2 to 5, more preferably 3.

In the case where a dye chromophore is adsorbed in multiple layers to a silver halide grain, the dye chromophore directly adsorbing to the silver halide grain, namely, the dye chromophore in the first layer, and the dye chromophore in the second or upper layer (also called second or subsequent layer) may have any reduction potential and any oxidation potential, however, the reduction potential of the dye chromophore in the first layer is preferably more positive than the value obtained by subtracting 0.2 V from the reduction potential of the dye chromophore in the second or upper layer.

The reduction potential and the oxidation potential can be measured by various methods, however, these are preferably measured by phase discrimination-type second harmonic a.c. polarography for obtaining exact values. The method for measuring the potential by phase discrimination-type second harmonic a.c. polarography is described in *Journal of Imaging Science,* Vol. 30, page 27 (1986).

The dye chromophore in the second or upper layer is preferably a light-emitting dye. As for the kind of the light-emitting dye, those having a skeleton structure of dyes used for dye laser are preferred. These are described, for example, in Mitsuo Maeda, *Laser Kenkyu* (*Study of Laser*), Vol. 8, page 694, page 803 and page 958 (1980), ibid., Vol. 9, page 85 (1981), and F. Sehaefer, *Dye Lasers,* Springer (1973).

The absorption maximum wavelength of the dye chromophore in the first layer in a silver halide photographic light-sensitive material is preferably longer than the absorption maximum wavelength of the dye chromophore in the second or upper layer. Furthermore, the light emission of the dye chromophore in the second or upper layer preferably overlaps the absorption of the dye chromophore in the first layer. In addition, the dye chromophores in the first layer preferably form a J-aggregate. In order to have absorption and spectral sensitivity in a desired wavelength range, the dye chromophores in the second or upper layer also preferably form a J-aggregate.

The excitation energy of the dye chromophore in the second or upper layer preferably transfers to the first layer dye chromophore with a transfer energy efficiency of 10% or more, more preferably 30% or more, still more preferably 60% or more, particularly preferably 90% or more. The term "excitation energy of the dye chromophore in the second or upper layer" as used herein means the energy of a dye chromophore in the excited state produced as a result of the dye chromophore in the second or upper layer absorbing light energy. When excitation energy of a certain molecule transfers to another molecule, the excitation energy is considered to transfer through excitation electron transfer mechanism, Forster model energy transfer mechanism, Dextor model energy transfer mechanism or the like. Therefore, it is also preferred for the multilayer adsorption system of the present invention to satisfy the conditions for causing an efficient excitation energy transfer achievable by these mechanisms, more preferably to satisfy the conditions for causing Forster model energy transfer mechanism. In order to elevate the efficiency of the Forster model energy transfer, reduction in the refractive index near the surface of an emulsion grain may be also effective.

The efficiency of the energy transfer from the dye chromophore in the second or upper layer to the dye chromophore in the first layer can be determined as (spectral sensitization efficiency at the excitation of the dye chromophore in the second or upper layer/spectral sensitization efficiency at the excitation of the dye chromophore in the first layer).

The meanings of the terms used in the present invention are described below.

Dye Occupation Area:

An occupation area per one dye molecule. This can be experimentally determined from the adsorption isotherm. In the case of the compound of the present invention having a plurality of dye chromophores, the dye occupation area of individual dyes is used as a base. This is simply 80 $Å^2$.

Single Layer Saturation Coverage:

An amount of dye adsorbed per unit grain surface area at the time of single layer saturation covering. This is expressed by a reciprocal of the minimum dye occupation area among dyes added.

Multilayer Adsorption:

This means a state where a dye chromophore is stacked in two or more layers on the surface of a silver halide grain. According to one of the methods for evaluating this, whether the amount of a dye chromophore adsorbed per unit grain surface area is larger than the single layer saturation coverage is determined.

Number of Adsorbed Layer:

This means the number of layers of dye chromophore stacked on the surface of a silver halide grain. According to one of the methods for evaluating this, the amount of the dye chromophore adsorbed per unit grain surface area is determined based on the single layer saturation coverage. For example, when a compound in which two dye chromophores are connected through a covalent bond is adsorbed in one layer portion as the compound, this means two-layer adsorption as the dye chromophore.

In the emulsion containing silver halide photographic emulsion grains having a light absorption intensity of 60 or a light absorption intensity of 100 or more, the distance between the shortest wavelength showing 50% of the maximum value Amax of spectral absorption factor by a sensitizing dye and the longest wavelength showing 50% of Amax and the distance between the shortest wavelength showing 50% of the maximum value Smax of spectral sensitivity and the longest wavelength showing 50% of Smax each is preferably 120 nm or less, more preferably 100 nm or less.

The distance between the shortest wavelength showing 80% of Amax and the longest wavelength showing 80% of Amax and the distance between the shortest wavelength showing 80% of Smax and the longest wavelength showing 80% of Smax each is preferably 20 nm or more and preferably 100 nm or less, more preferably 80 nm or less, still more preferably 50 nm or less.

The distance between the shortest wavelength showing 20% of Amax and the longest wavelength showing 20% of Amax and the distance between the shortest wavelength showing and 20% of Smax and the longest wavelength showing 20% of Smax each is preferably 180 nm or less, more preferably 150 nm or less, still more preferably 120 nm or less, most preferably 100 nm or less.

The longest wavelength showing spectral absorption factor of 50% of Amax is preferably from 460 to 510 nm, from 560 nm to 610 nm, or from 640 to 730 nm.

The longest wavelength showing spectral sensitivity of 50% of Smax is preferably from 460 to 510 nm, from 560 nm to 610 nm, or from 640 to 730 nm.

Assuming that the maximum value of spectral absorption factor by the sensitizing dye in the first layer of a silver halide grain is A1max and the maximum value of spectral absorption factor by the sensitizing dye in the second or upper layer is A2max, A1max and A2max each is preferably present in the range from 400 to 500 nm, from 500 to 600 nm, from 600 to 700 nm, or from 700 to 1,000 nm.

Assuming that the maximum value of spectral sensitivity by the sensitizing dye in the first layer of a silver halide grain is S1max and the maximum value of spectral sensitivity by the sensitizing dye in the second or upper layer is S2max, S1max and S2max each is preferably present in the range from 400 to 500 nm, from 500 to 600 nm, from 600 to 700 nm, or from 700 to 1,000 nm.

In the case of multilayer adsorption, if the dye chromophore in the second or upper layer is adsorbed in the monomer state, the absorption width and the spectral sensitivity width each sometimes becomes wider than the desired width. Accordingly, in the present invention, the dye chromophores adsorbed in the second or upper layer preferably form a J-aggregate so as to realize high sensitivity in the desired wavelength region. The J-aggregate gives a high fluorescence yield and a small Stokes' shift and therefore, is preferred also for transferring the light energy absorbed by the dye chromophore in the second or upper layer to the first layer dye chromophore approximated in the light absorption wavelength, using the Forster-type energy transfer.

In the present invention, the dye chromophore in the second or upper layer is a dye chromophore which is bound to a silver halide grain but not adsorbed directly to the silver halide.

In the present invention, the J-aggregate formed by the dye chromophores in the second or upper layer preferably satisfies the condition such that the absorption width in the longer wavelength side of absorption shown by the dye chromophore adsorbed in the second or upper layer is two times or less the absorption width in the longer wavelength side of absorption shown by the dye solution in the monomer state lacking in the interaction between dye chromophores. The absorption width in the longer wavelength side as used herein means an energy width between the absorption maximum wavelength and the wavelength being longer than the absorption maximum wavelength and showing absorption as small as ½ of the absorption maximum. It is known that when a J-aggregate is formed, the absorption width in the longer wavelength side is generally reduced as compared with the monomer state. When the dye chromophore in the second or upper layer is adsorbed in the monomer state, the adsorption site and the adsorption state are not uniform and therefore, the absorption width increases to as large as 2 times or more the absorption width in the longer wavelength side of a dye solution in the monomer state. The formation of a J-aggregate of dye chromophores in the second or upper layer can be confirmed by this.

The spectral absorption of the dye chromophore adsorbed in the second or upper layer can be determined by subtracting the spectral absorption attributable to the first layer dye chromophore from the entire spectral absorption of the emulsion.

The spectral absorption attributable to the first layer dye chromophore can be determined by measuring the absorption spectrum when only the first layer dye chromophore moiety is added.

In the case where multilayer adsorption can be attained by modifying the dye in the unlinked state, the spectral absorption spectrum attributable to the first layer dye can also be measured by adding a dye desorbing agent to the emulsion and thereby desorbing the dye in the second or upper layer.

In the experiment of desorbing a dye in the unlinked state from the grain surface using a dye desorbing agent, the first layer dye is usually desorbed after the dye in the second or upper layer is desorbed. Therefore, by selecting appropriate desorption conditions, the spectral absorption attributable to the first layer dye can be determined and thereby the spectral absorption of the dye in the second or upper layer can be obtained. The method of using a dye desorbing agent is described in Asanuma et al., *Journal of Physical Chemistry B*, Vol. 101, pp. 2149–2153 (1997).

In the present invention, a dye other than the dyes of the present invention may be added, however, the dye of the present invention preferably occupies 50% or more, more preferably 70% or more, most preferably 90% or more, of the total amount of dyes added.

The compounds for use in the present invention are described below.

The group and the like for use in the present invention is described in detail below.

In the present invention, when a specific site is called "a group", this means that the site itself may not be substituted or may be substituted by one or more (a possible maximum number of) substituents. For example, "an alkyl group" means a substituted or unsubstituted alkyl group. The substituent which can be used in the compound for use in the present invention may be any substituent irrespective of the presence or absence of substitution.

Assuming that this substituent is W, the substituent represented by W may be any substituent and is not particularly limited, however, examples thereof include a halogen atom, an alkyl group (including cycloalkyl group, bicycloalkyl group and tricycloalkyl group), an alkenyl group (including cycloalkenyl group and bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an ammonio group, an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phophinyl group, a phosphinyloxy group, a phosphinylamino group, a phosphono group, a silyl group, a hydrazino group, a ureido group, a boronic acid group (—$B(OH)_2$), a phoshato group (—$OPO(OH)_2$), a sulfato group (—$OSO_3H$) and other known substituents.

More specifically, W represents a halogen atom (e.g., fluorine, chlorine, bromine, iodine), an alkyl group [a linear, branched or cyclic, substituted or unsubstituted alkyl group; the alkyl group includes an alkyl group (preferably an alkyl group having from 1 to 30 carbon atoms, e.g., methyl, ethyl, n-propyl, isopropyl, tert-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-dodecyl-cyclohexyl), a bicycloalkyl group (preferably a substituted or unsubstituted bicycloalkyl group having from 5 to 30 carbon atoms, namely, a monovalent group resultant of removing one hydrogen atom from a bicycloalkane having from 5 to 30 carbon atoms, e.g., bicyclo[2,2]heptan-2-yl, bicyclo[2,2,2]octan-3-yl), and a tricyclo structure having many cyclic structures; the alkyl group in the substituent described below (for example, an alkyl group in an alkylthio group) means an alkyl group having such a concept and also includes an alkenyl group and an alkynyl group], an alkenyl group [a linear, branched or cyclic, substituted or unsubstituted alkenyl group; the alkenyl group includes an alkenyl group (preferably a substituted or unsubstituted alkenyl group having from 2 to 30 carbon atoms, e.g., vinyl, allyl, prenyl, geranyl, oreyl), a cycloalkenyl group (preferably a substituted or unsubstituted cycloalkenyl group having from 3 to 30 carbon atoms, namely, a monovalent group resultant of removing one hydrogen atom form a cycloalkane having from 3 to 30 carbon atoms, e.g., 2-cyclopenten-1-yl, 2-cyclohexen-1-yl), a bicycloalkenyl group (a substituted or unsubstituted bicycloalkenyl group, preferably a substituted or unsubstituted bicycloalkenyl group having from 5 to 30 carbon atoms, namely, a monovalent group resultant of removing one hydrogen atom from a bicycloalkane having one double bond, e.g., bicyclo[2,2,1]hept-2-en-1-yl, bicyclo[2,2,2]oct-2-en-4-yl)], an alkynyl group (preferably a substituted or unsubstituted alkynyl group having from 2 to 30 carbon atoms, e.g., ethynyl, propargyl, trimethylsilylethynyl), an aryl group (preferably a substituted or unsubstituted aryl group having from 6 to 30 carbon atoms, e.g., phenyl, p-tolyl, naphthyl, m-chlorophenyl, o-hexadecanoylaminophenyl), a heterocyclic group (preferably a monovalent group resultant of removing one hydrogen atom from a 5- or 6-membered substituted or unsubstituted, aromatic or non-aromatic heterocyclic compound, more preferably a 5- or 6-membered aromatic heterocyclic group having from 3 to 30 carbon atoms, e.g., 2-furyl, 2-thienyl, 2-pyrimidinyl, 2-benzothiazolyl; the heterocyclic group may also be a cationic heterocyclic group such as 1-methyl-2-pyridinio and 1-methyl-2-quinolinio), a cyano group, a hydroxyl group, a nitro group, a carboxyl group, an alkoxy group (preferably a substituted or unsubstituted alkoxy group having from 1 to 30 carbon atoms, e.g., methoxy, ethoxy, isopropoxy, tert-butoxy, n-octyloxy, 2-methoxyethoxy), an aryloxy group (preferably a substituted or unsubstituted aryloxy group having from 6 to 30 carbon atoms, e.g., phenoxy, 2-methylphenoxy, 4-tert-butylphenoxy, 3-nitrophenoxy, 2-tetradecanoylaminophenoxy), a silyloxy group (preferably a silyloxy group having from 3 to 20 carbon atoms, e.g., trimethylsilyloxy, tert-butyldimethylsilyloxy), a heterocyclic oxy group (preferably a substituted or unsubstituted heterocyclic oxy group having from 2 to 30 carbon atoms, e.g., 1-phenyltetrazol-5-oxy, 2-tetrahydropyranyloxy), an acyloxy group (preferably a formyloxy group, a substituted or unsubstituted alkylcarbonyloxy group having from 2 to 30 carbon atoms, or a substituted or unsubstituted arylcarbonyloxy group having from 6 to 30 carbon atoms, e.g., formyloxy, acetyloxy, pivaloyloxy, stearoyloxy, benzoyloxy, p-methoxyphenylcarbonyloxy), a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), an alkoxycarbonyloxy group (preferably a substituted or unsubstituted alkoxycarbonyloxy group having from 2 to 30 carbon atoms, e.g., methoxycarbonyloxy, ethoxycarbonyloxy, tert-butoxycarbonyloxy, n-octylcarbonyloxy), an aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxyphenoxy-carbonyloxy), an amino group (preferably an amino group, a substituted or unsubstituted alkylamino group having from 1 to 30 carbon atoms, or a substituted or unsubstituted anilino group having from 6 to 30 carbon atoms, e.g., amino, methylamino, dimethylamino, anilino, N-methyl-anilino, diphenylamino), an ammonio group (preferably an ammonio group or an ammonio group substituted by a substituted or unsubstituted alkyl, aryl or heterocyclic group having from 1 to 30 carbon atoms, e.g., trimethylammonio, triethyl-ammonio, diphenylmethylammonio), an acylamino group (preferably a formylamino group, a substituted or unsubstituted alkylcarbonylamino group having from 1 to 30 carbon atoms, or a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino), an aminocarbonylamino group (preferably a substituted or unsubstituted aminocarbonylamino group having from 1 to 30 carbon atoms, e.g., carbamoylamino, N,N-dimethylamino-carbonylamino, N,N-diethylaminocarbonylamino, morpholino-carbonylamino), an alkoxycarbonylamino group (preferably a substituted or unsubstituted alkoxycarbonylamino group having from 2 to 30 carbon atoms, e.g., methoxycarbonyl-amino, ethoxycarbonylamino, tert-butoxycarbonylamino, n-octadecyloxycarbonylamino, N-methyl-methoxycarbonylamino), an aryloxycarbonylamino group (preferably a substituted or unsubstituted aryloxycarbonylamino group having from 7 to 30 carbon atoms, e.g., phenoxycarbonylamino, p-chlorophenoxycarbonylamino, m-n-octyloxyphenoxycarbonylamino), a sulfamoylamino group (preferably a substituted or unsubstituted sulfamoylamino group having from 0 to 30 carbon atoms, e.g., sulfamoylamino, N,N-dimethylaminosulfonylamino, N-n-octylaminosulfonylamino), an alkyl- or arylsulfonylamino group (preferably a substituted or unsubstituted alkylsulfonylamino group having from 1 to 30 carbon atoms, or a substituted or unsubstituted arylsulfonylamino group having from 6 to 30 carbon atoms, e.g., methylsulfonylamino, butylsulfonylamino, phenyl-sulfonylamino, 2,3,5-trichlorophenylsulfonylamino, p-methylphenylsulfonylamino), a mercapto group, an alkylthio group (preferably a substituted or unsubstituted alkylthio group having from 1 to 30 carbon atoms, e.g., methylthio, ethylthio, n-hexadecylthio), an arylthio group (preferably a substituted or unsubstituted arylthio group having from 6 to 30 carbon atoms, e.g., phenylthio, p-chlorophenylthio, m-methoxyphenylthio), a heterocyclic thio group (preferably a substituted or unsubstituted heterocyclic thio group having from 2 to 30 carbon atoms, e.g., 2-benzo-thiazolylthio, 1-phenyltetrazol-5-ylthio), a sulfamoyl group (preferably a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), a sulfo group, an alkyl- or arylsulfinyl group (preferably a substituted or unsubstituted alkylsulfinyl group having from 1 to 30 carbon atoms, or a substituted or unsubstituted arylsulfinyl group having from 6 to 30 carbon atoms, e.g., methylsulfinyl, ethylsulfinyl, phenylsulfinyl, p-methylphenylsulfinyl), an alkyl- or arylsulfonyl group (preferably a substituted or unsubstituted alkylsulfonyl group having from 1 to 30 carbon atoms, or a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably a formyl group, a substituted or unsubstituted alkylcarbonyl group having from 2 to 30 carbon atoms, a substituted or unsubstituted arylcarbonyl group having from 7 to 30 carbon atoms, or a substituted or unsubstituted heterocyclic carbonyl group having from 4 to 30 carbon atoms and being bonded to a carbonyl group through the carbon atom, e.g., acetyl, pivaloyl, 2-chloroacetyl, stearoyl, benzoyl, p-n-octyloxyphenylcarbonyl, 2-pyridylcarbonyl, 2-furylcarbonyl), an aryloxycarbonyl group (preferably a substituted or unsubstituted aryloxycarbonyl group having from 7 to 30 carbon atoms, e.g., phenoxycarbonyl, o-chlorophenoxy-carbonyl, m-nitrophenoxycarbonyl, p-tert-butylphenoxycarbonyl), an alkoxycarbonyl group (preferably a substituted or unsubstituted alkoxycarbonyl group having from 2 to 30 carbon atoms, e.g., methoxycarbonyl, ethoxycarbonyl, tert-butoxycarbonyl, n-octadecyloxycarbonyl), a carbamoyl group (preferably a substituted or unsubstituted carbamoyl group having from 1 to 30 carbon atoms, e.g., carbamoyl, N-methylcarbamoyl, N,N-dimethyl-carbamoyl, N,N-di-n-octylcarbamoyl, N-(methylsulfonyl)-carbamoyl), an aryl or heterocyclic azo group (preferably a substituted or unsubstituted arylazo group having from 6 to 30 carbon atoms, or a substituted or unsubstituted heterocyclic azo group having from 3 to 30 carbon atoms, e.g., phenylazo, p-chlorophenylazo, 5-ethylthio-1,3,4-thiadiazol-2-ylazo), an imido group (preferably N-succinimido or N-phthalimido), a phosphino group (preferably a substituted or unsubstituted phosphino group having from 2 to 30 carbon atoms, e.g., dimethylphosphino, diphenylphosphino, methylphenoxyphosphino), a phosphinyl group (preferably a substituted or unsubstituted phosphinyl group having from 2 to 30 carbon atoms, e.g., phosphinyl, dioctyloxyphosphinyl, diethoxyphosphinyl), a phosphinyloxy group (preferably a substituted or unsubstituted phosphinyloxy group having from 2 to 30 carbon atoms, e.g., diphenoxyphosphinyloxy, dioctyloxyphosphinyloxy), a phosphinylamino group (preferably a substituted or unsubstituted phosphinylamino group having from 2 to 30 carbon atoms, e.g., dimethoxyphosphinylamino, dimethyl-aminophosphinylamino), a phospho group, a silyl group (preferably a substituted or unsubstituted silyl group having from 3 to 30 carbon atoms, e.g., trimethylsilyl, tert-butyldimethylsilyl, phenyldimethylsilyl), a hydrazino group (preferably a substituted or unsubstituted hydrazino group having from 0 to 30 carbon atoms, e.g., trimethylhydrazino), or a ureido group (preferably a substituted or unsubstituted ureido group having from 0 to 30 carbon atoms, e.g., N,N-dimethylureido).

Two Ws may form a ring in cooperation (for example, an aromatic or non-aromatic hydrocarbon or heterocyclic ring or a polycyclic condensed ring comprising a combination of these rings, e.g., benzene ring, naphthalene ring, anthracene ring, phenanthrene ring, fluorene ring, triphenylene ring, naphthacene ring, biphenyl ring, pyrrole ring, furan ring, thiophene ring, imidazole ring, oxazole ring, thiazole ring, pyridine ring, pyrazine ring, pyrimidine ring, pyridazine ring, indolizine ring, indole ring, benzofuran ring, benzothiophene ring, isobenzofuran ring, quinolidine ring, quinoline ring, phthalazine ring, naphthylidine ring, quinoxaline ring, quinoxazoline ring, isoquinoline ring, carbazole ring, phenanthridine ring, acridine ring, phenanthroline ring, thianthrene ring, chromene ring, xanthene ring, phenoxathiine ring, phenothiazine ring, phenazine ring).

Among these substituents W, those having a hydrogen atom may be deprived of the hydrogen atom and substituted by the above-described substituent. Examples of such a substituent include —$CONHSO_2$— group (e.g., sulfonylcarbamoyl group, carbamoylsulfamoyl group), —CONHCO— group (e.g., carbonylcarbamoyl group) and —$SO_2NHSO_2$— group (e.g., sulfonylsulfamoyl group).

Specific examples thereof include an alkylcarbonylaminosulfonyl group (e.g., acetylaminosulfonyl), an arylcarbonylaminosulfonyl group (e.g., benzoylamino-sulfonyl), an alkylsulfonylaminocarbonyl group (e.g., methylsulfonylaminocarbonyl) and an arylsulfonylamino-carbonyl group (e.g., p-methylphenylsulfonylaminocarbonyl).

The dye chromophore represented by Da, Db, Dc and Dd in formula (I) may any dye chromophore but examples thereof include dye chromophores described above and preferred examples are also the same. Preferred is the case where at least one of Da, Db and Dc is a cyanine dye, a merocyanine dye, a rhodacyanine dye, an oxonol dye, a hemicyanine dye, a streptocyanine dye or a hemioxonol dye, and more preferred is the case where all are a cyanine dye, a merocyanine dye, a rhodacyanine dye, an oxonol dye, a hemicyanine dye, a streptocyanine dye or a hemioxonol dye. Among these cyanine dye, merocyanine dye, rhodacyanine dye, oxonol dye, hemicyanine dye, streptocyanine dye and hemioxonol dye, preferred are a cyanine dye, a merocyanine dye, an oxonol dye, a hemicyanine dye, a streptocyanine dye and a hemioxonol dye, more preferred are a cyanine dye, a merocyanine dye, a hemicyanine dye, a streptocyanine dye and a hemioxonol dye, still more preferred are a hemicyanine dye, a streptocyanine dye and a hemioxonol dye, particularly preferred are a hemicyanine dye and a streptocyanine dye, and most preferred is a hemicyanine dye. When it is a hemicyanine dye, a streptocyanine dye or a hemioxonol dye, the residual color after processing is less, which is preferable.

Dd is preferably a cyanine dye, a merocyanine dye or a rhodacyanine dye, more preferably a cyanine dye or a merocyanine dye, still more preferably a cyanine dye.

Da, Db, Dc and Dd may be the same or different. Dd is preferably different from Da, Db and Dc because multilayer adsorption can be attained. Da, Db and Dc are preferably the same dye chromophore.

In the present invention, in the case where the linked dye represented by formula (I) (when $r_1$ is 1 and Xa is Dd) is adsorbed to a silver halide grain, it is preferred that Dd adsorbs to silver halide and Da, Db and Dc do not adsorb directly to silver halide. In other words, $[(\text{-Lb-})_{p3}[\text{Da}(\text{—La}_1\text{—})_{p1}\{\text{Db}(\text{—La}_2\text{—})_{p2}\}_{q1}\text{Dc}]$ is preferably lower than Dd in the adsorption strength to a silver halide grain.

As such, Dd is preferably a sensitizing dye moiety having adsorptivity to a silver halide grain, however, the adsorption may be attained by either physical adsorption or chemical adsorption.

Da, Db and Dc are preferably weak in the adsorptivity to a silver halide grain and is preferably a light-emitting dye. With respect to the kind of the light-emitting dye, those having a skeleton structure of dyes used for dye laser are preferred. These are described, for example, in Mitsuo Maeda, *Laser Kenkyu* (*Study of Laser*), Vol. 8, page 694, page 803 and page 958 (1980), ibid., Vol. 9, page 85 (1981), and F. Sehaefer, *Dye Lasers,* Springer (1973).

The absorption maximum wavelength of Dd in a silver halide photographic light-sensitive material is preferably longer than the absorption maximum wavelength of $[(\text{-Lb-})_{p3[Da(\text{—}La1\text{—})_{p1}\{\text{Db}(\text{—La}_2\text{—})_{p2}\}_{q1}\text{Dc}]}$. Furthermore, the light emission of $[(\text{-Lb-})_{p3}[\text{Da}(\text{—La}_1\text{—})_{p1}\{\text{Db}(\text{—La}_2\text{—})_{p2}\}_{q1}\text{Dc}]$. preferably overlaps the absorption of Dd. In addition, Dd preferably forms a J-aggregate. In order to let the linked dye represented by formula (I) have absorption and spectral sensitivity in a desired wavelength range, $[(\text{-Lb-})_{p3}[\text{Da}(\text{—La}_1\text{—})_{p1}\{\text{Db}(\text{—La}_2\text{—})_{p2}\}_{q1}\text{Dc}]$ also preferably forms a J-aggregate.

Dd and $[(\text{-Lb-})_{p3}[\text{Da}(\text{—La}_1\text{—})_{p1}\{\text{Db}(\text{—La}_2\text{—})_{p2}\}_{q1}\text{Dc}]$ each may have any reduction potential and any oxidation potential, however, the reduction potential of Dd is preferably more positive than the value obtained by subtracting 0.2 V from the reduction potential of $[(\text{-Lb-})_{p3[Da(\text{—}La1\text{—})_{p1}\{\text{Db}(\text{—La}_2\text{—})_{p2}\}_{q1}\text{Dc}]}$.

$La_1$, $La_2$ and Lb each represents a linking group (preferably a divalent linking group). The linking group includes a single bond (also called a mere bond). This linking group preferably comprises a single bond or an atom or atomic group containing at least one of carbon atom, nitrogen atom, sulfur atom and oxygen atom. $La_1$, $La_2$ and Lb each preferably represents a single bond or a linking group having from 0 to 100 carbon atoms, more preferably from 1 to 20 carbon atoms, constituted by one or a combination of two or more of an alkylene group (e.g., methylene, ethylene, trimethylene, tetramethylene, pentamethylene), an arylene group (e.g., phenylene, naphthylene,), an alkenylene group (e.g., ethenylene, propenylene), an alkynylene group (e.g., ethynylene, propynylene), an amide group, an ester group, a sulfoamido group, a sulfonic acid ester group, a ureido group, a sulfonyl group, a sulfinyl group, a thioether group, an ether group, a carbonyl group, —N(Va)- (wherein Va represents a hydrogen atom or a monovalent substituent; examples of the monovalent substituent include those represented by W described above) and a heterocyclic divalent group (e.g., 6-chloro-1,3,5-triazine-2,4-diyl, pyrimidine-2,4-diyl, quinoxaline-2,3-diyl).

The above-described linking group may have a substituent represented by W described above. Furthermore, the linking group may contain a ring (aromatic or nonaromatic hydrocarbon or heterocyclic ring).

$La_1$, $La_2$ and Lb each more preferably represents a single bond or a divalent linking group having from 1 to 10 carbon atoms, constituted by one or a combination of two or more of an alkylene group having from 1 to 10 carbon atoms (e.g., methylene, ethylene, trimethylene, tetramethylene, pentamethylene), an arylene group having from 6 to 10 carbon atoms (e.g., phenylene, naphthylene), an alkenylene group having from 2 to 10 carbon atoms (e.g., ethenylene, propenylene), an alkynylene group having from 2 to 10 carbon atoms (e.g., ethynylene, propynylene), an ether group, an amide group, an ester group, a sulfoamido group and a sulfonic acid ester group. This linking group may be substituted by W described above.

$La_1$, $La_2$ and Lb each is a linking group which may perform energy transfer or electron transfer by a through-bond interaction. The through-bond interaction includes a tunnel interaction and a super-exchange interaction. Among these, a through-bond interaction based on a super-exchange interaction is preferred. The through-bond interaction and the super-exchange interaction are interactions defined in Shammai Speiser, *Chem. Rev.,* Vol. 96, pp. 1960–1963 (1996). Preferred examples of the linking group which performs the energy transfer or electron transfer by such an interaction include those described in Shammai Speiser, *Chem. Rev.,* Vol. 96, pp. 1967–1969 (1996).

$p_1$, $p_2$ and $p_3$ each represents an integer of 1 to 4. When $p_1$, $p_2$ and $p_3$ each is 2 or more, this means that each of the pairs Da and Db, Db and Dc, and Xa and Da are linked by a plurality of linking groups.

When $La_1$ and $La_2$ are a single bond, $p_1$ and $p_2$ each is preferably 1, and when $La_1$ and $La_2$ are a linking group other than a single bond, $p_1$ and $p_2$ each is preferably 2, 3 or 4, more preferably 2. This is preferred because, as described above, the dye chromophores are fixed with each other to a specific disposition/orientation and the dye chromophore group exhibits an absorption spectrum of longer wavelength.

$p_3$ is preferably 1 or 2, more preferably 1. When $p_1$, $p_2$ and $p_3$ each is 2 or more, the plurality of linking groups $La_1$, $La_2$ or Lb contained may be different.

$q_1$ represents an integer of 0 to 5, preferably 0 or 1, more preferably 0. $q_2$ represents an integer of 1 to 5, preferably 1 or 2, more preferably 1. $r_1$ represents an integer of 1 to 5, preferably 1 or 2, more preferably 1. $r_2$ represents an integer of 0 to 5, preferably 0, 1 or 2, more preferably 0 or 1, still more preferably 1. When $q_1$, $q_2$, $r_1$ and $r_2$ each is 2 or more, the plurality of linking groups, dye chromophores or adsorptive groups to a silver halide grain represented by Xa, Lb, Da, $La_1$, Db, $La_2$ or Dc may be different from each other.

In the compound represented by formula (I), a dye chromophore (for example, a dye chromophore of not undergoing change in the absorption by the interaction) may be substituted.

The case when in formula (I), Xa is Dd and $r_2$ is an integer of 1 to 5 is described below. The compound represented by formula (I) as a whole preferably has an electric charge of −1 or less, more preferably −1.

In formula (I), preferably, Da, Db, Dc and Dd each is independently a methine dye selected from cyanines represented by formula (XI), merocyanines represented by formula (XII), rhodacyanines represented by formula (XIII), oxonols represented by formula (XIV), hemicyanines represented by formula (XV), streptocyanines represented by formula (XVI), and hemioxonols represented by formula (XVII):

(XI)

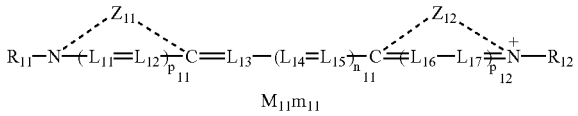

$M_{11}m_{11}$ wherein $L_{11}$, $L_{12}$, $L_{13}$, $L_{14}$, $L_{15}$, $L_{16}$ and $L_{17}$ each represents a methine group, $p_{11}$ and $p_{12}$ each represents 0 or 1, $n_{11}$ represents 0, 1, 2, 3 or 4, $Z_{11}$ and $Z_{12}$ each represents an atomic group necessary for forming a nitrogen-containing heterocyclic ring, provided that a ring may be condensed to $Z_{11}$ and $Z_{12}$, $M_{11}$ represents an electric charge balancing counter ion, $m_{11}$ represents a number of 0 or more necessary for neutralizing the electric charge of the molecule, and $R_{11}$ and $R_{12}$ each represents a hydrogen atom, an alkyl group, an aryl group or a heterocyclic group;

(XII)

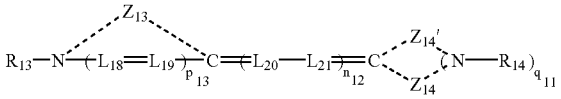

$M_{12}m_{12}$ wherein $L_{18}$, $L_{19}$, $L_{20}$ and $L_{21}$ each represents a methine group, $p_{13}$ represents 0 or 1, $q_{11}$ represents 0 or 1, $n_{12}$ represents 0, 1, 2, 3 or 4, $Z_{13}$ represents an atomic group necessary for forming a nitrogen-containing heterocyclic ring, $Z_{14}$ and $Z_{14}$' each represents an atomic group necessary for forming a heterocyclic or acyclic acidic terminal group together with $(N—R_{14})_{q11}$, provided that a ring may be condensed to $Z_{13}$, $Z_{14}$ and $Z_{14}$', $M_{12}$ represents an electric charge balancing counter ion, $m_{12}$ represents a number of 0 or more necessary for neutralizing the electric charge of the molecule, and $R_{13}$ and $R_{14}$ each represents a hydrogen atom, an alkyl group, an aryl group or a heterocyclic group;

3 or 4, $Z_{15}$ and $Z_{17}$ each represents an atomic group necessary for forming a nitrogen-containing heterocyclic ring, $Z_{16}$ and $Z_{16}$' each represents an atomic group necessary for forming a heterocyclic ring together with $(N—R_{16})_{q12}$, provided that a ring may be condensed to $Z_{15}$, to $Z_{16}$ and $Z_{16}$' and to $Z_{17}$, $M_{13}$ represents an electric charge balancing counter ion, $m_{13}$ represents a number of 0 or more necessary for neutralizing the electric charge of the molecule, and $R_{15}$, $R_{16}$ and $R_{17}$ each represents a hydrogen atom, an alkyl group, an aryl group or a heterocyclic group;

(XI)

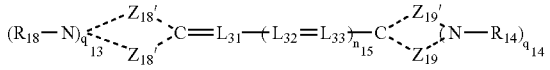

$M_{12}m_{12}$ wherein $L_{31}$, $L_{32}$ and $L_{33}$ each represents a methine group, $q_{13}$ and $q_{14}$ each represents 0 or 1, $n_{15}$ represents 0, 1, 2, 3 or 4, $Z_{18}$ and $Z_{18}$' each represents an atomic group necessary for forming a heterocyclic ring or an acyclic acidic terminal group together with $(N—R_{19})_{q14}$, provided that a ring may be condensed to $Z_{18}$ and $Z_{18}$' and to $Z_{19}$ and $Z_{19}$', $M_{14}$ represents an electric charge balancing counter ion, $m_{14}$ represents a number of 0 or more necessary for neutralizing the electric charge of the molecule, and $R_{18}$ and $R_{19}$ each represents a hydrogen atom, an alkyl group, an aryl group or a heterocyclic group;

(XV)

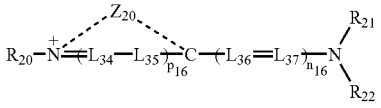

$M_{15}m_{15}$ wherein $L_{34}$, $L_{35}$, $L_{36}$ and $L_{37}$ each represents a methine group, $p_{16}$ represents 0 or 1, $n_{16}$ represents 0, 1, 2, 3 or 4, $Z_{20}$ represents an atomic group necessary for forming a nitrogen-containing heterocyclic ring, provided that a ring may be condensed to $Z_{20}$, $M_{15}$ represents an electric charge balancing counter ion, $m_{15}$ represents a number of 0 or more necessary for neutralizing the electric charge of the molecule, and $R_{20}$, $R_{21}$ and $R_{22}$ each represents a hydrogen atom, an alkyl group, an aryl group or a heterocyclic group;

(XIII)

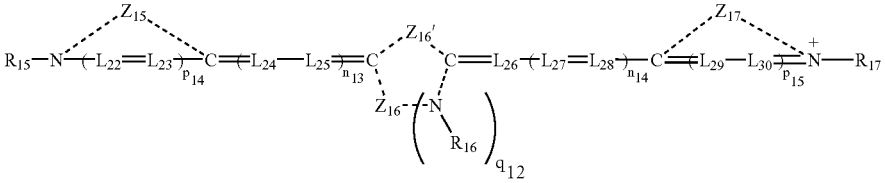

$M_{13}m_{13}$ wherein $L_{22}$, $L_{23}$, $L_{24}$, $L_{25}$, $L_{26}$, $L_{27}$, $L_{28}$, $L_{29}$ and $L_{30}$ each represents a methine group, $p_{14}$ and $p_{15}$ each represents 0 or 1, $q_{12}$ represents 0 or 1, $n_{13}$ and $n_{14}$ each represents 0, 1, 2, (XVI)

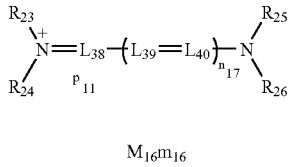

$M_{16}m_{16}$ wherein $L_{38}$, $L_{39}$ and $L_{40}$ each represents a methine group, $n_{17}$ represents 0, 1, 2, 3 or 4, $M_{16}$ represents an electric charge balancing counter ion, $m_{16}$ represents a number of 0 or more necessary for neutralizing the electric charge of the molecule, and $R_{23}$, $R_{24}$, $R_{25}$ and $R_{26}$ each represents a hydrogen atom, an alkyl group, an aryl group or a heterocyclic group; and (XVII)

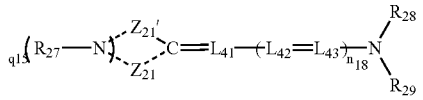

$M_{17}m_{17}$ wherein $L_{41}$, $L_{42}$ and $L_{43}$ each represents a methine group, $q_{15}$ represents 0 or 1, $n_{18}$ represents 0, 1, 2, 3 or 4, $Z_{21}$ and $Z_{21}$' each represents an atomic group necessary for forming a heterocyclic ring or an acyclic acidic terminal group together with $(N—R_{27})_{q15}$, provided that a ring may be condensed to $Z_{21}$ and $Z_{21}$', $M_{17}$ represents an electric charge balancing counter ion, $m_{17}$ represents a number of 0 or more necessary for neutralizing the electric charge of the molecule, and $R_{27}$, $R_{28}$ and $R_{29}$ each represents a hydrogen atom, an alkyl group, an aryl group or a heterocyclic group.

In formula (I), Dd is preferably a methine dye represented by formula (XI), (XII) or (XIII), more preferably a methine dye represented by formula (XI) or (XII), still more preferably a methine dye represented by formula (XI). In formula (I), Da, Db and Dc each is preferably a methine dye represented by formula (XI), (XII), (XIV), (XV), (XVI) or (XVII), more preferably a methine dye represented by formula (XI), (XII), (XV), (XVI) or (XVII), still more preferably a methine dye represented by formula (XV), (XVI) or (XVII), particularly preferably a methine dye represented by formula (XV) or (XVI), and most preferably a methine dye represented by formula (XV). When the methine dye represented by formula (XV), (XVI) or (XVII) is used, the residual color after processing is less, which preferable.

In formula (I), the $[Da(—La_1—)_{p1}\{Db(—La_2—)_{p2}\}_{q1}Dc]$ is preferably such that a methine dye represented formula (XV), (XVI) or (XVII) is connected to at least one- portion (preferably $R_{21}$s of two methine dyes represented by formula (XV) are bonded with each other, $R_{25}$s of two methine dyes represented by formula (XVI) are bonded with each other, or $R_{28}$s of two methine dyes represented by formula (XVII) are bonded with each other) or a methine dye represented by formula (XI), (XII) or (XIV) is connected to at least one portion, more preferably such that a methine dye represented by formula (XV), (XVI) or (XVII) is connected to at least one portion. The dye in which the methine dye represented by formula (XV), (XVI) or (XVII) is connected to at least one portion is preferable since the residual color is less.

The $[Da(—La_1—)_{p1}\{Db(—La_2—)_{p2}\}_{q1}Dc]$ is preferably such that a methine dye represented formula (XV), (XVI), (XVII), (XI) or (XII) is connected to at least one portion and preferred examples thereof include those represented by the following formulae:

The case represented by the following formula (XVIII), (XIX) or (XX) where a methine dye represented by formula (XV), (XVI) or (XVII) is connected to at least two portions:

(XVIII)

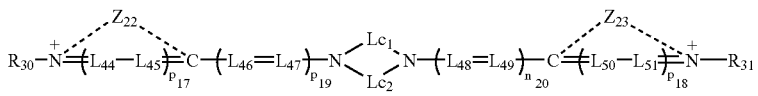

$M_{18}m_{18}$ wherein $L_{44}$ , $L_{45}$, $L_{46}$, $L_{48}$, $L_{49}$, $L_{50}$ and $L_{51}$ each represents a methine group, $p_{17}$ and $p_{18}$ each represents 0 or 1, $n_{19}$ and $n_{20}$ each represents 0, 1, 2, 3 or 4, $Z_{22}$ and $Z_{23}$ each represents an atomic group necessary for forming a nitrogen-containing heterocyclic ring, provided that a ring may be condensed to $Z_{22}$ and $Z_{23}$, $M_{18}$ represents an electric charge balancing counter ion, $m_{18}$ represents a number of 0 or more necessary for neutralizing the electric charge of the molecule, $R_{30}$ and $R_{31}$ each represents a hydrogen atom, an alkyl group, an aryl group or a heterocyclic group, and $Lc_1$ and $Lc_2$ each represents a linking group;

(XIX)

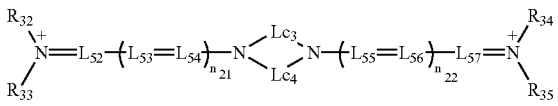

$M_{19}m_{19}$ wherein $L_{52}$, $L_{53}$, $L_{54}$, $L_{55}$, $L_{56}$ and $L_{57}$ each represents a methine group, $n_{21}$ and $n_{22}$ each represents 0, 1, 2, 3 or 4, $M_{19}$ represents an electric charge balancing counter ion, $m_{19}$ represents a number of 0 or more necessary for neutralizing the electric charge of the molecule, $R_{32}$, $R_{33}$, $R_{34}$ and $R_{35}$ each represents a hydrogen atom, an alkyl group, an aryl group or a heterocyclic group, and $Lc_3$ and $Lc_4$ each represents a linking group;

(XX)

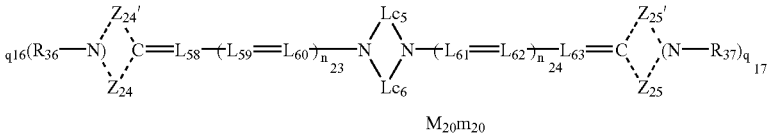

$M_{20}m_{20}$ wherein $L_{58}$, $L_{59}$, $L_{60}$, $L_{61}$, $L_{62}$ and $L_{63}$ each represents a methine group, $q_{16}$ and $q_{17}$ each represents 0 or 1, $n_{23}$ and $n_{24}$ each represents 0, 1, 2, 3 or 4, $Z_{24}$ and $Z_{24}'$ each represents an atomic group necessary for forming a heterocyclic ring or acyclic acidic terminal group together with $(N—R_{36})_{q16}$, $Z_{25}$ and $Z_{25}'$ each represents an atomic group necessary for forming a heterocyclic ring or acyclic acidic terminal group together with $(N—R_{37})_{q17}$, provided that a ring may be condensed to $Z_{24}$ and $Z_{24}'$ and to $Z_{25}$ and $Z_{25}'$, $M_{20}$ represents an electric charge balancing counter ion, $m_{20}$ represents a number of 0 or more necessary for neutralizing the electric charge of the molecule, $R_{36}$ and $R_{37}$ each represents a hydrogen atom, an alkyl group, an aryl group or a heterocyclic group, and $Lc_4$ and $Lc_5$ each represents a linking group;

The case represented by the following formula (2-1), (2-2), (2-3), (2-4) or (2-5) where a methine dye represented by formula (XV), (XVI) or (XVII) is connected to at least two portions:

(2-1)

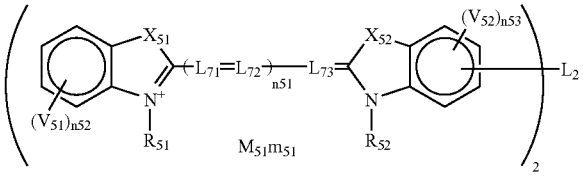

$M_{51}m_{51}$ (2-2)

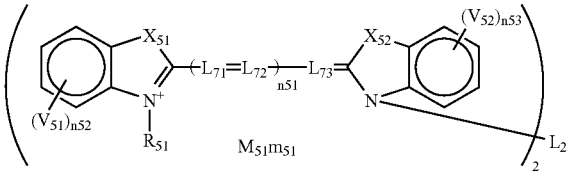

$M_{51}m_{51}$ wherein $L_2$ represents a linking group or a mere bond; $X_{51}$ and $X_{52}$ each independently represents —O—, —S—, —$NR_{53}$— or —$CR_{54}R_{55}$—; $R_{53}$ to $R_{55}$ each independently represents a hydrogen atom, an alkyl group, an alkenyl group, an aryl group or a heterocyclic group; $R_{51}$ and $R_{53}$ each independently represents a hydrogen atom, an alkyl group, an alkenyl group, an aryl group or a heterocyclic group; $L_{71}$ to $L_{73}$ each independently represents a methine group; each n51 independently represents an integer of 0 to 3; $V_{51}$ and $V_{52}$ each represents a substituent; $n_{52}$ and $n_{53}$ each independently represents an integer of 0 to 4; when $n_{52}$ and $n_{53}$ each is 2 or more, $V_{51}$s may be the same or different or may combine with each other to form a ring and $V_{52}$s may be the same or different or may combine with each other to form a ring; $M_{51}$ represents an electric charge balancing counter ion, and $m_{51}$ represents a number of 0 or more necessary for neutralizing the electric charge of the molecule;

(2-3)

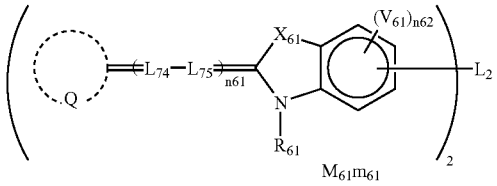

$M_{61}m_{61}$ (2-4)

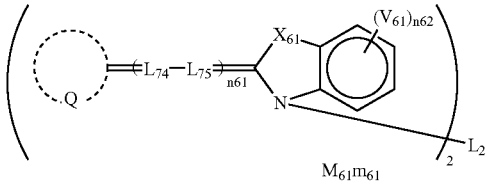

$M_{61}m_{61}$ (2-5)

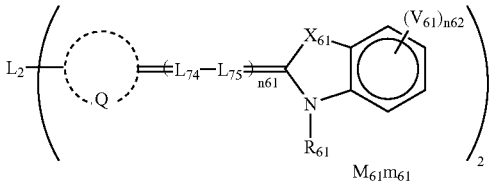

$M_{61}m_{61}$ wherein $L_2$ represents a linking group or a mere bond; $X_{61}$ represents —O—, —S—, —$NR_{53}$— or —$CR_{54}R_{55}$—; $R_{53}$ to $R_{55}$ each independently represents a hydrogen atom, an alkyl group, an alkenyl group, an aryl group or a heterocyclic group; each $R_{61}$ independently represents a hydrogen atom, an alkyl group, an alkenyl group, an aryl group or a heterocyclic group; $L_{74}$ and $L_{75}$ each independently represents a methine group; n61 independently represents an integer of 0 to 3; $V_{61}$ represents a substituent; $n_{62}$ represents an integer of 0 to 4; when $n_{62}$ is 2 or more, $V_{61}$s may be the same or different or may combine with each other to form a ring.

The ring formed by Q is represented by any one of the following formulae (3-1) to (3-5):

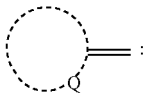

-continued (3-1)

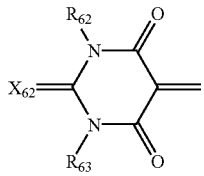

(3-2)

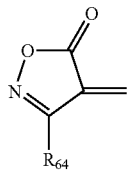

(3-3)

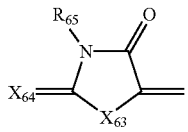

(3-4)

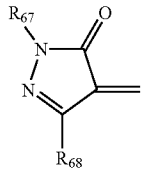

(3-5)

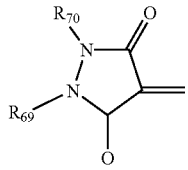

wherein $R_{62}$, $R_{63}$, $R_{65}$, $R_{67}$, $R_{69}$ and $R_{70}$ each independently represents a hydrogen atom, an alkyl group, an alkenyl group, an aryl group or a heterocyclic group, $R_{64}$ and $R_{68}$ each represents a substituent or a hydrogen atom, $X_{62}$ and $X_{64}$ each independently represents an oxygen atom or a sulfur atom, $X_{63}$ represents —O—, —S— or —$NR_{66}$—, and $R_{66}$ represents a hydrogen atom, an alkyl group, an alkenyl group, an aryl group or a heterocyclic group.

Among those formulae (XVIII), (XIX), (XX), (2-1), (2-2), (2-3), (2-4) and (2-5), preferred are formulae (XVIII), (XIX), (XX) and (2-3), more preferred are formulae (XVIII), (XIX) and (XX), still more preferred are formulae (XVIII) and (XIX), and particularly preferred is formula (XVIII).

The methine compounds represented by formulae (I) (XI), (XII), (XIII), (XIV), (XV), (XVI), (XVII), (XVIII), (XIX) and (XX) are described in detail below.

$Z_{11}$, $Z_{12}$, $Z_{13}$, $Z_{15}$, $Z_{17}$, $Z_{20}$, $Z_{22}$ and $Z_{23}$ each represents an atomic group necessary for forming a nitrogen-containing heterocyclic ring, preferably a 5- or 6-membered nitrogen-containing heterocyclic ring. However, a ring may be condensed to each of these groups. The ring may be either an aromatic ring or a non-aromatic ring, but an aromatic ring is preferred and examples thereof include hydrocarbon aromatic rings such as benzene ring and naphthalene ring, and heteroaromatic rings such as pyrazine ring and thiophene ring.

Specific examples of the nitrogen-containing heterocyclic ring include thiazoline nucleus, thiazole nucleus, benzothiazole nucleus, oxazoline nucleus, oxazole nucleus, benzoxazole nucleus, selenazoline nucleus, selenazole nucleus, benzoselenazole nucleus, tellurazoline nucleus, tellurazole nucleus, benzotellurazole nucleus, 3,3-dialkylindolenine nucleus (e.g., 3,3-dimethylindolenine), imidazoline nucleus, imidazole nucleus, benzimidazole nucleus, 2-pyridine nucleus, 4-pyridine nucleus, 2-quinoline nucleus, 4-quinoline nucleus, 1-isoquinoline nucleus, 3-isoquinoline nucleus, imidazo[4,5-b]quinoxaline nucleus, oxadiazole nucleus, thiadiazole nucleus, tetrazole nucleus and pyrimidine nucleus. Among these, preferred are benzothiazole nucleus, benzoxazole nucleus, 3,3-dialkylindolenine nucleus (e.g., 3,3-dimethylindolenine), benzimidazole nucleus, 2-pyridine nucleus, 4-pyridine nucleus, 2-quinoline nucleus, 4-quinoline nucleus, 1-isoquinoline nucleus and 3-isoquinoline nucleus.

These nuclei each may be substituted by a substituent represented by W or may be substituted or condensed by a ring. The substituent is preferably an alkyl group, an aryl group, an alkoxy group, a halogen atom, an aromatic ring condensation, a sulfo group, a carboxyl group or a hydroxyl group.

Specific examples of the heterocyclic ring formed by $Z_{11}$, $Z_{12}$, $Z_{13}$, $Z_{15}$, $Z_{17}$, $Z_{20}$, $Z_{22}$ and $Z_{23}$ include those described as examples of $Z_{11}$, $Z_{12}$, $Z_{13}$, $Z_{14}$ and $Z_{16}$ in U.S. Pat. No. 5,340,694, columns 23 to 24.

When the methine dye represented by formula (XI), (XII) or (XIII) is the dye chromophore represented by Dd of formula (I), $Z_{11}$, $Z_{12}$, $Z_{13}$, $Z_{15}$ and $Z_{17}$ each is preferably benzothiazole nucleus, benzoxazole nucleus, 3,3-dialkylindolenine nucleus (e.g., 3,3-dimethylindolenine) or benzimidazole nucleus, more preferably benzoxazole nucleus, benzothiazole nucleus or benzimidazole nucleus, and most preferably benzoxazole nucleus or benzothiazole nucleus. The substituent W on these nuclei is preferably a halogen atom, an aromatic group or an aromatic ring condensation.

When the methine dye represented by formula (XI) (XII), (XIII), (XV) or (XVIII) is the dye chromophore represented by Da, Db or Dc of formula (I), $Z_{11}$, $Z_{12}$, $Z_{13}$, $Z_{15}$ and $Z_{17}$ each is preferably benzothiazole nucleus, benzoxazole nucleus, 3,3-dialkylindolenine nucleus (e.g., 3,3-dimethylindolenine) or benzimidazole nucleus, more preferably benzoxazole nucleus, benzothiazole nucleus or benzimidazole nucleus, and most preferably benzoxazole nucleus or benzothiazole nucleus. $Z_{20}$, $Z_{22}$ and $Z_{23}$ each is preferably thiazoline nucleus, thiazole nucleus, oxazoline nucleus, oxazole nucleus, selenazoline nucleus, selenazole nucleus, tellurazoline nucleus, tellurazole nucleus, imidazoline nucleus, imidazole nucleus, 2-pyridine nucleus, 4-pyridine nucleus, oxadiazole nucleus, thiadiazole nucleus, tetrazole nucleus or pyrimidine nucleus, more preferably thiazoline nucleus, oxazoline nucleus, selenazoline nucleus, tellurazoline nucleus or imidazoline nucleus. The substituent W on these nuclei is preferably an acid radical.

The acid radial is described below. The acid radial is a group having a dissociative proton.

Specific examples thereof include a group from which a proton dissociates depending on the pKa thereof and the pH in the environment, such as sulfo group, carboxyl group, sulfato group, —$CONHSO_2$ group (e.g., sulfonylcarbamoyl group, carbonylsulfamoyl group), —CONHCO— group (e.g., carbonylcarbamoyl group), —$SO_2NHSO_2$— group (e.g., sulfonylsulfamoyl group), sulfonamido group, sulfamoyl group, phosphato group, phosphono group, boronic acid group and phenolic hydroxyl group. A proton-dissociative acid radical capable of dissociating in 90% or more, for example, at a pH from 5 to 11 is preferred.

The acid radical is more preferably a sulfo group, a carboxyl group, a —$CONHSO_2$— group, a —CONHCO— group or a —$SO_2NHSO_2$— group, more preferably a sulfo group or a carboxyl group, and most preferably a sulfo group.

Each of the trios $Z_{14}$, $Z_{14}'$ and $(N—R_{14})_{q11}$, $Z_{18}$, $Z_{18}'$ and $(N—R_{18})_{q13}$, $Z_{19}$, $Z_{19}'$ and $(N—R_{19})_{q14}$, $Z_{21}$, $Z_{21}'$ and $(N—R_{27})_{q15}$, $Z_{24}$, $Z_{24}'$ and $(N—R_{36})_{q16}$, and $Z_{25}$, $Z_{25}'$ and $(N—R_{37})_{q17}$ combine with each other to represent an atomic group necessary for forming a heterocyclic or acyclic acidic terminal group. Any heterocyclic ring (preferably 5- or 6-membered heterocyclic ring) may be formed but an acidic nucleus is preferred. The acidic nucleus and the acyclic acidic terminal group are described below. The acidic nucleus and the acyclic acidic terminal group each may have any acidic nucleus or acyclic acidic terminal group form of general merocyanine dyes. In preferred forms, $Z_{14}$, $Z_{18}$, $Z_{19}$, $Z_{21}$, $Z_{24}$ and $Z_{25}$ each is a thiocarbonyl group, a carbonyl group, an ester group, an acyl group, a carbamoyl group, a cyano group or a sulfonyl group, more preferably a thiocarbonyl group or a carbonyl group. $Z_{14}'$, $Z_{18}'$, $Z_{19}'$, $Z_{21}'$, $Z_{24}'$ and $Z_{25}'$ each represents a remaining atomic group necessary for forming the acidic nucleus or acyclic acidic terminal group. In the case of forming an acyclic acidic terminal group, $Z_{14}'$, $Z_{18}'$, $Z_{19}'$, $Z_{21}'$, $Z_{24}'$ and $Z_{25}'$ each is preferably a thiocarbonyl group, a carbonyl group, an ester group, an acyl group, a carbamoyl group, a cyano group or a sulfonyl group.

$q_{11}$, $q_{13}$, $q_{14}$, $q_{15}$, $q_{16}$ and $q_{17}$ each is 0 or 1, preferably 1.

The "acidic nucleus and acyclic acidic terminal group" as used herein are described, for example, in James (compiler), *The Theory of the Photographic Process,* 4th ed., pp. 197–200, Macmillan (1977). The acyclic acidic terminal group as used herein means an acidic, namely, electron-accepting terminal group which does not form a ring.

Specific examples of the acidic nucleus and acyclic acidic terminal group include those described in U.S. Pat. Nos. 3,567,719, 3,575,869, 3,804,634, 3,837,862, 4,002,480 and 4,925,777, JP-A-3-167546, and U.S. Pat. Nos. 5,994,051 and 5,747,236.

The acidic nucleus preferably forms a heterocyclic ring (preferably a 5- or 6-membered nitrogen-containing heterocyclic ring) comprising carbon, nitrogen and/or chalcogen (typically oxygen, sulfur, selenium and tellurium) atoms, more preferably a 5- or 6-membered nitrogen-containing heterocyclic ring comprising carbon, nitrogen and/or chalcogen (typically oxygen, sulfur, selenium and tellurium) atoms. Specific examples thereof include the following nuclei:

nuclei of 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazolidine-2,5-dione, 2-thiooxazoline-2,4-dione, isooxazolin-5-one, 2-thiazolin-4-one, thiazolidin-4-one, thiazolidine-2,4-dione, rhodanine, thiazolidine-2,4-dione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]-pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo[1,5-b]-quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide and 3-dicyanomethine-2,3-dihydrobenzo[d] thiophene-1,1-dioxide;

additionally include nuclei having an exomethylene structure in which the carbonyl or thiocarbonyl group constituting the above-described nuclei is substituted at the active methylene position of the acidic nucleus, and nuclei having an exomethylene structure in which an active methylene compound having a structure such as ketomethylene or cyanomethylene as a starting material of an acyclic acidic terminal group is substituted at the active methylene position.

These acidic nuclei and acyclic acidic terminal groups each may be substituted by a substituent represented by W described above or condensed with a ring.

Each of the trios $Z_{14}$, $Z_{14}'$ and $(N—R_{14})_{q11}$, $Z_{18}$, $Z_{18}'$ and $(N—R_{18})_{q13}$, $Z_{19}$, $Z_{19}'$ and $(N—R_{19})_{q14}$, $Z_{21}$, $Z_{21}'$ and $(N—R_{27})_{q15}$, $Z_{24}$, $Z_{24}'$ and $(N—R_{36})_{q16}$, and $Z_{25}$, $Z_{25}'$ and $(N-R_{37})_{q17}$ preferably form hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid or 2-thiobarbituric acid, more preferably hydantoin, 2- or 4-thiohydantoin, 2-oxazolin-5-one, rhodanine, barbituric acid or 2-thiobarbituric acid.

In the case where the methine dye represented by formula (XII) is the dye chromophore represented by Dd of formula (I), 2- or 4-thiohydantoin, 2-oxazolin-5-one or rhodanine is preferably formed.

In the case where the methine dye represented by formula (XII), (XIV), (XVII) or (XX) is the dye chromophore represented by Da, Db or Dc of formula (I), a barbituric acid is preferably formed.

Examples of the heterocyclic ring formed by $Z_{16}$, $Z_{16}'$ and $(N—R_{16})_{q12}$ are the same as those described above for the heterocyclic ring formed, for example, by $Z_{14}$, $Z_{14}'$ and $(N—R_{14})_{q11}$. The heterocyclic ring is preferably the heterocyclic ring formed, for example, by $Z_{14}$, $Z_{14}'$ and $(N—R_{14})_{q11}$, from which an oxo group or a thioxo group is eliminated The heterocyclic group is more preferably a heterocyclic group obtained by removing an oxo group or a thioxo group from the acidic nucleus described above as specific examples of the acidic nucleus formed, for example, by $Z_{14}$, $Z_{14}'$ and $(N—R_{14})_{q11}$.

The heterocyclic group is still more preferably a heterocyclic group obtained by removing an oxo group or a thioxo group from hydantoin, 2- or 4-thiohydantoin, 2-oxazolin-5-one, 2-thiooxazolin-2,4-dione, thiazolidine-2,4-dione, rhodanine, thiazolidine-2,4-dione, barbituric acid or 2-thiobarbituric acid, particularly preferably a heterocyclic group obtained by removing an oxo group or a thioxo group from hydantoin, 2- or 4-thiohydantoin, 2-oxazolin-5-one, rhodanine, barbituric acid or 2-thiobarbituric acid, and most preferably a heterocyclic group obtained by removing an oxo group or a thioxo group from 2- or 4-thiohydantoin, 2-oxazolin-5-one or rhodanine.

$q_{12}$ is 0 or 1, preferably 1.

$R_{11}$, $R_{12}$, $R_{13}$, $R_{14}$, $R_{15}$, $R_{16}$, $R_{17}$, $R_{18}$, $R_{19}$, $R_{20}$, $R_{21}$, $R_{22}$, $R_{23}$, $R_{24}$, $R_{25}$, $R_{26}$, $R_{27}$, $R_{28}$, $R_{29}$, $R_{30}$, $R_{31}$, $R_{32}$, $R_{33}$, $R_{34}$, $R_{35}$, $R_{36}$ and $R_{37}$ each represents a hydrogen atom, an alkyl group, an aryl group or a heterocyclic group, preferably an alkyl group, an aryl group or a heterocyclic group. Specific examples of the alkyl group, aryl group and heterocyclic group represented by $R_{11}$ to $R_{37}$ include an unsubstituted alkyl group having from 1 to 18, preferably from 1 to 7, more preferably from 1 to 4, carbon atoms (e.g., methyl, ethyl, propyl, isopropyl, butyl, isobutyl, hexyl, octyl, dodecyl, octadecyl), a substituted alkyl group having from 1 to 18, preferably from 1 to 7, more preferably from 1 to 4, carbon atoms (for example, an alkyl group substituted by the above-described substituent W, preferably an alkyl group having an acid radical described above; preferred examples thereof include an aralkyl group (e.g., benzyl, 2-phenylethyl), an unsaturated hydrocarbon group (e.g., allyl, vinyl, that is, the substituted alkyl group as used herein includes an alkenyl group and an alkynyl group), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), a sulfoalkenyl group, a sulfatoalkyl group, (e.g., 2-sulfatoethyl, 3-sulfatopropyl, 4-sulfatobutyl), a heterocyclic ring-substituted alkyl group (e.g., 2-(pyrrolidin-2-on-1-yl)ethyl, tetrahydro-furfuryl), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl) and an alkylsulfonylsulfamoylalkyl group (e.g., methanesulfonylsulfamoyl-methyl)}, an unsubstituted or substituted aryl group having from 6 to 20, preferably from 6 to 10, more preferably from 6 to 8, carbon atoms (in the case of a substituted aryl group, for example, an aryl group substituted by W described above, e.g., phenyl, 1-naphthyl, p-methoxyphenyl, p-methylphenyl, p-chlorophenyl), and an unsubstituted or substituted heterocyclic group having from 1 to 20, preferably from 3 to 10, more preferably from 4 to 8, carbon atoms (in the case of a substituted heterocyclic group, for example, a heterocyclic group substituted by W described above, e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl, 5-methyl-2-thienyl, 4-methoxy-2-pyrimidyl).

In the case where the methine dye represented by formula (XI), (XII) or (XIV) is the chromophore represented by Dd of formula (I), the substituents represented by $R_{11}$, $R_{12}$, $R_{13}$, $R_{14}$, $R_{15}$, $R_{16}$, $R_{17}$, $R_{18}$ and $R_{19}$ each is preferably an unsubstituted alkyl group or a substituted alkyl group. The substituted alkyl group is preferably an alkyl group having an acid radical described above. The acid radical is preferably a sulfo group, a carboxyl group, a —$CONHSO_2$— group, a —CONHCO— group or a —$SO_2NHSO_2$— group, more preferably a sulfo group or a carboxyl group, and most preferably a sulfo group.

In the case where the methine dye represented by formula (XI), (XII), (XIII), (XIV), (XV), (XVI), (XVII), (XVIII), (XIX) or (XX) is the chromophore represented by Da, Db or Dc of formula (I), the substituents represented by $R_{11}$ to $R_{37}$ each is preferably an unsubstituted alkyl group or a substituted alkyl group, more preferably an alkyl group having an acid radical described above. The acid radical is preferably a sulfo group, a carboxyl group, a —$CONHSO_2$— group, a —CONHCO— group or a —$SO_2NHSO_2$— group, more preferably a sulfo group or a carboxyl group, and most preferably a sulfo group.

$L_{11}$, $L_{12}$, $L_{13}$, $L_{14}$, $L_{15}$, $L_{16}$, $L_{17}$, $L_{18}$, $L_{19}$, $L_{20}$, $L_{21}$, $L_{22}$, $L_{23}$, $L_{24}$, $L_{25}$, $L_{26}$, $L_{27}$, $L_{28}$, $L_{29}$, $L_{30}$, $L_{31}$, $L_{32}$, $L_{33}$, $L_{34}$, $L_{35}$, $L_{36}$, $L_{37}$, $L_{38}$, $L_{39}$, $L_{40}$, $L_{41}$, $L_{42}$, $L_{43}$, $L_{44}$, $L_{45}$, $L_{46}$, $L_{47}$, $L_{48}$, $L_{49}$, $L_{50}$, $L_{51}$, $L_{52}$, $L_{53}$, $L_{54}$, $L_{55}$, $L_{56}$, $L_{57}$, $L_{58}$, $L_{59}$, $L_{60}$, $L_{61}$, $L_{62}$ and $L_{63}$ each independently represents a methine group. The methine group represented by $L_1$ to $L_{63}$ may have a substituent. Examples of the substituent include W described above, such as a substituted or unsubstituted alkyl group having from 1 to 15, preferably from 1 to 10, more preferably from 1 to 5, carbon atoms (e.g., methyl, ethyl, 2-carboxyethyl), a substituted or unsubstituted aryl group having from 6 to 20, preferably from 6 to 15, more preferably from 6 to 10, carbon atoms (e.g., phenyl, o-carboxyphenyl), a substituted or unsubstituted heterocyclic group having from 3 to 20, preferably from 4 to 15, more preferably from 6 to 10, carbon atoms (e.g., N,N-dimethylbarbituric acid), a halogen atom (e.g., chlorine, bromine, iodine, fluorine), an alkoxy group having from 1 to 15, preferably from 1 to 10, more preferably from 1 to 5, carbon atoms (e.g., methoxy, ethoxy), an amino group having from 0 to 15, preferably from 2 to 10, more preferably from 4 to 10, carbon atoms (e.g., methylamino, N,N-dimethylamino, N-methyl-N-phenylamino, N-methylpiperazino), an alkylthio group having from 1 to 15, preferably from 1 to 10, more preferably from 1 to 5, carbon atoms (e.g., methylthio, ethylthio) and an arylthio group having from 6 to 20, preferably from 6 to 12, more preferably from 6 to 10, carbon atoms (e.g., phenylthio, p-methylphenylthio). The methine group may form a ring together with another methine group or together with $Z_{11}$ to $Z_{25}$ or $R_{11}$ to $R_{37}$.

$L_{11}$, $L_{12}$, $L_{16}$, $L_{17}$, $L_{18}$, $L_{19}$, $L_{22}$, $L_{23}$, $L_{29}$, $L_{30}$, $L_{34}$, $L_{35}$, $L_{44}$, $L_{45}$, $L_{50}$ and $L_{51}$ each is preferably an unsubstituted methine group.

$n_{11}$, $n_{12}$, $n_{13}$, $n_{14}$, $n_{15}$, $n_{16}$, $n_{17}$, $n_{18}$, $n_{19}$, $n_{20}$, $n_{21}$, $n_{22}$, $n_{23}$ and $n_{24}$ each independently represents 0, 1, 2, 3 or 4. $n_{11}$, $n_{12}$, $n_{13}$, $n_{14}$ and $n_{15}$ each is preferably 0, 1, 2 or 3, more preferably 0, 1 or 2, still more preferably 0 or 1. $n_{16}$, $n_{17}$, $n_{18}$, $n_{19}$, $n_{20}$, $n_{21}$, $n_{22}$, $n_{23}$ and $n_{24}$ each is preferably 1, 2, 3 or 4, more preferably 2 or 3, still more preferably 2. When $n_{11}$ to $n_{24}$ each is 2 or more, the methine group is repeated but these methine groups need not be the same.

$p_{11}$, $p_{12}$, $p_{13}$, $p_{14}$, $p_{15}$, $p_{16}$, $p_{17}$ and $p_{18}$ each independently represents 0 or 1, preferably 0.

$M_1$, $M_{11}$, $M_{12}$, $M_{13}$, $M_{14}$, $M_{15}$, $M_{16}$, $M_{17}$, $M_{18}$, $M_{19}$ and $M_{20}$ each is included in the formulae for the purpose of showing the presence of a cation or an anion when required for neutralizing the ion charge of the dye. Typical examples of the cation include inorganic cation such as hydrogen ion ($H^+$), alkali metal ion (e.g., sodium ion, potassium ion, lithium ion) and alkaline earth metal ion (e.g., calcium ion), and organic cation such as ammonium ion (e.g., ammonium ion, tetraalkylammonium ion, triethylammonium ion, pyridinium ion, ethylpyridinium ion, 1,8-diazabicyclo[5.4.0]-7-undecenium ion). The anion may be either inorganic anion or organic anion and examples thereof include halogen anion (e.g., fluoride ion, chloride ion, iodide ion), substituted arylsulfonate ion (e.g., p-toluenesulfonate ion, p-chlorobenzenesulfonate ion), aryldisulfonate ion (e.g., 1,3-benzenesulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion and trifluoromethanesulfonate ion. Also, an ionic polymer or another dye having a charge opposite the dye may be used. When the counter ion is hydrogen ion, $CO_2^-$ and $SO_3^-$ may be denoted as $CO_2H$ and $SO_3H$, respectively.

$m_1$, $m_{11}$, $m_{12}$, $m_{13}$, $m_{14}$, $m_{15}$, $m_{16}$, $m_{17}$, $m_{18}$, mig and $m_{20}$ each represents a number of 0 or more necessary for balancing the electric charge, preferably a number of 0 to 4, more preferably from 0 to 1, and is 0 when an inner salt is formed.

$Lc_1$, $Lc_2$, $Lc_3$, $Lc_4$, $Lc_5$ and $Lc_6$ each represents a linking group and examples thereof include those described above for $La_1$, $La_2$ and Lb. The linking group is preferably a linking group except for a single bond.

The linking group is more preferably an alkylene group having from 1 to 10 carbon atoms (e.g., methylene, ethylene, trimethylene, tetramethylene, pentamethylene), which may be substituted, still more preferably an alkylene group having 2 or 3 carbon atoms (e.g., ethylene, trimethylene), which may be substituted, still more preferably an alkylene group having 2 carbon atoms (e.g., ethylene), which may be substituted. The substituent may be any substituent and examples thereof include W described above. The substituent is preferably a methyl group.

As for the moiety formed by each of the pairs $Lc_1$ and $Lc_2$, $Lc_3$ and $Lc_4$, and $Lc_5$ and $Lc_6$ together with nitrogen, most preferred examples are set forth below. Among (A), (B) and (C), (A) and (B) are preferred and (A) is more preferred.

(A)

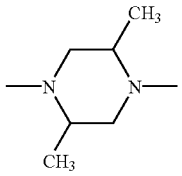

(B)

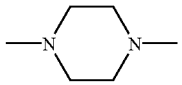

(C)

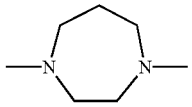

The methine compounds represented by formulae (2-1) to (2-5) are described in detail below.

In formulae (2-1) and (2-2), $L_2$ represents a mere bond or a linking group. In the case of a linking group, the linking group may be any linking group but is preferably a linking group having from 0 to 100, preferably from 1 to 20, carbon atoms, constructed by one or a combination of two or more of an alkylene group (preferably having from 1 to 20 carbon atoms (hereinafter referred to as "a C number"), e.g., methylene, ethylene, propylene, butylene, pentylene, hexylene, octylene), an arylene group (preferably having a C number of 6 to 26, e.g., phenylene, naphthylene), an alkenylene group (preferably having a C number of 2 to 20, e.g., ethenylene, propenylene, buadienylene), an alkynylene group (preferably having a C number of 2 to 20, e.g., ethynylene, propynylene, butadinylene), an amido group, an ester group, a sulfoamido group, a sulfonic acid ester group, a ureido group, a sulfonyl group, a sulf inyl group, a thioether group, an ether group, a carbonyl group, —$NR_{56}$— (wherein $R_{56}$ is a hydrogen atom or a monovalent substituent and preferred examples of the substituent include W) and a heterylene group (preferably having a C number of 1 to 26, e.g., 6-chloro-1,3,5-triazyl-2,4-diyl, pyrimidine-2,4-diyl, quinoxaline-2,3-diyl).

$L_2$ more preferably represents a mere bond or a linking group constructed by one or a combination of two or more of an alkylene group, an alkenylene group, an alkynylene group, an arylene group, an amido group, an ester group and an ether group.

$X_{51}$ and $X_{52}$ each independently represents —O—, —S—, —$NRS_{53}$— or —$CR_{54}R_{55}$—, $R_{53}$ to $R_{55}$ each independently represents a hydrogen atom, an alkyl group, an alkenyl group, an aryl group or a heterocyclic group (preferred examples of these groups are the same as those described for $R_{11}$ to $R_{19}$), $R_{53}$ preferably represents a hydrogen atom, an alkyl group or a sulfoalkyl group, more preferably an alkyl group or a sulfoalkyl group, and $R_{54}$ and $R_{55}$ each preferably represents an alkyl group.

$X_{51}$ and $X_{52}$ each is preferably —O— or —S—, more preferably —S—.

$R_{51}$ and $R_{52}$ each independently represents a hydrogen atom, an alkyl group, an alkenyl group, an aryl group or a heterocyclic group (preferred examples of these groups are the same as those described for $R_{11}$ to $R_{19}$), preferably a hydrogen atom, an alkyl group or an acid-substituted alkyl group (the acid radical is, for example, a carboxy group, a sulfo group, a phosphate group, a sulfonamide group, a sulfamoyl group or an acylsulfonamide group). The acid-substituted alkyl group is preferably a sulfoalkyl group.

$R_{51}$ and $R_{52}$ each is more preferably an alkyl group or a sulfoalkyl group.

$L_{71}$ to $L_{73}$ each independently represents a methine group (preferred examples are the same as those described for $L_{11}$ to $L_{33}$), preferably an unsubstituted methine group, an ethyl group-substituted methine group or a methyl group-substituted methine group.

Each n51 independently represents an integer of 0 to 3, preferably an integer of 0 to 2, more preferably 0 or 1. When n51 is 2 or more, the methine groups represented by $L_{71}$ or $L_{72}$ may be the same or different.

When n51 is 0, $X_{51}$ and $X_{52}$ both are preferably —S— and when n51 is 1, $X_{51}$ and $X_{52}$ both are preferably —O—.

$V_{51}$ and $V_{52}$ each represents a substituent and although the substituent may be any one of the above-described substituents W, preferred examples thereof include an alkyl group having a C number of 1 to 20 (preferred examples are the same as those for $R_{11}$ to $R_{19}$), a halogen atom (e.g., chlorine, bromine, iodine, fluorine), a nitro group, an alkoxy group having a C number of 1 to 20 (e.g., methoxy, ethoxy), an aryl group having a C number of 6 to 20 (e.g., phenyl, 2-naphthyl), a heterocyclic group having a C number of 0 to 20 (e.g., 2-pyridyl, 3-pyridyl, 1-pyrrolyl, 2-thienyl), an aryloxy group having a C number of 6 to 20 (e.g., phenoxy, 1-naphthoxy, 2-naphthoxy), an acylamino group having a C number of 1 to 20 (e.g., acetylamino, benzoylamino), a carbamoyl group having a C number of 1 to 20 (e.g., N,N-dimethylcarbamoyl), a sulfo group, a sulfonamido group having a C number of 0 to 20 (e.g., methanesulfonamido), a sulfamoyl group having a C number of 0 to 20 (e.g., N-methylsulfamoyl), a hydroxyl group, a carboxyl group, an alkylthio group having a C number of 1 to 20 (e.g., methylthio) and a cyano group. $V_{51}$ and $V_{52}$ each is preferably an alkyl group, a halogen atom (particularly, chlorine or bromine), an aryl group, an acylamino group, a carbamoyl group or an alkoxy group. $V_{11}$ and $V_{12}$ each is preferably an alkyl group, a halogen atom (particularly, chlorine or bromine), an aryl group, an acylamino group, a carbamoyl group, an alkoxy group, a hydroxyl group, a sulfo group or a carboxyl group, more preferably a hydroxyl group, a sulfo group or a carboxyl group, still more preferably a sulfo group. The substituted site is preferably 5- or 6-position.

n52 and n53 each independently represents an integer of 0 to 4, preferably from 0 to 2. When n52 and n53 each is 2 or more, the substituents represented by $V_{51}$ or $V_{52}$ may be the same or different or may be combined with each other to form a ring. The ring formed is preferably a benzene ring, a pyridine ring, a benzofuran ring, a thiophene ring, a pyrrole ring or an indole ring, more preferably a benzene ring.

$M_{51}$ represents an electric charge balancing counter ion and preferred examples thereof are the same as those described above for $M_{11}$ to $M_{14}$. $m_{51}$ represents a number of 0 or more necessary for neutralizing the electric charge of the molecule preferred examples thereof are the same as those described above for $m_{11}$ to $m_{14}$.

In formula (2-1), $L_2$ is preferably a mere bond, an alkylene group, an alkenylene group or an alkynylene group, more preferably a mere bond, an alkenylene group or an alkynylene group, and most preferably a mere bond.

In formula (2-2), $L_2$ is preferably a linking group constituted by one or a combination of two or more of an alkylene group, an arylene group, an amide group, an ether group and an ester group.

In formulae (2-1) and (2-2), the linking group (or mere bond) Lb is preferably connected to Dd through $R_{51}$, $R_{52}$, $V_{51}$ or $V_{52}$. At this time, the groups resulting from removing one hydrogen atom at respective terminals are connected with each other, however, this does not necessarily mean that the compound is produced by such a synthesis method.

Preferred examples of $V_{51}$ and $V_{52}$, when connected with Lb, include a carboxy group, an alkoxy group, an acylamino group, a carbamoyl group, a sulfonamido group, a sulfamoyl group, a hydroxy group and an alkylthio group. Among these, more preferred are an acylamino group and a carbamoyl group.

Lb is preferably connected with $R_{51}$ or $R_{52}$, more preferably with $R_{51}$.

In formulae (2-3) to (2-5), $L_2$ has the same meaning as in formulae (2-1) and (2-2).

$X_{61}$ preferably represents —O—, —S—, —$NR_{53}$— or —$CR_{54}R_{55}$— (wherein $R_{53}$ to $R_{55}$ each independently represents a hydrogen atom, an alkyl group, an alkenyl group, an aryl group or a heterocyclic group), more preferably —O—.

Each $R_{61}$ independently represents a hydrogen atom, an alkyl group, an alkenyl group, an aryl group or a heterocyclic group (preferred examples of these groups are the same as those described for $R_{11}$ to $R_{19}$), preferably a hydrogen atom, an alkyl group or an acid-substituted alkyl group (the acid radical is, for example, a carboxy group, a sulfo group, a phosphate group, a sulfonamide group, a sulfamoyl group or an acylsulfonamide group). The acid-substituted alkyl group is preferably a sulfoalkyl group.

$R_{61}$ is more preferably an alkyl group or a sulfoalkyl group.

$L_{74}$ and $L_{75}$ each independently represents a methine group (preferred examples are the same as those described for $L_{11}$ to $L_{33}$), preferably an unsubstituted methine group, an ethyl group-substituted methine group or a methyl group-substituted methine group.

n61 represents an integer of 0 to 3, preferably an integer of 0 to 2, more preferably 0 or 1, still more preferably 1.

$V_{61}$ represents a substituent and although the substituent may be any one of the above-described substituents W, preferred examples thereof include an alkyl group having a C number of 1 to 20 (preferred examples are the same as those for $R_{11}$ to $R_{19}$), a halogen atom (e.g., chlorine, bromine, iodine, fluorine), a nitro group, an alkoxy group having a C number of 1 to 20 (e.g., methoxy, ethoxy), an aryl group having a C number of 6 to 20 (e.g., phenyl, 2-naphthyl), a heterocyclic group having a C number of 0 to 20 (e.g., 2-pyridyl, 3-pyridyl, 1-pyrrolyl, 2-thienyl), an aryloxy group having a C number of 6 to 20 (e.g., phenoxy, 1-naphthoxy, 2-naphthoxy), an acylamino group having a C number of 1 to 20 (e.g., acetylamino, benzoylamino), a carbamoyl group having a C number of 1 to 20 (e.g., N,N-dimethylcarbamoyl), a sulfo group, a sulfonamido group having a C number of 0 to 20 (e.g., methanesulfonamido), a sulfamoyl group having a C number of 0 to 20 (e.g., N-methylsulfamoyl), a hydroxyl group, a carboxyl group, an alkylthio group having a C number of 1 to 20 (e.g., methylthio) and a cyano group. $V_{61}$ is preferably an alkyl group, a halogen atom, an aryl group, an acylamino group, a carbamoyl group, an alkoxy group, a hydroxyl group, a sulfo group or a carboxyl group, more preferably a hydroxyl group, a carboxyl group or a sulfo group, and most preferably a sulfo group.

The substituted site of $V_{61}$ is preferably 5- or 6-position.

n62 represents an integer of 0 to 4. When n62 is 2 or more, the substituents represented by $V_{61}$ may be the same or different or may be combined with each other to form a ring. The ring formed is preferably a benzene ring, a pyridine ring, a benzofuran ring, a thiophene ring, a pyrrole ring or an indole ring, more preferably a benzene ring.

$M_{61}$ represents an electric charge balancing counter ion and preferred examples thereof are the same as those described above for $M_{11}$ to $M_{14}$. $m_{61}$ represents a number of 0 or more necessary for neutralizing the electric charge of the molecule and preferred examples thereof are the same as those described above for $m_{11}$ to $m_{14}$.

In formulae (2-3) to (2-5), the ring formed by Q is represented by any one of formulae (3-1) to (3-5). In the formulae, $R_{62}$, $R_{63}$, $R_{65}$, $R_{67}$, $R_{69}$ and $R_{70}$ each independently represents a hydrogen atom, an alkyl group, an alkenyl group, an aryl group or a heterocyclic group (preferred examples of these groups are the same as those described for $R_{11}$ to $R_{19}$), preferably a hydrogen atom, an alkyl group, an aryl group, an acid-substituted alkyl group or an acid substituted aryl group (the acid radical is, for example, a carboxy group, a sulfo group, a phosphate group, a sulfonamide group, a sulfamoyl group or an acylsulfonamide group). The acid-substituted alkyl group is preferably a sulfoalkyl group and the acid-substituted aryl group is preferably a sulfo-substituted aryl group.

$R_{64}$ and $R_{69}$ each independently represents a substituent or a hydrogen atom and although the substituent may be any one of the above-described substituents W, preferred examples thereof include an alkyl group having a C number of 1 to 20 (preferred examples are the same as those for $R_{11}$ to $R_{19}$), a halogen atom (e.g., chlorine, bromine, iodine, fluorine), a nitro group, an alkoxy group having a C number of 1 to 20 (e.g., methoxy, ethoxy), an aryl group having a C number of 6 to 20 (e.g., phenyl, 2-naphthyl), a heterocyclic group having a C number of 0 to 20 (e.g., 2-pyridyl, 3-pyridyl, 1-pyrrolyl, 2-thienyl), an aryloxy group having a C number of 6 to 20 (e.g., phenoxy, 1-naphthoxy, 2-naphthoxy), an acylamino group having a C number of 1 to 20 (e.g., acetylamino, benzoylamino), a carbamoyl group having a C number of 1 to 20 (e.g., N,N-dimethylcarbamoyl), a sulfo group, a sulfonamido group having a C number of 0 to 20 (e.g., methanesulfonamido), a sulfamoyl group having a C number of 0 to 20 (e.g., N-methylsulfamoyl), an alkoxycarbonyl group having a C number of 2 to 20 (e.g., ethoxycarbonyl), an amino group having a C number of 0 to 20 (e.g., dimethylamino, anilino), a hydroxyl group, a carboxyl group, an alkylthio group having a C number of 1 to 20 (e.g., methylthio) and a cyano group.

$R_{64}$ and $R_{68}$ each is preferably a hydrogen atom, an alkyl group, an alkoxy group, an aryl group, an acylamino group, a carbamoyl group, a sulfo group, an alkoxycarbonyl group, a hydroxyl group, a carboxyl group or a cyano group.

$X_{62}$ and $X_{64}$ each independently represents an oxygen atom or a sulfur atom. $X_{62}$ preferably represents an oxygen atom.

$X_{63}$ represents —O—, —S— or —$NR_{66}$—, and $R_{66}$ represents a hydrogen atom, an alkyl group, an alkenyl group, an aryl group or a heterocyclic group (preferred examples of these groups are the same as those described for $R_{63}$), preferably a hydrogen atom, an alkyl group or an aryl group, more preferably an alkyl group or an aryl group.

$X_{63}$ is preferably —$NR_{66}$— or —S—. When $X_{63}$ is —$NR_{66}$—, $X_{62}$ is preferably an oxygen atom, and when $X_{63}$ is —S—, $X_{62}$ is preferably a sulfur atom. $X_{63}$ is more preferably —S—.

In formula (2-3), $L_2$ is preferably a mere bond, an alkylene group, an alkenylene group or an alkynylene group, more preferably a mere bond, an alkenylene group or an alkynylene group, and most preferably a mere bond.

In formulae (2-4) and (2-5), $L_2$ is preferably a linking group constituted by one or a combination of two or more of an alkylene group, an arylene group, an amide group, an ether group and an ester group. In formula (2-5), $L_2$ is connected to any one of $R_{62}$ to $R_{70}$. In formulae (2-3) to (2-5), the linking group (or mere bond) Lb is preferably connected to Dd through $R_{61}$, $V_{61}$, $R_{62}$ or $R_{63}$ to $R_{69}$. At this time, the groups resulting from removing one hydrogen atom at respective terminals are connected with each other, however, this does not necessarily mean that the compound is produced by such a synthesis method.

Preferred examples of $V_{61}$, when connected with Lb, include a carboxy group, an alkoxy group, an acylamino group, a carbamoyl group, a sulfonamido group, a sulfamoyl group, a hydroxy group and an alkylthio group. Among these, more preferred are an acylamino group and a carbamoyl group.

Lb is preferably connected with $R_{61}$ or $R_{63}$ to $R_{69}$, more preferably with $R_{63}$ to $R_{69}$.

The ring formed by Q is preferably represented by formula (3-1), (3-2) or (3-3), more preferably (3-1) or (3-2, and most preferably formula (3-1).

Among formulae (2-1) to (2-5), preferred is formula (2-3), more preferred is formula (2-3) where $L_2$ is a mere bond.

Specific examples of the dye for use in the particularly preferred technique, described in detail above, are set forth below, however, the present invention is not limited thereto.

Examples when in formula (1), $r_2$ is 1 and Xa is Dd (incidentally, D1 and La described in Japanese Patent Application No. 2000-368802 may also be preferably used as Xd and Lb, respectively):

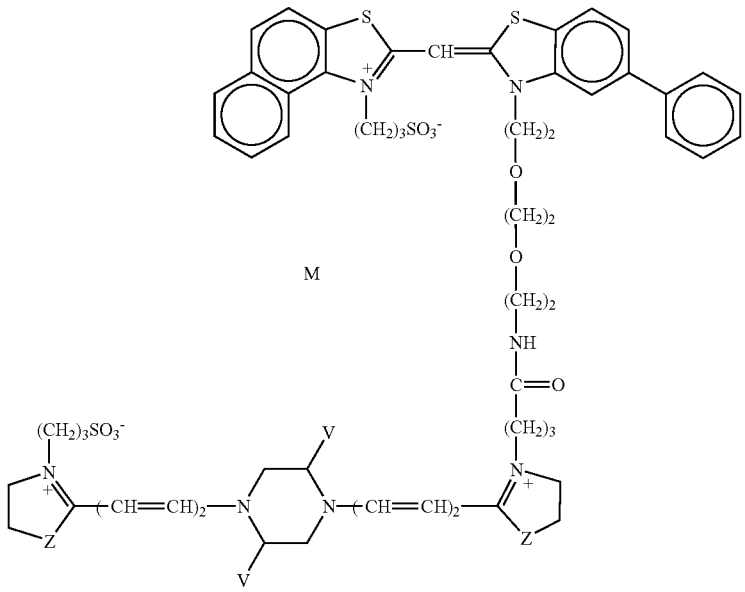

Z=S, V=$CH_3$, M=$Cl^-$ A-1

Z=S, V=H, M=$Cl^-$ A-2

Z=$CH_2$, V=$CH_3$, M=$Cl^-$ A-3

-continued
A-4
Z═O, V═$CH_3$, M═$Cl^-$
A-5
Z═N—$(CH_2)_2SO_3^-$, V═$CH_3$, M═$Na^+$
A-5a
Z═S, V═H, M═$I^-$
A-6
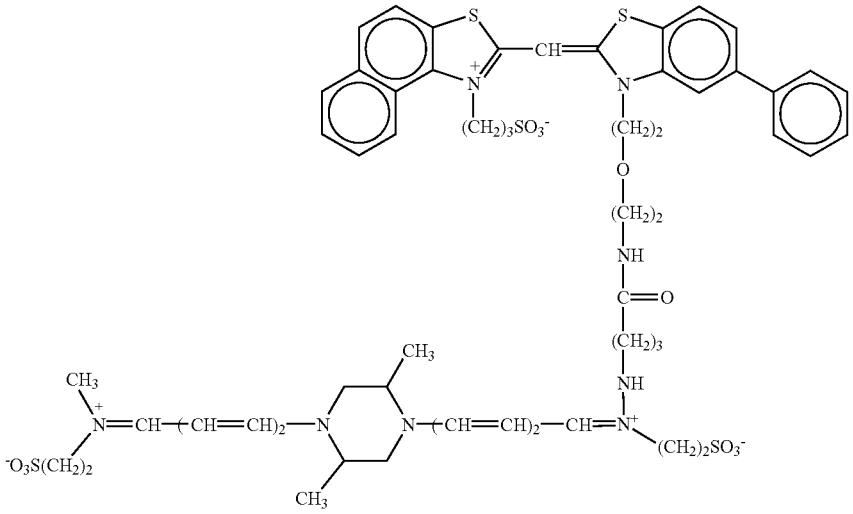
A-7
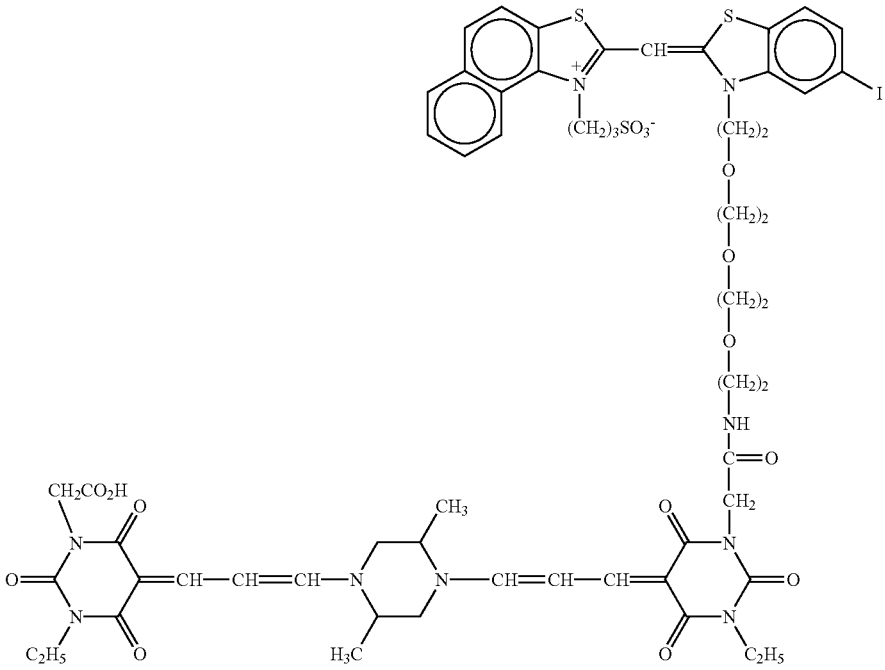

-continued
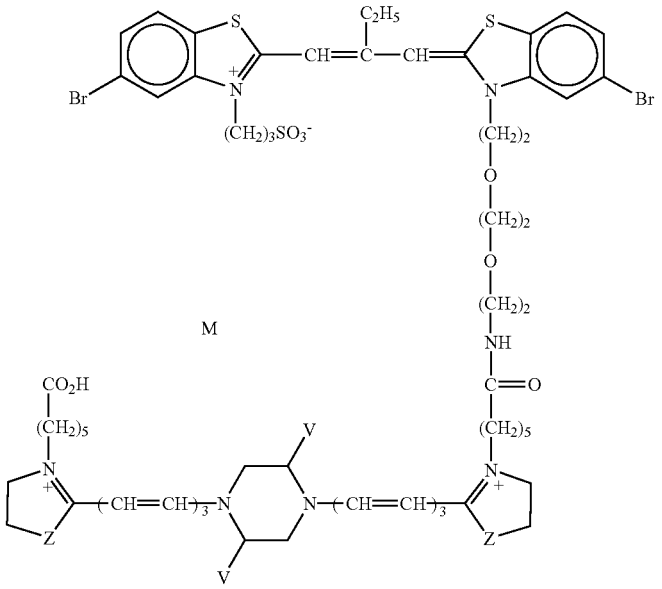
A-8
Z═S, V═H, M═2Cl⁻
A-9
Z═N—$(CH_2)_2SO_3^-$, V═$CH_3$, M═-
A-10
Z═$CH_2$, V═$CH_3$, M═2Cl⁻
A-11
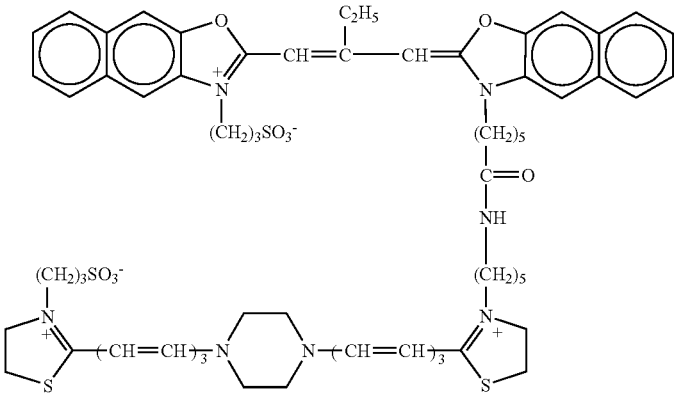

-continued
A-12
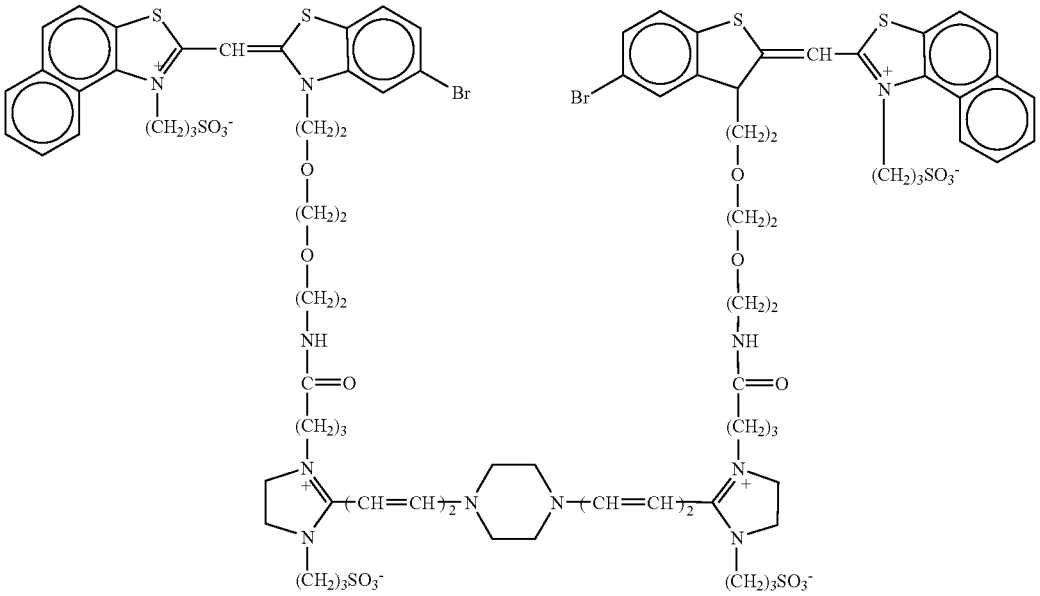
A-13
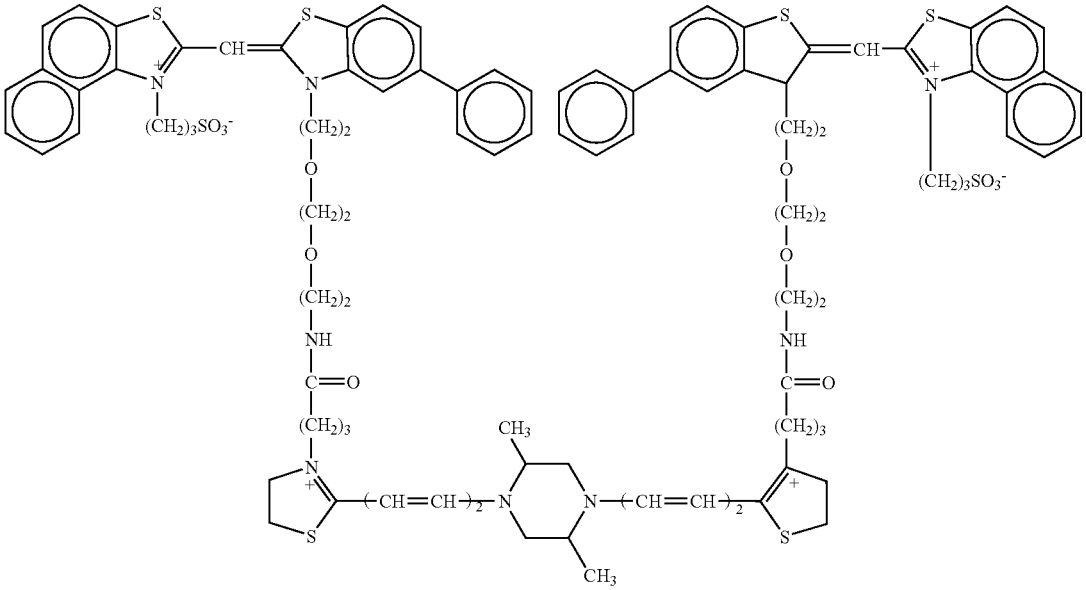

Examples when in formula (I) $r_2$ is 1 and Xa is Ad:

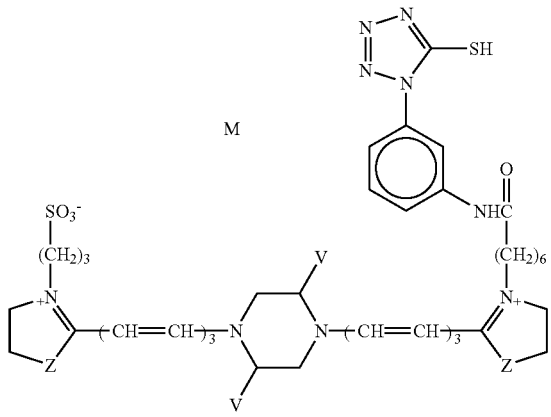

B-1 V = H, Z = S, M = $Cl^-$

B-2 V = $CH_3$, Z = S, M = $Br^-$

-continued

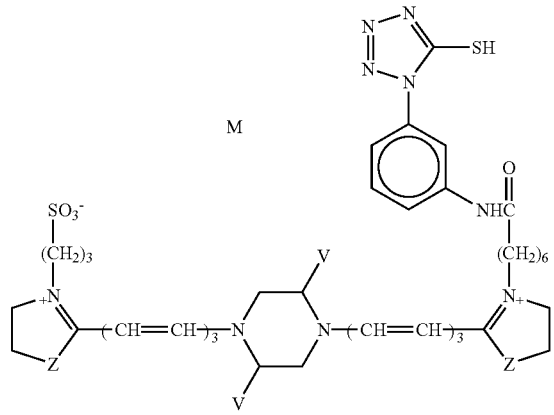

B-3 V = $CH_3$, Z = $CH_2$,

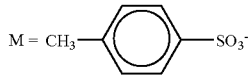

B-4 V = $CH_3$, Z = $N\text{-}(CH_2)_2SO_3^-$, M = $Na^+$

Examples when in formula (I), $r_2$ is 0 (the compounds show below are used in the interconnected state with a dye compound other than the multichromophore dye compound, preferably a dye adsorbed to a silver halide grain, by an attracting force except for covalent bonding or coordinate bonding; in the case where $r_2$ is 1 or more, the compounds shown below can be used as a partial structure of $[Da(—La_1—)_{p1}\{Db(—La_2—)_{p2}\}_{q1}Dc]$):

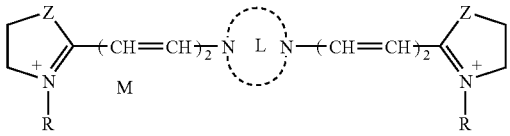

C-1

L= 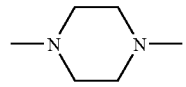 , Z=S, R=$CH_3$, M=$2I^-$

C-2

L= 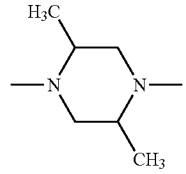 , Z=S, R=$CH_3$, M=$2I^-$

C-3

L= 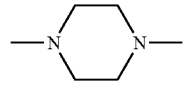 , Z=S, R=$(CH_2)_3SO_3^-$, M=-

C-4

L= 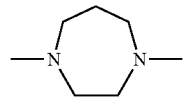 , Z=S, R=$CH_3$, M=$2I^-$

C-5

L= 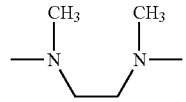 , Z=S, R=$CH_3$, M=$2I^-$

-continued

C-6

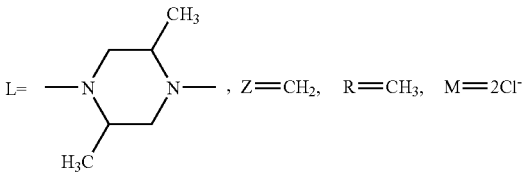

C-7

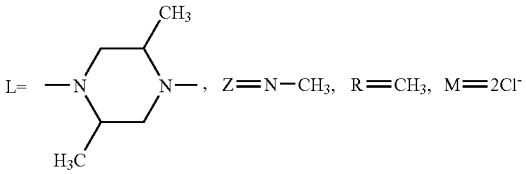

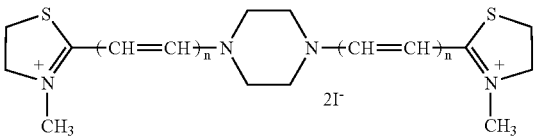

C-8 n = 3

C-9 n = 4

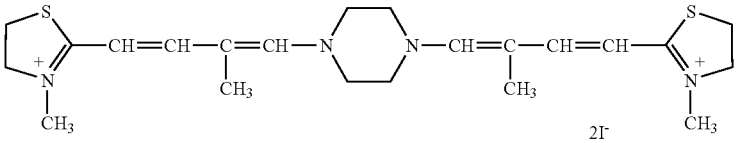

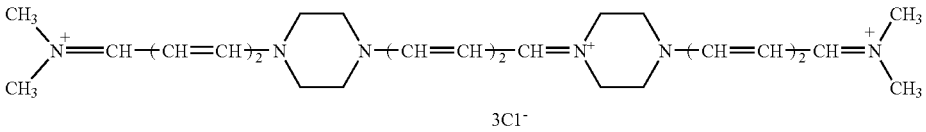

Examples when the multichromophore dye compound represented by formula (1) is connected with a dye compound other than the multichromophore dye compound by an attracting force except for covalent bonding or coordinate bonding:

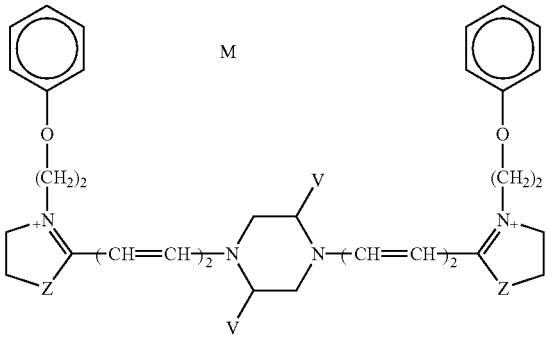

| | | | |
|---|---|---|---|
| AA-1 | Z = S, | V = $CH_3$, | M = $2Br^-$ |
| AA-2 | Z = S, | V = H, | M = $2Br^-$ |
| AA-3 | Z = $CH_2$, | V = $CH_3$, | M = $2Br^-$ |
| AA-4 | Z = O, | V = $CH_3$, | M = $2PTS^-$ |
| AA-5 | Z = $N^-(CH_2)_2SO_3^-$, | V = $CH_3$, | M = none |

-continued
AA-6
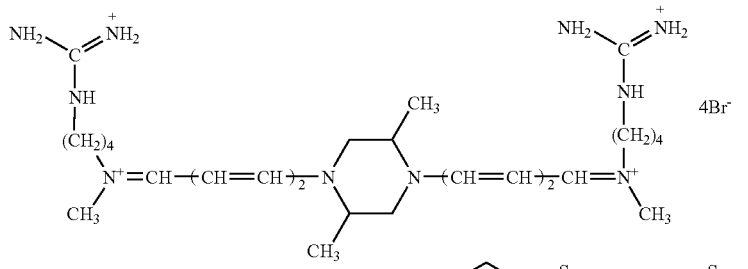
AA-7
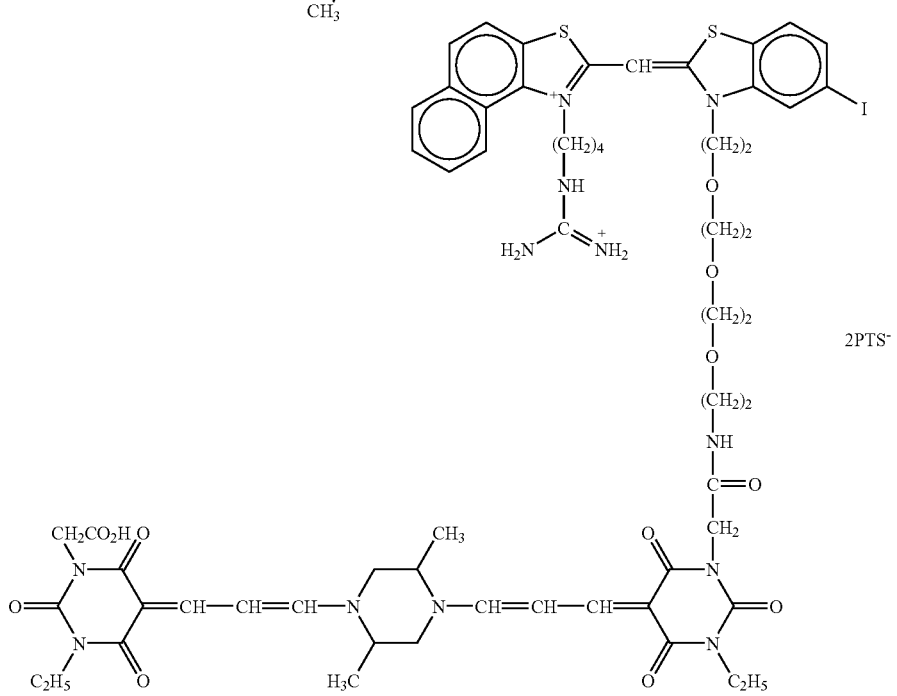
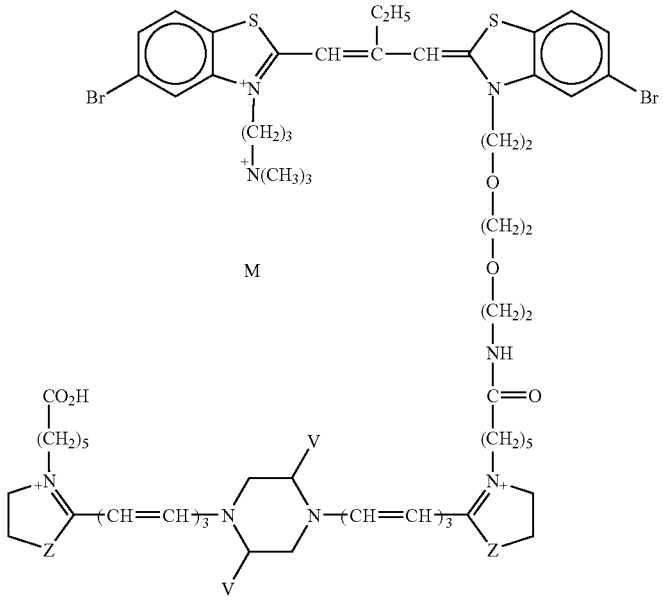
| | | | |
|---|---|---|---|
| AA-8 | Z = S, | V = H, | M = $3Br^-$ |
| AA-9 | Z = N—$(CH_2)_2SO_3^-$, | V = $CH_3$, | M = $Br^-$ |
| AA-10 | Z = $CH_2$, | V = $CH_3$, | M = $3PTS^-$ |

-continued
AA-11
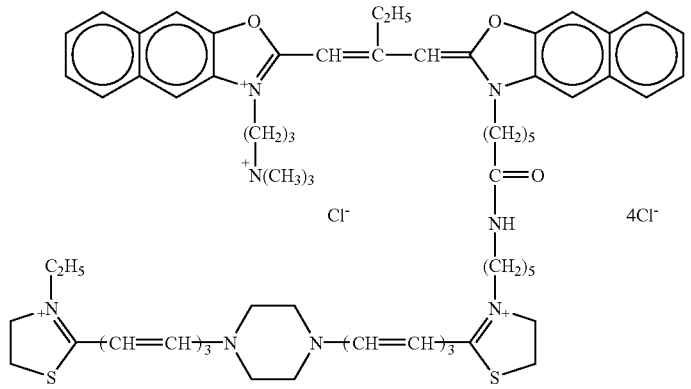
AA-12
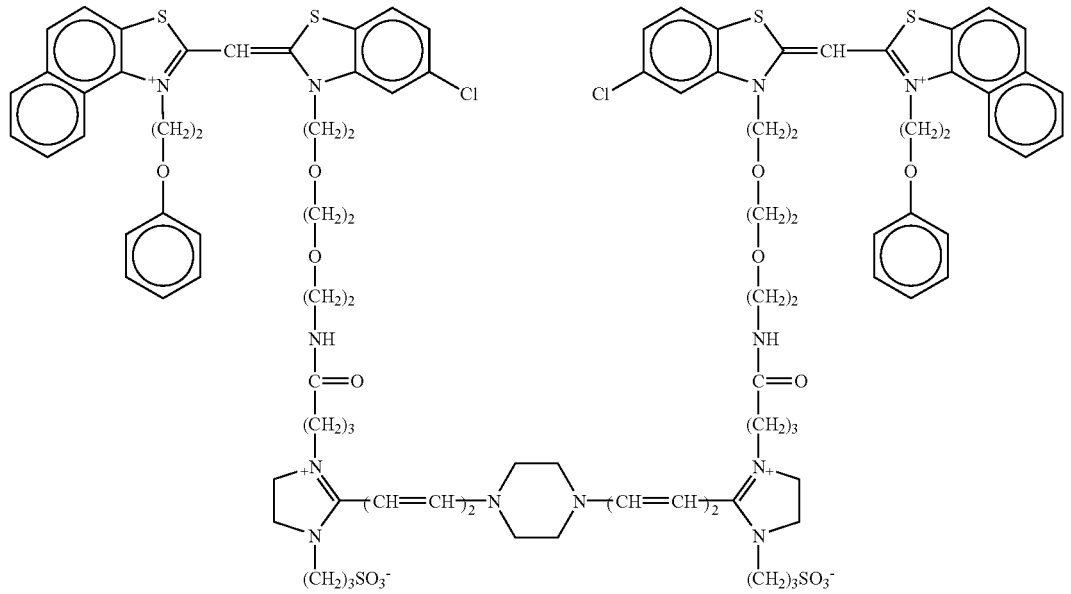
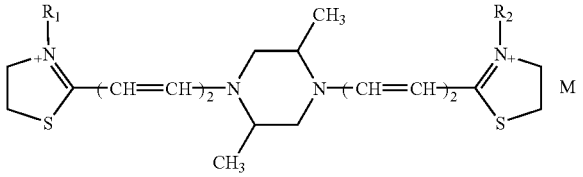
| | $R_1$ | $R_2$ | M |
|---|---|---|---|
| AA-13 | $-(CH_2)_3-SO_3^-$ | $-(CH_2)_3-SO_3^-$ | — |
| AA-14 | $-CH_2CH_2CH(SO_3^-)-Ph$ | $-CH_2CH_2CH(SO_3^-)-Ph$ | — |
| AA-15 | $-(CH_2)_3-\overset{+}{N}(CH_3)_3$ | $-(CH_2)_3-\overset{+}{N}(CH_3)_3$ | $4Br^-$ |
| AA-16 | $-(CH_2)_4-NH-C(=\overset{+}{N}H_2)-NH_2$ | $-(CH_2)_4-NH-C(=\overset{+}{N}H_2)-NH_2$ | $4Br^-$ |
| AA-17 | $-C_2H_5$ | $-C_2H_5$ | $2Br^-$ |
| AA-18 | $-(CH_2)_3-O-Ph$ | $-(CH_2)_3-O-Ph$ | $2Br^-$ |

-continued

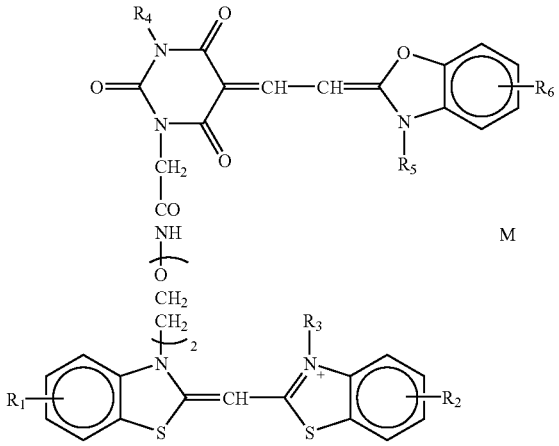

M

| | $R_1$ | $R_2$ | $R_3$ | $R_4$ | $R_5$ | $R_6$ | M |
|---|---|---|---|---|---|---|---|
| AA-19 | 5-Ph | 4,5-Benzo | $—(CH_2)_3-SO_3^-$ | n-Bu | Et | $—SO_3^-$ | $Na^+$ |
| AA-20 | 5-Ph | 4,5-Benzo | $—(CH_2)_3—\overset{+}{N}(CH_3)_3$ | n-Bu | Et | $—SO_3^-$ | $Br^-$ |
| AA-21 | 5-Ph | 4,5-Benzo | $—(CH_2)_3—\overset{+}{N}(CH_3)_3$ | $—(CH_2)_3-SO_3^-$ | Et | $—SO_3^-$ | — |
| AA-22 | 5-Ph | 4,5-Benzo | $—(CH_2)_3—\overset{+}{N}(CH_3)_3$ | $—(CH_2)_3-SO_3^-$ | $—(CH_2)_3-SO_3^-$ | H | — |
| AA-23 | 5-Ph | 4,5-Benzo | $—(CH_2)_3-OPh$ | n-Bu | Et | $—SO_3^-$ | — |
| AA-24 | 5-Ph | 4,5-Benzo | $—(CH_2)_4—NHC(=\overset{+}{N}H_2)NH_2$ | n-Bu | Et | $—SO_3^-$ | Br |
| AA-25 | 5-Ph | 4,5-Benzo | $—(CH_2)_4—NHC(=\overset{+}{N}H_2)NH_2$ | $—(CH_2)_3-SO_3^-$ | $—(CH_2)_3-SO_3^-$ | H | — |
| AA-26 | 5-Ph | 5-Ph | $—(CH_2)_4—NHC(=\overset{+}{N}H_2)NH_2$ | $—(CH_2)_3-SO_3^-$ | $—(CH_2)_3-SO_3^-$ | H | — |
| AA-27 | 4,5'-Benzo | 5-Cl | $—(CH_2)_4—NHC(=\overset{+}{N}H_2)NH_2$ | $—(CH_2)_3-SO_3^-$ | $—(CH_2)_3-SO_3^-$ | H | — |

-continued

AA-28

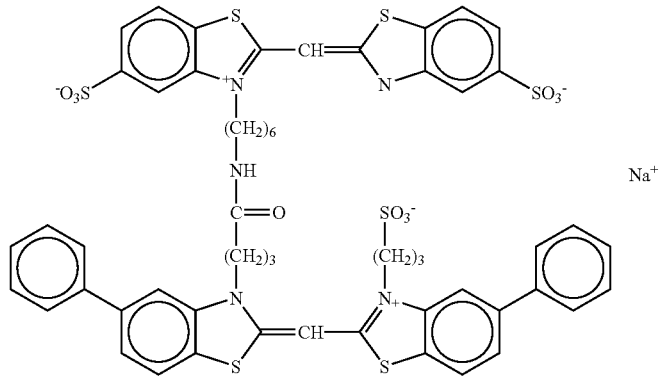

AA-29

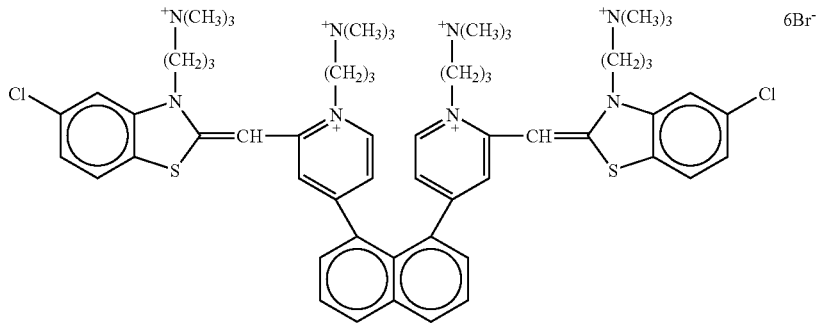

AA-30

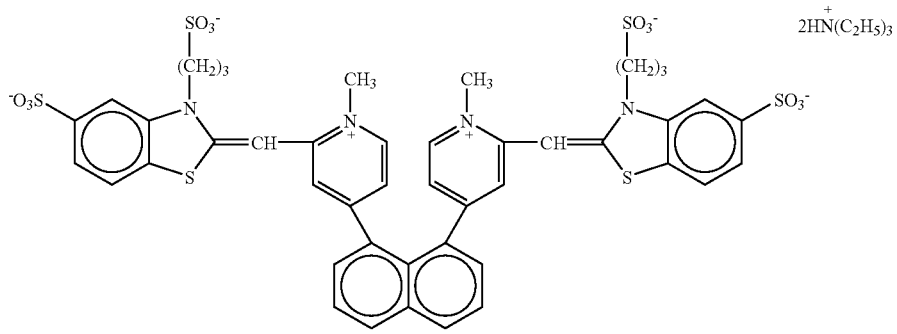

In the compound represented by formula (I), preferred examples of the chromophore Dd are set forth below, however, the present invention is not limited thereto. The following structural formulae of the compounds of the present invention are only one limiting structure out of possible resonance structures and the compounds each may have other structure which can be formed by resonance.

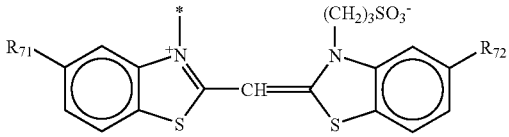

| | $R_{71}$ | $R_{72}$ |
|---|---|---|
| DA-1 | —Ph | —Cl |
| DA-2 | —Cl | —Cl |

-continued
| | | |
|---|---|---|
| DA-3 | —Ph | —Ph |
| DA-4 | —Cl | —H |
| DA-5 | 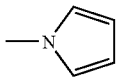 | —Cl |
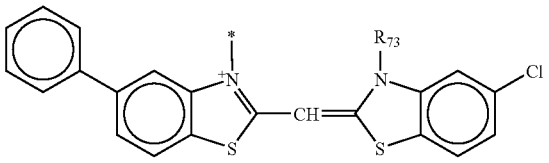
$R_{73}$
| | |
|---|---|
| DA-6 | $-(CH_2)_4-SO_3^-$ |
| DA-7 | $-(CH_2)_2-CH(CH_3)SO_3^-$ |
| DA-8 | $-C_2H_5$ |
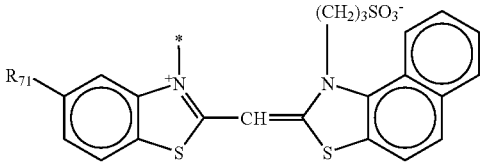
$R_{71}$
| | |
|---|---|
| DA-9 | —Cl |
| DA-10 | $—OCH_3$ |
| DA-11 | —Ph |
DA-12
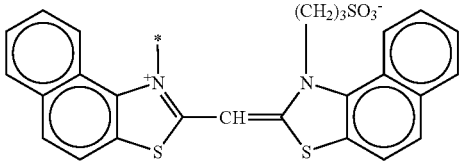
DA-13
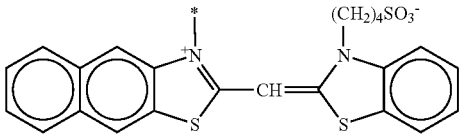
DA-14
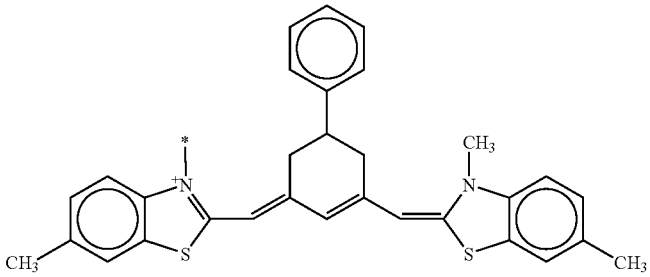
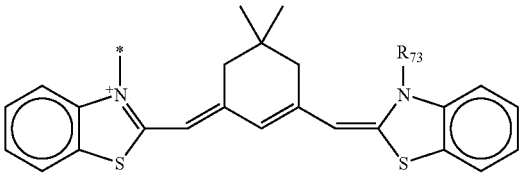
$R_{73}$ -continued
| | |
|---|---|
| DA-15 | $—C_2H_5$ |
| DA-16 | $-(CH)_3-SO_3^-$ |
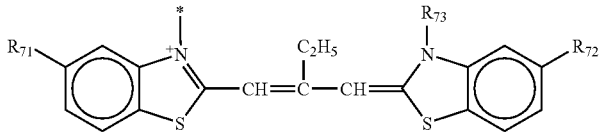
| | $R_{71}$ | $R_{72}$ | $R_{73}$ |
|---|---|---|---|
| DA-17 | —Cl | —Cl | $-(CH_2)_3-SO_3^-$ |
| DA-18 | $—CH_3$ | $—CH_3$ | $-(CH_2)_3-SO_3^-$ |
| DA-19 | —Cl | —Cl | $—CH_2CONH-(CH_2)_2-SO_3^-$ |
| DA-20 | —Cl | —Cl | $—CH_2CH(OH)CH_2SO_3^-$ |
DA-21
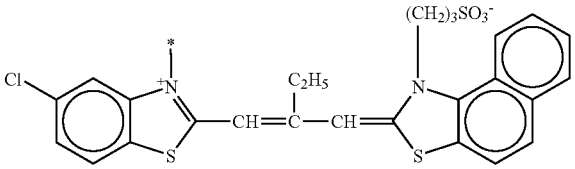
DA-22
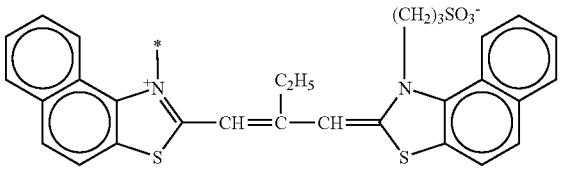
DA-23
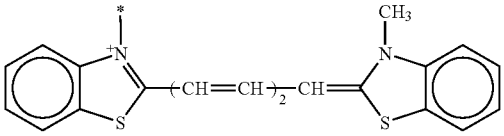
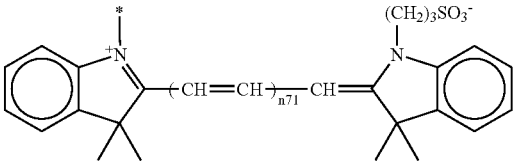
| | $n_{71}$ |
|---|---|
| DA-24 | 1 |
| DA-25 | 2 |
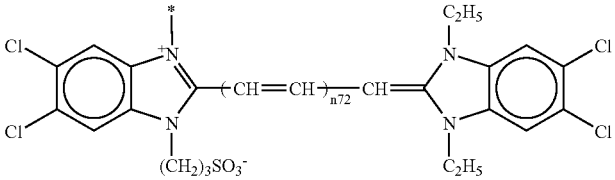
| | $n_{72}$ |
|---|---|
| DA-26 | 0 |
| DA-27 | 1 |
| DA-28 | 2 |
DA-29
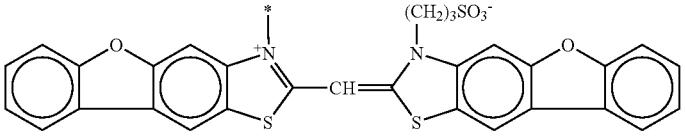

-continued
DA-30
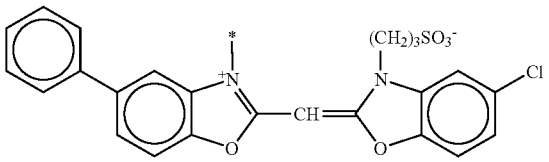
DA-31
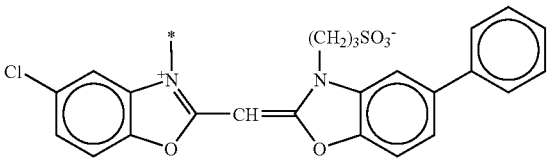
DA-32
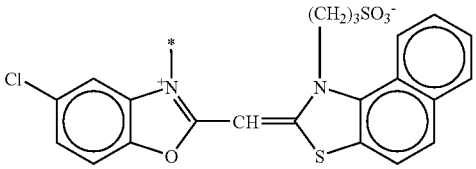
DA-33
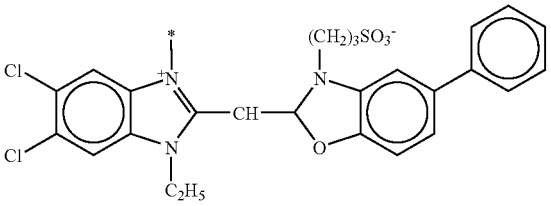
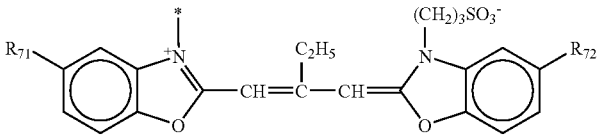
| | $R_{71}$ | $R_{72}$ |
|---|---|---|
| DA-34 | —Br | —Br |
| DA-35 | —Ph | —Cl |
| DA-36 | —Cl | —Cl |
| DA-37 | —Ph | —Ph |
DA-38
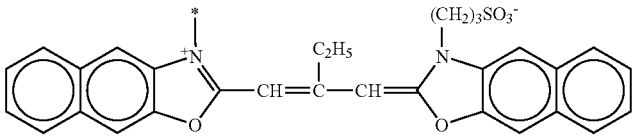
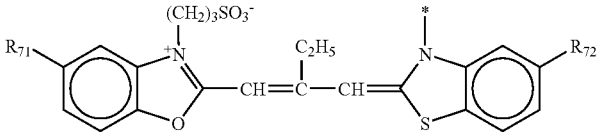
| | $R_{71}$ | $R_{72}$ |
|---|---|---|
| DA-39 | —Cl | —Cl |
| DA-40 | —Ph | —$CH_3$ |
| DA-41 | —$OCH_3$ | —$CH_3$ |

-continued
DA-42
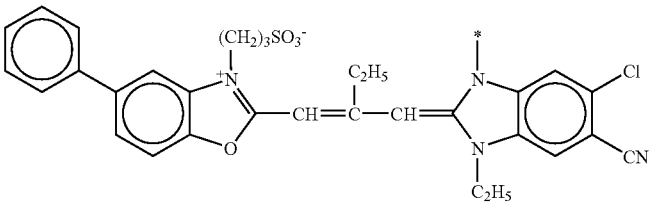
DA-43
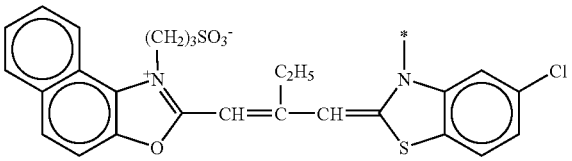
DA-44
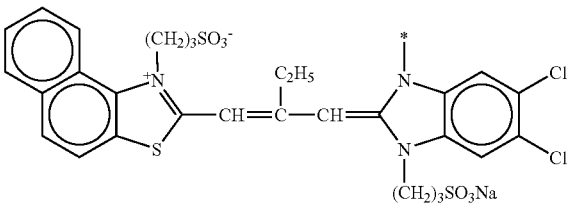
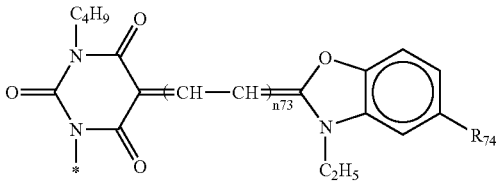
| | $n_{73}$ | $R_{74}$ |
|---|---|---|
| DA-45 | 1 | H |
| DA-46 | 1 | —$SO_3Na$ |
| DA-47 | 2 | H |
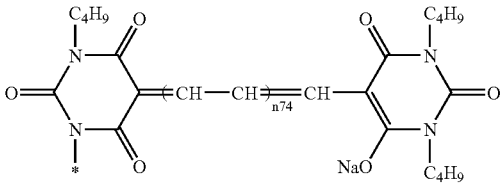
| | $n_{74}$ |
|---|---|
| DA-48 | 0 |
| DA-49 | 1 |
| DA-50 | 2 |
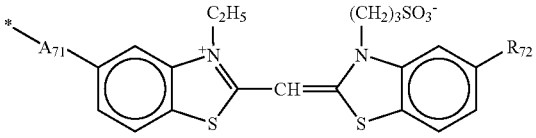
| | $A_{71}$ | $R_{72}$ |
|---|---|---|
| DA-51 | —O— | —Ph |
| DA-52 | —OC(=O)— | " |
| DA-53 | —NHCO— | " |
| DA-54 | —$NHSO_2$— | " |

-continued
| | | |
|---|---|---|
| DA-55 | —CONH— | " |
| DA-56 | —$SO_2NH$— | " |
| DA-57 | —NHCO— | —Cl |
DA-58
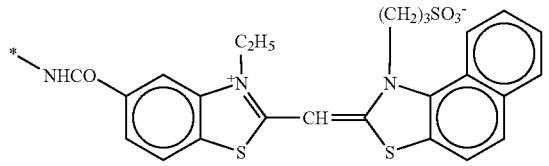
DA-59
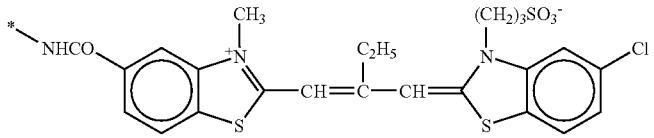
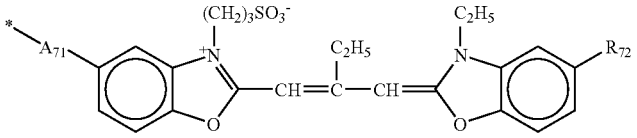
| | $A_{71}$ | $R_{72}$ |
|---|---|---|
| DA-60 | —NHCO— | —Br |
| DA-61 | —CONH— | —Cl |
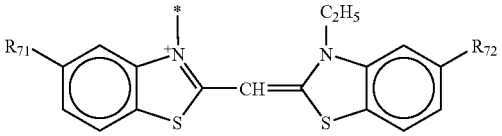
| | $R_{71}$ | $R_{72}$ |
|---|---|---|
| DA-62 | —Ph | —Cl |
| DA-63 | —Cl | —Cl |
| DA-64 | —Ph | —Ph |
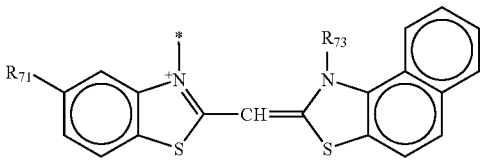
| | $R_{71}$ | $R_{73}$ |
|---|---|---|
| DA-65 | —Cl | —$CH_3$ |
| DA-66 | —Cl | —$C_2H_5$ |
| DA-67 | —$OCH_3$ | —$C_2H_5$ |
| DA-68 | —Ph | —$C_2H_5$ |
DA-69
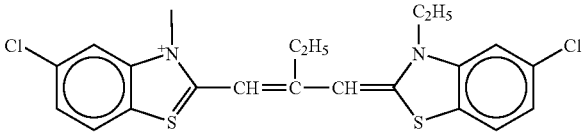
DA-70
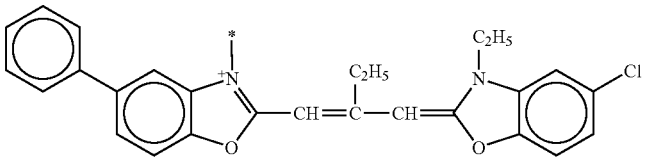

In the compounds of the present invention represented by formulae (2-1) to (2-5), preferred examples of $L_2$ are set forth below, however, the present invention is not limited thereto.

Examples of the linking chain —$L_2$—:

| | |
|---|---|
| L-101 | -(mere bond) |
| L-102 | —$CH_2$— |
| L-103 | $-(CH_2)_2-$ |
| L-104 | $-(CH_2)_3-$ |
| L-105 | $-(CH_2)_4-$ |
| L-106 | $-(CH_2)_8-$ |
| L-107 | —CH = CH— |
| L-108 | $-(CH = CH)_2-$ |
| L-109 | —C≡C— |
| L-110 | $-(C\equiv C)_2-$ |
| L-111 | 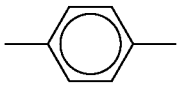 |

-continued

| | |
|---|---|
| L-112 | 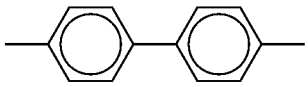 |
| L-113 | 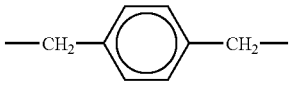 |
| L-114 | $-(CH_2)_2-O-(CH_2)_2-$ |
| L-115 | $-(CH_2)_2-O-(CH_2)_2O-(CH_2)_2-$ |
| L-116 | —$CH_2CONH-(CH_2)_4-NHCOCH_2$— |
| L-117 | $-(CH_2)_5-CONH-(CH_2)_4-$ |
| L-118 | —$CH_2COO-(CH_2)_6-$ |
| L-119 | —$CH_2CONH-(CH_2)_2-O-(CH_2)_2O-(CH_2)_2-$ |

In the compounds of the present invention represented by formulae (2-1) to (2-5), preferred examples of $[Da(—La_1—)_{p1}\{Db(—La_2—)_{p2}\}_{q1}Dc]$ are set forth below, however, the present invention is not limited thereto.

Examples of $[Da(—La_1—)_{p1}\{Db(—La_2—)_{p2}\}_{q1}Dc]$:

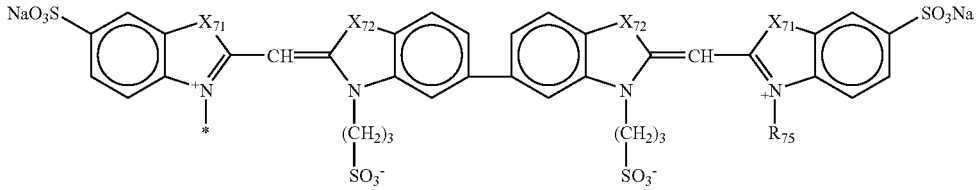

| | $X_{71}$ | $X_{72}$ | $R_{75}$ |
|---|---|---|---|
| DB-1 | —S— | —S— | —$C_2H_5$ |
| DB-2 | —S— | —S— | $-(CH_2)_5-COONa$ |
| DB-3 | —O— | —O— | $-(CH_2)_5-COONa$ |
| DB-4 | —$N(C_2H_5)$— | —$N(C_2H_5)$— | —$CH_2COONa$ |
| DB-5 | —$C(CH_3)_2$— | —$C(CH_3)_2$— | —$CH_2COOH$ |
| DB-6 | —S— | —O— | $-(CH_2)_3-SO_3Na$ |

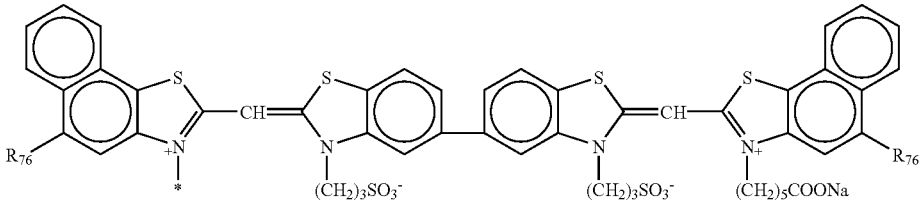

| | $R_{76}$ |
|---|---|
| DB-7 | H |
| DB-8 | —$SO_3Na$ |

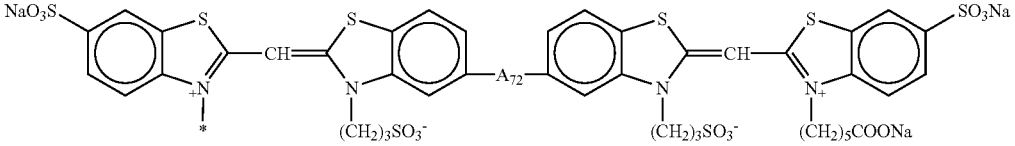

| | $A_{72}$ |
|---|---|
| DB-9 | —CH═CH— |
| DB-10 | —C≡C— |
| DB-11 | —C≡C—C≡C— |
| DB-12 | —O— |

-continued
| | |
|---|---|
| DB-13 | —$CH_2$ |
| DB-14 | 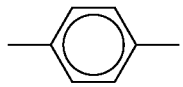 |
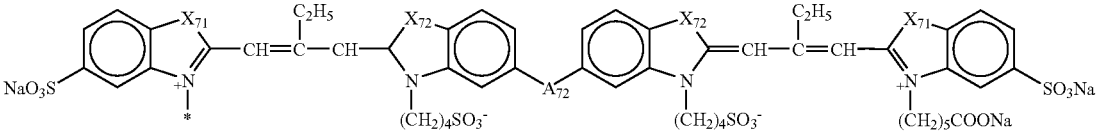
| | $X_{71}$ | $X_{72}$ | $A_{72}$ |
|---|---|---|---|
| DB-15 | —O— | —O— | — |
| DB-16 | —O— | —O— | —C≡C— |
| DB-17 | —O— | —S— | — |
| DB-18 | —S— | —O— | — |
| DB-19 | —S— | —S— | — |
| DB-20 | —N($C_2H_5$)— | —N($C_2H_5$)— | — |
| DB-21 | —C($CH_3$)$_2$— | —C($CH_3$)$_2$— | — |
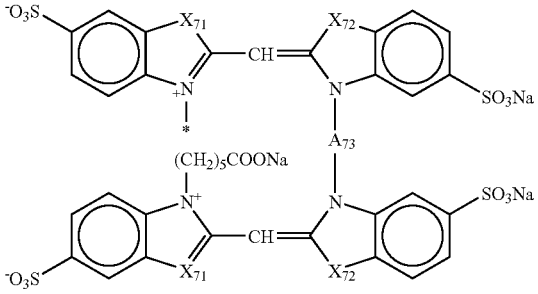
| | $X_{71}$ | $X_{72}$ | $A_{73}$ |
|---|---|---|---|
| DB-22 | —S— | —S— | -(CH$_2$)$_4$- |
| DB-23 | —S— | —S— | -(CH$_2$)$_2$-O-(CH$_2$)$_2$-O-(CH$_2$)$_2$- |
| DB-24 | —S— | —S— | 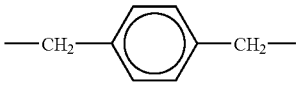 |
| DB-25 | —S— | —S— | -(CH$_2$)$_5$-CONH-(CH$_2$)-NHCO-(CH$_2$)$_5$- |
| DB-26 | —O— | —O— | -(CH$_2$)$_8$- |
| DB-27 | —O— | —S— | -(CH$_2$)$_4$- |
| DB-28 | —N($C_2H_5$)— | —N($C_2H_5$)— | -(CH$_2$)$_2$-O-(CH$_2$)$_2$- |
| DB-29 | —C($CH_3$)$_2$— | —C($CH_3$)$_2$— | -(CH$_2$)$_2$-O-(CH$_2$)$_2$O-(CH$_2$)$_2$- |
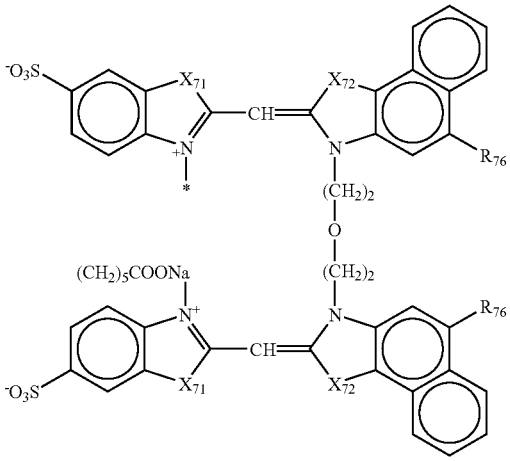

-continued
| | $X_{71}$ | $X_{72}$ | $R_{76}$ |
|---|---|---|---|
| DB-30 | —S— | —S— | H |
| DB-31 | —S— | —S— | —$SO_3Na$ |
| DB-32 | —O— | —S— | —$SO_3Na$ |
| DB-33 | —O— | —O— | —$SO_3Na$ |
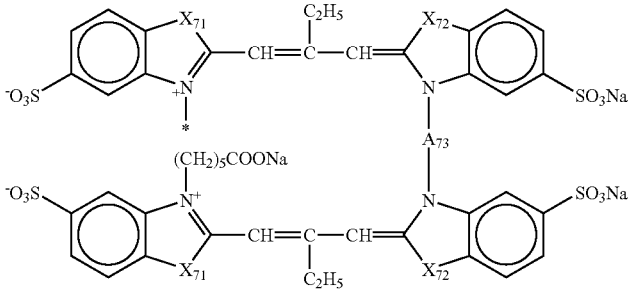
| | $X_{71}$ | $X_{72}$ | $A_{73}$ |
|---|---|---|---|
| DB-34 | —O— | —O— | $-(CH_2)_2-O-(CH_2)_2-$ |
| DB-35 | —O— | —S— | $-(CH_2)_4-$ |
| DB-36 | —S— | —S— | $-(CH_2)_2O-(CH_2)_2-O-(CH_2)_2-$ |
| DB-37 | —$N(C_2H_5)$— | —S— | $-(CH_2)_8-$ |
| DB-38 | —$C(CH_3)_2$— | —$C(CH_3)_2$— | $-(CH_2)_2O-(CH_2)_2-$ |
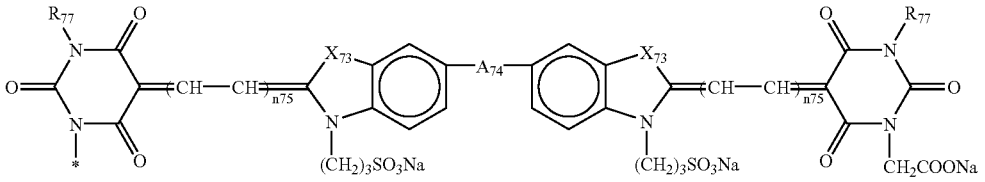
| | $R_{77}$ | $X_{73}$ | $n_{75}$ | $A_{74}$ |
|---|---|---|---|---|
| DB-39 | —$C_4H_9$ | —O— | 1 | — |
| DB-40 | —$C_4H_9$ | —O— | 2 | — |
| DB-41 | $-(CH_2)_2-SO_3Na$ | —O— | 1 | — |
| DB-42 | 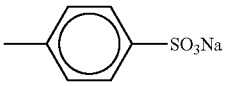 | —O— | 1 | — |
| DB-43 | —$C_4H_9$ | —S— | 1 | — |
| DB-44 | —$C_4H_9$ | —S— | 2 | — |
| DB-45 | —$C_4H_9$ | —$N(C_2H_5)$— | 1 | — |
| DB-46 | —$C_4H_9$ | —$C(CH_3)_2$— | 1 | — |
| DB-47 | —$C_4H_9$ | —O— | 1 | —CH = CH— |
| DB-48 | 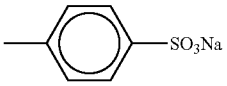 | —O— | 1 | —C≡C— |
| DB-49 | —$C_4H_9$ | —O— | 1 | —$CH_2$— |
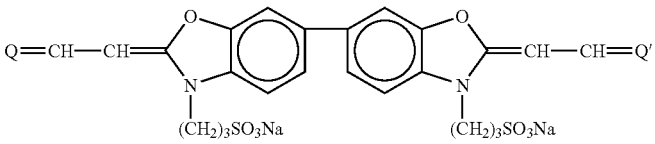
Q = Q' =

-continued
| | | |
|---|---|---|
| DB-50 | 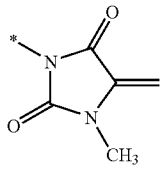 | 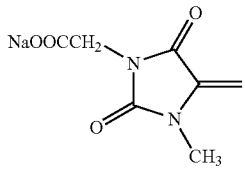 |
| DB-51 | 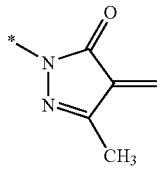 | 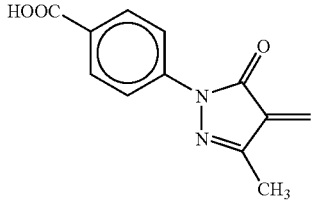 |
| DB-52 | 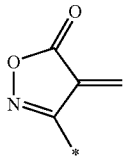 | 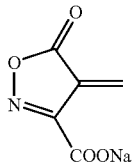 |
| DB-53 | 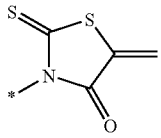 | 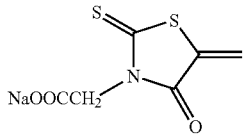 |
| DB-54 | 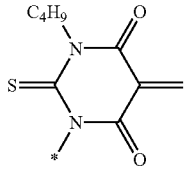 | 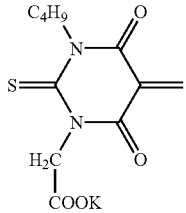 |
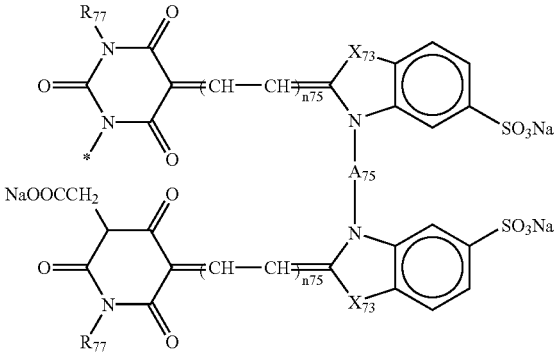
| | $R_{77}$ | $X_{73}$ | $n_{75}$ | $A_{75}$ |
|---|---|---|---|---|
| DB-55 | $—C_4H_9$ | —O— | 1 | $-(CH_2)_2-O-(CH_2)_2-$ |
| DB-56 | $—C_4H_9$ | —O— | 2 | $-(CH_2)_2-O-(CH_2)_2-O-(CH_2)_2-$ |
| DB-57 | $-(CH_2)_2-SO_3Na$ | —O— | 1 | $-(CH_2)_4-$ |
| DB-58 | 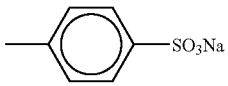 | —O— | 1 | $-(CH_2)_2-O-(CH_2)_2-$ |
| DB-59 | $—C_4H_9$ | —S— | 1 | $-(CH_2)_2-O-(CH_2)_2-O-(CH_2)_2-$ |

-continued
| | | | | |
|---|---|---|---|---|
| DB-60 | $—C_4H_9$ | $—N(C_2H_5)—$ | 1 | 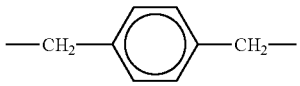 |
| DB-61 | $—C_4H_9$ | $—C(CH_3)_2$ | 1 | $—(CH_2)_5—CONH—(CH_2)_2—NHCO—(CH_2)_5—$ |
| DB-62 | 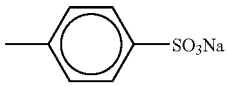 | —S— | 2 | $—(CH_2)_6—$ |
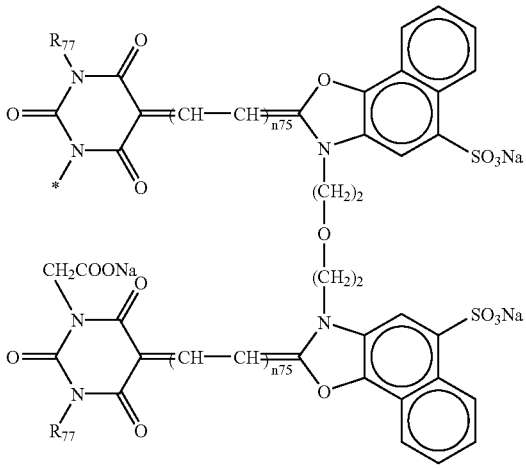
| | $R_{77}$ | $n_{75}$ |
|---|---|---|
| DB-63 | $—C_4H_9$ | 1 |
| DB-64 | $—C_4H_9$ | 2 |
| DB-65 | 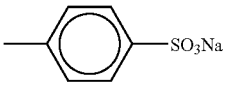 | 1 |
DB-66
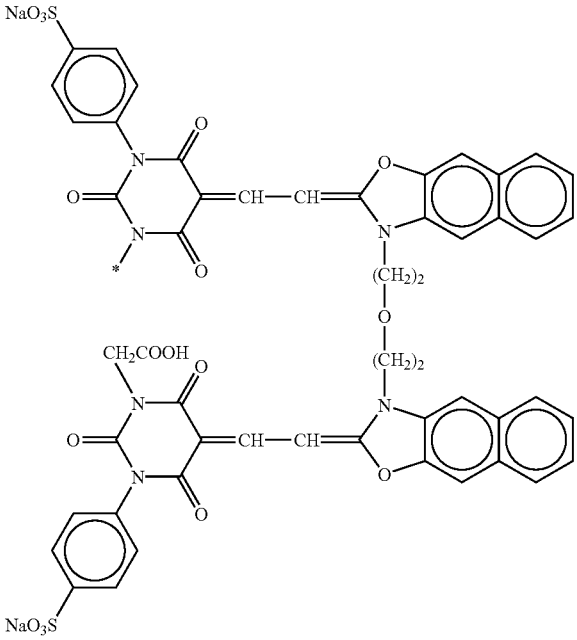

-continued
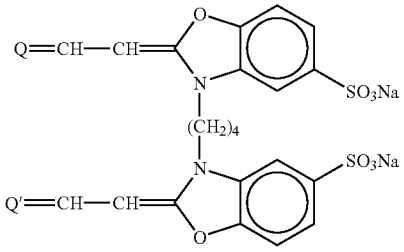
| | Q = | Q' = |
|---|---|---|
| DB-67 | 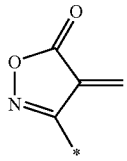 | 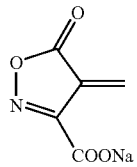 |
| DB-68 | 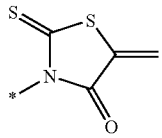 | 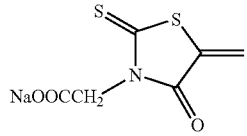 |
| DB-69 | 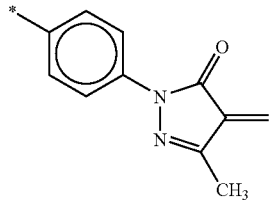 | 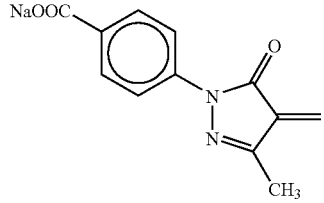 |
In the compound of the present invention represented by formula (I), preferred examples of —$La_1$—, —$La_2$— and —Lb— are set forth below, however, the present invention is not limited thereto.
Examples of the linking chains —La— and —Lb— (in the case of Lb, the left side is the Dd side):
L-1 $-(CH_2)_4-$
L-2 $-(CH_2)_8-$
L-3 $-(CH_2)_7CH=CH-(CH_2)_7-$
L-4
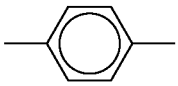
L-5
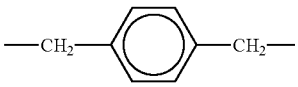
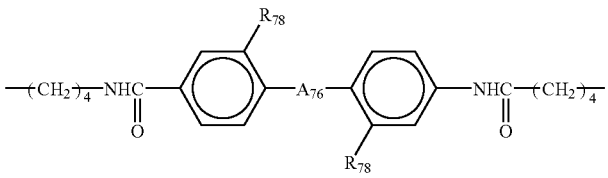

-continued
| | $A_{76}$ | $R_{78}$ |
|---|---|---|
| L-6 | — | H |
| L-7 | — | —$SO_3^-$ • $^+HNEt(i\text{-}Pr)_2$ |
| L-8 | —O— | H |
| L-9 | —O— | —$SO_3Na$ |
| L-10 | —$SO_2$— | H |
L-11
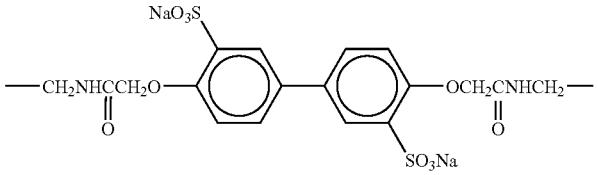
L-12
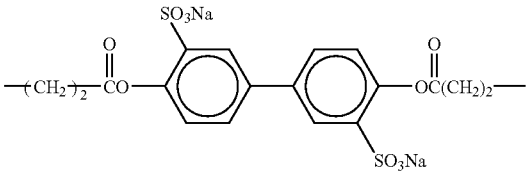
L-13
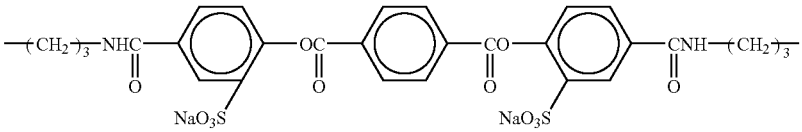
L-14
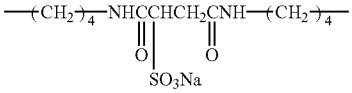
L-15
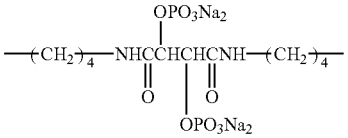
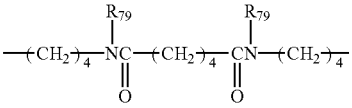
| | $R_{79}$ |
|---|---|
| L-16 | $-(CH_2)_3-SO_3Na$ |
| L-17 | $-(CH_2)_2-COONa$ |
| L-18 | $-(CH_2)_2-PO_3Na_2$ |
L-19
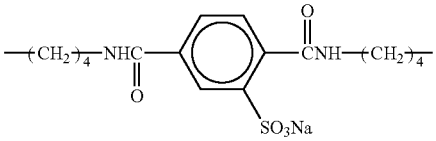
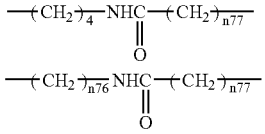

-continued

| | $n_{76}$ | $n_{77}$ |
|---|---|---|
| L-20 | 4 | 5 |
| L-21 | 8 | 5 |
| L-22 | 8 | 1 |
| L-23 | 4 | 3 |
| L-24 | 4 | 1 |

L-25

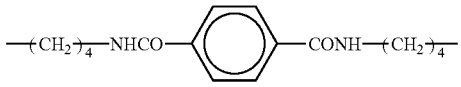

L-26 $-(CH_2)_4-NHCO-(CH_2)_2-CONH-(CH_2)_4-$ $$-(CH_2)_{n78}-\underset{\underset{O}{\|}}{C}NH-(CH_2)_{n79}-$$

| | $n_{78}$ | $n_{79}$ |
|---|---|---|
| L-27 | 5 | 4 |
| L-28 | 5 | 8 |
| L-29 | 1 | 6 |

L-30 $-(CH_2)_6-\underset{\underset{O}{\|}}{C}O-(CH_2)_5-$

L-31 $-(CH_2)_5-\underset{\underset{O}{\|}}{C}O-(CH_2)_6-$

L-32 $-(CH_2)_8-NHSO_2-(CH_2)_3-$ $$-(CH_2)_2-(OCH_2CH_2)_{n80}-NH\underset{\underset{O}{\|}}{C}-(CH_2)_{n81}-$$

| | $n_{80}$ | $n_{81}$ |
|---|---|---|
| L-33 | 2 | 5 |
| L-34 | 2 | 1 |
| L-35 | 3 | 1 |

$$-(CH_2)_2-(OCH_2CH_2)_{n82}-\underset{\underset{O}{\|}}{C}NH-(CH_2)_{n83}-$$

| | $n_{82}$ | $n_{83}$ |
|---|---|---|
| L-36 | 2 | 3 |
| L-37 | 2 | 4 |
| L-38 | 2 | 8 |

L-39 $-(CH_2)_3-\underset{\underset{O}{\|}}{C}NH-(CH_2)_2-(OCH_2CH_2)_2-CONH-(CH_2)_3-$ L-40 $-(CH_2)_4-NH\underset{\underset{O}{\|}}{C}-(CH_2CH_2O)_2-(CH_2)_2-$ L-41 $-(CH_2)_5-\underset{\underset{O}{\|}}{C}NH-(CH_2CH_2O)_2-NH\underset{\underset{O}{\|}}{C}CH_2-$ L-42 $-(CH_2)_2-\underset{\underset{O}{\|}}{C}NH-(CH_2)_2-NH\underset{\underset{O}{\|}}{C}CH_2-$

L-43 $-(CH_2)_2-(OCH_2CH_2)_2-NHSO_2-(CH_2)_3-$

-continued

| | $-(CH_2)_2-(A_{77}CH_2CH_2)_2-NHCO-(CH_2)_5-$ $A_{77}$ |
|---|---|
| L-44 | —S— |
| L-45 | —N(CH$_3$)— |
| L-46 | —CH(OH)— |

L-47 $-(CH_2)_2-SO_2-(CH_2)_2-NHCO-(CH_2)_5-$

L-48

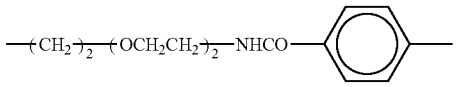

L-49 -(mere bond)

$-(CH_2)_n-$

L-50: n = 1

L-51: n = 2

L-52: n = 3

Specific examples of the compound represented by formula (I) when $[Da(—La_1—)_{p1}\{Db(—La_2—)_{p2}\}_{q1}DC]$ is represented by formulae (2-1) to (2-5) are set forth below, however, the present invention is not limited thereto.

Examples when in formula (I), $r_1$, $r_2$ and $p_3$ each is 1 and Xa is Dd (incidentally, D1 and La described in Japanese Patent Application No. 2000-368802 can also be preferably used as Xa and Lb, respectively):

Example of $Dd—Lb—[Da(—La_1—)_{p1}\{Db(—La_2—)_{p2}\}_{q1}Dc]_{q2}$:

| | Dd- | -Lb- | $-[Da(-La_1-)_{p1}\{Db(-La_2-)_{p2}\}_{q1}Dc]_{q2}$ |
|---|---|---|---|
| D-1 | DA-1 | L-34 | DB-39 |
| D-2 | DA-2 | L-22 | " |
| D-3 | DA-9 | L-34 | " |
| D-4 | DA-10 | L-35 | " |
| D-5 | DA-11 | L-34 | " |
| D-6 | DA-17 | L-33 | DB-19 |

-continued

| | Dd- | -Lb- | $-[Da(-La_1-)_{p1}\{Db(-La_2-)_{p2}\}_{q1}Dc]_{q2}$ |
|---|---|---|---|
| D-7 | DA-24 | " | DB-16 |
| D-8 | DA-27 | L-34 | DB-40 |
| D-9 | DA-35 | L-41 | DB-16 |
| D-10 | DA-37 | L-42 | DB-40 |
| D-11 | DA-11 | L-33 | DB-2 |
| D-12 | " | " | DB-8 |
| D-13 | " | " | DB-9 |
| D-14 | " | " | DB-10 |
| D-15 | " | L-27 | DB-11 |
| D-16 | " | L-33 | DB-22 |
| D-17 | " | " | DB-23 |
| D-18 | " | L-34 | DB-47 |
| D-19 | " | " | DB-53 |
| D-20 | " | " | DB-55 |
| D-21 | " | " | DB-63 |
| D-22 | DA-34 | L-42 | DB-34 |
| D-23 | DA-38 | " | DB-15 |

Examples when in formula (I) $r_2$ is 1 and Xa is Ad:

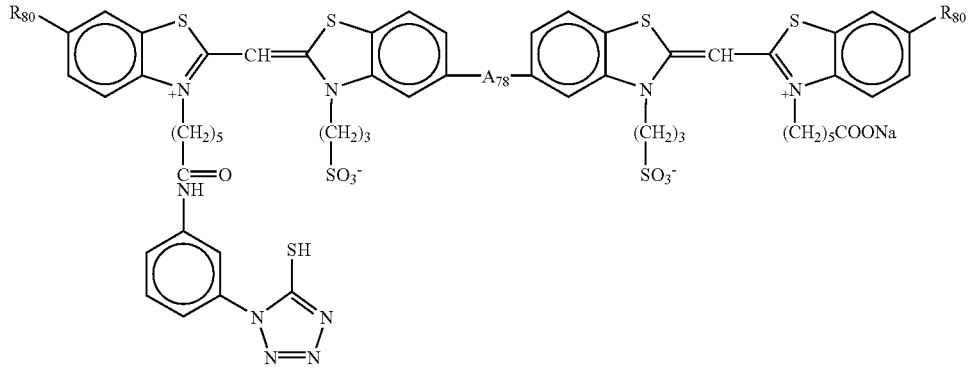

-continued
| | $R_{80}$ | $A_{78}$ |
|---|---|---|
| DC-1 | H | — |
| DC-2 | —$SO_3Na$ | — |
| DC-3 | —$SO_3Na$ | —CH═CH— |
| DC-4 | —$SO_3Na$ | —C≡C— |
DC-5
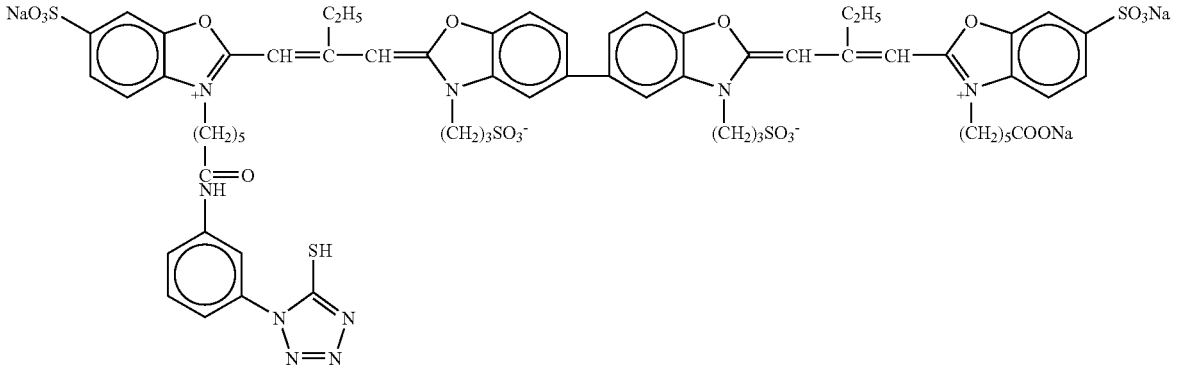
DC-6
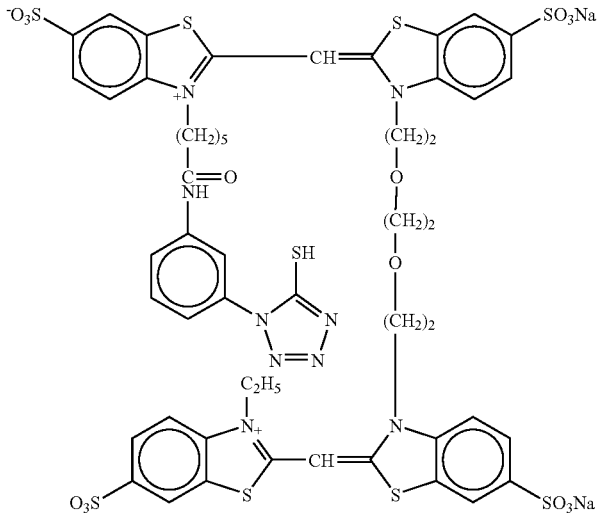
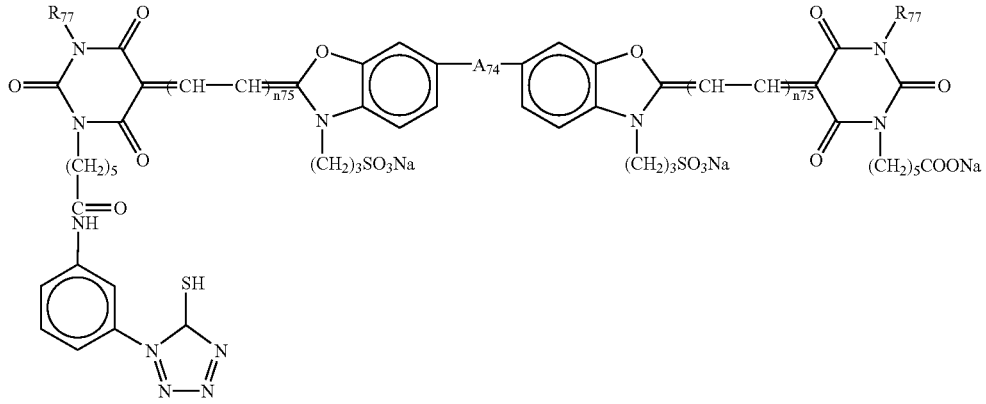
| | $R_{77}$ | $n_{75}$ | $A_{74}$ |
|---|---|---|---|
| DC-7 | $C_4H_9$ | 1 | — |
| DC-8 | $C_4H_9$ | 2 | — |
| DC-9 | $C_4H_9$ | 1 | $CH_2$ |

-continued
| | | | |
|---|---|---|---|
| DC-10 | $C_4H_9$ | 1 | —CH═CH— |
| DC-11 | $C_4H_9$ | 1 | —C≡C— |
| DC-12 | $-(CH_2)_2SO_3Na$ | 1 | — |
| DC-13 | 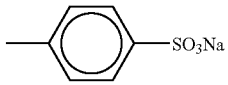 | 1 | — |
DC-14
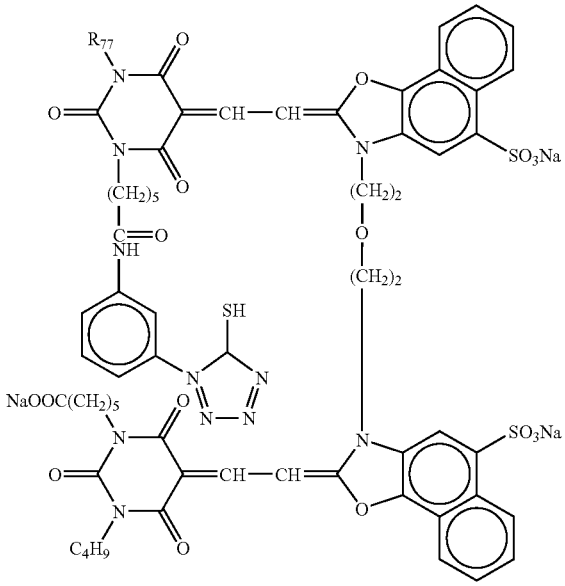
Examples when in formula (I), $r_2$ is 0 (the compounds show below are used in the interconnected state with a dye compound other than the multichromophore dye compound, preferably a dye adsorbed to a silver halide grain, by an attracting force except for covalent bonding or coordinate bonding):
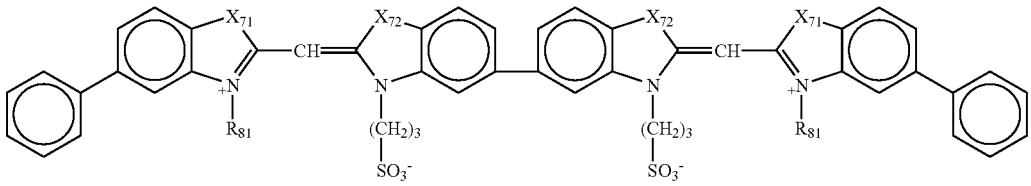
| | $X_{71}$ | $X_{72}$ | $R_{81}$ |
|---|---|---|---|
| DD-1 | —S— | —S— | 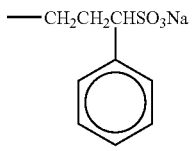 |
| DD-2 | —O— | —O— | 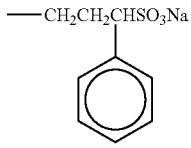 |

-continued
| | | | |
|---|---|---|---|
| DD-3 | —N($C_2H_5$)— | —N($C_2H_5$)— | $NaO_3S$ —$CH_2$— |
| DD-4 | —C($CH_3$)$_2$— | —C($CH_3$)$_2$— | $NaO_3S$ —$CH_2$— |
| DD-5 | —S— | —S— | —$CH_2CH_2O$— |
| DD-6 | —S— | —S— | —($CH_2$)$_3$$\overset{+}{N}$($CH_3$)$_3$ $Br^-$ |
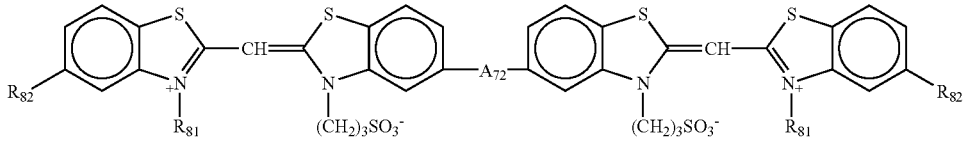
| | $A_{72}$ | $R_{81}$ | $R_{82}$ |
|---|---|---|---|
| DD-7 | —CH═CH— | —$CH_2CH_2CHSO_3Na$ | |
| DD-8 | —C≡C— | —$CH_2CH_2CHSO_3Na$ | |
| DD-9 | —C≡C—C≡C— | —$CH_2CH_2CHSO_3Na$ | —Cl |
| DD-10 | —O— | $NaO_3S$ —$CH_2$— | —Br |
| DD-11 | —$CH_2$— | —$CH_2CH_2O$— | —I |
| DD-12 | | —($CH_2$)$_3$$SO_3Na$ | |
| DD-13 | —C≡C— | —($CH_2$)$_3$$\overset{+}{N}$($CH_3$)$_3$ $Br^-$ | |

-continued
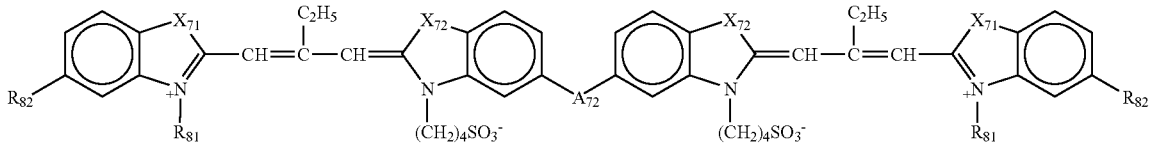
| | $X_{71}$ | $X_{72}$ | $R_{81}$ | $R_{82}$ | $A_{72}$ |
|---|---|---|---|---|---|
| DD-14 | O | O | $-CH_2CH_2CHSO_3Na$ 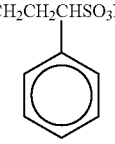 | 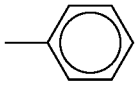 | — |
| DD-15 | O | O | $-CH_2CH_2O-$ 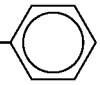 | —Br | — |
| DD-16 | O | O | $-(CH_2)_3\overset{+}{N}(CH_3)_3$ $Br^-$ | 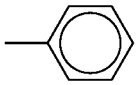 | — |
| DD-17 | O | O | $-(CH_2)_3\overset{+}{N}(CH_3)_3$ $Br^-$ | 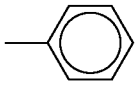 | —C≡C— |
| DD-18 | O | O | $-CH_2CH_2-$ 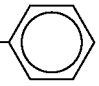 | 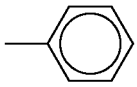 | —CH=CH— |
| DD-19 | S | S | $-CH_2CH_2-$ 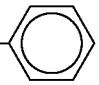 | 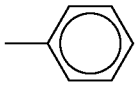 | — |
| DD-20 | S | S | $-(CH_2)_3\overset{+}{N}(CH_3)_3$ $Br^-$ | —Cl | — |
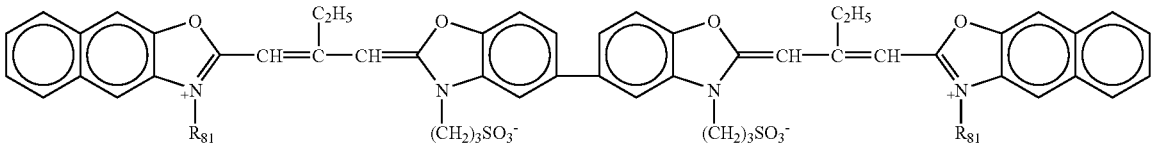
| | $R_{81}$ |
|---|---|
| DD-21 | $-CH_2CH_2CHSO_3Na$ 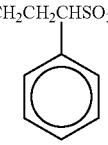 |
| DD-22 | $-CH_2CH_2O-$ 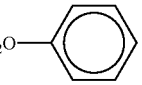 |
| DD-23 | $-(CH_2)_3\overset{+}{N}(CH_3)_3$ $Br^-$ |

-continued
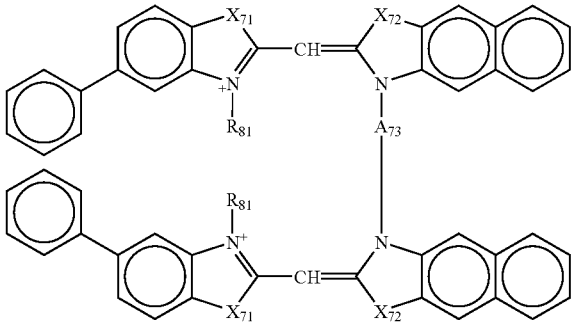
| | $X_{71}$ | $X_{72}$ | $R_{81}$ | $R_{73}$ |
|---|---|---|---|---|
| DD-24 | —S— | —S— | $—CH_2CH_2CHSO_3Na$ 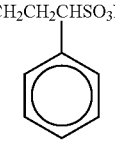 | $—(CH_2)_4—$ |
| DD-25 | —S— | —S— | $—CH_2CH_2CHSO_3Na$ 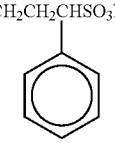 | $—(CH_2)_2O(CH_2)_2—$ |
| DD-26 | —S— | —S— | $—CH_2CH_2—$ 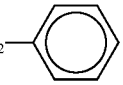 | $—(CH_2)_2O(CH_2)_2O(CH_2)_2—$ |
| DD-27 | —O— | —O— | $—CH_2—$ 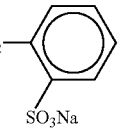 $SO_3Na$ | $—(CH_2)_2O(CH_2)_2—$ |
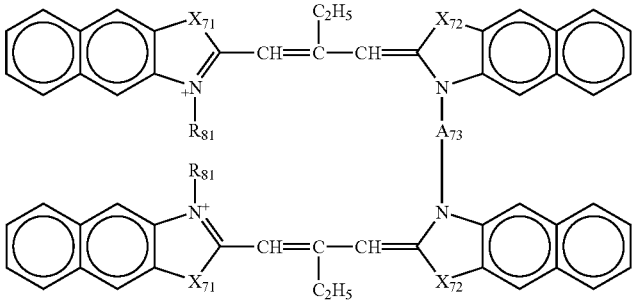
| | $X_{71}$ | $X_{72}$ | $R_{81}$ | $R_{73}$ |
|---|---|---|---|---|
| DD-28 | —O— | —O— | $—CH_2CH_2CHSO_3Na$ 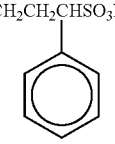 | $—(CH_2)_4—$ |
| DD-29 | —O— | —O— | $—CH_2CH_2CHSO_3Na$ 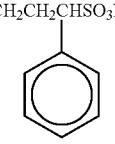 | $—(CH_2)_2O(CH_2)_2—$ |

-continued
| | | | | |
|---|---|---|---|---|
| DD-30 | —O— | —O— | $—CH_2CH_2—$ 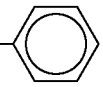 | $—(CH_2)_2O(CH_2)_2O(CH_2)_2—$ |
| DD-31 | —O— | —S— | $—CH_2—$ 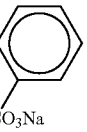 $SO_3Na$ | $—(CH_2)_2O(CH_2)_2—$ |
| DD-32 | —S— | —S— | $—CH_2—$ 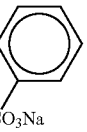 $SO_3Na$ | $—(CH_2)_2O(CH_2)_2—$ |
| DD-33 | —S— | —S— | $—CH_2CH_2—$ 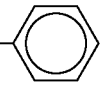 | $—(CH_2)_8—$ |
| DD-34 | —O— | —O— | $—(CH_2)_2\overset{+}{N}(CH_3)_3\ Br^-$ | $—(CH_2)_2O(CH_2)_2—$ |
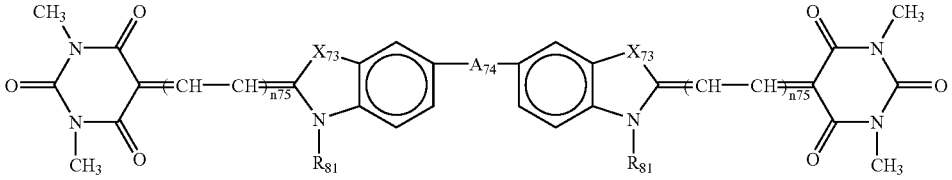
| | $R_{81}$ | $X_{73}$ | $n_{75}$ | $A_{74}$ |
|---|---|---|---|---|
| DD-35 | $—CH_2CH_2CHSO_3Na$ 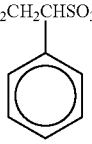 | —O— | 1 | — |
| DD-36 | $—CH_2—$ 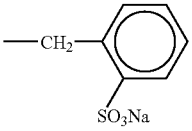 $SO_3Na$ | —O— | 2 | — |
| DD-37 | $—CH_2CH_2—$ 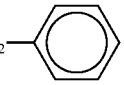 | —O— | 1 | — |
| DD-38 | $—(CH_2)_3\overset{+}{N}(CH_3)_3\ Br^-$ | —O— | 1 | — |
| DD-39 | $—CH_2CH_2CHSO_3Na$ 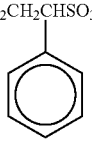 | —S— | 1 | — |
| DD-40 | $—CH_2CH_2CHSO_3Na$ 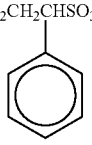 | $—C(CH_3)_2$ | 1 | — |

-continued

| | | | | |
|---|---|---|---|---|
| DD-41 | —$CH_2CH_2CHSO_3Na$ 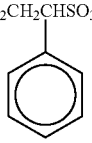 | —O— | 1 | —CH=CH— |
| DD-42 | —$CH_2CH_2CHSO_3Na$ 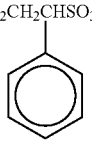 | —O— | 1 | —CH=CH— |

DD-43

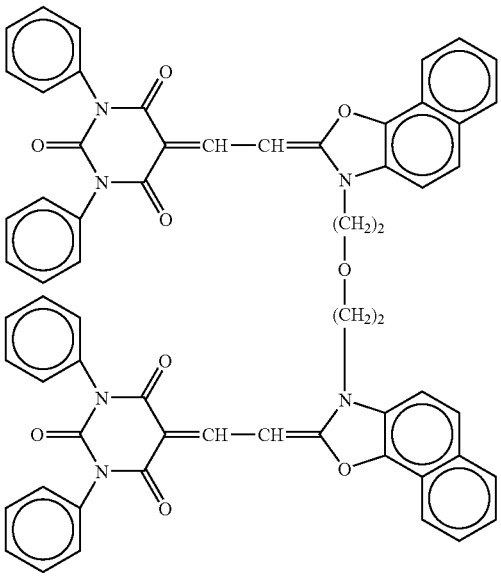

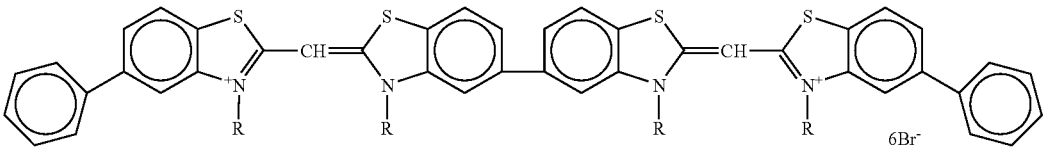

DD-44: R = —$(CH_2)_3$—$\overset{+}{N}(CH_3)_3$

DD-45: R = —$(CH_2)_4$—NH—$C(=\overset{+}{N}H_2)NH_2$

The dyes of the present invention can be synthesized by the methods described in F. M. Harmer, *Heterocyclic Compounds—Cyanine Dyes and Related Compounds,* John Wiley & Sons, New York, London (1964), D. M. Sturmer, *Heterocyclic Compounds—Special topics in heterocyclic chemistry,* Chap. 18, Sec. 14, pp. 482–515, John Wiley & Sons, New York, London (1977), and *Rodd's Chemistry of Carbon Compounds,* 2nd ed., Vol. IV, Part B, Chap. 15, pp. 369–422, Elsevier Science Publishing Company Inc., New York (1977).

In the present invention, not only the sensitizing dyes of the present invention but also a sensitizing dye other than those of the present invention can be used in combination. Preferred examples of the dye which can be used in combination include cyanine dyes, merocyanine dyes, rhodacyanine dyes, trinuclear merocyanine dyes, tetranuclear merocyanine dyes, allopolar dyes, hemicyanine dyes and styryl dyes. Among these, more preferred are cyanine dyes, merocyanine dyes and rhodacyanine dyes, still more preferred are cyanine dyes. These dyes are described in detail in F. M. Harmer, *Heterocyclic Compounds—Cyanine Dyes and Related Compounds,* John Wiley & Sons, New York, London (1964), D. M. Sturmer, *Heterocyclic Compounds—Special topics in heterocyclic chemistry,* Chap. 18, Section 14, pp. 482–515, Johan Wiley & Sons, New York, London (1977), and *Rodd's Chemistry of Carbon Compounds,* 2nd ed., Vol. IV, Part B. Chap. 15, pp. 369–422, Elsevier Science Publishing Company Inc., New York (1977).

Examples of preferred dyes include the sensitizing dyes represented by the formulae or described as specific examples in U.S. Pat. No. 5,994,051, pp. 32–44, and U.S. Pat. No. 5,747,236, pp. 30–39.

Examples of the formulae for preferred cyanine dyes, merocyanine dyes and rhodacyanine dyes include formulae (XI), (XII) and (XIII) described in U.S. Pat. No. 5,340,694, columns 21 to 22 (where, however, the numbers of n12, n15, n17 and n18 are not limited and each is an integer of 0 or more (preferably 4 or less)).

These sensitizing dyes may be used either individually or in combination of two or more thereof. The combination of sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862 and 4,026,707, British Patents 1,344,281 and 1,507,803, JP-B-43-49336 (the term "JP-B" as used herein means an "examined Japanese patent publication"), JP-B-53-12375, JP-A-52-110618 and JP-A-52-109925.

Together with the sensitizing dye, a dye which itself has no spectral sensitization effect or a substance which absorbs substantially no visible light, but which exhibits supersensitization may be contained in the emulsion.

Examples of the supersensitizing agent (for example, pyrimidylamino compounds, triazinylamino compounds, azolium compounds, aminostyryl compounds, aromatic organic acid formaldehyde condensates, azaindene compounds and cadmium salts) useful for the spectral sensitization of the present invention and examples of the combination of a supersensitizing agent with a sensitizing dye are described in U.S. Pat. Nos. 3,511,664, 3,615,613, 3,615,632, 3,615,641, 4,596,767, 4,945,038, 4,965,182, 2,933,390, 3,635,721, 3,743,510, 3,617,295 and 3,635,721. With respect to the use method thereof, those described in these patents are also preferred.

The sensitizing dyes (the same applies to other sensitizing dyes and supersensitizing agents) of the present invention may be added to the silver halide emulsion for use in the present invention in any process during the preparation of the emulsion, which has been heretofore recognized as useful. The addition may be performed at any time or step as long as it is before the coating of the emulsion, for example, during the formation and/or before the desalting of silver halide grains, during the desalting and/or after the desalting but before the initiation of chemical ripening as disclosed in U.S. Pat. Nos. 2,735,766, 3,628,960, 4,183,756 and 4,225,666, JP-A-58-184142 and JP-A-60-196749, immediately before or during the chemical ripening, or after the chemical ripening but before the coating as disclosed in JP-A-58-113920. Also, as disclosed in U.S. Pat. No. 4,225,666 and JP-A-58-7629, the same compound solely or in combination with a compound having a different structure may be added in parts, for example, during the grain formation and during or after the completion of chemical ripening, or before or during the chemical ripening and after the completion of chemical ripening. When added in parts, the kind of the compound or the combination of compounds may be varied.

The amount added of the sensitizing dye (the same applies to other sensitizing dyes and supersensitizing dyes) for use in the present invention varies depending on the shape and size of silver halide grain and the sensitizing dye may be added in any amount, however, the sensitizing dye can be used in an amount of $1\times10^{-6}$ to $8\times10^{-3}$ mol per mol of silver halide. For example, when the silver halide grain size is from 0.2 to 1.3 μm, the amount added is preferably from $2\times10^{-6}$ to $3.5\times10^{-3}$ mol, more preferably from $7.5\times10^{-6}$ to $1.5\times10^{-3}$ mol, per mol of silver halide.

However, in the case where the sensitizing dye for use in the present invention is adsorbed in multiple layers as described above, the sensitizing dye is preferably added in an amount necessary for the multilayer adsorption.

The sensitizing dye (the same applies to other sensitizing dyes and supersensitizing dyes) for use in the present invention can be dispersed directly in the emulsion or can be added to the emulsion in the form of a solution after dissolving the dye in an appropriate solvent such as methyl alcohol, ethyl alcohol, methyl cellosolve, acetone, water or pyridine or in a mixed solvent thereof. At this time, additives such as base, acid or surfactant can be allowed to be present together. For the dissolution, an ultrasonic wave may also be used. With respect to the method for adding these compounds, a method of dissolving the compound in a volatile organic solvent, dispersing the solution in a hydrophilic colloid and adding the dispersion to the emulsion described in U.S. Pat. No. 3,469,987, a method of dispersing the compound in a water-soluble solvent and adding the dispersion to the emulsion described in JP-B-46-24185, a method of dissolving the compound in a surfactant and adding the solution to the emulsion described in U.S. Pat. No. 3,822,135, a method of dissolving the compound using a compound capable of red shifting and adding the solution to the emulsion described in JP-A-51-74624, and a method of dissolving the compound in an acid substantially free of water and adding the solution to the emulsion described in JP-A-50-80826 may be used. In addition, for the addition to the emulsion, the methods described in U.S. Pat. Nos. 2,912,343, 3,342,605, 2,996,287 and 3,429,835 may be used.

The silver halide emulsion for use in the present invention is preferably silver bromide, silver chloride, silver iodobromide, silver iodochlorobromide, silver chlorobromide, silver chloroiodobromide or the like. The shape of the silver halide grain may be a regular crystal form such as octahedron, cubic and tetradecahedron, but a tabular grain is preferred.

The first emulsion for use in the present invention, namely, a tabular silver halide grain where the silver halide grain has parallel main planes of (111) face, has a silver chloride content of less than 10 mol % and comprises silver iodobromide or silver chloroiodobromide, is described below.

This emulsion comprises (111) main surfaces and side faces connecting these main surfaces. The tabular grain emulsion comprises silver iodobromide or silver chlorobromide. The silver halide grain may contain silver chloride but the silver chloride content is preferably 8 mol % or less, more preferably 3 mol % or less or 0 mol %. The silver iodide content is 40 mol % or less, preferably 20 mol % or less.

Irrespective of the silver iodide content, the coefficient of variation in the distribution of silver iodide content among grains is preferably 20% or less, more preferably 10% or less.

The silver iodide distribution preferably has a structure within the grain. In this case, the structure of the silver iodide distribution may be a duple structure, a triple structure, a quadruple structure or a grater structure. Also, the silver iodide content may be continuously changed inside the grain.

Preferably, 50% or more of the entire projected area is occupied by grains having an aspect ratio of 2 or more. The projected area and the aspect ratio of a tabular grain can be measured from an electron microscopic photograph by a carbon replica method of making a shadow together with a latex sphere for reference. The tabular grain is, when viewed from above, in the hexagonal, triangular or circular form and the aspect ratio is a value obtained by dividing the diameter of a circle having the same area as the projected area by the thickness. As for the shape of tabular grains, a higher ratio of hexagonal form is more preferred. The ratio of lengths of respective adjacent sides of the hexagonal form is preferably 1:2 or less.

The tabular grain size is preferably, in terms of the projected area diameter, from 0.1 to 20.0 μm, more preferably from 0.2 to 10.0 μm. The projected area diameter is the diameter of a circle having an area equal to the projected area of a silver halide grain. The thickness of a tabular grain is preferably from 0.01 to 0.5 μm, preferably from 0.02 to 0.4 μm. The thickness of a tabular grain is the distance between two main planes. The equivalent-sphere diameter is preferably from 0.1 to 5.0 μm, more preferably from 0.2 to 3 μm. The equivalent-sphere diameter is the diameter of a sphere having a volume equal to the volume of individual grains. The aspect ratio is preferably from 2 to 100, more preferably from 2 to 50. The aspect ratio is a value obtained by dividing the projected area diameter of a grain by the thickness of the grain.

The silver halide grain for use in the present invention is preferably monodisperse. The coefficient of variation in the equivalent-sphere diameter of all silver halide grains for use in the present invention is 30% or less, preferably 25% or less. In the case of a tabular grain, the coefficient of variation in the projected area diameter is important and the coefficient of variation in the projected area diameter of all silver halide grains for use in the present invention is preferably 30% or less, more preferably 25% or less, still more preferably 20% or less. The coefficient of variation in the thickness of tabular grains is preferably 30% or less, more preferably 25% or less, still more preferably 20% or less. The coefficient of variation is a value obtained by dividing the standard deviation in the equivalent diameter of individual silver halide grains by the average equivalent diameter or a value obtained by dividing the standard deviation in the thickness distribution of individual silver halide tabular grains by the average thickness.

The distance between twin planes of a tabular grain for use in the present invention may be 0.012 μm or less as described in U.S. Pat. No. 5,219,720 or the distance between (111) main planes/distance between twin planes may be 15 or more as described in JP-A-5-249585. This may be selected according to the purpose.

As the aspect ratio is higher, a more outstanding effect can be obtained. Therefore, in the tabular grain emulsion, 50% or more of the entire projected area is preferably occupied by grains having an aspect ratio of 5 or more, more preferably 8 or more. If the aspect ratio is excessively large, the above-described coefficient of variation in the grain size distribution is liable to become large. Therefore, usually, the aspect ratio is preferably 50 or less.

The dislocation line of a tabular grain can be observed by a direct method using a low-temperature transmission-type electron microscope described, for example, in J. F. Hamilton, *Phot. Sci. Eng.,* 11, 57 (1967) and T. Shiozawa, *J. Soc. Phot. Sci. Jap.,* 35, 213 (1972). More specifically, a silver halide grain is taken out from an emulsion by taking care not to impose a pressure high enough to generate any dislocation line on the grain, the silver halide grain is placed on a mesh for the observation through an electron microscope, and the sample is observed according to the transmission method while keeping the sample in the cooled state so as to prevent damages (for example, print-out) by the electron beam. At this time, as the thickness of the grain is larger, the electron beam is more difficult to transmit, therefore, a high-pressure type (200 kV or more for the thickness of 0.25 μm) electron microscope is preferably used for attaining clearer observation. From the photograph of grains taken by this method, the position and the number of dislocation lines on each grain when viewed from the direction perpendicular to the main plane can be determined.

The number of dislocation lines is preferably 10 or more on average, more preferably 20 or more on average, per one grain. In the case where the dislocation lines observed are densely present or intersected with each other, the number of dislocation lines per one grain may not be exactly counted in some cases. However, even in these cases, an approximate number may be counted like about 10, 20 or 30 lines and the case can be distinguished from the case where only a few dislocation lines are present. The average number of dislocation lines per one grain is determined as a number average by counting the number of dislocation lines on 100 or more grains.

The dislocation lines can be introduced, for example, in the vicinity of the outer circumference of a tabular grain. In this case, the dislocation is nearly perpendicular to the outer circumference and the dislocation lines generated extend from the position at the x % length of the distance between the center of the tabular grain and the side (outer circumference) to reach the outer circumference. This x value is preferably from 10 to less than 100, more preferably from 30 to less than 99, most preferably from 50 to less than 98. In this case, the shape formed by connecting the starting points of dislocation lines is nearly similar to the grain form but not completely a similar figure and may deform in some cases. This type of dislocation line is not observed in the center region of a grain. The dislocation lines crystallo-graphically direct towards the (211) direction but frequently weave or sometimes intersect with each other.

The dislocation lines may be present nearly uniformly throughout the outer circumference of a tabular grain or may be present at a local site on the outer circumference. More specifically, for example, in the case of a hexagonal tabular silver halide grain, the dislocation lines may be limited only to the neighborhood of six apexes or may be limited only to the neighborhood of one apex among them. On the contrary, the dislocation lines may be limited only to the sides exclusive of the neighborhood of six apexes.

Furthermore, the dislocation lines may be formed over the region including the centers of two parallel main planes of a tabular grain. When the dislocation lines are formed over the entire surface of a main plane, these may be crystallo-graphically directed nearly towards the (211) direction upon viewing from the direction perpendicular to the main plane but sometimes directed towards the (110) direction or formed randomly. Also, respective dislocation lines are random in the length and some dislocation may be observed as a short line on the main plane or some dislocation may be observed as a long line reaching the side (outer circumference). The dislocation lines are linear or weaving in many cases. Also, the dislocation lines often intersect with each other.

As described above, the sites of dislocation lines may be limited on the outer circumference, on the main plane or at the local site or the dislocation lines may be formed on these sites together, that is, may be present on the outer circumference and on the main plane at the same time.

The silver iodide content on the grain surface of this tabular grain emulsion is preferably 10 mol % or less, more preferably 5 mol % or less. In the present invention, the silver iodide content on the grain surface is determined by using XPS (X-ray photoelectron spectroscopy). The principle of the XPS method used for the analysis of the silver iodide content in the vicinity of the surface of a silver halide grain is described in Aihara et al., *Denshi no Bunko (Spectra of Electrons)*, Kyoritsu Library 16, Kyoritsu Shuppan (1978). A standard measurement method of XPS is to measure the intensities of photoelectrons (usually I-3d5/2 and Ag-3d5/2) of iodine (I) and silver (Ag) emitted from a silver halide in an appropriate sample form using Mg-Kα ray as the excitation X-ray. The content of iodine can be determined from a calibration curve of the photoelectron intensity ratio (intensity (I)/intensity (Ag)) of iodine (I) to silver (Ag) formed by using several kinds of standard samples having known iodine contents. The XPS measurement for a silver halide emulsion must be performed after gelatin adsorbed to the surface of a silver halide grain is decomposed and removed, for example, by protease. A tabular grain emulsion having a silver iodide content of 10 mol % or less on the grain surface is an emulsion where when emulsion grains contained in one emulsion are analyzed by XPS, the silver iodide content is 10 mol % or less. If obviously two or more kinds of emulsions are mixed, appropriate preprocessing such as centrifugal separation or filtration must be performed for analyzing one kind of emulsion.

The structure of the tabular grain emulsion for use in the present invention is preferably a triple structure comprising, for example, silver bromide/silver iodo-bromide/silver bromide, or a higher order structure. The silver iodide content may form a clear boundary between structures or may be continuously and gently changed. In the measurement of the silver iodide content using a powder X-ray diffraction method, the X-ray diffraction profile usually does not show distinct two crests different in the silver iodide content but show a trained shape extending in the direction toward higher silver iodide content.

The silver iodide content of a layer in the inner side than the surface is preferably higher than the silver iodide content on the surface. The silver iodide content of a layer in the inner side than the surface is preferably 5 mol % or more, more preferably 7 mol % or more.

The second emulsion for use in the present invention is described below, which is a hexagonal silver halide grain where the parallel main planes are (111) face, the ratio of the length of a side having a maximum length to the length of a side having a minimum length is 2 or less and the apex part and/or side face part and/or main plane part of the grain has at least one epitaxial junction per one grain. The epitaxial junction grain is a grain having, in addition to the silver halide grain body, a crystal part (namely, epitaxial part) joined to the grain body. The crystal part joined is usually projected from the silver halide grain body. The ratio of the joined crystal part (epitaxial part) to the entire silver amount of the grain is preferably from 2 to 30%, more preferably from 5 to 15%. The epitaxial part may be present in any portion of the grain body but is preferably present at the grain main surface part, the grain edge part or the grain corner part. The number of epitaxial junction is preferably at least one. The halogen composition of the epitaxial part is preferably AgCl, AgBrCl, AgBrClI, AgBrI, AgI, AgSCN or the like. In the case where an epitaxial part is present, a dislocation line may or may not be present inside the grain.

The method for preparing silver halide grains of the first emulsion and the second emulsion for use in the present invention is described below.

In the present invention, the preparation process comprises (a) a step of forming substrate grains and a step subsequent thereto (step (b)). Fundamentally, the step (b) is preferably performed subsequently to the step (a) but it may be possible to perform only the step (a). The step (b) is (bl) a step of introducing dislocation, (b) a step of introducing dislocation only to the corner part or (b) a step of providing epitaxial junction. At least one of these steps may be performed or a combination of two or more thereof may be performed.

The step (a) of forming substrate grains is described below. The substrate part preferably occupies at least 50% or more, more preferably 60% or more, of the entire silver amount used for the formation of a grain. The average iodide content of the substrate part is preferably from 0 to 30 mol %, more preferably from 0 to 15 mol %, based on the silver amount. If desired, the substrate part may have a core-shell structure. At this time, the core part of the substrate part is preferably from 50 to 70% of the entire silver amount of the substrate part, and the average iodide composition of the core part is preferably from 0 to 30 mol %, more preferably from 0 to 15 mol %. The iodide composition of the shell part is preferably from 0 to 3 mol %.

In a general preparation method of a silver halide emulsion, a silver halide nucleus is formed and then the silver halide grain is grown to obtain a grain having a desired size. Also in the present invention, the silver halide emulsion is prepared in the same manner. For the formation of a tabular grain, at least nucleation, ripening and growth steps are included. These steps are described in detail in U.S. Pat. No. 4,945,037.

1. Nucleation

For the nucleation of a tabular grain, a double jet method of performing the nucleation by adding an aqueous silver salt solution and an aqueous alkali halide solution to a reactor holding an aqueous gelatin solution, or a single jet method of adding an aqueous silver salt solution to a gelatin solution containing an alkali halide is generally used. If desired, a method of adding an aqueous alkali halide solution to a gelatin solution containing silver salt may also be used. Furthermore, if desired, the nucleation of a tabular grain may be performed by the method of adding a gelatin solution, a silver salt solution and an aqueous alkali halide solution to a mixer and immediately transferring the mixture to a reactor described in JP-A-2-44335. Also, the nucleation may be performed by the method of passing an aqueous solution containing an alkali halide and a protective colloid solution through a pipe and adding thereto an aqueous silver salt solution described in U.S. Pat. No. 5,104,786. The nucleation described in U.S. Pat. No. 6,022,681, where the chlorine content is 10 mol % or more based on the silver amount used for the nucleation, may also be used.

The nucleation is preferably performed by the dispersion medium formation using gelatin as the dispersion medium at a pBr of 1 to 4. As for the kind of gelatin, an alkali-treated gelatin, a low molecular weight gelatin (molecular weight: 3,000 to 40,000), an oxidation-treated gelatin described in U.S. Pat. Nos. 4,713,320 and 4,942,120, or an oxidation-treated gelatin having a low molecular weight may be used. In particular, an oxidation-treated gelatin having a low molecular weight is preferred.

The concentration of the dispersion medium is preferably 10 mass % or less, more preferably 1 mass % or less. The temperature at the nucleation is preferably from 5 to 60° C., however, in the case of forming fine tabular grains having an average grain size of 0.5 μm or less, the temperature is preferably from 5 to 48° C.

The pH of the dispersion medium is preferably from 1 to 10, more preferably from 1.5 to 9.

A polyalkylene oxide compound described in U.S. Pat. Nos. 5,147,771, 5,147,772, 5,147,773, 5,171,659, 5,210,013 and 5,252,453 and Japanese Patent 3,089,578 may be added at the nucleation step or subsequent ripening and growth steps.

2. Ripening

In the nucleation of 1, fine grains (particularly, octahedral and singlet twin grains) other than tabular grain are formed. Before entering into the growth process described later, it is necessary to allow grains other than tabular grain to disappear and obtain nuclei having a shape for growing into a tabular grain and having good mono-dispersity. For realizing this, it is well known to perform Ostwald ripening after the nucleation.

Immediately after the nucleation, the pBr is adjusted and then the ripening is performed by elevating the temperature until the ratio of hexagonal tabular grain reaches the maximum. At this time, a gelatin solution may be additionally added. In this case, the concentration of gelatin is preferably 10 mass % or less based on the dispersion medium solution. The gelatin additionally added here is an alkali-treated gelatin, an amino group-modified gelatin described in JP-A-11-143002, such as succinated gelatin and trimellited gelatin where 95% or more of amino group is modified, a imidazole group-modified gelatin described in JP-A-11-143003, or an oxidation-treated gelatin. In particular, succinated gelatin or trimellited gelatin is preferred.

The temperature at the ripening is from 40 to 80° C., preferably from 50 to 80° C., the pBr is from 1.2 to 3.0, and the pH is preferably from 1.5 to 9.

In order to attain swift disappearance of grains other than tabular grain, a silver halide solvent may be added. In this case, the concentration of the silver halide solvent is preferably 0.3 mol/liter or less, more preferably 0.2 mol/liter or less. In the case of use as a direct reversal emulsion, a silver halide solvent used in the neutral or acidic side, such as thioether compound, is preferred rather than $NH_3$ used in the alkaline side.

By performing the ripening as such, only tabular grains almost in 100% are obtained.

After the completion of ripening, when the silver halide solvent is not necessary in the next growth process, the silver halide solvent is removed as follows.

(1) In the case of an alkaline silver halide solvent such as $NH_3$, an acid having a large solubility product with $Ag^+$, such as $HNO_3$, is added to invalidate the solvent.

(2) In the case of a thioether-base silver halide solvent, an oxidizing agent such as $H_2O_2$ is added to invalidate the solvent as described in JP-A-60-136736.

3. Ripening

During the crystal growth subsequent to the ripening process, the pBr is preferably kept at 1.4 to 3.5. In the case where the dispersion medium solution before entering into the growth process is low in the gelatin concentration (1 mass % or less), gelatin may be additionally added. At this time, the gelatin concentration in the dispersion medium solution is preferably adjusted to 1 to 10 mass %. The gelatin used here is an alkali-treated gelatin, a succinated or trimellited gelatin where 95% of amino group is modified, or an oxidation-treated gelatin. In particular, a succinated gelatin and a trimellited gelatin are preferred.

During the growth, the pH is from 2 to 10, preferably from 4 to 8. In the presence of a succinated gelatin or a trimellited gelatin, the pH is preferably from 5 to 8. At the crystal growth time, $Ag^+$ and halide ion are preferably added each at a rate so that the crystal growth rate can be from 20 to 100%, preferably from 30 to 100%, of the crystal critical growth rate. In this case, the addition rates of silver ion and halide ion are increased along the growth of crystals and for this purpose, the addition rates of aqueous solutions of silver salt and halogen salt may be elevated or the concentrations of aqueous solutions may be increased, as described in JP-B-48-36890 and JP-B-52-16364. The addition may be performed by a double jet method of simultaneously adding an aqueous silver salt solution and an aqueous halogen salt solution but a method of simultaneously adding an aqueous silver nitrate solution, an aqueous halogen solution containing bromide and a silver iodide fine grain emulsion described in U.S. Pat. Nos. 4,672,027 and 4,693,964 is preferred. At this time, the growth temperature is preferably 50 to 90° C., more preferably from 60 to 85° C. The AgI fine grain emulsion added may be previously prepared or may be added while continuously preparing the emulsion. The preparation method therefor is described in JP-A-10-43570.

The average grain size of the AgI emulsion added is from 0.005 to 0.1 μm, preferably from 0.007 to 0.08 μm. The iodide composition of the substrate grain can be varied by the amount of the AgI emulsion added.

It is preferred to add silver iodobromide fine grain in place of adding an aqueous silver salt solution and an aqueous halide salt solution. At this time, when the iodide amount of the fine grain is made equal to the iodide amount of the substrate grain, a substrate grain having a desired iodide composition can be obtained. The silver iodobromide grain may be previously prepared but is preferably added while continuously preparing the grain. The grain size of the silver iodobromide fine grain added is from 0.005 to 0.1 μm, preferably from 0.01 to 0.08 μm. The temperature at the growth time is from 50 to 90° C., preferably 60 to 85° C.

The step (b) is described below.

The step (b1) is first described below. The step (b1) comprises a first shell step and a second shell step. On the substrate grain, a first shell is provided. The ratio of the first shell is preferably from 1 to 30% based on the entire silver amount and the average silver iodide content is from 20 to 100 mol %. Preferably, the ratio of the first shell is from 1 to 20% based on the entire silver amount and the average silver iodide content is from 25 to 100 mol %. The growth of the first shell on the substrate grain is fundamentally performed by adding an aqueous silver nitrate solution and an aqueous halogen solution containing iodide and bromide by a double jet method, adding an aqueous silver nitrate solution and an aqueous halogen solution containing iodide by a double jet method, or adding an aqueous halogen solution containing iodide by a single jet method.

Any of these methods may be used or a combination of two or more of these methods may be used. As apparently understood from the average silver iodide content of the first sell, silver iodide may be precipitated in addition to silver iodobromide mixed crystal at the formation of the first shell. However, usually, the silver iodide disappears at the next step of forming a second shell and all are changed into silver iodobromide mixed crystals.

The method for forming the first shell is preferably a method of adding, ripening and dissolving a silver iodobromide or silver iodide fine grain emulsion, more preferably a method of adding a silver iodide fine grain emulsion and then adding an aqueous silver nitrate solution or an aqueous silver nitrate solution and an aqueous halogen solution. In this case, the dissolution of the silver iodide fine grain emulsion is accelerated by the addition of the aqueous silver nitrate solution but the silver amount of the silver iodide fine grain emulsion added is used for the first shell and calculated as a silver iodide content of 100 mol % and the aqueous silver nitrate solution added is calculated as the second shell. The silver iodide fine grain emulsion is preferably added abruptly.

To add the silver iodide fine grain emulsion abruptly means to add the silver iodide fine grain emulsion preferably within 10 minutes, more preferably 7 minutes. This condition may vary depending on the temperature, pBr and pH of the system to which added, the kind and concentration of the protective colloid agent such as gelatin, the presence or absence, kind and concentration of the silver halide solvent, however, the addition time is preferably shorter as described above. At this addition, an aqueous silver salt solution such as silver nitrate is preferably not added in substance. The temperature of the system at the addition is preferably from 40 to 90° C., more preferably from 50 to 80° C.

The silver iodide fine grain emulsion may be sufficient if it is substantially silver iodide and insofar as a mixed crystal can be obtained, the emulsion may contain silver bromide and/or silver chloride. The silver iodide fine grain emulsion is preferably 100% silver iodide. The silver iodide can have a crystal structure of β form, γ form or as described in U.S. Pat. No. 4,672,026, α form or α form analogue. In the present invention, the crystal structure is not particularly limited but a mixture of β form and γ form is preferred, and β form is more preferred. The silver iodide fine grain emulsion may be formed immediately before the addition as described in U.S. Pat. No. 5,004,679 or may be added after passing through an ordinary water washing step. In the present invention, a silver iodide fine grain emulsion passed through an ordinary water washing step is preferably used. The silver iodide fine grain emulsion can be easily formed by the method described in U.S. Pat. No. 4,672,026. A double jet method of adding an aqueous silver salt solution and an aqueous iodide salt solution, where the grain formation is performed by keeping constant the pI value at the grain formation, is preferred. The pI is a logarithm of the reciprocal of the I-ion concentration. The temperature, pI, pH, the kind and concentration of protective colloid agent, and the presence or absence, kind and concentration of the silver halide solvent are not particularly limited, however, in the present invention, the grain size is preferably 0.1 μm, more preferably 0.07 μm. Since the grain is fine grain, the grain shape cannot be perfectly specified but the coefficient of variation in the distribution of grain size is preferably 25% or less and when this coefficient of variation is 20% or less, the effect of the present invention is remarkable. The size and size distribution of the silver iodide fine grain emulsion are determined by placing silver iodide fine grains on a mesh for the observation through an electron microscope and directly observing the grains by the transmission method not by the carbon replica method, because due to small grain size, the observation by the carbon replica method causes a large measurement error.

The grain size is defined as the diameter of a circle having a projected area equal to the grain observed. The grain size distribution is also determined using this equal projected area circle diameter. The silver iodide fine grain most effective in the present invention has a grain size of 0.02 to 0.06 μm and a coefficient of variation in the grain size distribution of 18% or less.

After the grain formation, the silver iodide fine grain emulsion is preferably subjected to ordinary water washing described in U.S. Pat. No. 2,614,929, and adjustment of pH, pI, concentration of a protective colloid agent such as gelatin, and concentration of silver iodide contained. The pH is preferably from 5 to 7. The pI value is preferably set to the pI value where the solubility of silver iodide becomes lowest, or a pI value higher than that value. The protective colloid agent is preferably an ordinary gelatin having an average molecular weight of about 100,000. A low molecular weight gelatin having an average molecular weight of 20,000 or less may also be preferably used. These gelatins different in the molecular weight may be used as a mixture and this is sometimes advantageous. The gelatin amount is preferably from 10 to 100 g, more preferably from 20 to 80 g, per 1 kg of the emulsion. The silver amount in terms of a silver atom is preferably from 10 to 100 g, more preferably from 20 to 80 g, per 1 kg of the emulsion. For the gelatin amount and/or silver amount, a value suitable for the abrupt addition of the silver iodide fine grain emulsion is preferably selected.

Usually, the silver iodide fine grain emulsion is previously dissolved and then added. At the addition, the stirring efficiency of the system must be sufficiently elevated. The rotation number in stirring is preferably set larger than usual. In order to prevent generation of bubbles at the stirring, the addition of a defoaming agent is effective. Specifically, the defoaming agent described in Examples and the like of U.S. Pat. No. 5,275,929 is used.

In a more preferred method for forming the first shell, an iodide ion-releasing agent described in U.S. Pat. No. 5,496,694 is used in place of conventional iodide ion supply method (a method of adding free iodide ion) and while abruptly producing iodide ion, a silver halide phase containing silver iodide can be formed.

The iodide ion-releasing agent releases iodide ion by the reaction with an iodide ion release-controlling agent (base and/or nucleophilic reagent). Preferred examples of the nucleophilic reagent used here include the following chemical species: hydroxide ion, sulfite ion, hydroxylamine, thiosulfate ion, metabisulfite ion, hydroxamic acids, oximes, dihydroxybenzenes, mercaptanes, sulfinate, carboxylate, ammonia, amines, alcohols, ureas, thioureas, phenols, hydrazines, hydrazides, semicarbazides, phosphines and sulfides.

By controlling the concentration and the addition method of base or nucleophilic agent or the temperature of reaction solution, the releasing speed and timing of iodide ion can be controlled. Preferred examples of the base include alkali hydroxide.

The concentration of each of the iodide ion-releasing agent and the iodide ion release-controlling agent used for abruptly producing iodide ion is from $1\times10^{-7}$ to 20 M, more preferably from $1\times10^{-5}$ to 10 M, still more preferably from $1\times10^{-4}$ to 5 M, particularly preferably from $1\times10^{-3}$ to 2M.

If the concentration exceeds 20 M, the iodide ion-releasing agent having a large molecular weight and the amount added of the iodide ion-releasing agent become excessively large for the volume of the grain formation container and this is not preferred.

If the concentration is less than $1\times10^{-7}$ M, the reaction rate of releasing iodide ion decreases and it disadvantageously becomes difficult to abruptly produce iodide ion.

The temperature is preferably from 30 to 80° C., more preferably from 35 to 75° C., still more preferably from 35 to 60° C.

At a high temperature exceeding 80° C., the reaction rate of releasing iodide ion generally increases extremely, whereas at a low temperature of less than 30° C., the reaction rate of releasing iodide ion generally decreases extremely. In either case, the use condition is limited and this is not preferred.

In the case of using a base at the release of iodide ion, the change in the liquid pH may be used. At this time, the pH for controlling the rate and timing of releasing iodide ion is preferably from 2 to 12, more preferably from 3 to 11, still more preferably from 5 to 10 and most preferably, the pH after adjustment is from 7.5 to 10.0. Even under neutral condition at a pH of 7, the hydroxide ion determined by the ion product of water acts as the controlling agent.

A nucleophilic reagent and a base may be used in combination. Also at this time, the pH may be controlled to the above-described range to control the rate and timing of releasing iodide ion.

In the case of releasing iodine atom in the form of iodide ion from the iodide ion-releasing agent, all iodine atoms may be released or a part may remain undecomposed.

On the tabular grain having the substrate grain and the first shell, a second shell is provided. The ratio of the second shell is preferably from 10 to 40 mol % based on the entire silver amount and the average silver iodide content is from 0 to 5 mol %. More preferably, the ratio of the second shell is from 15 to 30 mol % based on the entire silver amount and the average silver iodide content is from 0 to 3 mol %. On the tabular grain having the substrate grain and the first shell, the second shell may be grown toward the direction of increasing or decreasing the aspect ratio of the tabular grain. The growth of the second shell is fundamentally performed by adding an aqueous silver nitrate solution and an aqueous halogen solution containing bromide by a double jet method. Or, after adding an aqueous halogen solution containing bromide, an aqueous silver nitrate solution may be added by a single jet method. The temperature and pH of the system, the kind and concentration of the protective colloid agent such as gelatin, and the presence or absence, kind and concentration of the silver halide solvent can be varied over a wide range. In the present invention, the pBr at the completion of formation of the layer is preferably higher than the pBr at the initiation of formation of the layer. The pBr is preferably 2.9 or less at the initiation of formation of the layer and 1.7 or more at the completion of formation of the layer, more preferably 2.5 or less at the initiation of formation of the layer and 1.9 or more at the completion of formation of the layer, most preferably from 1 to 2.3 at the initiation of formation of the layer and from 2.1 to 4.5 at the completion of formation of the layer.

In the portion of the step (b1), a dislocation is preferably present. The dislocation line is preferably present in the vicinity of edge part of the tabular grain. The vicinity of edge part means the outer circumferential part (edge part) of six sides of a tabular grain and the inner side portion thereof, namely, the portion grown in the step (b1). The number of dislocation lines present in the edge part is preferably 10 or more on average per one grain, more preferably 20 or more on average per one grain. In the case where the dislocation lines observed are densely present or intersected with each other, the number of dislocation lines per one grain may not be exactly counted in some cases. However, even in these cases, an approximate number may be counted like about 10, 20 or 30 lines and the case can be distinguished from the case where only a few dislocation lines are present. The average number of dislocation lines per one grain is determined as a number average by counting the number of dislocation lines on 100 or more grains.

The tabular grain for use in the present invention is preferably uniform in the distribution of dislocation line amount among grains. In the emulsion of the present invention, the silver halide grain containing 10 or more dislocation lines per one grain preferably occupies from 50 to 100% (by number), more preferably from 70 to 100%, still more preferably from 90 to 100%, of all grains.

If the ratio is less than 50%, this is not preferred in view of homogeneity among grains.

In the present invention, for determining the ratio of grains containing a dislocation line and the number of dislocation lines, it is preferred to directly observe the dislocation lines on at least 100 grains, more preferably 200 grains or more, still more preferably 300 grains or more.

The step (b2) is described below.

The first embodiment is a method of dissolving only the vicinity of apex by iodide ion, the second embodiment is a method of simultaneously adding a silver salt solution and an iodide salt solution, the third embodiment is a method of dissolving substantially only the vicinity of apex using a silver halide solvent, and the fourth embodiment is a method of passing through halogen conversion.

The method of dissolving the vicinity of apex by iodide ion, which is the first embodiment, is described below.

When iodide ion is added to the substrate grain, the vicinity of each apex of the substrate grain is dissolved and the grain is rounded. Subsequently, a silver nitrate solution and a bromide solution, or a silver nitrate solution and a mixed solution of a bromide solution and an iodide solution, are added simultaneously, then, the grain further grows and dislocation is introduced into the vicinity of apex. This method is described in JP-A-4-149541 and JP-A-9-189974.

In this embodiment, the total amount of iodide ion added preferably satisfies the following condition for obtaining effective dissolution according to the present invention. Assuming that the value obtained by dividing the total molar number of iodide ion by the total silver amount molar number of the substrate grain and multiplying the resulting value by 100 is I2 (mol %), the (I2-I1) for the silver iodide content I1 (mol %) of the substrate grain is from 0 to 8, more preferably from 0 to 4.

In this embodiment, the concentration of iodide ion added is preferably lower, specifically, the concentration is preferably 0.2 mol/liter or less, more preferably 0.1 mol/liter.

The pAg at the addition of iodide ion is preferably 8.0 or more, more preferably 8.5 or more.

Subsequently to the dissolution of apex part of the substrate grain by the addition of iodide ion to the substrate grain, a silver nitrate solution is added alone or a silver nitrate solution and a bromide solution, or a silver nitrate solution and a mixed solution of a bromide solution and an iodide solution, are added simultaneously, whereby the grain is further grown and dislocation is introduced into the vicinity of apex.

The method of simultaneously adding a silver salt solution and an iodide salt solution, which is the second embodiment, is described blow. By rapidly adding a silver salt solution and an iodide salt solution to the substrate grain, silver iodide or silver halide having a high silver iodide content can be epitaxially produced at the apex part of the grain. At this time, the silver salt solution and the iodide salt solution each is preferably added at a rate of 0.2 to 0.5 minutes, more preferably from 0.5 to 2 minutes. This method is described in detail in JP-A-4-149541.

Subsequently to the dissolution of the apex part of a substrate grain by the addition of iodide ion to the substrate grain, a silver nitrate solution is added alone or a silver nitrate solution and a bromide solution, or a silver nitrate solution and a mixed solution of a bromide solution and an iodide solution are simultaneously added, whereby the grain is further grown and dislocation is introduced in the vicinity of apex.

The method of using a silver halide solvent, which is the third embodiment, is described below. When a silver halide solvent is added to a dispersion medium containing substrate grains and then a silver salt solution and an iodide salt solution are simultaneously added, silver iodide or silver halide having a high silver iodide content is preferentially grown at the apex part of the substrate grain. At this time, it is not necessary to rapidly add the silver salt solution and the iodide salt solution. This method is described in detail in JP-A-4-149541.

Subsequently to the dissolution of the apex part of a substrate grain by the addition of iodide ion to the substrate grain, a silver nitrate solution is added alone or a silver nitrate solution and a bromide solution, or a silver nitrate solution and a mixed solution of a bromide solution and an iodide solution are simultaneously added, whereby the grain is further grown and dislocation is introduced in the vicinity of apex.

The method of passing through halogen conversion, which is the fourth embodiment, is described below. In this method, the epitaxy of silver chloride is formed at the apex part of a substrate grain by adding an epitaxial growth site-supporting agent (hereinafter called "site director") such as a sensitizing dye described, for example, in JP-A-58-108526 or a water-soluble iodide ion to the substrate grain, and then iodide ion is added, whereby the silver chloride is halogen-converted into silver iodide or silver halide having a high silver iodide content. The site director may be a sensitizing dye, a water-soluble thiocyanate ion or a water-soluble iodide ion but is preferably iodide ion. The amount of iodide ion is preferably from 0.0005 to 1 mol %, more preferably from 0.001 to 0.5 mol % based on the substrate grain. When an optimal amount of iodide ion is added and then a silver salt solution and a chloride salt solution are added simultaneously, silver chloride epitaxy can be formed at the apex part of a substrate grain.

The halogen conversion of silver chloride by iodide ion is described below. A silver halide having a high solubility can be converted into a silver halide having a lower solubility by adding a halogen ion capable of forming a silver halide having a lower solubility. This process is called "halogen conversion" and described, for example, in U.S. Pat. No. 4,142,900. The silver chloride epitaxially grown at the apex part of a substrate grain is selectively halogen-converted by iodide ion, whereby a silver iodide phase is formed at the apex part of the substrate grain. This is described in detail in JP-A-4-149541.

Subsequently to the halogen-conversion of silver chloride epitaxially grown at the apex part of a substrate grain into a silver iodide phase by the addition of iodide ion, a silver nitrate solution is added alone or a silver nitrate solution and a bromide solution, or a silver nitrate solution and a mixed solution of a bromide solution and an iodide solution are simultaneously added, whereby the grain is further grown and dislocation is introduced in the vicinity of apex.

In the portion of the step (b2), a dislocation line is preferably present. The dislocation line is preferably present in the vicinity of the corner part of the tabular grain. The vicinity of the corner part means a three-dimensional portion surrounded, when a perpendicular is drawn to each of the sides constituting an apex from the point at the position of x % from the center of a straight line connecting the center of the grain to each apex, by the perpendiculars and sides. The x value is preferably 50 to less than 100, more preferably from 75 to less than 100. The number of dislocation lines present at the edge part is preferably 10 or more on average, more preferably 20 or more on average, per one grain. In the case where the dislocation lines observed are densely present or intersected with each other, the number of dislocation lines per one grain may not be exactly counted in some cases. However, even in these cases, an approximate number may be counted like about 10, 20 or 30 lines and the case can be distinguished from the case where only a few dislocation lines are present. The average number of dislocation lines per one grain is determined as a number average by counting the number of dislocation lines on 100 or more grains.

The tabular grain for use in the present invention is preferably uniform in the distribution of dislocation line amount among grains. In the emulsion of the present invention, the silver halide grain containing 10 or more dislocation lines per one grain preferably occupies from 50 to 100% (by number), more preferably from 70 to 100%, still more preferably from 90 to 100%, of all grains.

If the ratio is less than 50%, this is not preferred in view of homogeneity among grains.

In the present invention, for determining the ratio of grains containing a dislocation line and the number of dislocation lines, it is preferred to directly observe the dislocation lines on at least 100 grains, more preferably 200 grains or more, still more preferably 300 grains or more.

The step (b3) is described below.

As described in U.S. Pat. No. 4,435,501, the epitaxial formation of silver halide on a substrate grain can be attained on a portion, for example, edge or corner of a substrate grain, where the silver salt epitaxy is selected by iodide ion, aminoazaindene or site director such as spectral sensitizing dye, adsorbed to the surface of the substrate grain. In JP-A-8-69069, a silver salt epitaxial phase is formed at a selected site on an ultrathin tabular grain substrate and this epitaxial phase is optimally subjected to chemical sensitization, thereby achieving elevation of sensitivity.

Also in the present invention, it is very preferred to elevate the sensitivity of the substrate grain by using this method. The site director may be an aminoazaindene, a spectral sensitizing dye, an iodide ion or a thiocyanate ion. Any one of these may be selected according to the purpose or two or more may be used in combination. By varying the amount of sensitizing dye, iodide ion or thiocyanate ion added, the site where the silver salt epitaxial phase is formed can be limited to edge or corner of the substrate grain. The amount of iodide ion added is from 0.0005 to 1.0 mol %, preferably from 0.001 to 0.5 mol %, based on the silver amount of substrate grain. The amount of thiocyanate ion is from 0.01 to 0.2 mol %, preferably from 0.02 to 0.1 mol %, based on the silver amount of substrate grain. After the addition of this site director, a silver salt solution and a halogen salt solution are added to form a silver salt epitaxial phase. At this time, the temperature is preferably from 40 to 70° C., more preferably from 45 to 60° C., and the pAg is preferably 7.5 or less, more preferably 6.5 or less. By using a site director, a silver salt epitaxial phase is formed at the corner or edge part of the substrate grain. The thus-obtained emulsion may be subjected to selective chemical sensitization of the epitaxial phase to elevate the sensitivity as described in JP-A-8-69069 but may be further grown by simultaneously adding a silver salt solution and a halogen salt solution subsequently to the silver salt epitaxial formation. The aqueous halogen salt solution added here is preferably a bromide salt solution or a mixed solution of a bromide salt solution and an iodide salt solution. At this time, the temperature is preferably from 40 to 80° C., more preferably from 45 to 70° C., and the pAg is preferably from 5.5 to 9.5, more preferably from 6.0 to 9.0.

The epitaxial formation of the step (b3) is characterized in that a halogen composition different from the substrate grain is fundamentally formed on the outer part of the substrate grain formed in the step (a). The composition of the epitaxial phase is preferably AgCl, AgBrCl, AgBrClI, AgBrI, AgI, AgSCN or the like. The epitaxial layer is more preferably doped by a "dopant (metal complex)" described in JP-A-8-69069. The epitaxial growth site may be at least one part of corner part, edge part and main plane part of the substrate grain or may extend over a plurality of parts. The epitaxial growth site is preferably on the corner part, only the edge part, or the corner and edge parts.

In the portion of the step (b3), a dislocation line may not be present but is preferably present. The dislocation line is preferably present at the junction between the substrate grain and the epitaxial growth part, or in the epitaxial part. The number of dislocation lines present in the junction or epitaxial part is preferably 10 or more on average, more preferably 20 or more on average, per one grain. In the case where the dislocation lines observed are densely present or intersected with each other, the number of dislocation lines per one grain may not be exactly counted in some cases. However, even in these cases, an approximate number may be counted like about 10, 20 or 30 lines and the case can be distinguished from the case where only a few dislocation lines are present. The average number of dislocation lines per one grain is determined as a number average by counting the number of dislocation lines on 100 or more grains.

At the time of forming the epitaxial part, a hexacyano metal complex is preferably doped. Out of hexacyano metal complexes, those containing iron, ruthenium, osmium, cobalt, rhodium, iridium or chromium are preferred. The amount of the metal complex added is preferably $10^{-9}$ to $10^{-2}$ mol, more preferably from $10^{-8}$ to $10^{-4}$ mol, per mol of silver halide. The metal complex can be added by dissolving it in water or an organic solvent. The organic solvent preferably has compatibility with water. Examples of the organic solvent include alcohols, ethers, glycols, ketones, esters and amides.

Particularly, the metal complex is preferably a hexacyano metal complex represented by the following formula (I). The metal complex has an effect of providing a light-sensitive material having high sensitivity and preventing the generation of fogging even when the stock light-sensitive material is stored for a long period of time.

$$[M(CN)_6]^{n-} \quad (I)$$

(wherein M is iron, ruthenium, osmium, cobalt, rhodium, iridium or chromium, and n is 3 or 4).

Specific examples of the hexacyano metal complex include the followings.

(I-1) $[Fe(CN)_6]^{4-}$
(I-2) $[Fe(CN)_6]^{3-}$
(I-3) $[Ru(CN)_6]^{4-}$
(I-4) $[Os(CN)_6]^{4-}$
(I-5) $[Co(CN)_6]^{3-}$
(I-6) $[Rh(CN)_6]^{3-}$
(I-7) $[Ir(CN)_6]^{3-}$
(I-8) $[Cr(CN)_6]^{4-}$

For the counter cation of the hexacyano metal complex, an ion capable of easily mixing with water and suitable for the precipitation operation of silver halide emulsion is preferably used. Examples of the counter ion include alkali metal ion (e.g., sodium ion, potassium ion, rubidium ion, cesium ion, lithium ion), ammonium ion and alkylammonium ion.

The tabular grain for use in the present invention is preferably uniform in the distribution of dislocation line amount among grains. In the emulsion of the present invention, the silver halide grain containing 10 or more dislocation lines per one grain preferably occupies from 50 to 100% (by number), more preferably from 70 to 100%, still more preferably from 90 to 100%, of all grains.

If the ratio is less than 50%, this is not preferred in view of homogeneity among grains.

In the present invention, for determining the ratio of grains containing a dislocation line and the number of dislocation lines, it is preferred to directly observe the dislocation lines on at least 100 grains, more preferably 200 grains or more, still more preferably 300 grains or more.

For the protective colloid used in the preparation of the emulsion of the present invention and for the binder in other hydrophilic colloidal layers, gelatin is advantageously used, however, other hydrophilic colloids may also be used.

Examples thereof include proteins such as gelatin derivatives, graft polymers of gelatin to other polymer, albumin and casein; cellulose derivatives such as hydroxyethyl cellulose, carboxymethyl cellulose and cellulose sulfate; sugar derivatives such as sodium arginate and starch derivative; and various synthetic hydrophilic polymer materials including homopolymers and copolymers such as polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole.

The gelatin may be a lime-treated gelatin, an acid-treated gelatin or an enzyme-treated gelatin described in *Bull. Soc. Photo. Japan*, No. 16, p. 30 (1966). A hydrolysate or enzymolysate of gelatin may also be used.

The gelatin is preferably succinated or trimellited gelatin where 95% or more of amino group is modified, or an oxidation-treated gelatin. A low molecular weight gelatin or a low molecular weight oxidation-treated gelatin may also be preferably used.

Furthermore, a gelatin containing 30% or more, preferably 35% or more, of a component having a molecular weight distribution of 280,000 or more may be used. The lime-treated gelatin comprises, based on the molecular weight, sub-α (low molecular weight), α (molecular weight: about 100,000), β (molecular weight: about 200,000), γ (molecular weight: about 300,000) and a high molecular portion (void, the molecular weight: larger than 300,000). The ratio of respective components, namely, the molecular weight distribution is measured by the internationally established PAGI method. This method and the production process are described in detail in JP-A-11-237704.

The emulsion of the present invention is preferably washed with water for the purpose of desalting and dispersed in a newly prepared protective colloid. The protective colloid used here may be the above-described hydrophilic colloid or gelatin. At this time, a gelatin containing 30% or more, preferably 35% or more of a component having a molecular weight distribution of 280,000 is preferably used.

The temperature at the water washing may be selected according to the purpose but it is preferably selected within the range from 5 to 50° C. The pH at the water washing may also be selected according to the purpose but it is preferably selected within the range from 2 to 10, more preferably from 3 to 8. Furthermore, the pAg at the water washing may also be selected according to the purpose but it is preferably selected between 5 and 10. The water washing method may be selected from a noodle washing method, a dialysis method using a semipermeable membrane, a centrifugal separation method, a coagulation precipitation method and an ion exchange method. In the case of the coagulation precipitation method, a method of using a sulfate, a method of using an organic solvent, a method of using a water-soluble polymer or a method of using a gelatin derivative may be selected.

The tabular silver halide grain having parallel main planes of (100) face and comprising silver iodobromide or silver chloroiodobromide having a silver chloride content of less than 10 mol %, which is the silver halide grain of the third emulsion for use in the present invention, is described below.

In the {100} tabular grain for use in the present invention, the tabular grain having {100} face as the main plane and having an aspect ratio of 2 or more occupies from 50 to 100%, preferably from 70 to 100%, more preferably from 90 to 100%, of the entire projected area. The thickness of the grain is from 0.01 to 0.10 μm, preferably from 0.02 to 0.08 μm, more preferably from 0.03 to 0.07 μm, and the aspect ratio is from 2 to 100, preferably from 3 to 50, more preferably from 5 to 30. The coefficient of variation in the grain thickness (a percentage of (standard deviation of distribution/average grain thickness), hereinafter referred to as "COV.") is 30% or more, preferably 25% or more, more preferably 20% or more. The smaller COV. indicates higher degree of monodispersion.

The equivalent-circle diameter and thickness of a tabular grain are determined from the equivalent-circle diameter and thickness of individual grains on a photograph according to replica method taken by a transmission electron microscope (TEM). In this case, the thickness is calculated from the length of shadow of the replica. In the present invention, the COV. is a value obtained by measuring on at least 600 or more grains.

The composition of the {100} tabular grain for use in the present invention is silver chloroiodobromide or silver iodobromide having a silver chloride content of less than 10 mol %. Other silver salts, such as silver rhodanide, silver sulfide, silver selenide, silver telluride, silver carbonate, silver phosphate and organic acid silver, may be contained as another grain or as a part of the silver halide grain.

An X-ray diffraction method is known as a method of examining the halogen composition in the AgX crystal. The X-ray diffraction method is described in detail in *Kiso Bunseki Kagaku Koza* 24 *"X-Sen Kaisetsu"* (*Basic Analytical Chemistry Course Vol.* 24, *"X-Ray Diffraction"*). In a standard method, a diffraction angle of a (420) face of AgX is obtained by a powder method using Kβ ray of Cu as a radiation source.

From the diffraction angle 2θ obtained, a lattice constant a is determined as follows according to the Bragg's equation:

$$2d \sin \theta = \lambda$$

$$d = a/(h_2+k_2+1_2)_{1/2}$$

wherein 2θ is the diffraction angle of (hkl) face, λ is the wavelength of X-ray, and d is the face-to-face distance of (hkl) faces. The relationship between the halogen composition of a silver halide solid solution and the lattice constant a is already known (described, for example, in T. H. James (compiler), *The Theory of Photographic Process,* 4th ed., Macmillan, N.Y.) and therefore, when the lattice constant is obtained, the halogen composition can be determined.

The halogen composition structure of the {100} tabular grain for use in the present invention may be any structure. Examples thereof include a grain having a (core/shell) duplex structure different in the halogen composition between core and shell, and a grain having a multiplex structure having a core and two or more shells. The core composition is preferably silver bromide but not limited thereto. The shell composition preferably has a higher silver iodide content than the core.

The {100} tabular grain for use in the present invention preferably has an average silver iodide content of 2.3 mol or more and an average surface silver iodide content of 8 mol % or more. The coefficient of variation in the silver iodide content among grains is preferably 20% or less. The surface silver iodide content can be measured by the above-described XPS.

The {00} tabular grain for use in the present invention can be classified into the following 6 groups by the shape: (1) a grain where the main plane has a rectangular parallelogram shape, (2) a grain where out of 4 corners of the rectangular parallelogram, 1 corner or more, preferably from 1 to 4 corners, are non-equivalently dropped, namely, a grain where K1 [(=area of maximally dropped part)/area of minimally dropped part] is from 2 to ∞, (3) a grain where 4 corners are equivalently dropped (a grain where K1 is less than 2), (4) a grain where 5 to 100%, preferably from 20 to 100% of the area of the side surface of the dropped area is {111} face, (5) a grain where out of 4 sides constituting the main plane, at least two sides facing each other are curved to project toward the outer side, and (6) a grain where out of 4 corners of the rectangular parallelogram, 1 corner or more, preferably from 1 to 4 corners, are dropped in the form of a rectangular parallelogram. These can be confirmed by the observation using an electron microscope.

The ratio of {100} face occupying in the crystal habit on the surface of the {100} tabular grain for use in the present invention is 80% or more, preferably 90% or more. This can be statistically estimated using an electron microscopic photograph of grain. In the case where the {100} tabular ratio in the AgX grains in the emulsion is almost 100%, the {100} face ratio can be estimated by the following method. This method is described in *Nippon Kagaku Kai Shi* (*Journal of Japan Chemistry Society*), No. 6, p. 942 (1984). A benzo-thiacyanine dye is adsorbed to a constant amount of {100} tabular grains at 40° C. for 17 hours by varying the amount. From the light absorption at 625 nm, the sum total (S) of surface areas of all grains per the unit emulsion and the sum total (S1) of areas of {100} faces are determined and based on these values, the {100} face ratio is calculated according to the formula: S1/S×100 (%).

The average equivalent-sphere diameter of the {100} tabular grain for use in the present invention is preferably less than 0.35 μm. The grain size can be estimated by measuring the projected area and the thickness according to the replica method.

During the formation of {100} tabular grain for use in the present invention, an electron-capturing zone is preferably introduced by the doping of polyvalent metal ion. The electron-capturing zone means a portion having a polyvalent metal ion content concentration of $1\times10^{-5}$ to $1\times10^{-3}$ mol/mol of local silver and occupying from 5 to 30% of the grain volume. The polyvalent metal ion content concentration is preferably from $5\times10^{-5}$ to $5\times10^{-4}$ mol/mol of local silver.

The polyvalent metal ion content concentration must be uniform. The "uniform" means to introduce the metal ion into grain at a constant amount per the unit silver amount and also introduce the polyvalent metal ion into a reactor for the formation of grains at the same time with silver nitrate used for the grain formation. At this time, a halogen solution may also be added simultaneously. A compound containing the polyvalent metal ion for use in the present invention may be added in the form of an aqueous solution, or a fine grain doped with or adsorbed by a compound which works out to a polyvalent metal ion may be prepared and added.

The electron-capturing zone may be present in any portion inside the grain. The electron-capturing zone may be preset at two or more sites inside the grain.

The tabular grain having parallel main planes of (111) or (100) face, having an aspect ratio of 2 or more and containing at least 80 mol % of silver chloride, which is the silver halide grain of the fourth emulsion for use in the present invention, is described below.

In order to produce a (111) grain having a high silver chloride content, a special design is necessary. The method of producing a high silver chloride tabular grain using ammonia described in U.S. Pat. No. 4,399,215 (Wey), or the method of producing a high silver chloride tabular grain using a thiocyanate described in U.S. Pat. No. 5,061,617 (Maskasky) may be used. In the production of high silver chloride grains shown below, for producing a grain having an outermost surface of (111) face, a method of adding an additive (crystal phase-controlling agent) at the grain formation may be used. This is shown below.

| Patent No. | Crystal Phase Controlling Agent | Inventor |
|---|---|---|
| U.S. Pat. No. 4,400,463 | azaindenes + thioether peptizer | Maskasky |
| U.S. Pat. No. 4,783,398 | 2-4-dithiazolidinone | Mifune et al |
| U.S. Pat. No. 4,713,323 | aminopyrazolopyrimidine | Maskasky |
| U.S. Pat. No. 4,983,508 | bispyridinium salt | Ishiguro et al |
| U.S. Pat. No. 5,185,239 | triaminopyrimidine | Maskasky |
| U.S. Pat. No. 5,178,997 | 7-azaindole-base compound | Maskasky |
| U.S. Pat. No. 5,178,998 | xanthine | Maskasky |
| JP-A-64-70741 | dye | Nishikawa et al |
| JP-A-3-212639 | aminothioether | Ishiguro |
| JP-A-4-283742 | thiourea derivative | Ishiguro |
| JP-A-4-335632 | triazolium salt | Ishiguro |
| JP-A-2-32 | bispyridinium salt | Ishiguro et al |
| Japanese Patent Application 7-146891 | monopyridinium salt | Ohzeki et al |

For the formation of (111) tabular grain, as shown in the Table above, various crystal phase-controlling agents are used but among these, the compounds (Compounds 1 to 42) described in JP-A-2-32 are preferred, and Crystal Phase-Controlling Agents 1 to 29 described in Japanese Patent Application No. 6-333780 are more preferred, however, the present invention is not limited thereto.

The (111) tabular grain is obtained by forming two parallel twin planes. The formation of twin plane is governed by the temperature, dispersion medium (gelatin), halogen concentration and the like and therefore, suitable conditions of these must be selected. In the case of allowing a crystal phase-controlling agent to be present at the nucleation, the gelatin concentration is preferably from 0.1 to 10%, and the chloride concentration is 0.01 mol/liter or more, preferably 0.03 mol/liter or more.

In order to disperse grains in a monodisperse state, as disclosed in JP-A-8-184931, a crystal phase-controlling agent is preferably not used at the nucleation. In the case of not using a crystal phase-controlling agent at the nucleation, the gelatin concentration is from 0.03 to 10%, preferably from 0.05 to 1.0%, and the chloride concentration is from 0.001 to 1 mol/liter, preferably from 0.003 to 0.1 mol/liter. As for the nucleation temperature, a temperature from 2 to 90° C. can be freely selected but the temperature is preferably from 5 to 80° C., more preferably from 5 to 40° C.

Nuclei of tabular grains are formed at the initial nucleation stage but immediately after the nucleation, a large number of nuclei other than tabular grain are contained in the reactor. Therefore, a technique of performing the ripening after the nucleation to allow only tabular grains to remain and other grains to disappear is necessary. When ordinary Ostwald ripening is performed, tabular grain nuclei also dissolve and disappear and due to the decrease of tabular grain nuclei, the size of the obtained tabular grains increases. In order to prevent this, a crystal phase-controlling agent is added. In particular, when a phthalated gelatin is added, the effect of the crystal phase-controlling agent can be elevated and the tabular grains can be prevented from dissolving. The pAg during ripening is particularly important and is preferably from 60 to 130 mV to the silver chloride electrode.

Thereafter, the nuclei formed are subjected to physical ripening and grown by the addition of a silver salt and a halide in the presence of a crystal phase-controlling agent. At this time, the chloride concentration is 5 mol/liter or less, preferably from 0.05 to 1 mol/liter. The temperature at the growth of grains can be selected from the range of 10 to 90° C. but is preferably from 30 to 80° C.

The total amount of the crystal phase-controlling agent used is preferably $6\times10^{-5}$ mol or more, more preferably from $3\times10^{-4}$ to $6\times10^{-2}$ mol, per mol of silver halide, per mol of silver halide in the finished emulsion. The timing of adding the crystal phase-controlling agent may be in any period from the nucleation of silver halide grains to the physical ripening or during grain growth. Upon addition, the formation of {111) face starts. The crystal phase-controlling agent may be previously added to the reactor but in the case of forming small-size tabular grains, the crystal phase-controlling agent is preferably added to the reactor along the growth of grains and increased in the concentration.

In the case of the amount of dispersion medium used at the nucleation is insufficient for the growth, the dispersion medium must be replenished by the addition. For the growth, from 10 to 100 g/liter of gelatin is preferably present. The gelatin replenished is preferably phthalated gelatin or trimellited gelatin.

The pH at the grain formation may be freely selected but is preferably in the region from neutral to acidic.

The (100) tabular grain is described below. The (100) tabular grain is a tabular grain having main planes of (100) face. The main plane has a rectangular parallelogram shape, a triangular, quadrangular or pentagonal shape resulting from the dropping of one corner of the rectangular parallelogram (the dropped portion is in a right-angled triangular shape formed by the corner as an apex and the sides constituting the corner), or a quadrangular, pentagonal, hexagonal, heptagonal or octagonal shape where from 2 to 4 dropped portions are present.

Assuming that the rectangular parallelogram shape with the dropped portion being supplemented is called a supplemented quadrangle, the ratio of adjacent sides (length of long side/length of short side) of the rectangular parallelogram and the supplemented quadrangle is from 1 to 6, preferably from 1 to 4, more preferably from 1 to 2.

The tabular silver halide emulsion grain having (100) main planes is formed by adding an aqueous silver salt solution and an aqueous halide salt solution while stirring to a dispersion medium such as aqueous gelatin solution and mixing these solutions. At this time, a method of allowing silver iodide or iodide ion, or silver bromide or bromide ion to be present to generate distortion in the nucleus due to difference in the size of crystal lattice from silver chloride and thereby introducing a crystal defect of imparting anisotropic growth property such as screw dislocation is described, for example, in JP-A-6-301129, JP-A-6-347929, JP-A-9-34045 and JP-A-9-96881. When the screw dislocation is introduced, the formation of two-dimensional nuclei on this surface is not rate-determination under the low supersaturation condition and therefore, crystallization proceeds on this surface. Thus, by introducing screw dislocation, a tabular grain is formed. The low supersaturation condition as used herein means preferably 35% or less, more preferably from 2 to 20% of the critical addition time. The above-described crystal defect is not decided as screw dislocation but from the direction to which the dislocation is introduced or from the fact that anisotropic growth property is imparted to the grain, it is considered that that crystal defect is highly probably screw dislocation. The holding of this dislocation introduced is preferred for more reducing the thickness of the tabular grain as disclosed in JP-A-8-122954 and JP-A-9-189977.

Also, a method of forming (100) tabular grain by adding a (100) face formation accelerator is disclosed in JP-A-6-347928 (imidazoles or 3,5-diaminotriazoles) and JP-A-8-339044 (polyvinyl alcohols). However, the present invention is not limited thereto.

The high silver chloride grain means a grain having a silver chloride content of 80 mol % or more but the silver chloride content is preferably 95 mol % or more. The grain for use in the present invention preferably has a so-called core/shell structure comprising a core part and a shell part surrounding the core part. Preferably, 90 mol % or more of the core part is silver chloride. The core part may also consist of two or more portions different in the halogen composition. The shell part preferably occupies 50% or less, more preferably 20% or less, of the entire grain volume. The shell part is preferably silver iodochloride or silver iodobromochloride. The shell part preferably contains from 0.5 to 13 mol %, more preferably from 1 to 13 mol %, of iodide. The silver iodide content in the entire grain is preferably 5 mol % or less, more preferably 1 mol % or less. It is preferred that the silver bromide content of the shell part is higher than that of the core part. The silver bromide contents of the core and shell parts each is 20 mol % or less and particularly preferably 5 mol % or less.

The average grain size (diameter of an equivalent-sphere in terms of volume) of silver halide grains is not particularly limited but is preferably from 0.1 to 0.8 μm, more preferably from 0.1 to 0.6 μm.

The equivalent-circle diameter of silver halide tabular grain is preferably from 0.2 to 1.0 μm. The diameter of silver halide grain as used herein means a diameter of a circle having an area equal to the projected area of a grain on an electron microphotograph. The thickness is 0.2 μm or less, preferably 0.1 μm or less, more preferably 0.06 μm or less. In the present invention, 50% or more of the projected area of all silver halide grains containing a yellow dye-forming coupler has an average aspect ratio (diameter/thickness ratio) of 2 or more, preferably from 5 to 20.

In general, the tabular grain is in a tabular form having two parallel faces and accordingly, the "thickness" as used in the present invention is expressed by a distance between two parallel faces constituting the tabular grain.

The distribution of grain size of silver halide grains for use in the present invention may be polydisperse or monodisperse but is preferably monodisperse. In particular, the coefficient of variation in the equivalent-circle diameter of tabular grains occupying 50% or more of the entire projected area is preferably 20% or less, ideally 0%.

If the crystal phase-controlling agent is present on the grain surface after the grain formation, this affects the adsorption of sensitizing dye or development. Therefore, the crystal phase-controlling agent is preferably removed after the grain formation. However, when the crystal phase-controlling agent is removed, the high silver chloride (111) tabular grain cannot maintain the (111) face under ordinary conditions. Accordingly, the grain shape is preferably maintained by displacing the phase-controlling agent with a photographically useful compound such as sensitizing dye. This method is described in JP-A-9-80656, JP-A-9-106026 and U.S. Pat. Nos. 5,221,602, 5,286,452, 5,298,387, 5,298,388 and 5,176,992.

The crystal phase-controlling agent is desorbed from the grain by the above-described method and the desorbed crystal phase-controlling agent is preferably removed outside the emulsion by water washing. The water washing temperature may be a temperature of not causing coagulation of gelatin usually used as a protective colloid. As for the water washing method, various known techniques such as flocculation and ultrafiltration can be used. The water washing temperature is preferably 40° C. or more.

The desorption of the crystal phase-controlling agent is accelerated at a low pH. Accordingly, the-pH at the water washing step is preferably as low as possible insofar as the grains are not excessively agglomerated.

In the silver halide grain, ions of metal belonging to Group VIII of the periodic table, namely, metal selected from osmium, iridium, rhodium, platinum, ruthenium, palladium, cobalt, nickel and iron, and complex ions thereof may be used individually or in combination. Also, a plurality of these metals may be used.

The metal ion-providing compound can be incorporated into the silver halide grain for use in the present invention by adding the compound to an aqueous solution of gelatin as a dispersion medium, an aqueous halide solution, an aqueous silver salt solution or other aqueous solution at the formation of silver halide grains, or by adding a silver halide fine grain having previously incorporated thereinto the metal ion to a silver halide emulsion and dissolving the emulsion. The metal ion can be incorporated into the grain at any step before grain formation, during grain formation or immediately after grain formation. This addition time can be changed according to the site of grain to which the metal ion is added and the amount of the metal ion incorporated.

In the silver halide grain, 50 mol % or more, preferably 80 mol % or more, more preferably 100 mol % of the metal ion-providing compound is preferably localized in the surface layer from the silver halide grain surface to the position corresponding to 50% of the grain volume. The volume of this surface layer is preferably 30% or less. The local presence of metal ion in the surface area is advantageous for preventing the increase of internal sensitivity and obtaining high sensitivity. The metal ion-providing compound can be incorporated concentratedly in the surface layer, for example, by forming a silver halide grain (core) in the portion exclusive of the surface layer and supplying the metal ion-providing compound together with the addition of a water-soluble silver salt solution and an aqueous halide solution for forming the surface layer.

In the silver halide emulsion, various polyvalent metal ion impurities other than the Group VIII metals can be introduced during the emulsion grain formation or physical ripening. The amount of this compound added varies over a wide range according to the purpose but is preferably $10^{-9}$ to $10^{-2}$ mol per mol of silver halide.

The contents relating to the emulsion of the present invention in general are described below.

For performing the reduction sensitization which is preferably used in the present invention, a method of adding a reduction sensitizer to the silver halide, a method called silver ripening where the emulsion is grown or ripened in a low pAg atmosphere at a pAg of 1 to 7, or a method called high pH ripening where the emulsion is grown or ripened in a high pH atmosphere at a pH of 8 to 11 may be selected. Also, two or more of these methods may be used in combination.

The method of adding a reduction sensitizer is preferred because the reduction sensitization level can be delicately controlled.

Examples of the reduction sensitizer include stannous chloride, ascorbic acid and its derivatives, hydroquinone and its derivatives, catechol and its derivatives, hydroxylamine and its derivatives, amines and polyamines, hydrazine and its derivatives, paraphenylenediamine and its derivatives, formamidinesulfinic acid (thiourea dioxide), silane compounds and borane compounds. In the present invention, the reduction sensitization may be performed using a reduction sensitizer selected from these reduction sensitizers, and two or more compounds may also be used in combination. As for the reduction sensitization method, the methods disclosed in U.S. Pat. Nos. 2,518,698, 3,201,254, 3,411,917, 3,779,777 and 3,930,867 may be used, As for the use method of the reducing agent, the methods disclosed in JP-B-57-33572, JP-B-58-1410 and JP-A-57-179835 may be used. Preferred compounds as the reduction sensitizer are catechol and its derivatives, hydroxylamine and its derivatives, and formamidinesulfinic acid (thiourea dioxide). The amount of the reduction sensitizer added depends on the conditions in the production of emulsion and therefore, must be selected but is suitably from $10^{-7}$ to $10^{-1}$ mol per mol of silver halide.

The reduction sensitizer is added during the grain growth after dissolving it in water or a solvent such as alcohols, glycols, ketones, esters and amides.

Examples of the silver halide solvent which can be used in the present invention include (a) organic thioethers described in U.S. Pat. Nos. 3,271,157, 3,531,289 and 3,574,628, JP-A-54-1019 and JP-A-54-158917, (b) thiourea derivatives described in JP-A-53-82408, JP-A-55-77737 and JP-A-55-2982, (c) silver halide solvents having a thiocarbonyl group sandwiched by an oxygen or sulfur atom and a nitrogen atom described in JP-A-53-144319, (d) imidazoles described in JP-A-54-100717, (e) ammonia and (f) thiocyanate.

In particular, the solvent is preferably thiocyanate, ammonia or tetramethylthiourea. The amount of the solvent used varies depending on the kind but, for example, in the case of thiocyanate, the amount used is preferably from $1\times10^{-4}$ to $1\times10^{-2}$ mol per mol of silver halide.

According to the purpose, a salt of metal ion is preferably allowed to be present at the preparation of emulsion, for example, during grain formation, desalting or chemical sensitization, or before coating. The metal ion salt is preferably added during grain formation in the case of doping it into a grain and is preferably added after grain formation but before completion of chemical sensitization in the case of using the metal ion salt for the modification of the grain surface or as a chemical sensitizer. As described above, the metal ion salt may be doped throughout the grain or may be doped only into the core part, only into the shell part or only into the epitaxial part. Examples of the metal which can be used include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. This metal can be added when it is in the form of a salt capable of dissolving at the time of grain formation, such as ammonium salt, acetate, nitrate, sulfate, phosphate, hydroxide, six-coordinated complex salt or four-coordinated complex salt. Examples of the metal ion salt include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, $K_4Ru(CN)_6$. The ligand of the coordination compound can be selected from halo, aquo, cyano, cyanate, thiocyanate, nitrosyl, thionitrosyl, oxo and carbonyl. Only one of these metal compounds may be used but two or more thereof may also be used in combination.

The metal compound is preferably added after dissolving it in water or an appropriate organic solvent such as methanol or acetone. In order to stabilize the solution, a method of adding an aqueous solution of hydrogen halide (e.g., HCl, HBr) or an alkali halide (e.g., KCl, NaCl, KBr, NaBr) may be used. If desired, an acid or an alkali may also be added. The metal compound may be added to the reactor either before or during the grain formation. It is also possible to add the metal compound to an aqueous solution of water-soluble silver salt (e.g., $AgNO_3$) or alkali halide (e.g., NaCl, KBr, KI) and continuously add the solution during the formation of silver halide grains. Furthermore, the solution may be prepared independently of the water-soluble silver salt and the alkali halide and then continuously added in an appropriate timing during the grain formation. A combination of various addition methods is also preferably used.

In some cases, the method of adding a chalcogen compound during the preparation of emulsion described in U.S. Pat. No. 3,772,031 is also useful. A cyanate, a thiocyanate, a selenocyanate, a carbonate, a phosphate or an acetate may also be allowed to be present other than S, Se and Te.

The silver halide grain for use in the present invention may be subjected to at least one of sulfur sensitization, selenium sensitization, gold sensitization, palladium sensitization, noble metal sensitization and reduction sensitization, at any step in the process of preparing the silver halide emulsion. A combination use of two or more sensitization methods is preferred. By varying the step of performing the chemical sensitization, various types of emulsions may be prepared, more specifically, a type where a chemical sensitization speck is embedded inside the grain, a type where a chemical sensitization speck is embedded in the shallow part from the grain surface, and a type where a chemical sensitization speck is formed on the grain surface. In the emulsion for use in the present invention, the site of chemical sensitization speck can be selected according to the purpose, however, in general, at least one kind of chemical sensitization speck is preferably formed in the vicinity of the surface.

The chemical sensitization which can be preferably performed in the present invention is chalcogen sensitization, noble metal sensitization or a combination thereof. As described in T. H. James, *The Theory of the Photographic Process,* 4th ed., Macmillan, pp. 67–76 (1977), the chemical sensitization may be performed using active gelatin. Furthermore, as described in *Research Disclosure*, Vol. 120, 12008 (April, 1974), *Research Disclosure*, Vol. 34, 13452 (June, 1975), U.S. Pat. Nos. 2,642,361, 3,297,446, 3,772,031, 3,857,711, 3,901,714, 4,266,018 and 3,904,415 and British Patent 1,315,755, the chemical sensitization may be performed using sulfur, selenium, tellurium, gold, platinum, palladium, iridium or a combination of two or more of these sensitizing dyes at a pAg of 5 to 10, a pH of 5 to 8 and a temperature of 30 to 80° C. In the noble metal sensitization, a noble metal salt such as gold, platinum, palladium or iridium may be used and particularly, gold sensitization, palladium sensitization and a combination thereof are preferred. In the case of gold sensitization, a known compound such as chloroauric acid, potassium chloroaurate, potassium aurithiocyanate, gold sulfide or gold selenide may be used. The palladium compound means a palladium divalent or tetravalent salt. The palladium compound is preferably represented by $R_2PdX_6$ or $R_2PdX_4$, wherein R represents a hydrogen atom, an alkali metal atom or an ammonium group and X represents a halogen atom such as chlorine, bromine or iodine.

More specifically, $K_2PdCl_4$, $(NH_4)_2PdCl_6$, $Na_2PdCl_4$, $(NH_4)_2PdCl_4$, $Li_2PdCl_4$, $Na_2PdCl_6$ and $K_2PdBr_4$ are preferred. The gold compound and the palladium compound each is preferably used in combination with a thiocyanate or a selenocyanate.

Examples of the sulfur sensitizer which can be used include hypo, thiourea-base compounds, rhodanine-base compounds and sulfur-containing compounds described in U.S. Pat. Nos. 3,857,711, 4,266,018 and 4,054,457. The chemical sensitization may also be performed in the presence of a so-called chemical sensitization aid. Useful chemical sensitization aids are compounds known to suppress fogging in the process of chemical sensitization and at the same time, elevate the sensitivity, such as azaindene, azapyridazine and azapyrimidine. Examples of the chemical sensitization aid modifier are described in U.S. Pat. Nos. 2,131,038, 3,411,914 and 3,554,757, JP-A-58-126526 and Duffin, *Shashin Nyuzai Kagaku* (*Photographic Emulsion Chemistry*), supra, pp. 138–143.

In the chemical sensitization of emulsion for use in the present invention, gold sensitization is preferably used in combination. The amount of the gold sensitizer is preferably from $1\times10^{-7}$ to $1\times10^{-4}$ mol, more preferably from $5\times10^{-7}$ to $1\times10^{-5}$ mol, per mol of silver halide. The amount of the palladium compound is preferably from $5\times10^{-7}$ to $1\times10^{-3}$ mol per mol of silver halide. The amount of the thiocyanate compound or selenocyanate compound is preferably from $1\times10^{-6}$ to $5\times10^{-2}$ mol per mol of silver halide.

The amount of the sulfur sensitizer used for the silver halide grain of the present invention is preferably from $1\times10^{-7}$ to $1\times10^{-4}$, more preferably from $5\times10^{-7}$ to $1\times10^{-5}$ mol, per mol of silver halide.

The preferred sensitization method for the emulsion of the present invention includes selenium sensitization. In the selenium sensitization, a known labile selenium compound is used and specific examples of the selenium compound which can be used include colloidal metal selenium, selenoureas (e.g., N,N-dimethylselenourea, N,N-diethyl-selenourea), selenoketones and selenoamides. In some cases, the selenium sensitization is preferably performed in combination with one or both of sulfur sensitization and noble metal sensitization.

The selenium sensitization is described in detail below. The selenium sensitizer may be a selenium compound disclosed in conventionally known patents. More specifically, the selenium sensitization is usually performed by adding a labile selenium compound and/or a non-labile selenium compound and stirring the emulsion at a high temperature, preferably at 40° C. or more, for a predetermined time period. Preferred examples of the labile selenium compound include the compounds described in JP-B-44-15748, JP-B-43-13489, JP-A-4-25832 and JP-A-4-109240. Specific examples of the labile selenium sensitizer include isoselenocyanates (for example, aliphatic isoselenocyanates such as allyl isoselenocyanate), selenoureas, selenoketones, selenoamides, selenocarboxylic acids (e.g., 2-selenopropionic acid, 2-selenobutyric acid), selenoesters, diacyl selenides (e.g., bis(3-chloro-2,6-dimethoxybenzoyl) selenide), selenophosphates, phosphine selenides and colloidal metal selenium.

Preferred categories of the labile selenium compound are described above but the present invention is not limited thereto. As for the labile selenium compound as a sensitizer for photographic emulsions, it is generally understood by one skilled in the art that the structure of the compound is not particularly important insofar as the selenium is labile and the organic moiety of the selenium sensitizer molecule plays no part other than to carry selenium and allow the selenium in the labile form to be present in emulsion. In the present invention, labile selenium compounds having such a wide concept are advantageously used.

Examples of the non-labile selenium compound which can be used in the present invention include the compounds described in JP-B-46-4553, JP-B-52-34492 and JP-B-52-34491. Specific examples of the non-labile selenium compound include selenious acid, potassium selenocyanate, selenazoles, quaternary salt of selenazoles, diaryl selenide, diaryl diselenide, dialkyl selenide, dialkyl diselenide, 2-selenazolidinedione, 2-selenooxazolidine-thione and derivatives thereof.

Among these selenium compounds, preferred are the compounds represented by formulae (VII) and (VIII) of JP-A-11-15115.

The selenium sensitizer is dissolved in water, a sole organic solvent such as methanol and ethanol, or a mixed solvent thereof, and added at the chemical sensitization, preferably before the initiation of chemical sensitization. Not only one selenium sensitizer but also two or more of the above-described sensitizers in combination may be used. A combination use of a labile selenium compound and a non-labile selenium compound is preferred.

The amount of the selenium sensitizer added varies depending on the activity of selenium sensitizer used, the kind and size of silver halide, and the temperature and time period of ripening, however, the amount added is preferably $1\times10^{-8}$ mol or more, more preferably from $1\times10^{-7}$ to $5\times10^{-5}$ mol, per mol of silver halide of the emulsion. In the case of using a selenium sensitizer, the chemical ripening temperature is preferably 45° C. or more, more preferably from 50 to 80° C. The pAg and pH may be freely selected. For example, with a pH over a wide range from 4 to 9, the effect of the present invention can be obtained.

During the preparation of the emulsion of the present invention, an oxidizing agent for silver is preferably used. The term "oxidizing agent for silver" as used herein means a compound having a function of acting on metal silver to convert it into silver ion. In particular, a compound capable of converting very small silver grains by-produced during the formation and chemical sensitization of silver halide grains into silver ion is useful. The silver ion produced here may form a silver salt difficultly soluble in water, such as silver halide, silver sulfide and silver selenide, or may form a silver salt easily soluble in water, such as silver nitrate. The oxidizing agent for silver may be an inorganic material or an organic material. Examples of the inorganic oxidizing agent include ozone, hydrogen peroxide, adducts thereof (e.g., $NaBO2.H_2O_2.3H_2O$, $2NaCO_3.3H_2O_2$, $Na_4P_2O_7.2H_2O_2$, $2Na_2SO_4.H_2O_2.2H_2O$), peroxy acid salts (e.g., $K_2S_2O_8$, $K_2C_2O_6$, $K_2P_2O_8$), peroxy complex compounds (e.g., $K_2[Ti(O_2)C_2O_4].3H_2O$, $4K_2SO_4.Ti(O_2)OH.SO_4.2H_2O$, $Na_3[VO(O_2)(C_2H_4)_2].6H_2O$), oxygen acid salts such as permanganate (e.g. , $KMnO_4$) and chromate (e.g., $K_2Cr_2O_7$), halogen elements such as iodine and bromine, perhalogenates (e.g., potassium periodate), salts of metal having a high valency (e.g., potassium hexacyanoferrate), and thiosulfonates.

Examples of the organic oxidizing agent include quinones such as p-quinone, organic peroxides such as peracetic acid and perbenzoic acid, and compounds which release active halogen (for example, N-bromosuccinimide, Chloramine T, Chloramine B).

Among these oxidizing agents, preferred in the present invention are inorganic oxidizing agents such as ozone, hydrogen peroxide and an adduct thereof, halogen element and thiosulfonate, and organic oxidizing agents such as quinones. In a preferred embodiment, the above-described reduction sensitization is used in combination with the oxidizing agent for silver. The method may be selected from a method of using the oxidizing agent and then performing the reduction sensitization, a method reversed thereto and a method of allowing both to be present at the same time. The method may be selected and used at the grain formation or the chemical sensitization.

The photographic emulsion for use in the present invention may contain various compounds for the purpose of preventing fogging during the preparation, storage or photographic processing of the light-sensitive material or for stabilizing the photographic properties. More specifically, many compounds known as an antifoggant or a stabilizer may be added and examples thereof include thiazoles (e.g., benzothiazolium salt), nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (particularly 1-phenyl-5-mercaptotetrazole), mercaptopyrimidines, mercaptotriazines, thioketo compounds (e.g., oxazolinethione), and azaindenes (e.g., triazaindenes, tetraazaindenes (particularly 4-hydroxy-substituted (1,3,3a,7) tetraazaindenes), pentaazaindenes). For example, those described in U.S. Pat. Nos. 3,954,474 and 3,982,947, and JP-B-52-28660 may be used. One of preferred compounds is the compound described in JP-A-63-212932. The antifoggant and the stabilizer may be added at various times according to the purpose, such as before, during or after the grain formation, during the water washing, at the dispersion after the water washing, before, during or after the chemical sensitization, and before the coating. These antifoggants and stabilizers each is added during the preparation of the emulsion not only to bring out its inherent antifogging or stabilizing effect but also for various purposes such as control of the crystal habit of grain, reduction of the grain size, decrease in the solubility of the grain, control of the chemical sensitization and control of the dye arrangement.

It is also preferred to perform the sensitization using an organic electron-donating compound comprising an electron-donating group and a splitting-off group described in U.S. Pat. Nos. 5,747,235 and 5,747,236, EP-A-786692, EP-A-893731, EP-A-893732, and WO99/05570.

In the present invention, one or more light-sensitive layer may be provided on a support. Furthermore, the light-sensitive layer may be provided on not only one surface but also both surfaces of the support. The light-sensitive layer of the present invention can be used for black-and-white silver halide photographic light-sensitive materials (e.g., X-ray light-sensitive material, lith-type light-sensitive material, black-and-white negative film for photographing), color photographic light-sensitive materials (e.g., color negative film, color reversal film, color paper), diffusion transfer light-sensitive material (e.g., color diffusion transfer element, silver salt diffusion transfer element) and heat-developable light-sensitive materials (including black-and-white and color).

The color photographic light-sensitive material is described in detail below, however, the present invention is not limited thereto.

The light-sensitive material is sufficient if at least one silver halide emulsion layer of blue-sensitive layer, green-sensitive layer or red-sensitive layer is provided on a support. The number and order of the silver halide emulsion layers and light-insensitive layers are not particularly limited. A typical example thereof is a silver halide photographic light-sensitive material comprising a support having thereon at least one color sensitive layer consisting of a plurality of silver halide emulsion layers having substantially the same color sensitivity but different in the light sensitivity. This light-sensitive layer is a unit light-sensitive layer having color sensitivity to any one of blue light, green light and red light. In the case of a multilayer silver halide color photographic light-sensitive material, the unit light-sensitive layers are generally arranged in the order of a red-sensitive layer, a green-sensitive layer and a blue-sensitive layer from the support side. However, depending upon the purpose, this arrangement order may be reversed or a layer having different light sensitivity may be interposed between layers having the same color sensitivity.

A light-insensitive layer such as interlayer between respective layers may also be provided between the above-described silver halide light-sensitive layers or as an uppermost or lowermost layer.

The interlayer may contain a coupler and a DIR compound described in JP-A-61-43748, JP-A-59-113438, JP-A-59-113440, JP-A-61-20037 and JP-A-61-20038, and may contain a color mixing inhibitor which is commonly used.

The plurality of silver halide emulsion layers constituting each unit light-sensitive layer preferably employ a two-layer structure consisting of a high-speed emulsion layer and a low-speed emulsion layer described in German Patent 1,121,470 and British Patent 923,045. Usually, the layers are preferably arranged such that the light sensitivity sequentially decreases toward the support. Also, a light-insensitive layer may be provided between respective silver halide emulsion layer. It may also be possible to provide a low-speed emulsion layer farther from the support and provide a high-speed emulsion layer closer to the support as described in JP-A-57-112751, JP-A-62-200350, JP-A-62-206541 and JP-A-62-206543.

Specific examples of the layer arrangement from the side remotest from the support include an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL and an order of BH/BL/GH/GL/RL/RH.

As described in JP-B-55-34932, the emulsion layers may be arranged in the order of blue-sensitive layer/GH/RH/GL/RL from the side remotest from the support. Also, as described in JP-A-56-25738 and JP-A-62-63936, the emulsion layers may be arranged in the order of blue-sensitive layer/GL/RL/GH/RH from the side remotest from the support.

In addition, an arrangement consisting of three layers different in the light sensitivity may be used as described in JP-B-49-15495, where a silver halide emulsion layer having highest light sensitivity is provided as an upper layer, a silver halide emulsion layer having light sensitivity lower than that of the upper layer is provided as a medium layer and a silver halide emulsion layer having light sensitivity lower than that of the medium layer is provided as a lower layer so as to sequentially decrease the light sensitivity toward the support. Even in this structure consisting of three layers different in the light sensitivity, the layers having the same color sensitivity may be provided in the order of medium-speed emulsion layer/high-speed emulsion layer/low-speed emulsion layer from the side remote from the support as described in JP-A-59-202464.

In addition, the layers may be provided in the order of high-speed emulsion layer/low-speed emulsion layer/medium-speed emulsion layer or low-speed emulsion layer/medium-speed emulsion layer/high-speed emulsion layer.

The layer arrangement may be changed as described above also in the case of structures consisting of four or more layers.

As described above, various layer structures and arrangements may be selected according to the purpose of respective light-sensitive materials.

In the light-sensitive material of the present invention, various additives described above are used but various additives other than those may also be used according to the purpose.

These additives are more specifically described in *Research Disclosure*, Item 17643 (December, 1978), ibid., Item 18716 (November, 1979) and ibid., Item 308119 (December, 1989). The pertinent portions are shown together in the table below.

| Kinds of Additives | RD17643 | RD18716 | RD308119 |
|---|---|---|---|
| 1. Chemical sensitizer | p. 23 | p. 648, right col. | p. 996 |
| 2. Sensitivity increasing agent | | p. 648, right col. | |
| 3. Spectral sensitizer, supersensitizer | pp. 23–24 | p. 648, right col. to p. 649, right col. | p. 996, right to p. 998, right |
| 4. Brightening agent | p. 24 | p. 647, right col. | p. 998, right |
| 5. Antifoggant, stabilizer | pp. 24–25 | p. 649, right col. | p. 998, right to p. 1000, right |
| 6. Light absorbent, filter dye, UV absorbent | pp. 25–26 | p. 649, right col. to p. 650, left col. | p. 1003, left to right |
| 7. Stain inhibitor | p. 25, right col. | p. 650, left to right cols. | p. 1002, right |
| 8. Dye Image Stabilizer | p. 25 | | p. 1002, right |
| 9. Hardening agent | p. 26 | p. 651, left col. | p. 1004, right to p. 1005, left |
| 10. Binder | p. 26 | p. 651, left col. | p. 1003, right to p. 1004, right |
| 11. Plasticizer, lubricant | p. 27 | p. 650, right col. | p. 1006, left to right |
| 12. Coating aid, surfactant | pp. 26–27 | p. 650, right col. | p. 1005, left to p. 1006, left |
| 13. Antistatic agent | p. 27 | p. 650, right col. | p. 1006, right to p. 1007, left |
| 14. Matting agent | | | p. 1008, left to p. 1009, left |

Furthermore, in order to prevent the deterioration of the photographic performance due to formaldehyde gas, a compound capable of reacting with and thereby fixing the formaldehyde described in U.S. Pat. Nos. 4,411,897 and 4,435,503 is preferably added to the light-sensitive material.

In the present invention, various color couplers can be used. Specific examples thereof are described in the patents cited in supra *Research Disclosure* No. 17643, VII-C to G, and ibid., No. 307105, VII-C to G.

Preferred examples of the yellow coupler include those described in U.S. Pat. Nos. 3,933,501, 4,022,620, 4,326,024, 4,401,752 and 4,248,961, JP-B-58-10739, British Patents 1,425,020 and 1,476,760, and U.S. Pat. Nos. 3,973,968, 4,314,023 and 4,511,649, and EP-A-249473.

As the magenta coupler, 5-pyrazolone compounds and pyrazoloazole compounds are preferred. In particular, preferred are those described in U.S. Pat. Nos. 4,310,619 and 4,351,897, European Patent 73,636, U.S. Pat. Nos. 3,061,432 and 3,725,067, *Research Disclosure*, No. 24220 (June, 1984), JP-A-60-33552, *Research Disclosure*, No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and WO88/04795.

The cyan coupler includes naphthol couplers and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, German Patent (OLS) No. 3,329,729, EP-A-121365, EP-A-249453, U.S. Pat. Nos. 3,446,622, 4,333,999, 4,775,616, 4,451,559, 4,427,767, 4,690,889, 4,254,212 and 4,296,199, and JP-A-61-42658.

Typical examples of the polymerized dye-forming coupler are described in U.S. Pat. Nos. 3,451,820, 4,080,211, 4,367,282, 4,409,320 and 4,576,910, British Patent 2,102,137, and EP-A-341188.

As the coupler which provides a colored dye having an appropriate diffusibility, those described in U.S. Pat. No. 4,366,237, British Patent 2,125,570, European Patent 96,570 and German Patent Application (OLS) No. 3,234,533 are preferred.

As the colored coupler for correcting unnecessary absorption of the colored dye, those described in *Research Disclosure*, No. 17643, Item VII-G, ibid., No. 307105, Item VII-G, U.S. Pat. No. 4,163,670, JP-B-57-39413, U.S. Pat. Nos. 4,004,929 and 4,138,258, and British Patent 1,146,368 are preferred. Also, couplers of correcting unnecessary absorption of the colored dye by a fluorescent dye released upon coupling described in U.S. Pat. No. 4,774,181 and couplers containing as a splitting-off group a dye precursor group capable of reacting with a developing agent to form a dye described in U.S. Pat. No. 4,777,120 may be preferably used.

Compounds which release a photographically useful residue upon coupling can also be preferably used in the present invention. With respect to the DIR coupler which releases a development inhibitor, preferred examples thereof are described in the patents cited in supra RD17643, Item VII-F and ibid., No. 307105, Item VII-F, JP-A-57-151944, JP-A-57-154234, JP-A-60-184248, JP-A-63-37346, JP-A-63-37350, and U.S. Pat. Nos. 4,248,962 and 4,782,012.

With respect to the coupler which imagewise releases a nucleating agent or a developing accelerator at the time of development, those described in British Patents 2,097,140 and 2,131,188, JP-A-59-157638 and JP-A-59-170840 are preferred. Also, compounds which release a fogging agent, a development accelerator, a silver halide solvent or the like by the oxidation-reduction reaction with an oxidation product of a developing agent described in JP-A-60-107029, JP-A-60-252340, JP-A-1-44940 and JP-A-1-45687 are preferred.

Other than these, examples of the compounds which can be used in the light-sensitive material of the present invention include competing couplers described in U.S. Pat. No. 4,130,427, polyequivalent couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in JP-A-60-185950 and JP-A-62-24252, couplers which release a dye capable of retrieving the color after the release described in EP-A-173302 and EP-A-313308, bleach accelerator-releasing couplers described in RD. Nos. 11449 and 24241, and JP-A-61-201247, ligand-releasing couplers described in U.S. Pat. No. 4,555,477, leuco dye-releasing couplers described in JP-A-63-75747, and fluorescent dye-releasing couplers described in U.S. Pat. No. 4,774,181.

The couplers for use in the present invention can be incorporated into the light-sensitive material by various known dispersion methods.

Examples of the high boiling point solvent which is used in the oil-in-water dispersion method are described, for example, in U.S. Pat. No. 2,322,027.

Specific examples of the high boiling point organic solvent having a boiling point of 175° C. or more at atmospheric pressure, which is used in the oil-in-water dispersion method, include phthalic acid esters (e.g., dibutyl phthalate, dicyclohexyl phthalate, di-2-ethylhexyl phthalate, decyl phthalate, bis(2,4-di-tert-amylphenyl) phthalate, bis(2,4-di-tert-amylphenyl) isophthalate, bis(1,1-diethylpropyl) phthalate); phosphoric acid or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate); benzoic acid esters (e.g., 2-ethylhexyl benzoate, dodecyl benzoate, 2-ethylhexyl-p-hydroxy benzoate); amides (e.g., N,N-diethyldodecanamide, N,N-diethyllaurylamide, N-tetradecylpyrrolidone); alcohols or phenols (e.g., isostearyl alcohol, 2,4-di-tert-amylphenol); aliphatic carboxylic acid esters (e.g., bis(2-ethylhexyl)sebacate, dioctyl azerate, glycerol tributylate, isostearyl lactate, trioctyl citrate); aniline derivatives (e.g., N,N-dibutyl-2-butoxy-5-tert-octylaniline); and hydrocarbons (e.g., paraffin, dodecylbenzene, diisopropylnaphthalene). As an auxiliary solvent, for example, an organic solvent having a boiling point of about 30° C. or more, preferably from 50 to about 160° C., may be used. Typical examples thereof include ethyl acetate, butyl acetate, ethyl propionate, methyl ethyl ketone, cyclohexanone, 2-ethoxyethyl acetate and dimethylformamide.

The process and effects of the latex dispersion method and specific examples of the latex for impregnation are described, for example, in U.S. Pat. No. 4,199,363, German Patent Application (OLS) Nos. 2,541,274 and 2,541,230.

The color light-sensitive material of the present invention preferably contains an antiseptic or fungicide of various types and examples thereof include phenethyl alcohol and those described in JP-A-63-257747, JP-A-62-272248 and JP-A-1-80941, such as 1,2-benzoisothiazolin-3-one, n-butyl-p-hydroxybenzoate, phenol, 4-chloro-3,5-dimethylphenol, 2-phenoxyethanol and 2-(4-thiazolyl)-benzimidazole.

The present invention can be applied to various color light-sensitive materials. Representative examples thereof include color negative film for common use or motion picture, color reversal film for slide or television, color paper, color positive film, and color reversal paper. Particularly, the present invention can also be preferably used for color dupe film.

Examples of suitable supports which can be used in the present invention include those described in supra *RD* No. 17643, page 28, ibid., No. 18716, from page 647, right column to page 648, left column, and ibid., No. 307105, page 879.

In the light-sensitive material of the present invention, the total thickness of all hydrophilic colloidal layers on the side having emulsion layers is preferably 28 μm or less, more preferably 23 μm or less, still more preferably 18 μm or less, particularly preferably 16 μm or less. The film swelling rate $T_{1/2}$ is preferably 30 seconds or less, more preferably 20 seconds or less. The "film thickness" as used herein means a film thickness determined under the humidity control (2 days) at a temperature of 25° C. and a relative humidity of 55%. The film swelling rate $T_{1/2}$ can be determined by a method known in this technical field, for example, by means of a swellometer described in A. Green et al., *Photogr. Sci. and Eng.*, Vol. 19, No. 2, pp. 124–129. The film swelling rate $T_{1/2}$ is defined as a time spent until half the saturated film thickness is reached, where the saturated film thickness is 90% of the maximum swollen film thickness reached on the processing with a color developer at 30° C. for 3 minutes and 15 seconds.

The film swelling rate $T_{1/2}$ can be adjusted by adding a film hardening agent to gelatin used as a binder or changing the aging conditions after the coating.

In the light-sensitive material of the present invention, a hydrophilic colloidal layer (hereinafter referred to as a "back layer") having a total dry thickness of 2 to 20 μm is preferably provided on the side opposite the side having emulsion layers. This back layer preferably contains, for example, the above-described light absorbent, filter dye, ultraviolet absorbent, antistatic agent, hardening agent, binder, plasticizer, lubricant, coating aid and surface active agent. The back layer preferably has a percentage swelling of 150 to 500%.

The color photographic light-sensitive material according to the present invention can be developed by an ordinary method described in supra *RD*, No. 17643, pp. 28–29, ibid., No. 18716, page 651, from left to right columns, and ibid., No. 307105, pp. 880–881.

The color developer for use in the development processing of the light-sensitive material of the present invention is preferably an alkaline aqueous solution mainly comprising an aromatic primary amine color developing agent. As the color developing agent, an aminophenol-base compound is useful but a p-phenylenediamine-base compound is preferred and representative examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino- N-ethyl-β-methoxyethylaniline, and sulfates, hydrochlorides and p-toluenesulfonates thereof. Among these, particularly preferred are sulfates of 3-methyl-4-amino-N-ethyl-N-β-hydroxyethylaniline. If desired, these compounds can be used in combination of two or more thereof.

The color developer in general contains, for example, a pH buffering agent such as carbonate, borate or phosphate of an alkali metal, and a development inhibitor or antifoggant such as chloride salt, bromide salt, iodide salt, benzimidazoles, benzothiazoles and mercapto compounds. The color developer may also contain, if desired, a preservative of various types, such as hydroxylamine, diethylhydroxylamine, sulfite, hydrazines (e.g., N,N-biscarboxymethylhydrazine), phenylsemicarbazides, triethanolamine and catecholsulfonic acids; an organic solvent such as ethylene glycol and diethylene glycol; a development accelerator such as benzyl alcohol, polyethylene glycol, quaternary ammonium salts and amines; a dye-forming coupler; a competing coupler; an auxiliary developing agent such as 1-phenyl-3-pyrazolidone; a tackifying agent; and a chelating agent of various types, including aminopolycarboxylic acid, aminopolyphosphonic acid, alkylphosphonic acid and phosphonocarboxylic acid. Representative examples of the chelating agent include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts thereof.

In the case of performing reversal processing, the color development is usually performed after black-and-white development is performed. The black-and-white developer can use, for example, known black-and-white developing agents individually or in combination, such as dihydoxybenzenes (e.g., hydroquinone), 3-pyrazolidones (e.g., 1-phenyl-3-pyrazolidone) and aminophenols (e.g., N-methyl-p-aminophenols). The color developer and the black-and-white developer each usually has a pH of 9 to 12. Although the replenishing amount of these developers varies depending on the color photographic light-sensitive material processed, it is generally 3 liter or less per $m^2$ of the light-sensitive material and when the bromide ion concentration in the replenisher is decreased, the replenishing amount can be reduced even to 500 ml or less. In the case of reducing the replenishing amount, the contact area of the processing solution with air is preferably reduced to prevent evaporation or air oxidation of the solution.

The contact area of the photographic processing solution with air in a processing tank can be shown by an opening ratio defined below.

opening ratio=[contact area ($cm^2$) of processing solution with air)]÷[volume of processing solution ($cm^3$)]

The opening ratio defined above is preferably 0.1 or less, more preferably from 0.001 to 0.05. The opening ratio can be reduced, for example, by a method of providing a shielding material such as floating lid on the surface of the photographic processing solution in the processing tank, a method of using a movable lid described in JP-A-1-82033 or a slit development processing method described in JP-A-63-216050. The opening ratio is preferably reduced not only in two steps of color development and black-and-white development but also in all subsequent steps such as bleaching, bleach-fixing, fixing, water washing and stabilization. Also, the replenishing amount can be reduced by using means for suppressing the accumulation of bromide ion in the developer.

The color development time is usually set to from 2 to 5 minutes, however, further reduction in the processing time can be achieved by setting high temperature and high pH conditions and using a color developing agent in a high concentration.

After color development, the photographic emulsion layer is usually subjected to bleaching. The bleaching may be performed simultaneously with fixing (bleach-fixing) or these may be performed separately. For the purpose of increasing the processing speed, a processing method of performing bleaching and then bleach-fixing may also be used. Furthermore, a method of performing the processing in a bleach-fixing bath consisting of two continued tanks, a method of performing fixing before the bleach-fixing or a method of performing bleaching after the bleach-fixing may be freely selected according to the purpose. Examples of the bleaching agent include compounds of a polyvalent metal such as iron(III), peracids (particularly, sodium persulfate is suitable for cinematic color negative film), quinones and nitro compounds. Representative examples of the bleaching agent include organic complex salts of iron(III), for example, complex salts with an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether diaminetetraacetic acid, and complex salts with citric acid, tartaric acid or malic acid. Among these, aminopolycarboxylic acid ferrate complex salts including ethylenediaminetetraacetato ferrate complex salt and 1,3-diaminopropanetetraacetato ferrate complex salt are preferred in view of rapid processing and prevention of environmental pollution. The aminopolycarboxylic acid ferrate complex salts are particularly useful in both the bleaching solution and the bleach-fixing solution. The bleaching solution or bleach-fixing solution using the aminopolycarboxylic acid ferrate complex salt usually has a pH of from 4.0 to 8 but the processing may be performed at a lower pH for increasing the processing speed.

A bleaching accelerator may be used, if desired, in the bleaching solution, bleach-fixing solution or a prebath thereof. Specific examples of useful bleaching accelerators include compounds described in the following specifications: for example, compounds having a mercapto group or a disulfide group described in U.S. Pat. No. 3,893,858, German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-18426 and *Research Disclosure*, No. 17129 (July, 1978); thiazolidine derivatives described in JP-A-51-140129; thiourea derivatives described in JP-B-45-8506, JP-A-52-20832, JP-A-53-32735 and U.S. Pat. No. 3,706,561; iodide salts described in German Patent 1,127,715 and JP-A-58-16235; polyoxyethylene compounds described in German Patent Nos. 966,410 and 2,748,430; polyamine compounds described in JP-B-45-8836; compounds described in JP-A-49-40943, JP-A-49-59644, JP-A-53-94927, JP-A-54-35727, JP-A-55-26506 and JP-A-58-163940; and bromide ion. Among these, compounds having a mercapto group or a disulfide group are preferred in view of their large acceleration effect and in particular, the compounds described in U.S. Pat. No. 3,893,858, German Patent No. 1,290,812 and JP-A-53-95630 are preferred. Also, the compounds described in U.S. Pat. No. 4,552,884 are preferred. The bleaching accelerator may also be incorporated into the light-sensitive material. The bleaching accelerator is particularly effective in bleach-fixing a color light-sensitive material for photographing.

In addition to the above-described compounds, the bleaching solution or bleach-fixing solution preferably contains an organic acid in order to prevent bleaching stains. A particularly preferred organic acid is a compound having an acid dissociation constant (pKa) of 2 to 5 and specific examples thereof include acetic acid, propionic acid and hydroxyacetic acid.

Examples of the fixing agent for use in the fixing solution or bleach-fixing solution include thiosulfates, thiocyanates, thioether-base compounds, thioureas and a large quantity of iodide salt. Among these, a thiosulfate is commonly used and in particular, ammonium thiosulfate can be most widely used. A combination use of a thiosulfate for example, with a thiocyanate, a thioetherbase compound or a thiourea is also preferred. As the preservative of the fixing solution or bleach-fixing solution, sulfites, bisulfites and carbonyl bisulfite adducts are preferred and also, sulfinic acid compounds described in EP-A-294769 are preferred. Furthermore, the fixing solution or bleach-fixing solution preferably contains an aminopolycarboxylic acid or organic phosphonic acid of various types for the purpose of stabilizing the solution.

In the present invention, the fixing solution or bleach-fixing solution preferably contains a compound having a pKa of from 6.0 to 9.0 so as to adjust the pH, more preferably an imidazole such as imidazole, 1-methylimidazole, 1-ethylimidazole and 2-methylimidazole, in an amount of from 0.1 to 10 mol/liter.

The total desilvering time is preferably as short as possible within the range of not causing desilvering failure. The time period is preferably from 1 to 3 minutes, more preferably from 1 to 2 minutes. The processing temperature is from 25 to 50° C., preferably from 35 to 45° C. In this preferred temperature range, the desilvering rate is improved and staining after the processing can be effectively prevented.

In the desilvering step, the stirring is preferably intensified as much as possible. Specific examples of the method for intensifying the stirring include a method of colliding a jet stream of a processing solution against the emulsion surface of the light-sensitive material described in JP-A-62-183460, a method of increasing the stirring effect using rotary means described in JP-A-62-183461, a method of increasing the stirring effect by moving the light-sensitive material while contacting the emulsion surface with a wire blade disposed in the solution to cause turbulence on the emulsion surface, and a method of increasing the circulation flow rate of the processing solution as a whole. Such means for intensifying the stirring is effective in all of bleaching solution, bleach-fixing solution and fixing solution. The intensification of stirring is considered to increase the supply rate of the bleaching agent or fixing agent into the emulsion layer and, as a result, elevate the desilvering rate. The above-described means for intensifying the stirring is more effective when a bleaching accelerator is used and in this case, the acceleration effect can be remarkably increased or the fixing inhibitory action can be eliminated by the bleaching accelerator.

The automatic developing machine used for developing the light-sensitive material of the present invention preferably has means for transporting a light-sensitive material described in JP-A-60-191257, JP-A-60-191258 and JP-A-60-191259. As described in JP-A-60-191257 above, such transportation means can extremely reduce the amount of a processing solution carried over from a previous bath to a post bath and provides a great effect of preventing the processing solution from deterioration in the capability. This effect is particularly effective for reducing the processing time or decreasing the replenishing amount of a processing solution in each step.

The silver halide color photographic light-sensitive material of the present invention is generally subjected to water washing and/or stabilization after desilvering. The amount of washing water in the water washing step can be set over a wide range according to the properties (for example, attributable to a material used such as coupler) or use of the light-sensitive material and additionally according to the temperature of washing water, the number of water washing tanks (stage number), the replenishing system such as countercurrent or co-current system, or other various conditions. Among these, the relationship between the number of water washing tanks and the amount of water in a multi-stage countercurrent system can be determined according to the method described in *Journal of the Society of Motion Picture and Television Engineers*, Vol. 64, pp. 248–253 (May, 1955).

According to the multi-stage countercurrent system described in the above-described publication, the amount of washing water may be greatly reduced but due to the increase in the residence time of water in the tank, a problem arises such that bacteria proliferate and the floats generated adhere to the light-sensitive material. In the processing of the color light-sensitive material of the present invention, a method of reducing calcium ion and magnesium ion described in JP-A-62-288838 can be very effectively used for solving such a problem. Furthermore, isothiazolone compounds and thiabendazoles described in JP-A-57-8542, chlorine-base bactericides such as chlorinated sodium isocyanurate, and bactericides such as benzotriazole described in Hiroshi Horiguchi, *Bokin, Bobai-Zai no Kagaku* (*Chemistry of Bactericides and Fungicides*), Sankyo Shuppan (1986), *Biseibutsu no Mekkin, Sakkin, Bobai-Gijutsu* (*Sterilizing, Disinfecting and Fungicidal Technology for Microorganisms*), compiled by Eisei Gijutsu Kai, issued by Kogyo Gijutsu Kai (1982), and *Bokin-Bobai Zai Jiten* (*Handbook of Bactericides and Fungicides*), compiled by Nippon Bokin Bobai Gakkai (1986), can be also used.

The washing water in the processing of the light-sensitive material of the present invention has a pH of from 4 to 9, preferably from 5 to 8. The washing water temperature and the water washing time may be variously set, for example, according to the properties and use of the light-sensitive material but the temperature and the processing time are generally from 15 to 45° C. and from 20 seconds to 10 minutes, preferably from 25 to 40° C. and from 30 seconds to 5 minutes, respectively. The light-sensitive material of the present invention can also be processed directly with a stabilizing solution in place of the above-described water washing. In such a stabilization processing, any known method described in JP-A-57-8543, JP-A-58-14834 and JP-A-60-220345 can be used.

In some cases, the stabilization processing may be further performed following the above-described water washing. An example thereof is a stabilization bath containing a dye stabilizer and a surfactant, which is used as a final bath in the processing of a color light-sensitive material for photographing. Examples of the dye stabilizer include aldehydes such as formalin and glutaraldehyde, N-methylol compounds, and hexamethylene-tetramine- or aldehyde sulfite-addition products. This stabilization bath may also contain various chelating agents and fungicides.

The overflow solution accompanying the replenishing of washing water and/or stabilizing solution can be re-used in other processing steps such as desilvering step.

In the processing using, for example, an automatic developing machine, if each processing solution is concentrated due to evaporation, water is preferably added to correct the concentration.

In the silver halide color photographic light-sensitive material of the present invention, a color developing agent may be incorporated so as to simplify the processing and increase the processing rate. In order to incorporate the color developing agent, various precursors of the color developing agent are preferably used. Examples thereof include indoaniline compounds described in U.S. Pat. No. 3,342,597, Schiff base-type compounds described in U.S. Pat. No. 3,342,599, *Research Disclosure*, No. 14850 and ibid., No. 15159, aldol compounds described in ibid., No. 13924, metal salt complexes described in U.S. Pat. No. 3,719,492 and urethane-base compounds described in JP-A-53-135628.

In the silver halide color light-sensitive material of the present invention, if desired, 1-phenyl-3-pyrazolidone of various types may be incorporated for the purpose of accelerating the color development. Typical examples of the compound are described in JP-A-56-64339, JP-A-57-144547 and JP-A-58-115438.

In the present invention, each processing solution is used at a temperature of 10 to 50° C. The standard temperature is usually from 33 to 38° C. but higher temperatures may be used to accelerate the processing and thereby shorten the processing time, or on the contrary, lower temperatures may be used to achieve improved image quality or improved stability of the processing solution.

The silver halide light-sensitive material of the present invention can also be applied to heat-developable light-sensitive materials described in U.S. Pat. No. 4,500,626, JP-A-60-133449, JP-A-59-218443, JP-A-61-238056 and EP-A-210660.

Furthermore, the silver halide color photographic light-sensitive material of the present invention can be effectively applied to a film unit with a lens described in JP-B-2-32615 and JP-B-U-3-39784 (the term "JP-B-U" as used herein means an "examined Japanese utility model publication") and if the case is so, the effect is more readily brought out.

EXAMPLE

The present invention is described in greater detail below by referring to the Examples, however, the present invention should not be construed as being limited thereto.

Example 1

Emulsion Em-A was prepared by the following production process.

(Em-A) (Emulsion for High-Speed Blue-Sensitive Layer)

42.2 Liter of an aqueous solution containing 31.7 g of KBr and 31.7 g of low molecular weight gelatin having a molecular weight of 15,000 and phthalated to a phthalation ratio of 97% was vigorously stirred while keeping it at 35° C. Thereto, 1,583 ml of an aqueous containing 316.7 g of $AgNO_3$ and 1,583 ml of an aqueous solution containing 221.5 g of KBr and 52.7 g of low molecular weight gelatin having a molecular weight of 15,000 were added by a double jet method over 1 minute. Immediately after the completion of addition, 52.8 g of KBr was added and then 2,485 ml of an aqueous solution containing 398.2 g of $AgNO_3$ and 2,581 ml of an aqueous solution containing 291.1 g of KBr were added by a double jet method over 2 minutes. Immediately after the completion of addition, 47.8 g of KBr was added. Thereafter, the temperature was elevated to 40° C. and the emulsion was thoroughly ripened. After the completion of ripening, 79.2 g of KBr and 923 g of gelatin having a molecular weight of 100,000 and phthalated to a phthalation ratio of 97% were added and then 15,947 ml of an aqueous solution containing 5,103 g of $AgNO_3$ and an aqueous KBr solution were added by a double jet method over 12 minutes while accelerating the flow rate such that the final flow rate became 1.4 times the initial flow rate. At this time, the silver potential was kept at −60 mV to the saturated calomel electrode. After washing with water, gelatin was added and then, the emulsion was adjusted to a pH of 5.7, a pAg of 8.8, a mass of 131.8 g as silver per kg of emulsion and a mass of gelatin of 64.1 g to prepare a seed emulsion. Separately, 1,211 ml of an aqueous solution containing 1.7 g of KBr and 46 g of phthalated gelatin to a phthalation ratio of 97% was vigorously stirred while keeping it at 75° C. Thereto, 9.9 g of the seed emulsion prepared above was added and then 0.3 g of modified silicone oil (L7602, a product of Nippon Unicar) was added. After adjusting the pH to 5.5 by adding $H_2SO_4$, 67.6 ml of an aqueous solution containing 7.0 g of $AgNO_3$ and an aqueous KBr solution were added by a double jet method over 6 minutes while accelerating the flow rate such that the final flow rate became 5.1 times the initial flow rate. At this time, the silver potential was kept at −20 mV to the saturated calomel electrode. After adding 2 mg of sodium benzenethiosulfonate and 2 mg of thiourea dioxide, 410 ml of an aqueous solution containing 144.5 g of $AgNO_3$ and a KBr and KI mixed solution containing 7 mol % of KI were added by a double jet method over 56 minutes while accelerating the flow rate such that the final flow rate became 3.7 times the initial flow rate. At this time, the silver potential was kept at −30 mV to the saturated calomel electrode. Thereafter, 121.3 ml of an aqueous solution containing 45.6 g of $AgNO_3$ and an aqueous KBr solution were added over 22 minutes by a double jet method. At this time, the silver potential was kept at +20 mV to the saturated calomel electrode. The temperature was elevated to 82° C., KBr was added to adjust the silver potential to −80 mV, and then an AgI fine grain emulsion having a grain size of 0.037 μm was added in an amount of 6.33 g in terms of the mass of KI. Immediately after the completion of addition, 206.2 ml of an aqueous solution containing 66.4 g of $AgNO_3$ was added over 16 minutes. For 5 minutes at the initiation of addition, the silver potential was kept at −80 mV by an aqueous KBr solution. After water washing, gelatin containing 30% of a component having a molecular weight of 280,000 or more measured by PAGI method was added and the pH and the pAg were adjusted to 5.8 and 8.7, respectively, at 40° C. Subsequently, Compounds 11 and 12 were added, the temperature was elevated to 60° C., a sensitizing dye shown in Tale 2 was added, and then, potassium thiocyanate, chloroauric acid, sodium thiosulfate, N,N-dimethylselenourea and calcium nitrate were added to optimally perform the chemical sensitization. At the completion of chemical sensitization, Compounds 13 and 14 were added. The term "optimally perform the chemical sensitization" as used herein means that the amounts of sensitizing dye and compounds each was selected from the range of $10^{-1}$ to $10^{-8}$ mol per mol of silver halide.

Compound 11

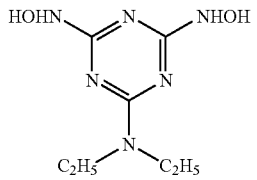

Compound 12

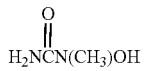

Compound 13

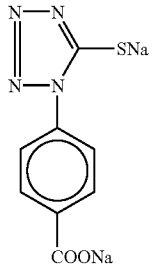

Compound 14

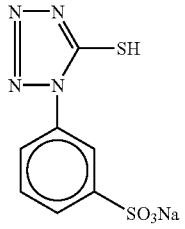

The obtained grains were observed through a transmission electron microscope while cooling with liquid nitrogen, as a result, 10 or more dislocation lines were observed per one grain in the periphery of grain.

In the present invention, Silver Halide Emulsions Em-A to Em-P having the properties shown in Table 1 were used.

TABLE 1

| Emulsion No. | Equivalent-Sphere Diameter, μm | Projected Area Diameter, μm | Aspect Ratio | Iodide Content, mol % |
|---|---|---|---|---|
| Em-A | 1.7 | 3.15 | 9.5 | 6.1 |
| Em-B | 1.0 | 2.0 | 12.2 | 10.0 |
| Em-C | 0.7 | — | 1 | 4.0 |
| Em-D | 0.4 | 0.53 | 3.5 | 4.1 |
| Em-E | 1.1 | 2.63 | 20.6 | 6.7 |
| Em-F | 1.2 | 2.74 | 18 | 6.9 |
| Em-G | 0.9 | 1.98 | 15.9 | 6.1 |
| Em-H | 0.7 | 1.22 | 8 | 6.0 |
| Em-I | 0.4 | 0.63 | 6 | 6.0 |
| Em-J | 1.3 | 3.18 | 22 | 3.5 |
| Em-K | 1.0 | 2.37 | 20 | 4.0 |
| Em-L | 0.8 | 1.86 | 19 | 3.6 |
| Em-M | 0.6 | 1.09 | 8.9 | 2.9 |
| Em-N | 0.4 | 0.63 | 6 | 2.0 |
| Em-O | 0.3 | 0.38 | 3 | 1.0 |
| Em-P | 1.3 | 3.18 | 22 | 3.5 |

The formulation for the preparation of the emulsified product of the present invention is roughly described below.

To a 10% gelatin solution, a solution obtained by dissolving coupler in ethyl acetate, a high-boiling point organic solvent and a surfactant were added and mixed. The obtained mixture was emulsified using a homogenizer (manufactured by Nippon Seiki) to obtain an emulsified product.

1) Support

The support used in this Example was prepared by the following method.

100 Parts by weight of polyethylene-2,6-naphthalate polymer and 2 parts by weight of Tinuvin P.326 (produced by Geigy) as an ultraviolet absorbent were dried, melted at 300° C., extruded from a T-die, stretched longitudinally to 3.3 times at 140° C., then stretched transversely to 3.3 times at 130° C., and heat fixed at 250° C. for 6 seconds to obtain a PEN (polyethylene naphthalate) film having a thickness of 90 μm. To this PEN film, a blue dye, a magenta dye and a yellow dye (I-1, I-4, I-6, I-24, I-26, I-27 and II-5 described in *JIII Journal of Technical Disclosure*, No. 94-6023) were added each in an appropriate amount. Furthermore, the film was wound around a stainless-made core having a diameter of 20 cm and imparted with heat history of 110° C. for 48 hours to obtain a support difficult of curling habit.

2) Coating of Undercoat Layer

Both surfaces of the support obtained above were subjected to corona discharge treatment, UV discharge treatment and glow discharge treatment. Then, an undercoat solution comprising 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$ and 0.02 g/m$^2$ of a polyamide-epichlorohydrin polycondensate was coated (10 ml/m$^2$, using a bar coater) on each surface to provide an undercoat layer in the side of high temperature at the stretching. The drying was performed at 115° C. for 6 minutes (rollers and conveyance device in the drying zone all were heated at 115° C.)

3) Coating of Back Layer

On one surface of the undercoated support, an antistatic layer, a magnetic recording layer and a slipping layer (i.e., sliding layer) each having the following composition were provided as the back layer.

3-1) Coating of Antistatic Layer 0.2 g/m$^2$ of a fine particle powder dispersion having a resistivity of 5 Ω·cm of tin oxide-antimony oxide composite having an average particle size of 0.005 μm (secondary aggregate particle size: about 0.08 μm) was coated together with 0.05 g/m$^2$ of gelatin, 0.02 g/m$^2$ of $(CH_2{=}CHSO_2CH_2CH_2NHCO)_2CH_2$, 0.005 g/m$^2$ of poly (polymerization degree: 10)oxyethylene-p-nonylphenol and resorcin.

3-2) Coating of Magnetic Recording Layer 0.06 g/m$^2$ of cobalt-γ-iron oxide (specific surface area: 43 m$^2$/g, long axis: 0.14 μm, short axis: 0.03 μm, saturation magnetization: 89 A·m$^2$/Kg (emu/g), $Fe^{2+}/Fe^{3+}$=6/94, the surface was treated with aluminum oxide and silicon oxide to 2 mass % (i.e., weight %) based on iron oxide) subjected to covering treatment with 3-poly(polymerization degree: 15)oxyethylene-propyloxytrimethoxysilane (15 mass %) was coated by a bar coater together with 1.2 g/m$^2$ of diacetyl cellulose (iron oxide was dispersed by an open kneader and a sand mill) and as a hardening agent, 0.3 g/m$^2$ of $C_2H_5C(CH_2OCONH{-}C_6H_3(CH_3)NCO)_3$ using acetone, methyl ethyl ketone and cyclohexanone as solvents to obtain a magnetic recording layer having a layer thickness of 1.2 μm. Silica particle (0.3 μm) as a matting agent and aluminum oxide (0.15 μm) as an abrasive subjected to covering treatment with 3-poly(polymerization degree: 15)oxyethylenepropyloxytrimethoxysilane(15 mass %) were added each to 10 mg/m$^2$. The drying was performed at 115° C. for 6 minutes (rollers and conveyance device in the drying zone all were heated at 115° C.). The increase in the color density of the magnetic recording layer DB by X-light (blue filter) was about 0.1, the saturation magnetization moment of the magnetic recording layer was 4.2 emu/m$^2$, the coercive force was 7.3×10$^4$ A/m and the squareness ratio was 65%.

3-3) Preparation of Slipping Layer

Diacetyl cellulose (25 mg/m$^2$) and a mixture of $C_6H_{13}CH(OH)C_{10}H_{20}COOC_{40}H_{81}$ (Compound a, 6 mg/M$^2$)/$C_{50}H_{101}O(CH_2CH_2O)_{16}H$ (Compound b, 9 mg/m$^2$) were coated. The mixture was prepared by melting the compounds in xylene/propylene monomethyl ether (1/1) at 105° C. and pouring and dispersing the melt in propylene monomethyl ether (10-fold amount) at normal temperature. The resulting mixture was formed into a dispersion (average particle size: 0.01 μm) in acetone and then added. Silica particle (0.3 μm) as a matting agent and alumina oxide (0.15 μm) covered with 3-poly(polymerization degree: 15)oxyethylenepropyloxytrimethoxysilane (15 mass %) as an abrasive were added each to 15 mg/m$^2$. The drying was performed at 115° C. for 6 minutes (rollers and the conveyance device in the drying zone all were heated at 115° C.). The slipping layer had excellent capabilities such that the coefficient of dynamic friction was 0.06 (stainless steel ball: 5 mmϕ; load: 100 g; speed: 6 cm/min), the coefficient of static friction was 0.07 (by clip method) and the coefficient of dynamic friction between the emulsion surface and the slipping layer, which will be described later, was 0.12.

4) Coating of Light-Sensitive Layer

The layers each having the following composition were coated to overlay one on another in the side opposite to the back layer provided above to prepare a color negative light-sensitive material sample. Samples 101 to 112 were prepared using emulsions, sensitizing dyes and the like shown in Tables 1 and 2.

(Composition of Light-Sensitive Layer)

The main materials used in each layer are classified as follows.

ExC: cyan coupler

ExM: magenta coupler

ExY: yellow coupler

UV: ultraviolet absorbent

HBS: high-boiling point organic solvent

H: gelatin hardening agent (Specific compounds are noted by the numeral affixed to the symbol and chemical formulae are shown later.)

Numerals corresponding to respective components each shows a coated amount expressed by the unit of g/m$^2$. In the case of silver halide, the coated amount is shown in terms of silver.

| | | |
|---|---|---|
| First Layer (First Antihalation Layer) | | |
| Black Colloidal Silver | as silver | 0.155 |
| Surface fogging AgBrI (2) of 0.07 μm | as silver | 0.01 |
| Gelatin | | 0.87 |
| ExC-1 | | 0.002 |
| ExC-3 | | 0.002 |
| Cpd-2 | | 0.001 |

-continued

| | | |
|---|---|---|
| HBS-1 | | 0.004 |
| HBS-2 | | 0.002 |
| Second Layer (Second Antihalation Layer) | | |
| Black Colloidal Silver | as silver | 0.066 |
| Gelatin | | 0.407 |
| ExM-1 | | 0.050 |
| ExF-1 | | 2.0 × 10$^{-3}$ |
| HBS-1 | | 0.074 |
| Solid Disperse Dye ExF-2 | | 0.015 |
| Solid Disperse Dye ExF-3 | | 0.020 |
| Third Layer (Interlayer) | | |
| AgBrI (2) of 0.07 μm | as silver | 0.020 |
| ExC-2 | | 0.022 |
| Polyethyl acrylate latex | | 0.085 |
| Gelatin | | 0.294 |
| Fourth Layer (Low-speed Red-Sensitive Emulsion Layer) | | |
| Silver Iodobromide Emulsion M | as silver | 0.065 |
| Silver Iodobromide Emulsion N | as silver | 0.100 |
| Silver Iodobromide Emulsion O | as silver | 0.158 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| Fifth Layer (Medium-speed Red-Sensitive Emulsion Layer) | | |
| Silver Iodobromide Emulsion K | as silver | 0.21 |
| Silver Iodobromide Emulsion L | as silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| Sixth Layer (High-speed Red-Sensitive Emulsion Layer) | | |
| Silver Iodobromide Emulsion P | as silver | 1.67 |
| ExC-1 | | 0.18 |
| ExC-3 | | 0.07 |
| ExC-6 | | 0.047 |
| Cpd-2 | | 0.046 |
| Cpd-4 | | 0.077 |
| HBS-1 | | 0.25 |
| HBS-2 | | 0.12 |
| Gelatin | | 2.12 |
| Seventh Layer (Interlayer) | | |
| Cpd-1 | | 0.089 |
| Solid Disperse Dye ExF-4 | | 0.030 |
| HBS-1 | | 0.050 |
| Polyethyl acrylate latex | | 0.83 |
| Gelatin | | 0.84 |
| Eighth Layer (Layer for Imparting Interlayer Effect to Red-Sensitive Layer): | | |
| Silver Iodobromide Emulsion E | as silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |

-continued

| | | |
|---|---|---|
| Ninth Layer (Low-speed Green-Sensitive Emulsion Layer): | | |
| Silver Iodobromide Emulsion G | as silver | 0.39 |
| Silver Iodobromide Emulsion H | as silver | 0.28 |
| Silver Iodobromide Emulsion I | as silver | 0.35 |
| ExM-2 | | 0.36 |
| ExM-3 | | 0.045 |
| ExG-1 | | 0.005 |
| HBS-1 | | 0.28 |
| HBS-3 | | 0.01 |
| HBS-4 | | 0.27 |
| Gelatin | | 1.39 |
| Tenth Layer (Medium-speed Green-Sensitive Emulsion Layer): | | |
| Silver Iodobromide Emulsion F | as silver | 0.20 |
| Silver Iodobromide Emulsion G | as silver | 0.25 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-3 | | $2.1 \times 10^{-3}$ |
| Gelatin | | 0.44 |
| Eleventh Layer (High-speed Green-Sensitive Emulsion Layer): | | |
| Silver Iodobromide Emulsion J | as silver | 1.200 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.008 |
| ExM-2 | | 0.013 |
| Cpd-4 | | 0.007 |
| HBS-1 | | 0.18 |
| Polyethyl acrylate latex | | 0.099 |
| Gelatin | | 1.11 |
| Twelfth Layer (Yellow Filter Layer) | | |
| Yellow Colloidal Silver | as silver | 0.047 |
| Cpd-1 | | 0.16 |
| ExF-5 | | 0.010 |
| Solid Disperse Dye ExF-6 | | 0.010 |
| HBS-1 | | 0.082 |
| Gelatin | | 1.057 |
| Thirteenth Layer (Low-speed Blue-Sensitive Emulsion Layer): | | |
| Silver Iodobromide Emulsion B | as silver | 0.18 |
| Silver Iodobromide Emulsion C | as silver | 0.20 |
| Silver Iodobromide Emulsion D | as silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| Fourteenth Layer (High-speed Blue-Sensitive Emulsion Layer): | | |
| Emulsion A shown in Table 2 | as silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |

-continued

| | | |
|---|---|---|
| Fifteenth Layer (First Protective Layer) | | |
| AgBrI (2) of 0.07 μm | as silver | 0.30 |
| UV-1 | | 0.21 |
| UV-2 | | 0.13 |
| UV-3 | | 0.20 |
| UV-4 | | 0.025 |
| F-18 | | 0.009 |
| F-19 | | 0.005 |
| F-20 | | 0.005 |
| HBS-1 | | 0.12 |
| HBS-4 | | $5.0 \times 10^{-2}$ |
| Gelatin | | 2.3 |
| Sixteenth Layer (Second Protective Layer) | | |
| H-1 | | 0.40 |
| B-1 (Diameter: 1.7 μm) | | $5.0 \times 10^{-2}$ |
| B-2 (Diameter: 1.7 μm) | | 0.15 |
| B-3 | | 0.05 |
| S-1 | | 0.20 |
| Gelatin | | 0.75 |

Furthermore, in order to improve storability, processability, pressure resistance, and antifungal and microbicidal property, B-4 to B-6, F-1 to F-18, iron salt, lead salt, gold salt, platinum salt, palladium salt, iridium salt, ruthenium salt and rhodium salt were appropriately added to each layer. Also, in the preparation of samples, calcium in the form of an aqueous calcium nitrate solution was added in an amount of $8.5\times10^{-3}$ g to the coating solution for the eighth layer and in an amount of $7.9\times10^{-3}$ g to the coating solution for the eleventh layer, per mol of silver halide. In addition, at least one of W-1, W-6, W-7 and W-8 was added for improving the antistatic property and at least one of W-2 and W-5 was added for improving the coatability.

Preparation of Dispersion of Organic Solid Disperse Dye:

ExF-3 was dispersed by the following method. That is, 21.7 ml of water, 3 ml of a 5% aqueous solution of sodium p-octylphenoxyethoxyethoxyethanesulfonate and 0.5 g of a 5% aqueous solution of p-octylphenoxypolyoxyethylene ether (polymerization degree: 10) were charged into a 700-ml pot mill and thereto 5.0 g of Dye ExF-3 and 500 ml of zirconium oxide beads (diameter: 1 mm) were added. The contents were dispersed for 2 hours using a BO-Type vibration ball mill manufactured by Chuo Koki K. K. After the dispersion, the contents were taken out and added to 8 g of an aqueous 12.5% gelatin solution and thereafter, beads were removed by filtration to obtain a gelatin dispersion of the dye. The thus-obtained fine dye particles had an average particle diameter of 0.44 μm.

The solid dispersion of ExF-4 was obtained in the same manner. The fine dye particles obtained had an average particle diameter of 0.24 μm. ExF-2 was dispersed by the microprecipitation dispersing method described in Example 1 of EP-A-549489. The average particle diameter was 0.06 μm.

The solid dispersion of ExF-6 was dispersed by the following method.

To 2,800 g of a wet cake of ExF-6 containing 18% or water, 4,000 g of water and 376 g of a 3% solution of W-2 were added and stirred to obtain a slurry of ExF-6 having a concentration of 32%. Then, zirconia beads having an average particle size of 0.5 mm were filled in Ultraviscomill (UVM-2) manufactured by Imex and the slurry was passed therethrough and dispersed at a peripheral speed of about 10 m/sec and a discharge amount -of 0.5 liter/min for 8 hours.

The compounds used for forming each layer are shown below.
ExC-1
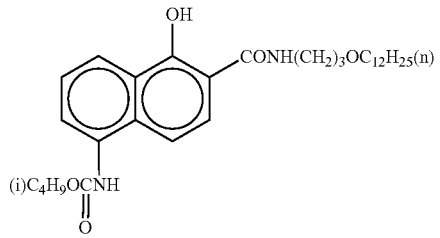
ExC-2
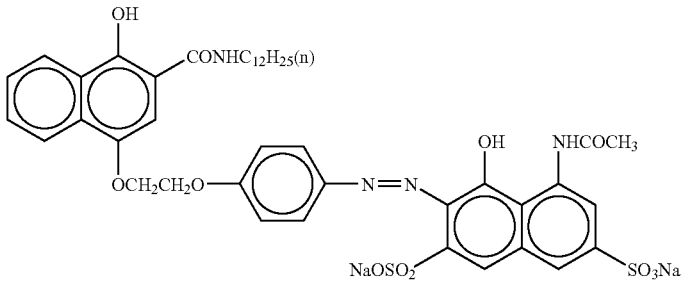
ExC-3
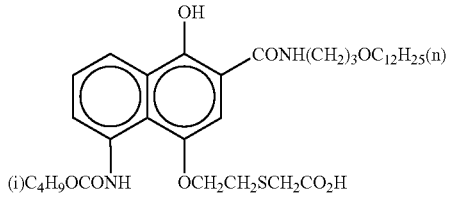
ExC-4
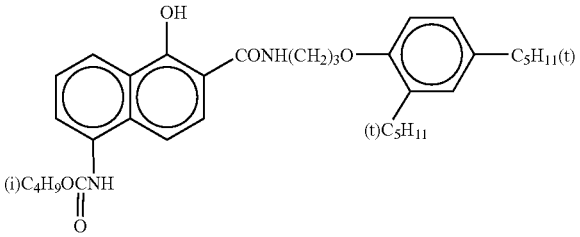
ExC-5
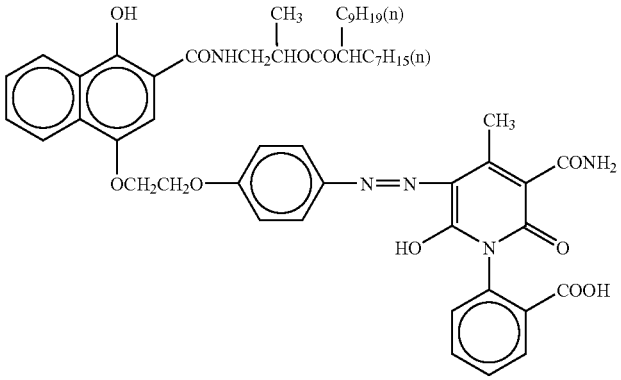

-continued
ExC-6
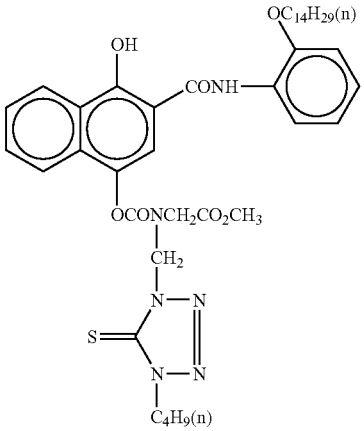
ExC-7
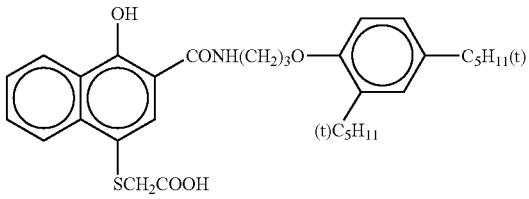
ExC-8
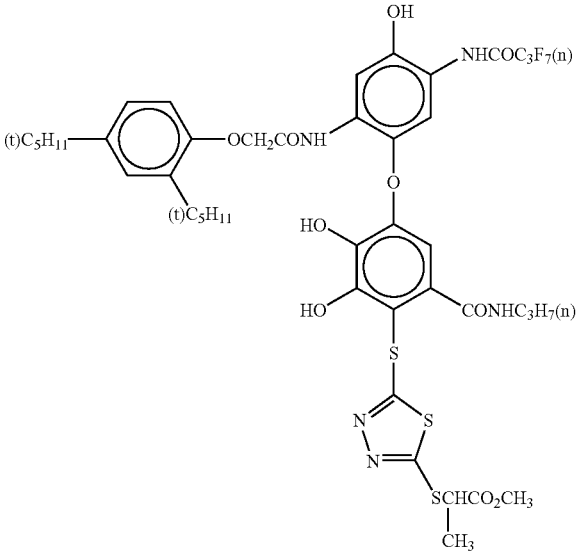
ExM-1
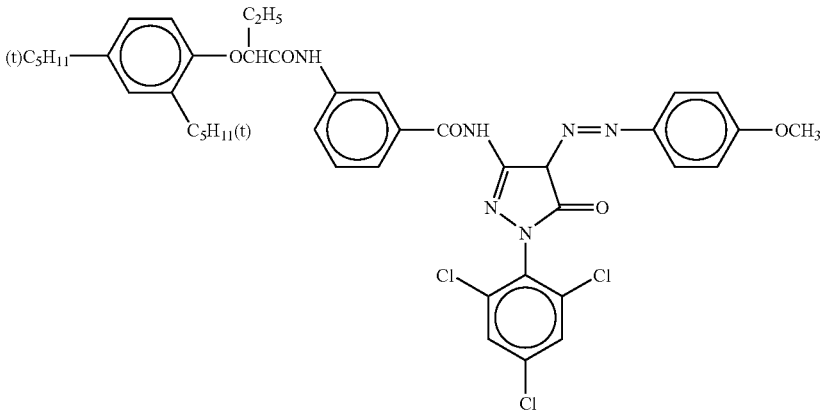

-continued
ExM-2
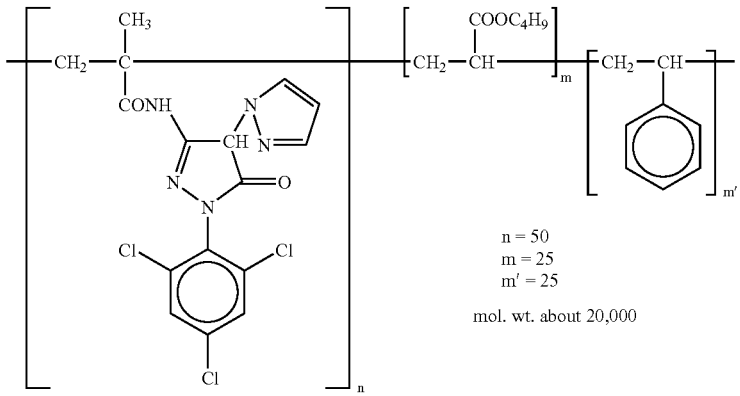
ExM-3
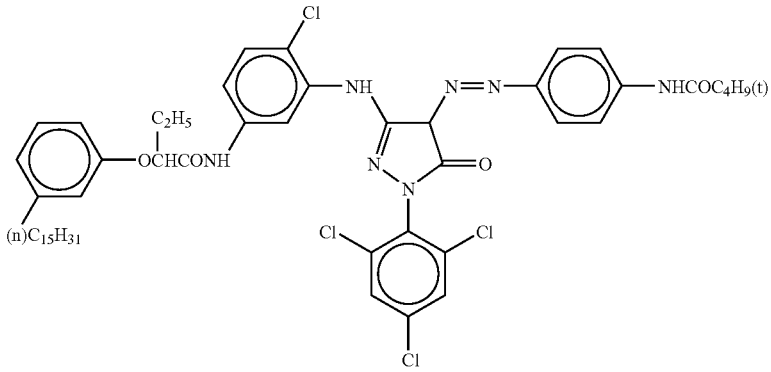
ExM-4
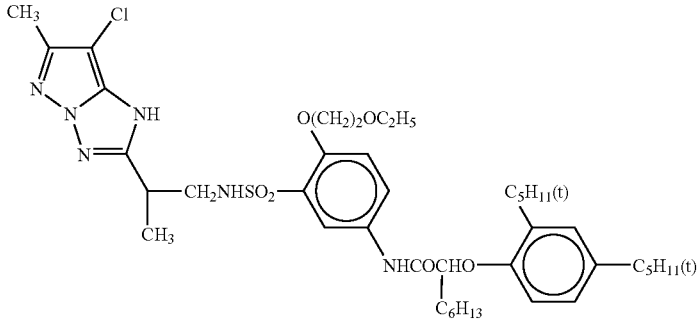
ExM-5
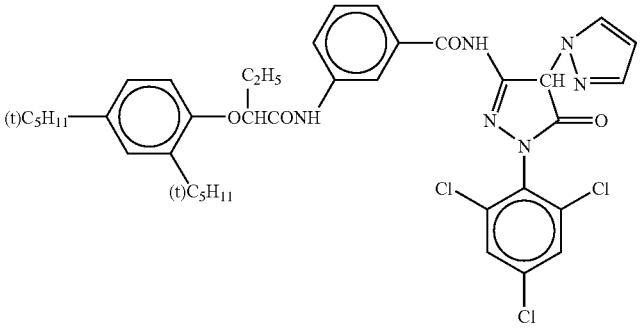

-continued
ExY-1
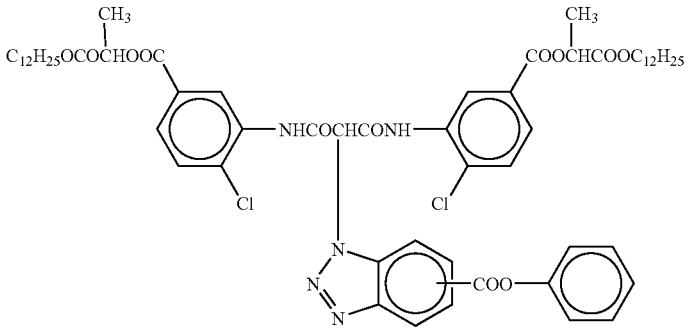
ExY-2
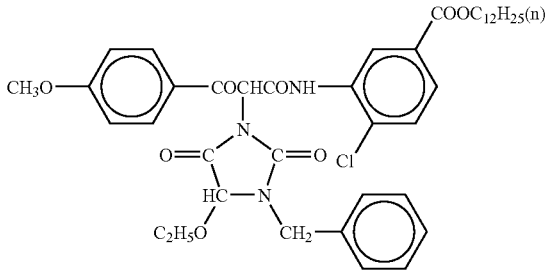
ExY-3
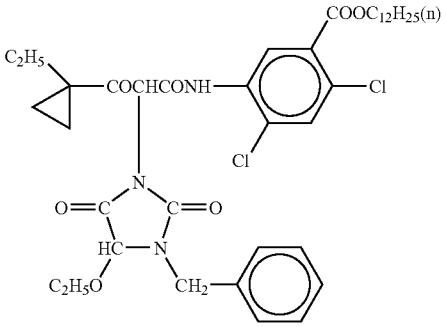
ExY-4
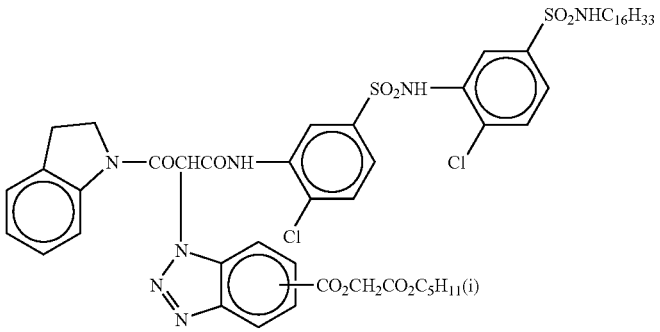

-continued
ExY-5
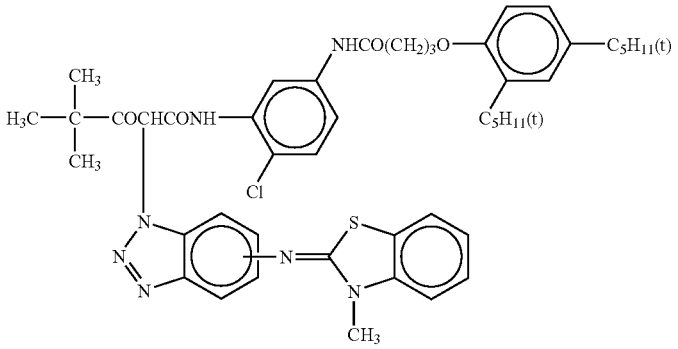
ExG-1
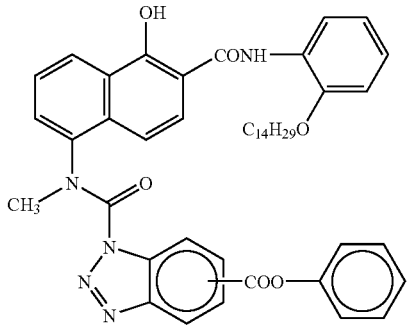
ExY-6
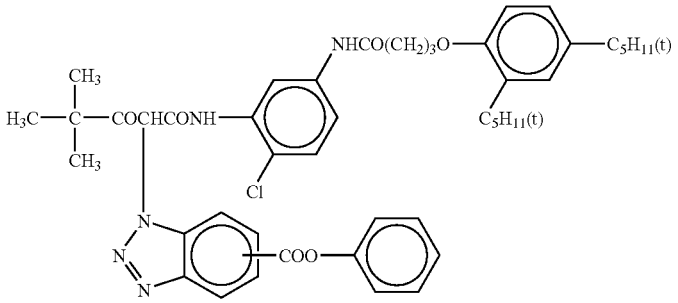
ExF-1
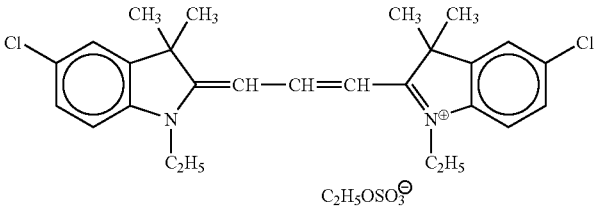
ExF-2
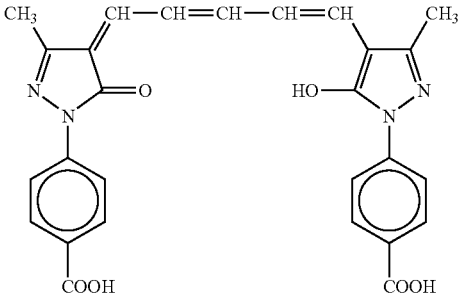

-continued
ExF-3
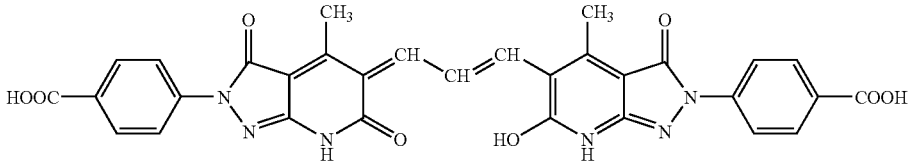
ExF-4
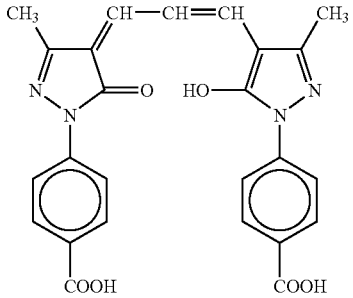
ExF-5
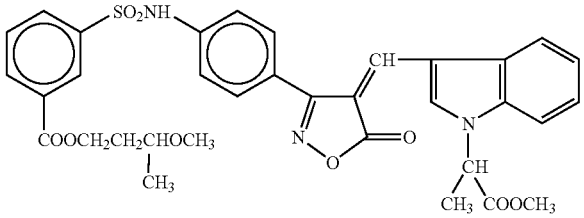
ExF-6
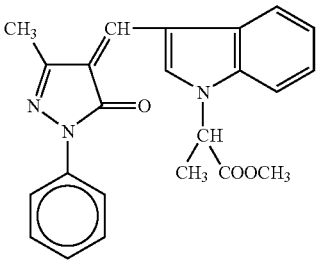
Cpd-1
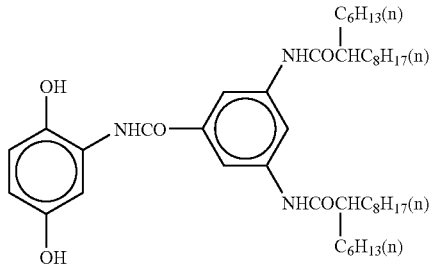
Cpd-2
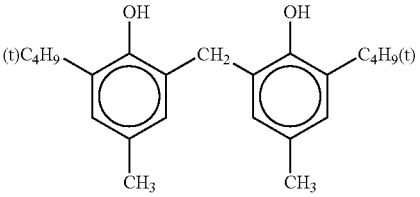
Cpd-3
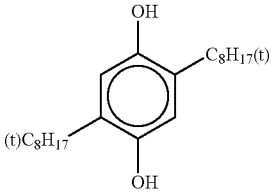
Cpd-4
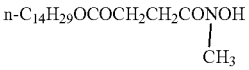
UV-1
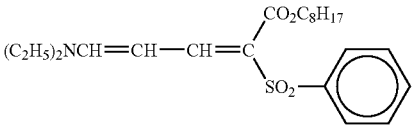
UV-2
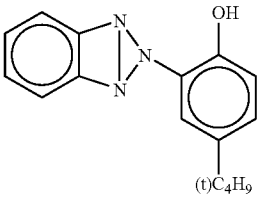
UV-3
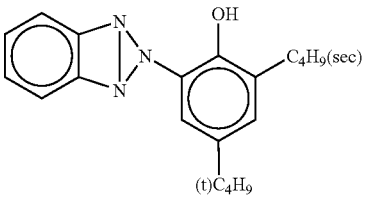

-continued
UV-4
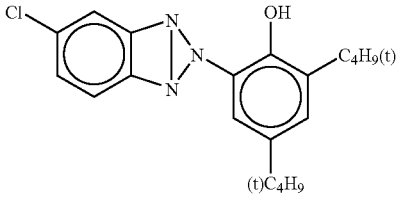
HBS-1 Tricresyl phosphate
HBS-2 Di-n-Butyl phthalate
HBS-3
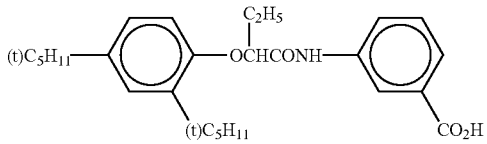
HBS-4 Tri(2-ethylhexyl)phosphate
H-1
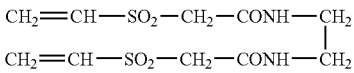
S-1
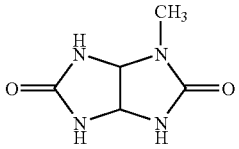
B-1
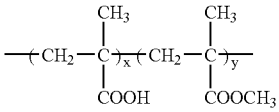
x/y = 10/90 (by mass)
average molecular weight:
about 35,000
B-2
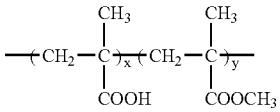
x/y = 40/60 (by mass)
average molecular weight:
about 20,000
B-3
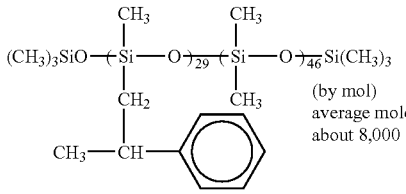
(by mol)
average molecular weight:
about 8,000
B-4
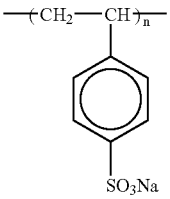
average molecular weight:
about 750,000
B-5
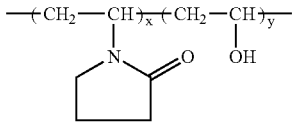
x/y = 70/30 (by mass)
average molecular weight:
about 17,000
B-6
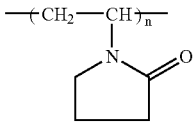
average molecular weight:
about 10,000
W-1
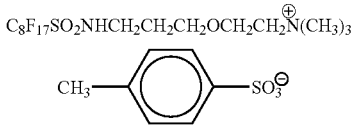
W-2
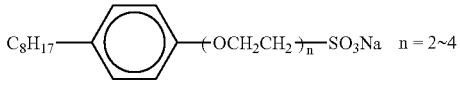
n = 2~4
W-3
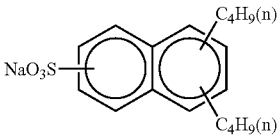
W-4
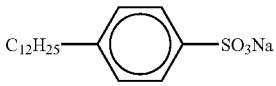
W-5
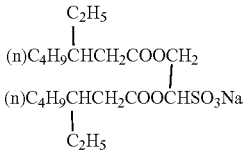
W-6
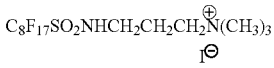

-continued
W-7
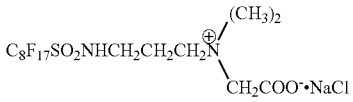
W-8
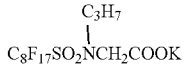
F-1
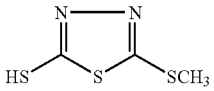
F-2
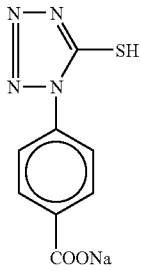
F-3
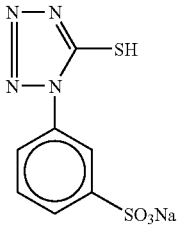
F-4
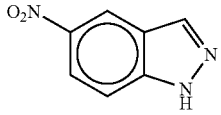
F-5
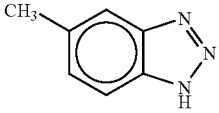
F-6
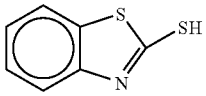
F-7
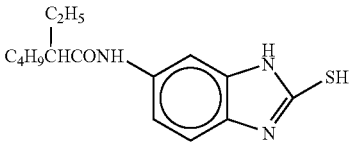
F-8
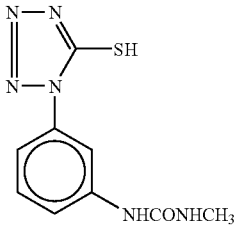
F-9
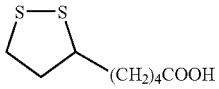
F-10
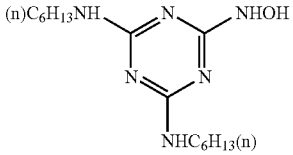
F-11
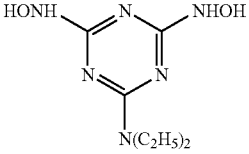
F-12
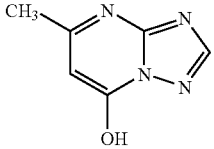
F-13
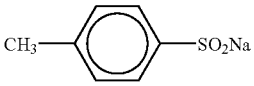
F14
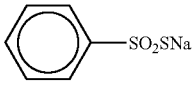
F-15
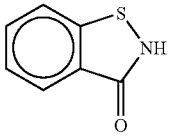
F-16
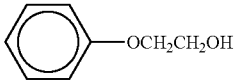

-continued

F-17

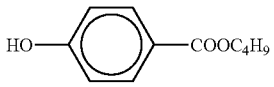

F-18

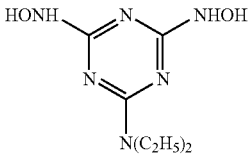

F-19

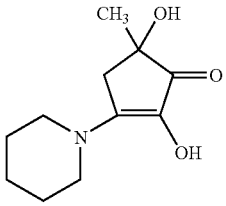

F-20

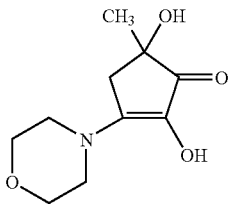

The samples were evaluated by the following method. Each sample was exposed for 1/100 second through Gelatin Filter SC-39 (a long wavelength light transmitting filter with a cut-off wavelength of 390 nm) produced by Fuji Photo Film Co., Ltd. and a continuous wedge. The development was performed as follows by using an automatic developing machine FP-360B manufactured by Fuji Photo Film Co., Ltd. which was modified not to flow the overflow solution of the bleaching bath to the post bath but to discharge all to the waste solution tank. In this FP-360B, an evaporation correcting means described in *JIII Journal of Technical Disclosure*, No. 94-4992 was mounted.

The processing steps and the composition of each processing solution are shown below.

(Processing Step)

| Step | Processing Time | Processing Temperature (° C.) | Replenishing Amount* (ml) | Tank Volume (liter) |
|---|---|---|---|---|
| Color development | 3 min 5 sec | 37.8 | 20 | 11.5 |
| Bleaching | 50 sec | 38.0 | 5 | 5 |
| Fixing (1) | 50 sec | 38.0 | — | 5 |
| Fixing (2) | 50 sec | 38.0 | 8 | 5 |
| Water washing | 30 sec | 38.0 | 17 | 3 |
| Stabilization (1) | 20 sec | 38.0 | — | 3 |
| Stabilization (2) | 20 sec | 38.0 | 15 | 3 |
| Drying | 1 min 30 sec | 60.0 | | |

*Replenishing amount was per 1.1 m of the 35 mm-width light-sensitive material (corresponding to 1 roll of 2 Ex.).

The stabilizing solution and the fixing solution each was in a countercurrent system of from (2) to (1) and the overflow solution of washing water was all introduced into the fixing bath (2). The amount of developer carried over into the bleaching step, the amount of bleaching solution carried over into the fixing step and the amount of fixing solution carried over into the water washing step were 2.5 ml, 2.0 ml and 2.0 ml, respectively, per 1.1 m of the 35 mm-width light-sensitive material. The cross-over time was 6 seconds in each interval and this time is included in the processing time of the previous step.

The open area of the above-described processing machine was 100 $cm^2$ for the color developer, 120 $cm^2$ for the bleaching solution and about 100 $cm^2$ for other processing solutions.

The composition of each processing solution is shown below.

(Color Developer)

| | Tank Solution (g) | Replenisher (g) |
|---|---|---|
| Diethylenetriaminepentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium N,N-bis(2-sulfonato-ethyl) hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |
| Hydroxylamine sulfate | 2.4 | 3.3 |
| 2-Methyl-4-[N-ethyl-N-β-hydroxy-ethylamino] aniline sulfate | 4.5 | 6.5 |
| Water to make | 1.0 liter | 1.0 liter |
| pH (adjusted by potassium hydroxide and sulfuric acid) | 10.05 | 10.18 |

(Bleaching Solution)

| | Tank Solution (g) | Replenisher (g) |
|---|---|---|
| Ammonium 1,3-diaminopropane-tetraacetato ferrate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 liter | 1.0 liter |
| pH [adjusted by aqueous ammonia] | 4.6 | 4.0 |

(Fixing Solution (1): Tank Soloution)

A 5:95 (by volume) mixed solution of the bleaching tank solution above and the fixing tank solution shown below (pH: 6.8).

(Fixing Solution (2))

| | Tank Solution (g) | Replenisher (g) |
|---|---|---|
| Aqueous ammonium thiosulfate solution (750 g/liter) | 240 ml | 720 ml |
| Imidazole | 7 | 21 |
| Ammonium methanethiosulfonate | 5 | 15 |
| Ammonium methanesulfinate | 10 | 30 |
| Ethylenediaminetetraacetic acid | 13 | 39 |
| Water to make | 1.0 liter | 1.0 liter |
| pH [adjusted by aqueous ammonia and acetic acid] | 7.4 | 7.45 |

(Washing Water)

Tap water was passed through a mixed bed column filled with an H-type strongly acidic cation exchange resin (Amberlite IR-120B, produced by Rhom and Haas) and an OH-type strongly basic anion exchange resin (Amberlite-IR-400, produced by the same company) to reduce the calcium and magnesium ion concentrations each to 3 mg/liter or less and then thereto 20 mg/liter of sodium isocyanurate dichloride and 150 mg/liter of sodium sulfate were added. The resulting solution had a pH of 6.5 to 7.5.

(Stabilizing Solution)

The tank solution and the replenisher were common.

| | (unit: g) |
|---|---|
| Sodium p-toluenesulfinate | 0.03 |
| Polyoxyethylene-p-monononylphenyl ether (average polymerization degree: 10) | 0.2 |
| Sodium 1,2-benzoisothiazolin-3-one | 0.10 |
| Disodium ethylenediaminetetra-acetate | 0.05 |
| 1,2,4-Triazole | 1.3 |
| 1,4-Bis(1,2,4-triazol-1-yl-methyl)piperazine | 0.75 |
| Water to make | 1.0 liter |
| pH | 8.5 |

Samples 101 to 110 were subjected to the above-described processing. The processed samples each was measured on the density using a blue filter and from the value obtained, the photographic performance was evaluated. The sensitivity was shown by the reciprocal of light intensity required for giving an optical density of fog+0.2 and the sensitivity of Samples 102 to 110 was shown by a relative value by taking the sensitivity of Sample 101 as 100 for control.

The results are shown in Table 2.

The amount of dye adsorbed was determined as follows. Each liquid emulsion obtained was centrifuged at 10,000 rpm for 10 minutes, the precipitate was freeze-dried, and 25 ml of an aqueous 25% sodium thiosulfate solution and methanol were added to 0.05 g of the precipitate to make 50 ml. The resulting solution was analyzed by high-performance liquid chromatography and the dye density was determined by quantitation. From the thus-obtained amount of dye adsorbed and the single layer saturation coverage, the number of dye layers adsorbed was determined. The number of dye layers adsorbed is shown in terms of the number of dye chromophore layers adsorbed. That is, when the number of layers adsorbed of a linked dye having two dye chromophores is 1, the number of dye chromophore layers adsorbed becomes 2.

Here, the number of layers adsorbed of Samples 101, 102 and 105 are shown as representative examples. The number of layers adsorbed was 0.88 in Comparative Sample 101 and 1.79 in Comparative Sample 102, whereas the number of layers adsorbed in Sample 105 of the present invention was 2.66 and thus remarkably large. Also in other Samples 103, 104 and 106 to 109 of the present invention, the number of layers adsorbed is large similarly to Sample 105.

The light absorption intensity per unit area was measured as follows. The emulsions obtained each was thinly coated on a slide glass and the transmission spectrum and reflection spectrum of individual grains were determined using a microspectrophotometer MSP65 manufactured by Karl Zweiss K. K. by the following method to determine the absorption spectrum. For the reference of transmission spectrum, the portion where grains were not present was used and for the reference of reflection spectrum, the value obtained by measuring silicon carbide of which reflectance is known was used. The measured part was a circular aperture part having a diameter of 1 μm. After adjusting the position not to allow the aperture part to overlap the contour of a grain, the transmission spectrum and the reflection spectrum were measured in the wave number region from 10,000 $cm^{-1}$ (1,000 nm) to 28,000 $cm^{-1}$ (357 nm). The absorption spectrum was determined from the absorption factor A (=1−T (transmittance)−R (reflectance)). Using the absorption factor A' obtained by subtracting the absorption of silver halide, -Log (1−A') was integrated with respect to the wave number ($cm^{-1}$) and the value obtained was halved and used as a light absorption intensity per unit area. The integration range is from 10,000 to 28,000 $cm^{-1}$. At this time, the light source used was a tungsten lamp and the light source voltage was 8 V. In order to minimize the damage of dye due to the light irradiation, a monochromator in the primary side was used and the wavelength distance and the slit width were set to 2 nm and 2.5 nm, respectively. The absorption spectrum and the light absorption intensity were determined on 200 grains and the average thereof was employed As representative examples, the light absorption intensities of Emulsion Em-A in Samples 101, 102 and 105 are shown. The light absorption intensity was 56 in Comparative Sample 101 and 101 in Comparative Sample 102, whereas the light absorption intensity in Sample 105 of the present invention was 169 and thus remarkably large. In other Samples 103, 104 and 106 to 110, the light absorption intensity of Emulsion Em-A was large similarly to Sample 105.

As representative examples, the distance for 50% of Amax and the distance for 50% of Smax each was compared between Sample 102 and Sample 105, as a result, Sample 105 was found to exhibit absorption and spectral sensitivity distribution each in a narrow width as compared with Comparative Sample 102. This occurred because in Sample 105 of the present invention, two dye chromophores of Dye D-5 in the second and upper layers formed J-aggregate by the interaction. Also in other Samples 103, 104 and 106 to 110 of the present invention, the absorption and the spectral sensitivity distribution were narrow similarly to Sample 105.

From these results, it is seen that when the dye of the present invention is used, a silver halide photographic light-sensitive material having a blue-sensitive layer exhibiting high sensitivity and at the same time, having a narrow spectral sensitivity distribution is obtained.

TABLE 2

| Sample No. | Sensitizing dye | Blue Filter Sensitivity | Remarks |
|---|---|---|---|
| 101 | SS-1 | 100 (control) | Comparison |
| 102 | SS-2 | 185 | " |
| 103 | D-1 | 265 | Invention |
| 104 | D-3 | 274 | " |
| 105 | D-5 | 285 | " |
| 106 | D-11 | 273 | " |
| 107 | D-12 | 274 | " |
| 108 | D-13 | 268 | " |
| 109 | D-14 | 270 | " |
| 110 | D-18 | 280 | " |

The amount (added molar number) of Sensitizing Dye SS-1 added in Sample 101 was 90% of the saturation coverage and the added molar number of the sensitizing dye in Samples 02 to 110 was the same as that of Sensitizing Dye SS-1 in Sample 101.

SS-1

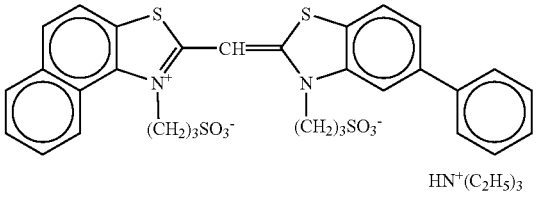

SS-2

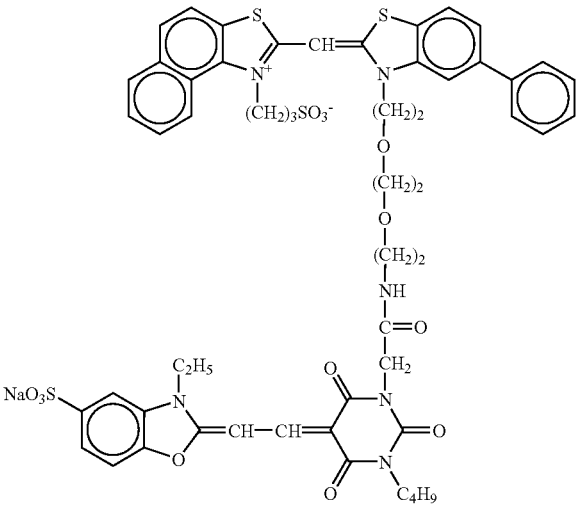

Example 2

Emulsions A and color negative light-sensitive materials were prepared in the same manner as in Example 1 except for using a sensitizing dye shown in Table 3.

Samples 201 to 212 were processed and evaluated on the photographic performance in the same manner as in Example 1. The sensitivity is shown by a reciprocal of light intensity required for giving an optical density of fog+0.2. The sensitivity of Samples 202 to 212 is shown as a relative value by taking the sensitivity of Sample 201 as 100 for control. The results obtained are shown in Table 3.

The number of layers adsorbed in Samples 201, 202 and 203 determined by measuring the amount of dye adsorbed in the same manner as in Example 1 are shown. The number of layers adsorbed was 0.88 in Comparative Sample 201 and 1.74 in Comparative Sample 202, whereas the number of layers adsorbed in Sample 203 of the present invention was 2.68 and thus remarkably large. Also in other Samples 204 to 210 of the present invention, the number of layers adsorbed was large similarly to Sample 203.

Also, the number of layers adsorbed in Samples 211 and 212 of the present invention was 1.98, which was lager than that of Sample 202.

The light absorption intensities of Samples 201, 202 and 203 determined in the same manner as in Example 1 are shown. The light absorption intensity was 56 in Sample 201 and 101 in Sample 202, whereas the light absorption intensity in Sample 203 of the present invention was 170 and thus remarkably large. Also in other Samples 204 to 210 of the present invention, the light absorption intensity was large similarly to Sample 203.

The light absorption intensity of Samples 211 and 212 of the present invention was 111 and 112, respectively, and was larger than that of Sample 202.

As representative examples, the distance for 50% of Amax and the distance for 50% of Smax each was compared between Sample 202 and Sample 203, as a result, Sample 203 of the present invention was found to exhibit narrow absorption and narrow spectral sensitivity distribution as compared with Comparative Sample 202. This occurred because in Sample 103 of the present invention, two dye chromophores in the second and upper layers formed J-aggregate by the interaction. Also in other Samples 204 to 212 of the present invention, the absorption and the spectral sensitivity distribution were narrow similarly to Sample 203.

From these results, it is seen that when the dye of the present invention is used, a silver halide photographic light-sensitive material having high sensitivity and at the same time, having a narrow spectral sensitivity distribution is obtained, and the samples of the present invention are excellent in the resided order after processing.

TABLE 3

| Sample No. | Sensitizing Dye | Blue Filter Sensitivity | Remarks |
|---|---|---|---|
| 201 | SS-1 | 100 (control) | Comparison |
| 202 | SS-3 | 181 | " |
| 203 | A-1 | 285 | Invention |
| 204 | A-2 | 275 | " |
| 205 | A-3 | 285 | " |
| 206 | A-4 | 280 | " |
| 207 | A-5 | 285 | " |
| 208 | A-5a | 286 | " |
| 209 | A-6 | 265 | " |
| 210 | A-7 | 260 | " |
| 211 | A-12 | 198 | " |
| 212 | A-13 | 199 | " |

The amount (added molar number) of Sensitizing Dye SS-1 added in Sample 201 was 90% of the saturation coverage amd the added molar number of the sensitizing dye in Samples 202 to 212 was the same as that of Sensitizing Dye SS-1 in Sample 201.

SS-3

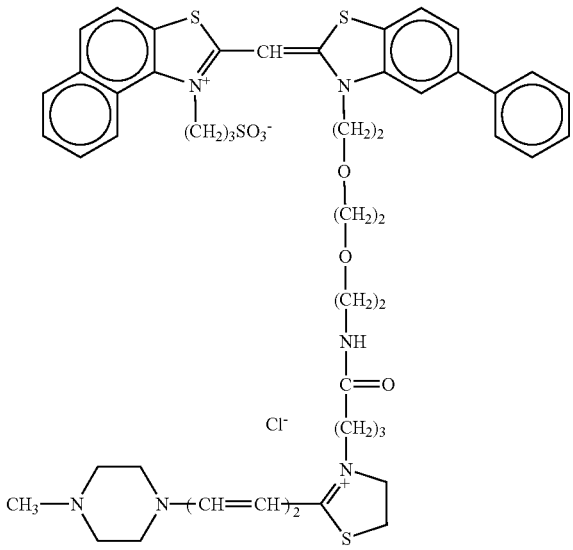

Example 3

In the preparation of Emulsion A, sensitizing dyes and chemical sensitizers were added by the following method. That is, a first sensitizing dye shown in Table 4 was added in an amount of $3.6\times10^{-4}$ mol/mol-Ag and then potassium thiocyanate, chloroauric acid, sodium thiosulfate, N,N-dimethylselenourea and calcium nitrate were added, thereby optimally performing the chemical sensitization. At the completion of chemical sensitization, Compounds 13 and 14 were added. In the case where a second sensitizing dye is present, the second sensitizing dye was added in an amount of $3.6\times10^{-4}$ mol/mol-Ag after the addition of Compounds 13 and 14. The term "optimally perform the chemical sensitization" as used herein means that the amount added of each compound was selected from the range of $10^{-1}$ to $10^{-8}$ mol per mol of silver halide. Except for these, emulsions were prepared in the same manner as Emulsion A.

Samples 301 to 319 were processed and evaluated on the photographic performance in the same manner as in Example 1. The sensitivity is shown by a reciprocal of light intensity required for giving an optical density of fog+0.2 and the sensitivity of Samples 302 to 319 was shown by a relative value by taking the sensitivity of Sample 301 as 100 for control. The results obtained are shown in Table 4.

The amount of dye adsorbed was measured in the same manner as in Example 1. As for the single layer saturation coverage, an adsorption isotherm of D-1 was prepared and the amount of saturation adsorption therein was used as the single layer saturation coverage.

The light absorption intensities of Samples 301, 307 and 308 determined in the same manner as in Example 1 are shown. The light absorption intensity was 52 in Comparative Sample 301, whereas the light absorption intensity was remarkably large as 80 in Sample 308 and 96 in Sample 307. In other samples of the present invention, the light absorption intensity was confirmed to be large as compared with Sample 301.

Also, in samples of the present invention, the dye in the second layer was confirmed to exhibit narrow absorption and narrow spectral sensitivity distribution. This is attributable to the fact that the multichromophore dye compound used in the present invention formed J-aggregate within the molecule.

From these results, it is seen that when the dye of the present invention is used, a silver halide photographic light-sensitive material having high sensitivity and at the same time, having a narrow spectral sensitivity distribution is obtained.

TABLE 4

| Sample | First Dye | Second Dye | Associated State of Second Dye | Number of Layers Adsorbed | Sensitivity | Remarks |
|---|---|---|---|---|---|---|
| 301 | DS-1 | — | — | 0.76 | 100 | Comparison |
| 302 | DS-2 | — | — | 0.77 | 99 | Comparison |
| 303 | DS-1 | DS-3 | — | 1.05 | 101 | Comparison |
| 304 | DS-1 | AA-13 | J | 1.18 | 122 | Invention |
| 305 | DS-1 | AA-14 | J | 1.54 | 133 | Invention |
| 306 | DS-1 | AA-15 | J | 1.63 | 139 | Invention |
| 307 | DS-1 | AA-16 | J | 1.98 | 151 | Invention |
| 308 | DS-1 | AA-17 | J | 1.24 | 123 | Invention |
| 309 | DS-1 | AA-18 | J | 1.76 | 148 | Invention |
| 310 | DS-2 | AA-17 | J | 1.37 | 129 | Invention |
| 311 | DS-2 | AA-13 | J | 1.42 | 132 | Invention |
| 312 | DS-2 | AA-14 | J | 1.88 | 147 | Invention |
| 313 | DS-2 | AA-18 | J | 1.93 | 153 | Invention |
| 314 | DS-1 | AA-20 | H | 1.35 | 119 | Invention |
| 315 | DS-1 | AA-21 | H | 1.38 | 124 | Invention |
| 316 | DS-1 | AA-15 | H | 1.45 | 128 | Invention |
| 317 | DS-5 | — | — | 0.93 | 95 | Comparison |
| 318 | DS-4 | — | — | 0.73 | 97 | Comparison |
| 319 | B-2 | — | J | 1.38 | 126 | Invention |

DS-1

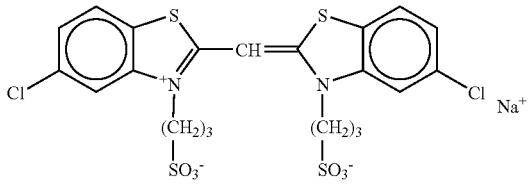

DS-2

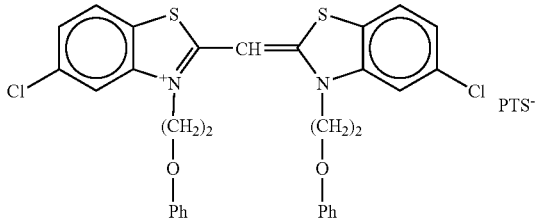

DS-3

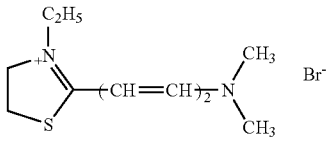

DS-4

TABLE 4-continued

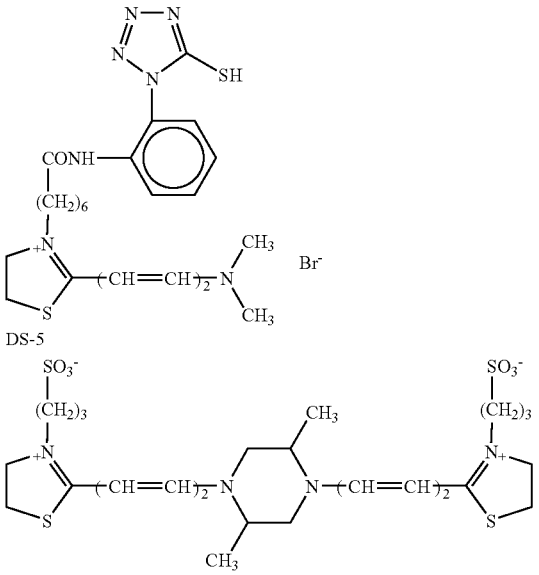

DS-5

Example 4

Preparation of Em-Z:

1,200 ml of an aqueous solution containing 0.99 g of KBr and 0.38 g of phthalated gelatin having a molecular weight of 100,000 and a phthalation ratio of 97% was adjusted to a pH 2 and vigorously stirred while keeping it at 60° C. An aqueous solution containing 1.96 g of $AgNO_3$ and an aqueous solution containing 1.97 g of KBr and 0.172 g of KI were added by a double jet method over 30 seconds. After completion of ripening, 12.8 g of trimellited gelatin containing 35 μmol/g of methionine and having a molecular weight of 100,000, where the amino group was chemically modified with a trimellitic acid, was added. The pH was adjusted to 5.9 and then 2.99 g of KBr and 6.2 g of NaCl were added. Thereafter, 60.7 ml of an aqueous solution containing 27.3 g of $AgNO_3$ and an aqueous KBr solution were added by a double jet method over 35 minutes. At this time, the silver potential was kept at −50 mV to the saturated calomel electrode. An aqueous solution containing 65.6 g of $AgNO_3$ and an aqueous KBr solution were added by a double jet method over 37 minutes while accelerating the flow rate such that the final flow rate became 2.1 times the initial flow rate. At this time, the AgI fine particle emulsion used in the preparation of Em-A was simultaneously added to have a silver iodide content of 6.5 mol % while accelerating the flow rate and keeping the silver potential at −50 mV. Thereto, 1.5 mg of thiourea dioxide was added and then, 132 ml of an aqueous solution containing 41.8 g of $AgNO_3$ and an aqueous KBr solution were added by a double jet method over 13 minutes. The addition of the aqueous KBr solution was controlled such that the silver potential became +40 mV at the completion of addition. After adding 2 mg of sodium benzenethiosulfonate, KBr was added to adjust the silver potential to −100 mV. Thereto, the above-described AgI fine particle emulsion was added in an amount of 6.2 g as a mass of KI. Immediately after the completion of addition, 300 ml of an aqueous solution containing 88.5 g of $AgNO_3$ was added over 8 minutes. The potential was adjusted to become +60 mV at the completion of addition by adding an aqueous KBr solution. After water washing, gelatin was added and the pH and the pAg were adjusted to 6.5 and 8.2, respectively, at 40° C. The prepared emulsion grain was a tabular grain having a projected area diameter of 3.18 μm and an aspect ratio of 22. Compounds 11 and 12 were added and then the temperature was elevated to 61° C. Thereafter, a sensitizing dye shown in Table 5 was added and then, $K_2KrCl_6$, potassium thiocyanate, chloroauric acid, sodium thiosulfate and N,N-dimethylselenourea were added, thereby optimally performing the chemical sensitization. At the completion of chemical sensitization, Compounds 13 and 14 were added.

Samples 501 to 505 were prepared by coating Emulsion Em-Z having adsorbed therein the dye shown in Table 5, in place of Em-J (Silver Iodobromide Emulsion J) of Example 1 and compared on the photographic sensitivity in the same manner as in Example 1 except for performing green filter exposure. For the high-speed blue-sensitive layer, Em-A (however, a dye was not adsorbed) was used. The dye in Emulsion Em-X of Samples 501 to 505 was evaluated on The number of layers adsorbed and the light absorption intensity in the same manner as in Example 1. The results are shown in Table 5. The distance for 50% of Amax and the distance for 50% of Smax each was compared between Sample 502 and Sample 504 and between Sample 503 and Sample 505. As a result, Samples 504 and 505 of the present invention were found to exhibit narrow absorption and narrow spectral sensitivity distribution as compared with Comparative Samples 502 and 503. This occurred because in the case of Dye A-11 and D-23 in Samples 504 and 505 of the present invention, two dye chromophores in the second and upper layer interacted to have absorption at a longer wavelength and exhibit sharp absorption.

TABLE 5

| Sample | Sensitizing Dye | Green Filter Sensitivity | Number of Layers Adsorbed | Light Absorption Intensity | Remarks |
|---|---|---|---|---|---|
| 501 | SS-4 | 100 (control) | 0.92 | 91 | Comparison |
| 502 | SS-5 | 195 | 1.85 | 175 | Comparison |
| 503 | SS-6 | 192 | 1.85 | 175 | Comparison |
| 504 | A-11 | 298 | 2.83 | 268 | Invention |
| 505 | D-23 | 297 | 2.81 | 266 | Invention |

TABLE 5-continued

SS-4

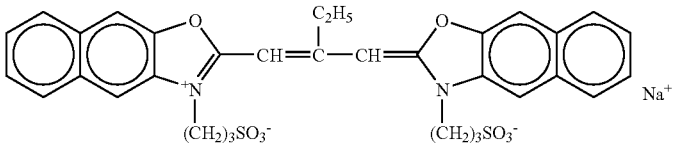

SS-6

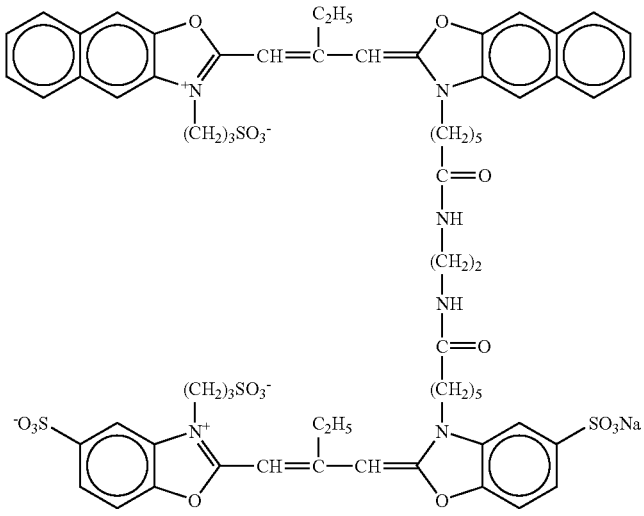

SS-5

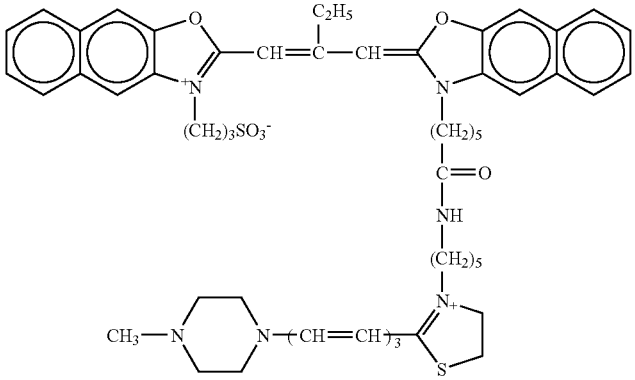

From these results, it is seen that when the dye of the present invention is used, a silver halide photographic light-sensitive material having high sensitivity is obtained and at the same time, a silver halide photographic light-sensitive material having narrow spectral sensitivity distribution preferred for color light-sensitive materials is obtained.

Example 5

Figure 2:
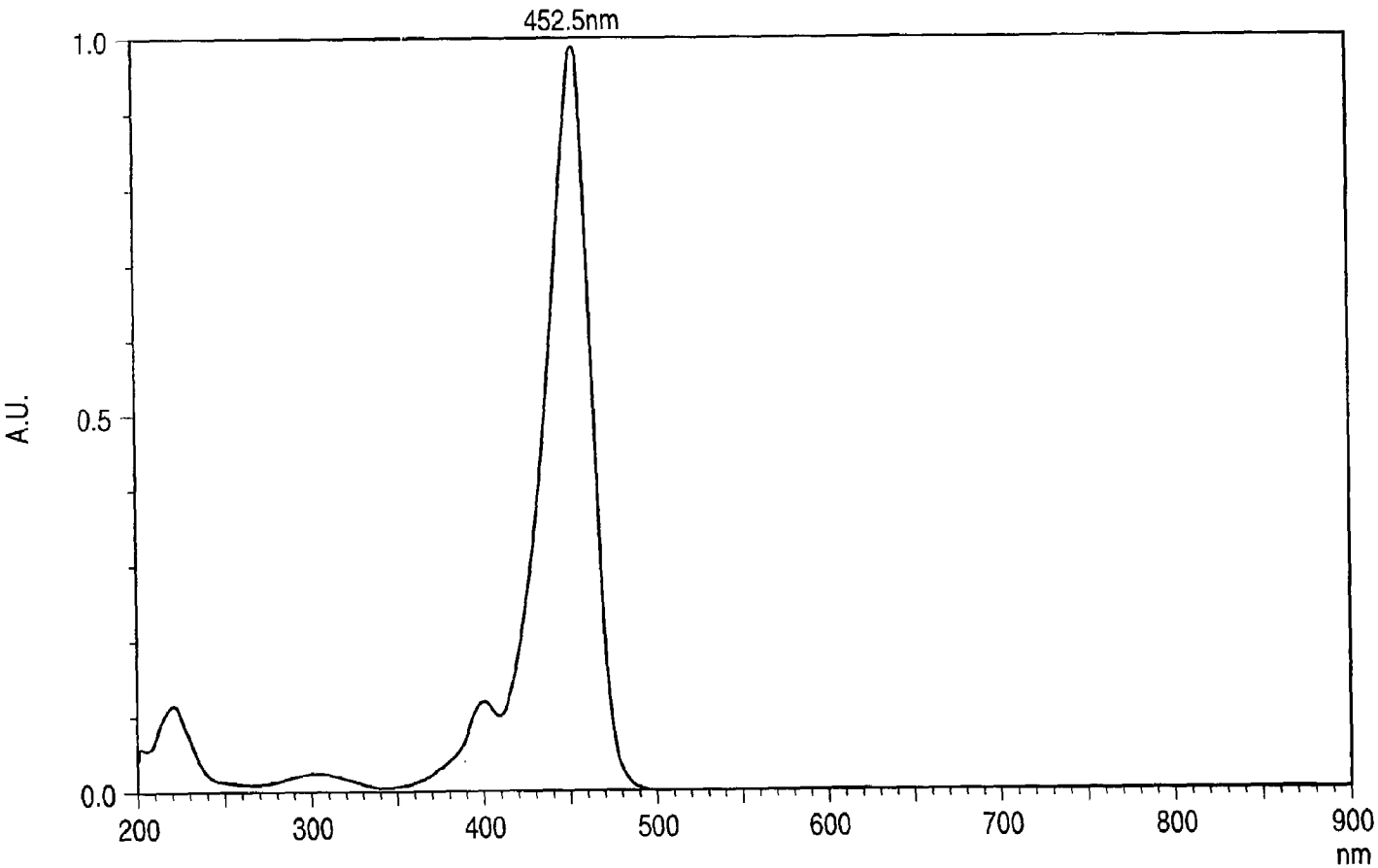
FIG. 2 shows an absorption spectrum of Dye C-1 of the present invention.

Comparison of Absorption Property:

FIGS. 1 and 2 show absorption spectra in methanol solution of Comparative Dye SS-7 and Dye C-1 having a two dye chromophores moiety of exhibiting absorption shifted to a longer wavelength by the interaction, which is preferably used in the present invention. It is seen that C-1 is shifted about 25 nm to the longer wavelength and exhibits sharp absorption as compared with SS-7. Dye density of SS-7: $1.1\times10^{-5}$ mol/liter, λmax (MeOH)=427.2 nm, $\epsilon=1.14\times10^{5}$; and dye density of C-1: $7.3\times10^{-6}$ mol/liter, λmax (MeOH)=452.5 nm, $\epsilon=2.43\times10^{5}$. In the Figures, the ordinate shows the absorbance (unit is optional).

SS-7

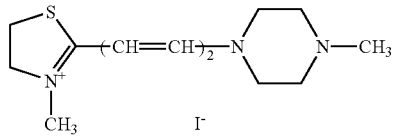

Example 6

The same comparison and evaluation as in Examples 1 to 4 was made for the system of color negative light-sensitive material in Example 1 of JP-A-11-305369, the systems of color reversal light-sensitive material in Example 1 of JP-A-7-92601 and JP-A-11-160828, the system of color paper light-sensitive material in Example 1 of JP-A-6-

347944, the system of instant light-sensitive material in Example 1 of JP-A-2000-284442 (Japanese Patent Application No. 11-89801), the system of printing light-sensitive material in Example 1 of JP-A-8-292512, the system of X-ray light-sensitive material in Example 1 of JP-A-8-122954, and the systems of heat-developable light-sensitive material in Example 5 of JP-A-2000-122206, Example 1 of JP-A-2001-281785 (Japanese Patent Application No. 2000-89436) and Example 1 of JP-A-6-130607. The results were the same as those in Examples 1 to 5.

According to the present invention, a silver halide photographic light-sensitive material having high sensitivity and having a desired spectral sensitivity distribution can be obtained.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising at least one multichromophore dye compound having at least two dye chromophores connected by covalent bonding or coordinate bonding, at least two of said dye chromophores forming a dye chromophore group, the light absorption of said dye chromophore group differing from the sum of individual light absorptions of respective dye chromophores constituting said dye chromophore group, and the absorption maximum wavelength of said dye chromophore group is longer, by 20 nm or more, than the maximum wavelength of the sum of the absorptions of individual dye chromophores.

2. The silver halide photographic light-sensitive material as claimed in claim 1, wherein said dye chromophore group is in the aggregated state.

3. The silver halide photographic light-sensitive material as claimed in claim 1, wherein the absorption maximum wavelength of said dye chromophore group is longer than the maximum wavelength of the sum of absorptions of individual dye chromophores.

4. The silver halide photographic light-sensitive material as claimed in claim 1, wherein said multichromophore dye compound contains at least three dye chromophores.

5. The silver halide photographic light-sensitive material as claimed in claim 1, wherein said multichromophore dye compound further contains an adsorption group to a silver halide grain.

6. The silver halide photographic light-sensitive material as claimed in claim 1, wherein said multichromophore dye compound is bonded to another dye compound by an attracting force except for covalent bonding or coordinate bonding.

7. The silver halide photographic light-sensitive material as claimed in claim 5, wherein the adsorption group in the multichromophore dye compound is connected through a linking chain containing a heteroatom and a multichromophore.

8. The silver halide photographic light-sensitive material as claimed in claim 1, wherein said multichromophore dye compound has a divalent or greater valent charge.

9. The silver halide photographic light-sensitive material as claimed in claim 6, wherein said multichromophore dye compound and the dye compound other than the multichromophore dye compound have opposite charges.

10. The silver halide photographic light-sensitive material as claimed in claim 1, wherein said multichromophore dye compound has a hydrogen bond-donating group.

11. The silver halide photographic light-sensitive material as claimed in claim 1, wherein at least one chromophore of said multichromophore dye compound is selected from the group consisting of cyanine, merocyanine, oxonol, hemicyanine, streptocyanine and hemioxonol.

12. The silver halide photographic light-sensitive material as claimed in claim 1, wherein said multichromophore dye compound is a compound represented by the following formula (I):

$$(Xa)_{r2}[(\text{—}Lb\text{—})_{p3}[Da(\text{—}La_1\text{—})_{p1}\{Db(\text{—}La_2\text{—})_{p2}\}_{q1}Dc]_{q2}]_{r1} \quad (I)$$

$$M_1m_1$$

wherein Da, Db and Dc each represents a dye chromophore, $La_1$, $La_2$ and Lb each represents a linking group, p1, p2 and p3 each represents an integer of 1 to 4, q1 represents an integer of 0 to 5, q2 represents an integer of 1 to 5, Xa represents a dye chromophore (Dd) or an absorptive group (Ad) to a silver halide grain, r1 represents an integer of 1 to 5, r2 represents an integer of 0 to 5, M1 represents an electric charge balancing counter ion, and $m_1$ represents a number necessary for neutralizing the electric charge of molecule.

13. The silver halide photographic light-sensitive material as claimed in claim 1, wherein a dye chromophore is adsorbed in multiple layers on the surface of a silver halide grain.

14. The silver halide photographic light-sensitive material as claimed in claim 1, which contains a silver halide grain having a spectral absorption maximum wavelength of less than 500 nm and a light absorption intensity of 60 or more or having a spectral absorption maximum wavelength of 500 nm or more and a light absorption intensity of 100 or more.

15. The silver halide photographic light-sensitive material as claimed in claim 13, wherein in the silver halide grain, the excitation energy of the dye chromophore of the second or upper layer transfers to the dye chromophore in the first layer with an efficiency of 10% or more.

16. The silver halide photographic light-sensitive material as claimed in claim 13, wherein in the silver halide grain, the dye chromophore of the first layer and the dye chromophore of the second or upper layer both exhibit J-band absorption.

17. The silver halide photographic light-sensitive material as claimed in claim 1, wherein said photographic light-sensitive material contains a silver halide emulsion comprising tabular grains having an aspect ratio of 2 or more is present in a proportion of 50% (area) or more of all silver halide grains in the silver halide emulsion.

18. The silver halide photographic light-sensitive material as claimed in claim 17, wherein the silver halide emulsion is subjected to selenium sensitization.

* * * * *